US010279212B2

(12) United States Patent
Dalebout et al.

(10) Patent No.: US 10,279,212 B2
(45) Date of Patent: May 7, 2019

(54) STRENGTH TRAINING APPARATUS WITH FLYWHEEL AND RELATED METHODS

(71) Applicant: ICON Health & Fitness, Inc., Logan, UT (US)

(72) Inventors: William Dalebout, North Logan, UT (US); Michael L. Olson, Providence, UT (US)

(73) Assignee: ICON HEALTH & FITNESS, INC., Logan, UT (US)

( * ) Notice: Subject to any disclaimer, the term of this patent is extended or adjusted under 35 U.S.C. 154(b) by 189 days.

(21) Appl. No.: 15/472,954

(22) Filed: Mar. 29, 2017

(65) Prior Publication Data

US 2017/0197106 A1 Jul. 13, 2017

Related U.S. Application Data

(63) Continuation of application No. 15/019,088, filed on Feb. 9, 2016, now Pat. No. 9,616,276, which is a (Continued)

(51) Int. Cl.
*A63B 21/00* (2006.01)
*A63B 21/04* (2006.01)
(Continued)

(52) U.S. Cl.
CPC ..... *A63B 21/225* (2013.01); *A63B 21/005* (2013.01); *A63B 21/0051* (2013.01);
(Continued)

(58) Field of Classification Search
CPC ..... A63B 21/225; A63B 24/0087; A63B 24/0062; A63B 21/151; A63B 21/4047;
(Continued)

(56) References Cited

U.S. PATENT DOCUMENTS 9,595 A 2/1853 Moreland
9,695 A 5/1853 Hinsdale
(Continued)

FOREIGN PATENT DOCUMENTS

CN 2172137 Y 7/1994
CN 101784308 11/2001
(Continued)

OTHER PUBLICATIONS

*Nautilus, Inc.* v. *ICON Health & Fitness, Inc.*, Civil Case Nos. IPR2017-01363, IPR2017-01407, IPR2017-01408, Record of Oral Hearing held Aug. 29, 2018; 104 pages.
(Continued)

*Primary Examiner* — Andrew S Lo
(74) *Attorney, Agent, or Firm* — Maschoff Brennan

(57) ABSTRACT

Embodiments of a strength training apparatus and related methods are provided. In one embodiment, a strength training apparatus may include a base member, a tower structure, a first arm, a second arm, a flywheel, a cable and pulley system, a torque sensor, and a console. The cable and pulley system may be configured to effect rotation of the flywheel. The torque sensor may be configured to measure torque applied to the flywheel during the rotation of the flywheel. The console may include an output device. The console may further be in communication with the torque sensor. The console may further be configured to calculate an amount of work expended by a user based at least in part on the measured torque. The output device may be configured to provide an indication of the calculated amount of work expended by the user.

34 Claims, 7 Drawing Sheets

Related U.S. Application Data continuation of application No. 14/213,793, filed on Mar. 14, 2014, now Pat. No. 9,254,409.

(60) Provisional application No. 61/786,007, filed on Mar. 14, 2013.

(51) Int. Cl.

| | |
|---|---|
| ***A63B 21/22*** | (2006.01) |
| ***A63B 21/005*** | (2006.01) |
| ***A63B 23/035*** | (2006.01) |
| ***A63B 23/12*** | (2006.01) |
| ***A63B 24/00*** | (2006.01) |
| *A63B 71/06* | (2006.01) |

(52) U.S. Cl.

CPC .... *A63B 21/0052* (2013.01); *A63B 21/00076* (2013.01); *A63B 21/00192* (2013.01); *A63B 21/0442* (2013.01); *A63B 21/151* (2013.01); *A63B 21/154* (2013.01); *A63B 21/156* (2013.01); *A63B 21/4035* (2015.10); *A63B 21/4043* (2015.10); *A63B 21/4047* (2015.10); *A63B 21/4049* (2015.10); *A63B 23/03525* (2013.01); *A63B 23/03533* (2013.01); *A63B 23/03541* (2013.01); *A63B 23/12* (2013.01); *A63B 23/1209* (2013.01); *A63B 23/1218* (2013.01); *A63B 23/1227* (2013.01); *A63B 24/0062* (2013.01); *A63B 24/0087* (2013.01); *A63B 21/0056* (2013.01); *A63B 2024/0065* (2013.01); *A63B 2024/0093* (2013.01); *A63B 2071/0625* (2013.01); *A63B 2071/0675* (2013.01); *A63B 2071/0694* (2013.01); *A63B 2220/54* (2013.01); *A63B 2220/833* (2013.01); *A63B 2225/09* (2013.01)

(58) Field of Classification Search

CPC ..... A63B 21/005; A63B 23/03525; A63B 21/0051; A63B 21/00192; A63B 23/12; A63B 21/4035; A63B 21/4043; A63B 21/4049; A63B 23/1227; A63B 23/1218; A63B 23/1209; A63B 23/03541; A63B 23/03533; A63B 21/156; A63B 21/154; A63B 21/0442; A63B 21/0052; A63B 21/00076; A63B 21/0056; A63B 2071/0625; A63B 2024/0093; A63B 2225/09; A63B 2220/833; A63B 2220/54; A63B 2071/0694; A63B 2071/0675; A63B 2024/0065

See application file for complete search history.

(56) References Cited

U.S. PATENT DOCUMENTS

| | | | |
|---|---|---|---|
| 34,577 | A | 3/1862 | Jabden |
| 104,973 | A | 7/1870 | Man |
| 115,826 | A | 6/1871 | Creed |
| 192,338 | A | 6/1877 | Marshall |
| 232,022 | A | 9/1880 | Gifford |
| 232,579 | A | 9/1880 | Weeks |
| 248,121 | A | 10/1881 | Tuttle |
| 284,294 | A | 9/1883 | Graves |
| 321,388 | A | 6/1885 | Ruebsam |
| 325,435 | A | 9/1885 | North |
| 337,942 | A | 3/1886 | Parley |
| 339,638 | A | 4/1886 | Goldie |
| 348,493 | A | 8/1886 | Greene |
| 353,089 | A | 11/1886 | Smith |
| 356,219 | A | 1/1887 | Yeoman |
| 359,778 | A | 3/1887 | Pauber |
| 372,272 | A | 10/1887 | Murphy |
| 374,496 | A | 12/1887 | Reach |
| 421,779 | A | 2/1890 | Steven |
| 428,912 | A | 5/1890 | Holmes |
| 447,780 | A | 3/1891 | Luge |
| 450,792 | A | 4/1891 | Dodd |
| 457,400 | A | 8/1891 | Dowd |
| 470,837 | A | 3/1892 | Hart |
| 480,271 | A | 8/1892 | Newton |
| 484,352 | A | 10/1892 | Ayton |
| 549,084 | A | 10/1895 | Whitaker |
| 588,350 | A | 8/1897 | Perkins |
| 601,307 | A | 3/1898 | Salisbury |
| 603,350 | A | 5/1898 | Towers |
| 610,716 | A | 9/1898 | Marshal |
| 624,995 | A | 5/1899 | Tellefsen |
| 659,216 | A | 10/1900 | Dowling |
| 663,486 | A | 12/1900 | Boren |
| 674,391 | A | 5/1901 | Baker |
| 679,784 | A | 8/1901 | Ryan |
| 680,556 | A | 8/1901 | Wray |
| 682,988 | A | 9/1901 | Carroll |
| 683,284 | A | 9/1901 | Honey |
| 685,788 | A | 11/1901 | Mcfadden |
| 689,418 | A | 12/1901 | Ryan |
| 722,462 | A | 3/1903 | Smith |
| 723,625 | A | 3/1903 | Thornley |
| 754,992 | A | 3/1904 | Grabner |
| 760,374 | A | 5/1904 | Belvoir |
| 761,504 | A | 5/1904 | Kleinbach |
| 766,930 | A | 8/1904 | Clemons |
| 772,906 | A | 10/1904 | Reach |
| 776,824 | A | 12/1904 | Bryon, Jr. |
| 807,670 | A | 12/1905 | Grabner |
| 846,389 | A | 3/1907 | Blackburn |
| 852,193 | A | 4/1907 | Mcmillan |
| 881,521 | A | 3/1908 | Wilson |
| 897,722 | A | 9/1908 | Day |
| 931,394 | A | 8/1909 | Day |
| 937,795 | A | 10/1909 | Hackney |
| 943,127 | A | 12/1909 | Van Boven |
| 964,745 | A | 7/1910 | Blakoe |
| 979,609 | A | 12/1910 | Vaughn |
| 1,016,729 | A | 2/1912 | Barrett |
| 1,019,861 | A | 3/1912 | Titus |
| 1,020,777 | A | 3/1912 | Peterson |
| 1,064,968 | A | 6/1913 | Hagen |
| 1,082,940 | A | 12/1913 | Sharp |
| 1,115,826 | A | 11/1914 | Johnson |
| 1,123,272 | A | 1/1915 | Goodman |
| 1,144,085 | A | 6/1915 | Abplanalp |
| 1,211,765 | A | 1/1917 | Schmidt |
| 1,316,683 | A | 9/1919 | Calvert |
| 1,422,888 | A | 7/1922 | Reeves |
| 1,495,278 | A | 5/1924 | Titus |
| 1,539,214 | A | 5/1925 | Shockey |
| 1,570,482 | A | 1/1926 | Hale |
| 1,576,474 | A | 3/1926 | Walker |
| 1,580,530 | A | 4/1926 | Rambo |
| 1,585,748 | A | 5/1926 | Wendelken |
| 1,672,944 | A | 6/1928 | Jowett |
| 1,698,831 | A | 1/1929 | Titus |
| 1,715,870 | A | 6/1929 | Spain |
| 1,766,089 | A | 6/1930 | Wood |
| 1,778,635 | A | 10/1930 | Heisler |
| 1,824,406 | A | 9/1931 | Petersime |
| 1,850,530 | A | 3/1932 | Brown |
| 1,851,843 | A | 3/1932 | Inman |
| 1,893,728 | A | 1/1933 | Bullis |
| 1,902,694 | A | 3/1933 | Edwards |
| 1,917,566 | A | 7/1933 | Wood |
| 1,919,627 | A | 7/1933 | Fitz Gerald |
| 1,928,089 | A | 9/1933 | Blickman |
| 1,930,416 | A | 10/1933 | Chauvot |
| 1,973,945 | A | 9/1934 | Chavin |
| 1,978,579 | A | 10/1934 | Hooks |
| 1,982,843 | A | 12/1934 | Traver |
| 1,982,872 | A | 12/1934 | Newton |
| 1,991,520 | A | 2/1935 | Postl |
| 2,067,136 | A | 1/1937 | Bridenbaugh |

(56) References Cited

U.S. PATENT DOCUMENTS 2,117,957 A 5/1938 Ritter
2,129,262 A 9/1938 Cole
2,145,940 A 2/1939 Marlowe
2,153,077 A 4/1939 Clarke
2,165,700 A 7/1939 Glynn
2,177,957 A 10/1939 Stewart
2,183,345 A 12/1939 Brandon
2,209,034 A 7/1940 Rene
2,219,219 A 10/1940 Boger
2,247,946 A 7/1941 Hein et al.
2,255,864 A 9/1941 Stephens
2,274,574 A 2/1942 Zerne
2,315,485 A 4/1943 Jones
2,346,105 A 4/1944 Haehnel
2,379,984 A 7/1945 Nereaux
2,399,915 A 5/1946 Drake
2,413,841 A 1/1947 Minuto
2,436,987 A 3/1948 Bailleaux
2,438,548 A 3/1948 Ehmann
2,440,644 A 4/1948 Powell
2,456,017 A 12/1948 Park
2,470,544 A 5/1949 Bell
2,472,391 A 6/1949 Albizu
2,500,299 A 3/1950 Spitzkeit
2,512,417 A 6/1950 Polite
2,569,007 A 9/1951 Klyce
2,573,351 A 10/1951 Motis
2,607,816 A 8/1952 Ryder
2,632,645 A 3/1953 Barkschat
2,637,319 A 5/1953 Bruene
2,640,696 A 6/1953 Lemieux
2,641,250 A 6/1953 Brockman
2,642,288 A 6/1953 Bell
2,645,539 A 7/1953 Thompson
2,646,282 A 7/1953 Ringman
2,648,540 A 8/1953 Hunter
2,654,135 A 10/1953 Grizzard et al.
2,674,453 A 4/1954 Hummert
2,695,797 A 11/1954 Mccarthy et al.
2,714,507 A 8/1955 Goodrich
2,740,178 A 4/1956 Kellems
2,743,623 A 5/1956 Wells
2,746,822 A 5/1956 Copenhaver
2,763,156 A 9/1956 Garigal
2,779,139 A 1/1957 Boettcher
2,842,365 A 7/1958 Kelley
2,843,858 A 7/1958 Bjorklund
2,855,200 A 10/1958 Blickman
2,874,971 A 2/1959 Devery
2,906,532 A 9/1959 Echols
2,924,456 A 2/1960 Miller
2,927,006 A 3/1960 Brooks
2,938,695 A 5/1960 Ciampa
2,968,337 A 1/1961 Bartlett
2,969,060 A 1/1961 Swanda
2,977,120 A 3/1961 Morris
2,978,830 A 4/1961 Killian
2,984,594 A 5/1961 Runton
2,985,933 A 5/1961 Peterson et al.
3,000,628 A 9/1961 Kellogg
3,035,671 A 5/1962 Sicherman
3,057,201 A 10/1962 Jaeger
3,059,312 A 10/1962 Jamieson
3,068,002 A 12/1962 Balne
3,068,950 A 12/1962 Davidson
3,072,426 A 1/1963 Kraft
3,090,092 A 5/1963 Szemplak
3,099,509 A 7/1963 Duenke
3,112,108 A 11/1963 Hanke
3,115,332 A 12/1963 Singleton
3,118,441 A 1/1964 Prosser
3,127,171 A 3/1964 Noland et al.
3,161,395 A 12/1964 Carter
3,179,071 A 4/1965 Johnston
3,193,287 A 7/1965 Robinson
3,194,598 A 7/1965 Goldfuss
3,205,888 A 9/1965 Stroop
3,246,894 A 4/1966 Salisbury
3,256,630 A 6/1966 Spector
3,270,494 A 9/1966 Holmes
3,312,466 A 4/1967 Melchiona
3,316,898 A 5/1967 Brown
3,319,273 A 5/1967 Solin
3,323,367 A 6/1967 Searle
3,342,485 A 9/1967 Gaul
3,345,067 A 10/1967 Smith
3,349,621 A 10/1967 Mullen
3,358,813 A 12/1967 Kohlhagen
3,370,584 A 2/1968 Girten
3,373,993 A 3/1968 Oja et al.
3,378,259 A 4/1968 Kupchinski
3,380,737 A 4/1968 Elia
3,381,958 A 5/1968 Gulland
3,384,370 A 5/1968 Bailey et al.
3,390,460 A 7/1968 Brown
3,394,934 A 7/1968 Elia
3,408,067 A 10/1968 Armstrong
3,408,069 A 10/1968 Lewis
3,411,497 A 11/1968 Rickey et al.
3,411,776 A 11/1968 Holkesvick et al.
3,416,174 A 12/1968 Novitske
3,424,005 A 1/1969 Brown
3,428,311 A 2/1969 Mitchell
3,428,312 A 2/1969 Machen
3,430,084 A 2/1969 Hall
3,430,507 A 3/1969 Hurst et al.
3,432,164 A 3/1969 Deeks
3,438,627 A 4/1969 La Lanne
3,444,830 A 5/1969 Doetsch
3,446,503 A 5/1969 Lawton
3,456,592 A 7/1969 Nelsen
3,465,592 A 9/1969 Perrine
3,482,835 A 12/1969 Dean
3,488,051 A 1/1970 Scherer
3,495,824 A 2/1970 Cuinier
3,501,140 A 3/1970 Eichorn
3,511,500 A 5/1970 Dunn
3,514,110 A 5/1970 Thomander
3,518,985 A 7/1970 Quinton
3,522,947 A 8/1970 Anderson
3,540,724 A 11/1970 Hunter
3,547,435 A 12/1970 Scott
3,554,541 A 1/1971 Spoth
3,563,541 A 2/1971 Sanquist
3,566,861 A 3/1971 Weiss
3,567,219 A 3/1971 Foster
3,568,669 A 3/1971 Stites
3,583,465 A 6/1971 Youngs et al.
3,586,322 A 6/1971 Kverneland
3,588,101 A 6/1971 Jungreis
3,589,193 A 6/1971 Thornton
3,589,715 A 6/1971 Mark
3,589,720 A 6/1971 Agamian
3,592,466 A 7/1971 Parsons
3,598,404 A 8/1971 Bowman
3,601,398 A 8/1971 Brochman
3,602,502 A 8/1971 Jaegar
3,606,320 A 9/1971 Erwin, Jr.
3,606,406 A 9/1971 Walters
3,608,898 A 9/1971 Berlin
3,614,097 A 10/1971 Blickman
3,614,108 A 10/1971 Garten
3,617,056 A 11/1971 Herbold
3,628,654 A 12/1971 Haracz
3,628,791 A 12/1971 Garcia
3,634,895 A 1/1972 Childers
3,636,577 A 1/1972 Nissen
3,638,941 A 2/1972 Kulkens
3,640,528 A 2/1972 Proctor
3,640,530 A 2/1972 Henson et al.
3,641,601 A 2/1972 Sieg
3,642,279 A 2/1972 Cutter
3,643,943 A 2/1972 Erwin, Jr. et al.
3,647,209 A 3/1972 La Lanne

(56) References Cited

U.S. PATENT DOCUMENTS 3,650,529 A 3/1972 Salm
3,652,085 A 3/1972 Civalier
3,658,327 A 4/1972 Thiede
3,659,845 A 5/1972 Quinton
3,664,666 A 5/1972 Lloyd
3,664,910 A 5/1972 Hollie
3,664,916 A 5/1972 Grellier et al.
3,672,124 A 6/1972 Pirotta
3,679,244 A 7/1972 Reddy
3,686,776 A 8/1972 Dahl
3,689,066 A 9/1972 Hagen
3,690,655 A 9/1972 Chapman
3,703,284 A 11/1972 Hesen
3,708,166 A 1/1973 Annas
3,708,167 A 1/1973 Potgieter
3,709,197 A 1/1973 Moseley
3,728,940 A 4/1973 Peterson
3,731,917 A 5/1973 Townsend
3,738,649 A 6/1973 Miller
3,741,538 A 6/1973 Useldinger
3,744,480 A 7/1973 Gause et al.
3,744,712 A 7/1973 Papadopoulos
3,744,794 A 7/1973 Gause et al.
3,751,033 A 8/1973 Rosenthal
3,756,595 A 9/1973 Hague
3,758,109 A 9/1973 Bender
3,759,511 A 9/1973 Zinkin
3,761,083 A 9/1973 Buchner
3,767,195 A 10/1973 Dimick
3,771,785 A 11/1973 Speyer
3,782,718 A 1/1974 Saylor
3,784,193 A 1/1974 Simjian
3,788,412 A 1/1974 Vincent
3,789,467 A 2/1974 Aratani et al.
3,792,860 A 2/1974 Selnes
3,797,624 A 3/1974 Powell et al.
3,802,698 A 4/1974 Burian et al.
3,802,701 A 4/1974 Good
3,807,728 A 4/1974 Chillier
3,809,393 A 5/1974 Jones
3,814,420 A 6/1974 Encke
3,815,903 A 6/1974 Blomqvist
3,818,194 A 6/1974 Biro
3,822,488 A 7/1974 Johnson
3,822,599 A 7/1974 Brentham
3,825,253 A 7/1974 Speyer
3,826,491 A 7/1974 Elder
3,831,942 A 8/1974 Del Mar
3,833,216 A 9/1974 Philbin
3,834,696 A 9/1974 Spector
3,840,227 A 10/1974 Chesemore
3,845,756 A 11/1974 Olsson
3,851,874 A 12/1974 Wilkin
3,858,873 A 1/1975 Jones
3,858,874 A 1/1975 Weider
3,858,938 A 1/1975 Kristensson et al.
3,859,840 A 1/1975 Gause
3,861,215 A 1/1975 Bradley
3,869,121 A 3/1975 Flavell
3,870,297 A 3/1975 Elder
3,874,375 A 4/1975 Penner
3,874,657 A 4/1975 Niebojewski
3,880,274 A 4/1975 Bechtloff
3,883,922 A 5/1975 Fleischhauer
3,884,464 A 5/1975 Evangelos
3,891,207 A 6/1975 Helliwell
3,892,404 A 7/1975 Martucci
3,901,379 A 8/1975 Bruhm
3,902,480 A 9/1975 Wilson
3,902,717 A 9/1975 Kulkens
3,903,613 A 9/1975 Bisberg
3,904,196 A 9/1975 Berlin
3,909,857 A 10/1975 Herrera
3,912,263 A 10/1975 Yatso
3,913,908 A 10/1975 Speyer
3,918,710 A 11/1975 Niebojewski
3,920,240 A 11/1975 Ross
3,926,430 A 12/1975 Good, Jr.
3,929,026 A 12/1975 Hofmann
3,938,400 A 2/1976 Konyha
3,938,803 A 2/1976 Wilmoth
3,941,377 A 3/1976 Lie
3,948,513 A 4/1976 Pfotenhauer
3,953,025 A 4/1976 Mazman
3,957,266 A 5/1976 Rice
3,958,803 A 5/1976 Geisselbrecht
3,963,101 A 6/1976 Stadelmann et al.
3,971,555 A 7/1976 Mahnke
3,974,491 A 8/1976 Sipe
3,976,058 A 8/1976 Tidwell
3,977,451 A 8/1976 Duba
3,979,931 A 9/1976 Man
3,981,500 A 9/1976 Ryan
3,984,666 A 10/1976 Barron
3,998,454 A 12/1976 Jones
4,004,801 A 1/1977 Campanaro
4,012,015 A 3/1977 Nelson et al.
4,020,795 A 5/1977 Marks
4,024,949 A 5/1977 Kleysteuber et al.
4,026,545 A 5/1977 Schonenberger
4,026,548 A 5/1977 Birdwell
4,027,531 A 6/1977 Dawson
4,029,312 A 6/1977 Wright
4,033,567 A 7/1977 Lipfert
4,042,305 A 8/1977 Vincent
4,043,552 A 8/1977 Kerkonian
4,056,265 A 11/1977 Ide
4,059,265 A 11/1977 Wieder et al.
4,060,240 A 11/1977 Dunston
4,061,257 A 12/1977 St. Clair
4,063,726 A 12/1977 Wilson
4,063,727 A 12/1977 Hall
4,066,257 A 1/1978 Moller
4,066,259 A 1/1978 Brentham
4,066,868 A 1/1978 Witkin et al.
4,067,372 A 1/1978 Masson
4,071,235 A 1/1978 Zent
4,072,309 A 2/1978 Wilson
4,073,490 A 2/1978 Feather
4,074,409 A 2/1978 Smith
4,074,519 A 2/1978 Garrett
4,074,903 A 2/1978 Diez de Aux
4,076,236 A 2/1978 Ionel
4,076,237 A 2/1978 Dussia
4,093,196 A 6/1978 Bauer
4,093,211 A 6/1978 Hughes et al.
4,094,330 A 6/1978 Jong
4,098,100 A 7/1978 Wah
4,101,124 A 7/1978 Mahnke
4,111,417 A 9/1978 Gardner
4,112,928 A 9/1978 Putsch
4,113,071 A 9/1978 Muller et al.
4,120,294 A 10/1978 Wolfe
4,120,924 A 10/1978 Rainville
4,122,585 A 10/1978 Sharp et al.
4,131,701 A 12/1978 VanAuken
4,140,312 A 2/1979 Buchmann
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,154,441 A 5/1979 Gajda
4,157,181 A 6/1979 Cecka
4,157,594 A 6/1979 Raabe
4,161,998 A 7/1979 Trimble
4,167,938 A 9/1979 Remih
4,168,061 A 9/1979 Gordon
4,170,351 A 10/1979 Ozbey
4,171,805 A 10/1979 Abbott
4,176,836 A 12/1979 Coyle
4,179,134 A 12/1979 Atkinson
4,183,156 A 1/1980 Rudy
4,183,494 A 1/1980 Cleveland

(56) References Cited

U.S. PATENT DOCUMENTS 4,188,030 A 2/1980 Hooper
4,193,630 A 3/1980 Steele
4,198,044 A 4/1980 Holappa
4,199,139 A 4/1980 Mahnke
4,200,279 A 4/1980 Lambert, Jr.
4,200,280 A 4/1980 Goodwin
4,204,673 A 5/1980 Speer, Sr.
4,207,879 A 6/1980 Safadago
4,208,049 A 6/1980 Wilson
4,215,516 A 8/1980 Huschle et al.
4,216,856 A 8/1980 Moring et al.
4,220,996 A 9/1980 Searcy
4,227,689 A 10/1980 Keiser
4,231,568 A 11/1980 Riley
4,231,569 A 11/1980 Rae
4,235,437 A 11/1980 Ruis et al.
4,236,239 A 11/1980 Imgruth et al.
4,239,092 A 12/1980 Janson
4,240,627 A 12/1980 Brentham
4,241,915 A 12/1980 Noble
4,248,476 A 2/1981 Phelps
4,249,725 A 2/1981 Mattox
4,249,773 A 2/1981 Giambalvo
4,251,932 A 2/1981 Love
4,252,314 A 2/1981 Ceppo
4,253,661 A 3/1981 Russell
4,253,662 A 3/1981 Podolak
4,256,302 A 3/1981 Keiser et al.
4,257,590 A 3/1981 Sullivan et al.
4,258,821 A 3/1981 Wendt
4,258,913 A 3/1981 Brentham
4,263,897 A 4/1981 Terayama
4,274,625 A 6/1981 Gaetano
4,275,882 A 6/1981 Grosser et al.
4,278,095 A 7/1981 Lapeyre
4,278,249 A 7/1981 Forrest
4,286,782 A 9/1981 Fuhrhop
4,290,601 A 9/1981 Mittelstadt
4,296,924 A 10/1981 Anzaldua et al.
4,298,893 A 11/1981 Holmes
4,300,760 A 11/1981 Bobroff
4,300,761 A 11/1981 Howard
4,301,808 A 11/1981 Taus
4,307,880 A 12/1981 Abram
4,313,602 A 2/1982 Sullivan
4,313,603 A 2/1982 Simjian
4,316,609 A 2/1982 Silberman
4,316,610 A 2/1982 Hinds
4,322,609 A 3/1982 Kato
4,323,237 A 4/1982 Jungerwirth
4,324,501 A 4/1982 Herbenar
4,325,548 A 4/1982 Piccini
4,327,713 A 5/1982 Okazaki et al.
4,328,964 A 5/1982 Walls
4,328,965 A 5/1982 Hatfield
4,328,968 A 5/1982 Hacker
4,333,978 A 6/1982 Kocher
4,334,676 A 6/1982 Schonenberger
4,334,678 A 6/1982 Doyel
4,334,695 A 6/1982 Ashby
4,337,283 A 6/1982 Haas, Jr.
4,337,529 A 6/1982 Morokawa
4,342,452 A 8/1982 Summa
4,344,616 A 8/1982 Ogden
4,345,756 A 8/1982 Hoagland
4,346,888 A 8/1982 Szabo
4,349,192 A 9/1982 Lambert, Jr. et al.
4,349,597 A 9/1982 Fine et al.
4,350,336 A 9/1982 Hanford
4,354,675 A 10/1982 Barclay et al.
4,354,676 A 10/1982 Ariel
4,355,061 A 10/1982 Zeigler
4,355,645 A 10/1982 Mitani et al.
4,357,010 A 11/1982 Telle
4,357,011 A 11/1982 Voris
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,368,735 A 1/1983 Filmer
4,369,081 A 1/1983 Curry et al.
4,369,966 A 1/1983 Silberman et al.
4,370,766 A 2/1983 Teague, Jr.
4,371,162 A 2/1983 Hartzell
4,372,553 A 2/1983 Hatfield
4,373,716 A 2/1983 Pagani
4,374,587 A 2/1983 Ogden
4,374,588 A 2/1983 Ruggles
4,376,533 A 3/1983 Kolbel
4,377,045 A 3/1983 Aurensan
4,378,111 A 3/1983 Tsuchida et al.
4,382,596 A 5/1983 Silberman
4,383,684 A 5/1983 Schliep
4,383,714 A 5/1983 Ishida
4,384,715 A 5/1983 Barrett, Jr.
4,387,893 A 6/1983 Baldwin
4,389,047 A 6/1983 Hall
4,390,179 A 6/1983 Szkalak
4,391,440 A 7/1983 Berger
4,397,462 A 8/1983 Wilmarth
4,398,713 A 8/1983 Ellis
4,402,504 A 9/1983 Christian
4,406,451 A 9/1983 Gaetano
4,408,613 A 10/1983 Relyea
4,422,635 A 12/1983 Herod
4,422,636 A 12/1983 de Angeli
4,423,630 A 1/1984 Morrison
4,423,864 A 1/1984 Wiik
4,424,693 A 1/1984 Best et al.
4,426,077 A 1/1984 Becker
4,428,577 A 1/1984 Croom
4,428,578 A 1/1984 Kirkpatrick
4,431,181 A 2/1984 Baswell
4,431,184 A 2/1984 Lew et al.
4,434,981 A 3/1984 Norton
4,441,708 A 4/1984 Brentham
4,445,684 A 5/1984 Ruff
4,448,434 A 5/1984 Anderson
4,452,448 A 6/1984 Ausherman
4,453,766 A 6/1984 DiVito
4,456,245 A 6/1984 Baldwin
4,456,246 A 6/1984 Szabo
4,461,472 A 7/1984 Martinez
4,461,473 A 7/1984 Cole
4,463,948 A 8/1984 Mohr
4,465,274 A 8/1984 Davenport
4,465,276 A 8/1984 Cox
4,465,277 A 8/1984 Dittrich
4,474,370 A 10/1984 Oman
4,476,582 A 10/1984 Strauss et al.
4,477,071 A 10/1984 Brown et al.
4,478,413 A 10/1984 Siwula
4,480,831 A 11/1984 Muller-Deinhardt
4,482,152 A 11/1984 Wolff
4,489,933 A 12/1984 Fisher
4,489,936 A 12/1984 Dal Monte
4,491,318 A 1/1985 Francke
4,492,375 A 1/1985 Connelly
4,493,561 A 1/1985 Bouchet
4,494,662 A 1/1985 Clymer
4,495,560 A 1/1985 Sugimoto et al.
4,496,147 A 1/1985 DeCloux et al.
4,499,784 A 2/1985 Shum
4,502,679 A 3/1985 De Lorenzo
4,502,682 A 3/1985 Miller
4,504,055 A 3/1985 Wells
4,504,968 A 3/1985 Kaneko et al.
4,505,474 A 3/1985 Mattox
4,505,475 A 3/1985 Olschansky et al.
4,505,495 A 3/1985 Foss et al.
4,509,510 A 4/1985 Hook
4,511,137 A 4/1985 Jones
4,512,566 A 4/1985 Bicocchi
4,512,567 A 4/1985 Phillips

(56) References Cited

U.S. PATENT DOCUMENTS 4,512,571 A 4/1985 Hermelin
4,515,363 A 5/1985 Schleffendorf
4,515,988 A 5/1985 Bayer et al.
4,519,603 A 5/1985 Decloux
4,521,013 A 6/1985 Dofel
4,522,394 A 6/1985 Broussard
4,529,194 A 7/1985 Haaheim
4,529,196 A 7/1985 Logan
4,529,197 A 7/1985 Gogarty
4,529,198 A 7/1985 Hettick, Jr.
4,531,727 A 7/1985 Pitre
4,531,731 A 7/1985 Law
4,533,136 A 8/1985 Smith et al.
4,536,244 A 8/1985 Greci et al.
4,537,396 A 8/1985 Hooper
4,538,805 A 9/1985 Parviainen
4,540,171 A 9/1985 Clark
4,540,173 A 9/1985 Hopkins, Jr.
4,542,897 A 9/1985 Melton
4,542,899 A 9/1985 Hendricks
4,544,152 A 10/1985 Taitel
4,544,153 A 10/1985 Babcock
4,546,967 A 10/1985 Kecala
4,546,970 A 10/1985 Mahnke
4,546,971 A 10/1985 Raasoch
4,548,405 A 10/1985 Lee
4,549,044 A 10/1985 Durham
4,549,433 A 10/1985 Gneiss et al.
4,549,733 A 10/1985 Salyer
4,549,734 A 10/1985 Hibler, Jr.
4,555,108 A 11/1985 Monteiro
4,555,109 A 11/1985 Hartmann
4,563,001 A 1/1986 Terauds
4,563,003 A 1/1986 Bugallo et al.
4,564,193 A 1/1986 Stewart
4,565,369 A 1/1986 Bedgood
4,566,461 A 1/1986 Lubell et al.
4,566,689 A 1/1986 Ogden
4,566,690 A 1/1986 Schook
4,566,732 A 1/1986 Ostergaard, Sr.
4,569,518 A 2/1986 Fulks
4,569,519 A 2/1986 Mattox et al.
4,571,682 A 2/1986 Silverman et al.
4,572,500 A 2/1986 Weiss
4,572,504 A 2/1986 DiBartolo
4,573,449 A 3/1986 Warnke
4,575,074 A 3/1986 Damratoski
4,576,352 A 3/1986 Ogden
4,576,376 A 3/1986 Miller
4,576,377 A 3/1986 Wolff
4,577,860 A 3/1986 Matias et al.
4,577,865 A 3/1986 Shishido
4,579,360 A 4/1986 Nishimura et al.
4,580,983 A 4/1986 Cassini et al.
4,581,269 A 4/1986 Tilman
4,582,320 A 4/1986 Shaw
4,586,495 A 5/1986 Petrofsky
4,587,695 A 5/1986 Jensen
4,589,656 A 5/1986 Baldwin
4,591,147 A 5/1986 Smith et al.
4,591,150 A 5/1986 Mosher
4,591,151 A 5/1986 Hensley
4,592,544 A 6/1986 Smith et al.
4,598,908 A 7/1986 Morgan
4,600,188 A 7/1986 Bangerter et al.
4,600,189 A 7/1986 Olschansky et al.
4,600,196 A 7/1986 Nomura, et al.
4,601,142 A 7/1986 Frommelt
4,602,779 A 7/1986 Ogden
4,603,855 A 8/1986 Sebelle
4,603,856 A 8/1986 Fiore
4,606,540 A 8/1986 Chin Sen
4,606,541 A 8/1986 Kirkpatrick
4,607,840 A 8/1986 Harper
4,607,841 A 8/1986 Gala
4,608,969 A 9/1986 Hamlin
4,609,174 A 9/1986 Nakatani
4,610,448 A 9/1986 Hill
4,610,449 A 9/1986 Diercks, Jr.
4,611,805 A 9/1986 Franklin et al.
4,614,337 A 9/1986 Schonenberger
4,616,822 A 10/1986 Trulaske
4,618,139 A 10/1986 Haaheim
4,618,140 A 10/1986 Brown
4,618,144 A 10/1986 Gibson
4,619,454 A 10/1986 Walton
4,620,701 A 11/1986 Mojden
4,620,704 A 11/1986 Shifferaw
4,621,623 A 11/1986 Wang
4,621,807 A 11/1986 Stramer
4,621,810 A 11/1986 Cummins
4,624,457 A 11/1986 Silberman et al.
4,627,614 A 12/1986 de Angeli
4,627,615 A 12/1986 Nurkowski
4,627,616 A 12/1986 Kauffman
4,627,618 A 12/1986 Schwartz
4,630,817 A 12/1986 Buckley
4,632,385 A 12/1986 Geraci
4,632,386 A 12/1986 Beech
4,632,388 A 12/1986 Schleffendorf
4,632,390 A 12/1986 Richey
4,632,393 A 12/1986 Van Noord
4,632,414 A 12/1986 Ellefson
4,632,421 A 12/1986 Shamie
4,634,118 A 1/1987 Jensen
4,634,127 A 1/1987 Rockwell
4,635,926 A 1/1987 Minkow
4,635,927 A 1/1987 Shu
4,635,928 A 1/1987 Ogden et al.
4,637,605 A 1/1987 Ritchie
4,638,523 A 1/1987 Todd
4,638,969 A 1/1987 Brown
4,638,994 A 1/1987 Gogarty
4,641,833 A 2/1987 Trethewey
4,642,080 A 2/1987 Takano et al.
4,642,769 A 2/1987 Petrofsky
4,643,418 A 2/1987 Bart
4,643,420 A 2/1987 Riley
4,645,197 A 2/1987 Mcfee
4,645,198 A 2/1987 Levenston
4,645,200 A 2/1987 Hix
4,645,201 A 2/1987 Evans
4,645,917 A 2/1987 Penney et al.
4,647,037 A 3/1987 Donohue
4,647,040 A 3/1987 Ehrenfried
4,647,041 A 3/1987 Whiteley
4,648,481 A 3/1987 Lee
4,648,594 A 3/1987 Schleffendorf
4,650,067 A 3/1987 Brule
4,650,183 A 3/1987 McIntyre
4,650,184 A 3/1987 Brebner
4,650,185 A 3/1987 Cartwright
4,651,446 A 3/1987 Yukawa et al.
4,651,581 A 3/1987 Svensson
4,651,988 A 3/1987 Sobel
4,655,448 A 4/1987 Harder
4,657,246 A 4/1987 Salyer
4,659,074 A 4/1987 Taitel et al.
4,659,078 A 4/1987 Blome
4,660,550 A 4/1987 Bodine
4,662,629 A 5/1987 Plovie
4,662,630 A 5/1987 Dignard et al.
4,664,371 A 5/1987 Viander
4,664,373 A 5/1987 Hait
4,664,646 A 5/1987 Rorabaugh
4,665,388 A 5/1987 Ivie et al.
4,666,149 A 5/1987 Olschansky et al.
4,666,151 A 5/1987 Chillier
4,671,257 A 6/1987 Kaiser et al.
4,673,177 A 6/1987 Szymski
4,673,180 A 6/1987 Rice
4,674,740 A 6/1987 Iams et al.
4,674,743 A 6/1987 Hirano
4,678,182 A 7/1987 Nakao et al.

(56) References Cited

U.S. PATENT DOCUMENTS 4,678,185 A 7/1987 Mahnke
4,679,786 A 7/1987 Rodgers
4,679,787 A 7/1987 Guilbault
4,684,121 A 8/1987 Nestegard
4,684,126 A 8/1987 Dalebout et al.
4,685,670 A 8/1987 Zinkin
4,685,671 A 8/1987 Hagerman et al.
4,687,195 A 8/1987 Potts
4,697,809 A 10/1987 Rockwell
4,700,946 A 10/1987 Breunig
4,702,475 A 10/1987 Elstein et al.
4,705,267 A 11/1987 Jackson
4,706,953 A 11/1987 Graham
4,708,337 A 11/1987 Shyu
4,708,338 A 11/1987 Potts
4,708,837 A 11/1987 Baxter et al.
4,709,917 A 12/1987 Yang
4,709,918 A 12/1987 Grinblat
4,709,920 A 12/1987 Schnell
4,711,447 A 12/1987 Mansfield
4,714,244 A 12/1987 Kolomayets et al.
4,714,248 A 12/1987 Koss
4,717,146 A 1/1988 Nohara
4,718,207 A 1/1988 Frommelt
4,720,099 A 1/1988 Carlson
4,720,789 A 1/1988 Hector et al.
4,721,301 A 1/1988 Drake
4,721,303 A 1/1988 Fitzpatrick
4,722,522 A 2/1988 Lundgren
4,725,057 A 2/1988 Shifferaw
4,726,581 A 2/1988 Chang
4,726,582 A 2/1988 Fulks
4,728,099 A 3/1988 Pitre
4,729,558 A 3/1988 Kuo
4,729,562 A 3/1988 Pipasik
4,730,828 A 3/1988 Lane
4,730,829 A 3/1988 Carlson
4,733,858 A 3/1988 Lan
4,733,860 A 3/1988 Steffee
4,733,905 A 3/1988 Buickerood
4,741,530 A 5/1988 Wolf
4,743,009 A 5/1988 Beale
4,743,010 A 5/1988 Geraci
4,743,015 A 5/1988 Marshall
4,743,017 A 5/1988 Jaeger
4,744,559 A 5/1988 Mahnke et al.
4,746,115 A 5/1988 Lahman
4,749,184 A 6/1988 Tobin
4,750,736 A 6/1988 Watterson
4,750,738 A 6/1988 Dang
4,751,755 A 6/1988 Carey, Jr. et al.
4,753,437 A 6/1988 Lapcevic
4,756,098 A 7/1988 Boggia
4,756,527 A 7/1988 Ledbetter
4,757,495 A 7/1988 Decker et al.
4,757,987 A 7/1988 Allemand
4,759,540 A 7/1988 Yu et al.
4,763,284 A 8/1988 Carlin
4,763,897 A 8/1988 Yakata
4,765,610 A 8/1988 Sidwell
4,765,613 A 8/1988 Voris
4,765,616 A 8/1988 Wolff
4,768,780 A 9/1988 Hayes
4,770,411 A 9/1988 Armstrong et al.
4,771,148 A 9/1988 Bersonnet
4,771,577 A 9/1988 Abe
4,772,015 A 9/1988 Carlson et al.
4,773,170 A 9/1988 Moore et al.
4,773,640 A 9/1988 Kolbel et al.
4,774,679 A 9/1988 Carlin
4,775,149 A 10/1988 Wilson
4,776,581 A 10/1988 Shepherdson
4,776,582 A 10/1988 Ramhorst
4,776,587 A 10/1988 Carlson et al.
4,778,173 A 10/1988 Joutras
4,779,867 A 10/1988 Hinds
4,779,884 A 10/1988 Minati
4,784,384 A 11/1988 Deola
4,786,049 A 11/1988 Lautenschlager
4,786,050 A 11/1988 Geschwender
4,789,153 A 12/1988 Brown
4,790,522 A 12/1988 Drutchas
4,790,528 A 12/1988 Nakao et al.
4,790,596 A 12/1988 Shifferaw
4,792,134 A 12/1988 Chen
4,793,608 A 12/1988 Mahnke et al.
4,797,968 A 1/1989 Wenzlick
4,798,377 A 1/1989 White
4,798,760 A 1/1989 Diaz-Kotti
4,799,475 A 1/1989 Iams et al.
4,799,671 A 1/1989 Hoggan et al.
4,801,079 A 1/1989 Gonella
4,801,139 A 1/1989 Vanhoutte
4,801,140 A 1/1989 Bergeron
4,804,178 A 2/1989 Friedebach
4,805,901 A 2/1989 Kulick
4,807,874 A 2/1989 Little
4,807,893 A 2/1989 Huang
4,809,804 A 3/1989 Houston et al.
4,809,972 A 3/1989 Rasmussen et al.
4,809,973 A 3/1989 Johns
4,809,976 A 3/1989 Berger
4,813,665 A 3/1989 Carr
4,813,667 A 3/1989 Watterson
4,813,668 A 3/1989 Solloway
4,813,743 A 3/1989 Mizelle
4,814,661 A 3/1989 Ratzlaff et al.
4,817,938 A 4/1989 Nakao et al.
4,817,939 A 4/1989 Augspurger et al.
4,817,940 A 4/1989 Shaw et al.
4,818,175 A 4/1989 Kimura
4,818,234 A 4/1989 Redington
4,819,583 A 4/1989 Guerra
4,819,818 A 4/1989 Simkus
4,822,029 A 4/1989 Sarno
4,822,034 A 4/1989 Shields
4,822,035 A 4/1989 Jennings et al.
4,822,038 A 4/1989 Maag
4,824,104 A 4/1989 Bloch
4,826,153 A 5/1989 Schalip
4,826,157 A 5/1989 Fitzpatrick
4,826,158 A 5/1989 Fields, Jr.
4,826,159 A 5/1989 Hersey
4,828,255 A 5/1989 Lahman
4,828,257 A 5/1989 Dyer et al.
4,828,522 A 5/1989 Santos
4,828,713 A 5/1989 McDonald et al.
4,830,362 A 5/1989 Bull
4,830,363 A 5/1989 Kennedy
4,830,365 A 5/1989 March
4,832,332 A 5/1989 Dumbser
4,834,365 A 5/1989 Jones
4,834,396 A 5/1989 Schnell
4,836,530 A 6/1989 Stanley, Jr.
4,836,535 A 6/1989 Pearson
4,837,157 A 6/1989 Turnell et al.
4,838,180 A 6/1989 Gutgsell
4,838,543 A 6/1989 Armstrong et al.
4,838,544 A 6/1989 Sasakawa et al.
4,840,372 A 6/1989 Oglesby et al.
4,840,373 A 6/1989 Maag
4,842,266 A 6/1989 Sweeney, Sr.
4,842,268 A 6/1989 Jenkins
4,844,448 A 7/1989 Niznik
4,844,449 A 7/1989 Truslaske
4,844,450 A 7/1989 Rodgers, Jr.
4,844,453 A 7/1989 Hestilow
4,844,456 A 7/1989 Habing et al.
4,846,458 A 7/1989 Potts
4,846,693 A 7/1989 Baer
4,850,585 A 7/1989 Dalebout
4,852,874 A 8/1989 Sleichter, III et al.
4,854,578 A 8/1989 Fulks
4,855,942 A 8/1989 Bianco

(56) References Cited

U.S. PATENT DOCUMENTS

| | | | |
|---|---|---|---|
| 4,856,773 | A | 8/1989 | Deola |
| 4,856,775 | A | 8/1989 | Colledge |
| 4,858,912 | A | 8/1989 | Boyd |
| 4,858,915 | A | 8/1989 | Szabo |
| 4,858,918 | A | 8/1989 | Iams et al. |
| 4,860,763 | A | 8/1989 | Schminke |
| 4,861,020 | A | 8/1989 | Soligny, Sr. |
| 4,861,023 | A | 8/1989 | Wedman |
| 4,861,025 | A | 8/1989 | Rockwell |
| 4,863,157 | A | 9/1989 | Mendel et al. |
| 4,863,161 | A | 9/1989 | Telle |
| 4,863,163 | A | 9/1989 | Wehrell |
| 4,865,344 | A | 9/1989 | Romero, Sr. et al. |
| 4,866,704 | A | 9/1989 | Bergman |
| 4,867,442 | A | 9/1989 | Matthews |
| 4,867,443 | A | 9/1989 | Jensen |
| 4,869,493 | A | 9/1989 | Johnston |
| 4,869,494 | A | 9/1989 | Lambert, Sr. |
| 4,869,497 | A | 9/1989 | Stewart et al. |
| 4,872,670 | A | 10/1989 | Nichols |
| 4,875,676 | A | 10/1989 | Zimmer |
| 4,877,239 | A | 10/1989 | Dela Rosa |
| 4,878,662 | A | 11/1989 | Chern |
| 4,878,663 | A | 11/1989 | Luquette |
| 4,880,227 | A | 11/1989 | Sowell |
| 4,880,229 | A | 11/1989 | Broussard |
| 4,880,230 | A | 11/1989 | Cook |
| 4,883,272 | A | 11/1989 | Lay |
| 4,886,266 | A | 12/1989 | Trulaske |
| 4,887,929 | A | 12/1989 | Hale |
| 4,889,108 | A | 12/1989 | Bond et al. |
| 4,889,131 | A | 12/1989 | Salem et al. |
| 4,889,458 | A | 12/1989 | Taylor |
| 4,891,764 | A | 1/1990 | McIntosh |
| 4,891,785 | A | 1/1990 | Donohoo |
| 4,893,409 | A | 1/1990 | Poehlmann |
| 4,893,810 | A | 1/1990 | Lee |
| 4,894,933 | A | 1/1990 | Tonkel et al. |
| 4,898,379 | A | 2/1990 | Shiba |
| 4,898,381 | A | 2/1990 | Gordon |
| 4,900,012 | A | 2/1990 | Fu |
| 4,900,013 | A | 2/1990 | Rodgers, Jr. |
| 4,900,016 | A | 2/1990 | Caruthers |
| 4,900,017 | A | 2/1990 | Bold, Jr. |
| 4,900,018 | A | 2/1990 | Ish, III |
| 4,902,006 | A | 2/1990 | Stallings, Jr. |
| 4,902,007 | A | 2/1990 | Ferrari |
| 4,904,829 | A | 2/1990 | Berthaud et al. |
| 4,905,330 | A | 3/1990 | Jacobs |
| 4,907,795 | A | 3/1990 | Shaw et al. |
| 4,907,797 | A | 3/1990 | Gezari et al. |
| 4,907,798 | A | 3/1990 | Burchatz |
| 4,907,973 | A | 3/1990 | Hon |
| 4,909,504 | A | 3/1990 | Yang |
| 4,909,505 | A | 3/1990 | Tee |
| 4,911,427 | A | 3/1990 | Matsumoto et al. |
| 4,911,436 | A | 3/1990 | Lighter |
| 4,911,438 | A | 3/1990 | Van Straaten |
| 4,912,638 | A | 3/1990 | Pratt, Jr. |
| 4,913,396 | A | 4/1990 | Dalebout et al. |
| 4,913,419 | A | 4/1990 | McAuliffe |
| 4,913,422 | A | 4/1990 | Elmore |
| 4,913,423 | A | 4/1990 | Farran |
| 4,915,377 | A | 4/1990 | Malnke et al. |
| 4,915,379 | A | 4/1990 | Sapp |
| 4,917,376 | A | 4/1990 | Lo |
| 4,919,418 | A | 4/1990 | Miller |
| 4,919,419 | A | 4/1990 | Houston |
| 4,921,242 | A | 5/1990 | Watterson |
| 4,921,245 | A | 5/1990 | Roberts |
| 4,921,247 | A | 5/1990 | Sterling |
| 4,923,193 | A | 5/1990 | Pitzen et al. |
| 4,925,183 | A | 5/1990 | Kim |
| 4,925,189 | A | 5/1990 | Braeunig |
| 4,925,200 | A | 5/1990 | Jones |
| 4,925,724 | A | 5/1990 | Ogden |
| 4,927,136 | A | 5/1990 | Leask |
| 4,928,546 | A | 5/1990 | Walters |
| 4,928,957 | A | 5/1990 | Lanier et al. |
| 4,928,961 | A | 5/1990 | Madden |
| 4,930,768 | A | 6/1990 | Lapcevic |
| 4,930,769 | A | 6/1990 | Nenoff |
| 4,930,770 | A | 6/1990 | Baker |
| 4,934,690 | A | 6/1990 | Bull |
| 4,934,692 | A | 6/1990 | Owens |
| 4,934,694 | A | 6/1990 | Mcintosh |
| 4,938,469 | A | 7/1990 | Crandell |
| 4,938,473 | A | 7/1990 | Lee |
| 4,938,474 | A | 7/1990 | Sweeney et al. |
| 4,940,233 | A | 7/1990 | Bull |
| 4,941,652 | A | 7/1990 | Nagano et al. |
| 4,941,673 | A | 7/1990 | Bennett |
| 4,944,511 | A | 7/1990 | Francis |
| 4,944,518 | A | 7/1990 | Flynn |
| 4,948,121 | A | 8/1990 | Haaheim et al. |
| 4,948,123 | A | 8/1990 | Schook |
| 4,949,951 | A | 8/1990 | Deola |
| 4,949,954 | A | 8/1990 | Hix |
| 4,949,958 | A | 8/1990 | Richey |
| 4,949,959 | A | 8/1990 | Stevens |
| 4,949,993 | A | 8/1990 | Stark et al. |
| 4,952,265 | A | 8/1990 | Yamanaka et al. |
| 4,953,415 | A | 9/1990 | Lehtonen |
| 4,953,858 | A | 9/1990 | Zelli |
| 4,955,466 | A | 9/1990 | Almes et al. |
| 4,958,832 | A | 9/1990 | Kim |
| 4,959,713 | A | 9/1990 | Morotomi et al. |
| 4,960,276 | A | 10/1990 | Feuer et al. |
| 4,964,632 | A | 10/1990 | Rockwell |
| 4,968,028 | A | 11/1990 | Wehrell |
| 4,971,305 | A | 11/1990 | Rennex |
| 4,971,316 | A | 11/1990 | Dalebout et al. |
| 4,973,050 | A | 11/1990 | Santoro |
| 4,974,831 | A | 12/1990 | Dunham |
| 4,974,832 | A | 12/1990 | Dalebout |
| 4,974,836 | A | 12/1990 | Hirsch |
| 4,974,838 | A | 12/1990 | Sollenberger |
| 4,976,424 | A | 12/1990 | Sargeant et al. |
| 4,976,428 | A | 12/1990 | Ghazi |
| 4,976,435 | A | 12/1990 | Shatford |
| 4,978,122 | A | 12/1990 | Dibowski |
| 4,982,955 | A | 1/1991 | Heasley |
| 4,984,810 | A | 1/1991 | Stearns |
| 4,986,261 | A | 1/1991 | Iams et al. |
| 4,986,534 | A | 1/1991 | Meier et al. |
| 4,986,689 | A | 1/1991 | Drutchas |
| 4,989,860 | A | 2/1991 | Iams et al. |
| 4,990,838 | A | 2/1991 | Kawato et al. |
| 4,992,190 | A | 2/1991 | Shtarkman |
| 4,995,777 | A | 2/1991 | Warmington |
| 4,998,723 | A | 3/1991 | Santoro |
| 4,998,725 | A | 3/1991 | Watterson et al. |
| 5,000,440 | A | 3/1991 | Lynch |
| 5,000,442 | A | 3/1991 | Dalebout et al. |
| 5,000,446 | A | 3/1991 | Sarno |
| 5,001,632 | A | 3/1991 | Hall Tipping |
| 5,002,271 | A | 3/1991 | Gonzales |
| 5,004,224 | A | 4/1991 | Wang |
| 5,005,832 | A | 4/1991 | Hoeven |
| 5,007,630 | A | 4/1991 | Real et al. |
| 5,007,631 | A | 4/1991 | Wang |
| 5,011,139 | A | 4/1991 | Towley, III |
| 5,011,142 | A | 4/1991 | Eckler |
| 5,013,031 | A | 5/1991 | Bull |
| 5,015,926 | A | 5/1991 | Casler |
| 5,016,870 | A | 5/1991 | Bulloch et al. |
| 5,018,725 | A | 5/1991 | Cook |
| 5,020,793 | A | 6/1991 | Loane |
| 5,020,794 | A | 6/1991 | Englehardt et al. |
| 5,020,795 | A | 6/1991 | Airy et al. |
| 5,022,377 | A | 6/1991 | Stevens |
| 5,024,441 | A | 6/1991 | Rousseau |
| 5,026,049 | A | 6/1991 | Goodman |
| 5,027,303 | A | 6/1991 | Witte |

(56) References Cited

U.S. PATENT DOCUMENTS

| | | | |
|---|---|---|---|
| 5,029,801 | A | 7/1991 | Dalebout et al. |
| 5,029,848 | A | 7/1991 | Sleamaker |
| 5,029,849 | A | 7/1991 | Nurkowski |
| 5,029,850 | A | 7/1991 | Van Straaten |
| 5,031,455 | A | 7/1991 | Cline |
| 5,031,905 | A | 7/1991 | Walsh |
| 5,032,048 | A | 7/1991 | Walton et al. |
| 5,033,740 | A | 7/1991 | Schwartz et al. |
| 5,034,576 | A | 7/1991 | Dalebout et al. |
| 5,035,418 | A | 7/1991 | Harabayashi |
| RE33,662 | E | 8/1991 | Blair et al. |
| 5,037,084 | A | 8/1991 | Flor |
| 5,037,089 | A | 8/1991 | Spagnuolo |
| 5,037,090 | A | 8/1991 | Fitzpatrick |
| 5,039,088 | A | 8/1991 | Shifferaw |
| 5,039,091 | A | 8/1991 | Johnson |
| 5,040,785 | A | 8/1991 | Charnitski |
| 5,040,787 | A | 8/1991 | Brotman |
| 5,040,788 | A | 8/1991 | Randall |
| 5,042,704 | A | 8/1991 | Izzo |
| 5,042,799 | A | 8/1991 | Stanley |
| 5,044,629 | A | 9/1991 | Ryan |
| 5,044,631 | A | 9/1991 | Jones |
| 5,044,632 | A | 9/1991 | Jones |
| 5,046,382 | A | 9/1991 | Steinberg |
| 5,046,722 | A | 9/1991 | Antoon |
| 5,048,823 | A | 9/1991 | Bean |
| 5,048,825 | A | 9/1991 | Kelly |
| 5,048,826 | A | 9/1991 | Ryan |
| 5,050,872 | A | 9/1991 | Farenholtz |
| 5,050,873 | A | 9/1991 | Jones |
| 5,051,638 | A | 9/1991 | Pyles |
| 5,052,375 | A | 10/1991 | Stark |
| 5,052,684 | A | 10/1991 | Kosuge et al. |
| 5,054,770 | A | 10/1991 | Bull |
| 5,054,774 | A | 10/1991 | Belsito |
| 5,056,777 | A | 10/1991 | Capjon et al. |
| 5,058,881 | A | 10/1991 | Measom |
| 5,058,882 | A | 10/1991 | Dalebout et al. |
| 5,058,884 | A | 10/1991 | Fuller, Sr. |
| 5,058,888 | A | 10/1991 | Walker et al. |
| 5,062,626 | A | 11/1991 | Dalebout et al. |
| 5,062,627 | A | 11/1991 | Bingham |
| 5,062,629 | A | 11/1991 | Vaughan |
| 5,062,630 | A | 11/1991 | Nelson |
| 5,062,631 | A | 11/1991 | Dau et al. |
| 5,062,632 | A | 11/1991 | Dalebout et al. |
| 5,062,633 | A | 11/1991 | Engel et al. |
| 5,064,191 | A | 11/1991 | Johnson |
| 5,066,000 | A | 11/1991 | Dolan |
| 5,067,710 | A | 11/1991 | Watterson et al. |
| 5,071,115 | A | 12/1991 | Welch |
| 5,071,119 | A | 12/1991 | Johnson |
| 5,072,928 | A | 12/1991 | Stearns et al. |
| 5,072,929 | A | 12/1991 | Peterson et al. |
| 5,074,550 | A | 12/1991 | Sloan |
| 5,077,916 | A | 1/1992 | Beneteau |
| 5,078,152 | A | 1/1992 | Bond et al. |
| 5,080,353 | A | 1/1992 | Tench |
| 5,081,991 | A | 1/1992 | Chance |
| 5,085,426 | A | 2/1992 | Wanzer et al. |
| 5,085,427 | A | 2/1992 | Finn |
| 5,085,430 | A | 2/1992 | Habing |
| 5,086,385 | A | 2/1992 | Launey et al. |
| 5,087,047 | A | 2/1992 | McConnell |
| 5,088,729 | A | 2/1992 | Dalebout |
| 5,089,960 | A | 2/1992 | Sweeney, Jr. |
| 5,090,694 | A | 2/1992 | Pauls et al. |
| 5,094,249 | A | 3/1992 | Marras et al. |
| 5,094,447 | A | 3/1992 | Wang |
| 5,094,449 | A | 3/1992 | Stearns |
| 5,096,225 | A | 3/1992 | Osawa |
| 5,100,129 | A | 3/1992 | Porter |
| 5,102,121 | A | 4/1992 | Solow et al. |
| 5,102,122 | A | 4/1992 | Piane, Jr. |
| 5,102,124 | A | 4/1992 | Diodati |
| 5,102,380 | A | 4/1992 | Jacobson et al. |
| 5,104,119 | A | 4/1992 | Lynch |
| 5,104,120 | A | 4/1992 | Watterson et al. |
| 5,106,079 | A | 4/1992 | Escobedo |
| 5,108,090 | A | 4/1992 | Reed |
| 5,108,093 | A | 4/1992 | Watterson |
| 5,109,778 | A | 5/1992 | Berkowitz et al. |
| 5,110,117 | A | 5/1992 | Fisher et al. |
| 5,110,118 | A | 5/1992 | Winey |
| 5,110,121 | A | 5/1992 | Foster |
| 5,112,045 | A | 5/1992 | Mason et al. |
| 5,112,287 | A | 5/1992 | Brewer |
| 5,113,427 | A | 5/1992 | Ryoichi et al. |
| 5,114,388 | A | 5/1992 | Trulaske |
| 5,114,391 | A | 5/1992 | Pitzen et al. |
| 5,116,297 | A | 5/1992 | Stonecipher |
| 5,117,674 | A | 6/1992 | Howard |
| 5,118,112 | A | 6/1992 | Bregman et al. |
| 5,120,289 | A | 6/1992 | Yu |
| 5,123,629 | A | 6/1992 | Takeuchi |
| 5,123,885 | A | 6/1992 | Shields |
| 5,123,886 | A | 6/1992 | Cook |
| 5,125,647 | A | 6/1992 | Smith |
| 5,125,884 | A | 6/1992 | Weber et al. |
| 5,129,872 | A | 7/1992 | Dalton et al. |
| 5,131,895 | A | 7/1992 | Rogers, Jr. |
| 5,131,898 | A | 7/1992 | Panagos |
| 5,135,216 | A | 8/1992 | Bingham et al. |
| 5,135,445 | A | 8/1992 | Christensen |
| 5,135,449 | A | 8/1992 | Jones |
| 5,135,453 | A | 8/1992 | Sollenberger |
| 5,135,458 | A | 8/1992 | Huang |
| 5,135,459 | A | 8/1992 | Perry, Jr. |
| 5,137,272 | A | 8/1992 | Wilkinson |
| 5,137,501 | A | 8/1992 | Mertesdorf |
| 5,138,730 | A | 8/1992 | Masuda |
| 5,141,478 | A | 8/1992 | Upper |
| 5,141,480 | A | 8/1992 | Lennox et al. |
| 5,141,483 | A | 8/1992 | Smith |
| 5,142,358 | A | 8/1992 | Jason |
| 5,145,475 | A | 9/1992 | Cares |
| 5,145,481 | A | 9/1992 | Friedebach |
| 5,147,266 | A | 9/1992 | Ricard |
| 5,149,084 | A | 9/1992 | Dalebout et al. |
| 5,149,312 | A | 9/1992 | Croft et al. |
| 5,151,071 | A | 9/1992 | Jain et al. |
| 5,152,210 | A | 10/1992 | Chen |
| 5,154,684 | A | 10/1992 | Delf |
| 5,156,650 | A | 10/1992 | Bals |
| 5,158,093 | A | 10/1992 | Shvartz |
| 5,158,518 | A | 10/1992 | Pizzuto |
| 5,158,520 | A | 10/1992 | Lemke et al. |
| 5,160,305 | A | 11/1992 | Lin |
| 5,162,029 | A | 11/1992 | Schine |
| 5,163,885 | A | 11/1992 | Wanzer et al. |
| 5,167,159 | A | 12/1992 | Lucking |
| 5,167,597 | A | 12/1992 | David |
| 5,167,850 | A | 12/1992 | Shtarkman |
| 5,169,362 | A | 12/1992 | Schwartz |
| 5,169,363 | A | 12/1992 | Campanaro |
| 5,171,196 | A | 12/1992 | Lynch |
| 5,176,601 | A | 1/1993 | Reynolds |
| 5,176,602 | A | 1/1993 | Roberts |
| 5,178,590 | A | 1/1993 | Stephens |
| 5,178,593 | A | 1/1993 | Roberts |
| 5,178,599 | A | 1/1993 | Scott |
| 5,180,347 | A | 1/1993 | Chen |
| 5,180,351 | A | 1/1993 | Ehrenfried |
| 5,180,352 | A | 1/1993 | Sreter |
| 5,180,647 | A | 1/1993 | Rowland et al. |
| 5,181,894 | A | 1/1993 | Shieng |
| 5,184,295 | A | 2/1993 | Mann |
| 5,184,988 | A | 2/1993 | Dunham |
| 5,184,991 | A | 2/1993 | Brangi |
| 5,184,994 | A | 2/1993 | Morris |
| 5,186,471 | A | 2/1993 | Vancraeynest |
| 5,186,697 | A | 2/1993 | Rennex |
| 5,190,509 | A | 3/1993 | Davison, Jr. |

(56) References Cited

U.S. PATENT DOCUMENTS

| | | | |
|---|---|---|---|
| 5,190,513 | A | 3/1993 | Habing et al. |
| 5,192,255 | A | 3/1993 | Dalebout et al. |
| 5,192,257 | A | 3/1993 | Panasewicz |
| 5,192,258 | A | 3/1993 | Keller |
| 5,194,059 | A | 3/1993 | Wu |
| 5,195,781 | A | 3/1993 | Osawa |
| 5,195,935 | A | 3/1993 | Fencel |
| 5,195,937 | A | 3/1993 | Engel et al. |
| 5,199,931 | A | 4/1993 | Easley et al. |
| 5,199,934 | A | 4/1993 | Lin |
| 5,199,935 | A | 4/1993 | Gibson et al. |
| 5,201,694 | A | 4/1993 | Zappel |
| 5,201,772 | A | 4/1993 | Maxwell |
| 5,202,424 | A | 4/1993 | Vlassara et al. |
| 5,203,126 | A | 4/1993 | Sorenson et al. |
| 5,203,229 | A | 4/1993 | Chen |
| 5,203,800 | A | 4/1993 | Meredith |
| 5,203,826 | A | 4/1993 | Dalebout |
| 5,204,670 | A | 4/1993 | Stinton |
| 5,205,798 | A | 4/1993 | Lekhtman |
| 5,205,800 | A | 4/1993 | Grant |
| 5,205,802 | A | 4/1993 | Swisher |
| 5,206,671 | A | 4/1993 | Eydelman et al. |
| 5,207,489 | A | 5/1993 | Miller |
| 5,207,621 | A | 5/1993 | Koch et al. |
| 5,207,622 | A | 5/1993 | Wilkinson et al. |
| 5,207,625 | A | 5/1993 | White |
| 5,207,628 | A | 5/1993 | Graham |
| 5,209,223 | A | 5/1993 | McGorry et al. |
| 5,209,482 | A | 5/1993 | Hopfer |
| 5,209,715 | A | 5/1993 | Walker et al. |
| 5,211,614 | A | 5/1993 | Henes |
| 5,211,617 | A | 5/1993 | Millen |
| 5,213,555 | A | 5/1993 | Hood |
| 5,215,510 | A | 6/1993 | Baran |
| 5,217,422 | A | 6/1993 | Domzalski |
| 5,221,240 | A | 6/1993 | Mann |
| 5,221,245 | A | 6/1993 | Yeh |
| 5,222,928 | A | 6/1993 | Yacullo |
| 5,224,909 | A | 7/1993 | Hamilton |
| 5,226,866 | A | 7/1993 | Engel et al. |
| 5,226,868 | A | 7/1993 | Montgomery |
| 5,230,672 | A | 7/1993 | Brown et al. |
| 5,230,673 | A | 7/1993 | Maeyama et al. |
| 5,230,680 | A | 7/1993 | Wu |
| 5,231,752 | A | 8/1993 | Hereford |
| 5,232,422 | A | 8/1993 | Bishop, Jr. |
| 5,233,520 | A | 8/1993 | Kretsch et al. |
| 5,234,392 | A | 8/1993 | Clark |
| 5,234,395 | A | 8/1993 | Miller et al. |
| 5,236,406 | A | 8/1993 | Webber |
| 5,240,417 | A | 8/1993 | Smithson et al. |
| 5,242,339 | A | 9/1993 | Thornton |
| 5,242,340 | A | 9/1993 | Jerome |
| 5,242,342 | A | 9/1993 | Silverman |
| 5,242,343 | A | 9/1993 | Miller |
| 5,242,344 | A | 9/1993 | Hundley |
| 5,242,345 | A | 9/1993 | Mitchell |
| 5,242,347 | A | 9/1993 | Keeton |
| 5,242,348 | A | 9/1993 | Bates |
| 5,242,353 | A | 9/1993 | Cole et al. |
| 5,243,998 | A | 9/1993 | Silverman et al. |
| 5,244,444 | A | 9/1993 | Wostry |
| 5,246,411 | A | 9/1993 | Rackman |
| 5,247,853 | A | 9/1993 | Dalebout |
| 5,250,012 | A | 10/1993 | Whitcomb, Jr. |
| 5,250,013 | A | 10/1993 | Brangi |
| 5,254,065 | A | 10/1993 | Pollock |
| 5,254,066 | A | 10/1993 | Brown et al. |
| 5,254,067 | A | 10/1993 | Habing et al. |
| 5,256,115 | A | 10/1993 | Scholder |
| 5,256,117 | A | 10/1993 | Potts et al. |
| 5,256,118 | A | 10/1993 | Chen |
| 5,256,121 | A | 10/1993 | Brotman |
| 5,256,126 | A | 10/1993 | Grotstein |
| 5,257,084 | A | 10/1993 | Marsh |
| 5,257,701 | A | 11/1993 | Edelson |
| 5,257,964 | A | 11/1993 | Petters |
| 5,260,870 | A | 11/1993 | Tsuchiya et al. |
| 5,261,864 | A | 11/1993 | Fitzpatrick |
| 5,261,865 | A | 11/1993 | Trainor |
| 5,263,913 | A | 11/1993 | Boren |
| 5,263,915 | A | 11/1993 | Habing |
| 5,263,916 | A | 11/1993 | Bobich |
| 5,267,925 | A | 12/1993 | Boyd |
| 5,267,929 | A | 12/1993 | Chen |
| 5,267,930 | A | 12/1993 | Henes |
| 5,269,081 | A | 12/1993 | Gray |
| 5,269,519 | A | 12/1993 | Malone |
| 5,269,736 | A | 12/1993 | Roberts |
| 5,269,737 | A | 12/1993 | Sobotka |
| 5,269,738 | A | 12/1993 | Boren |
| 5,271,416 | A | 12/1993 | Lepley |
| 5,273,285 | A | 12/1993 | Long |
| 5,273,505 | A | 12/1993 | Jones |
| 5,277,678 | A | 1/1994 | Friedebach et al. |
| 5,277,683 | A | 1/1994 | Wilkins |
| 5,277,684 | A | 1/1994 | Harris |
| 5,279,528 | A | 1/1994 | Dalebout et al. |
| 5,279,529 | A | 1/1994 | Eschenbach |
| 5,279,531 | A | 1/1994 | Jen Huey |
| 5,280,936 | A | 1/1994 | Schmidlin |
| 5,281,193 | A | 1/1994 | Colbo, Jr. |
| 5,282,776 | A | 2/1994 | Dalebout |
| 5,284,461 | A | 2/1994 | Wilkinson et al. |
| 5,284,463 | A | 2/1994 | Shields |
| 5,284,464 | A | 2/1994 | Lee, III et al. |
| 5,286,243 | A | 2/1994 | Lapcevic |
| 5,290,205 | A | 3/1994 | Densmore et al. |
| 5,290,211 | A | 3/1994 | Stearns |
| 5,290,214 | A | 3/1994 | Chen |
| 5,292,293 | A | 3/1994 | Schumacher |
| 5,292,297 | A | 3/1994 | Hsu |
| 5,295,927 | A | 3/1994 | Easley |
| 5,295,928 | A | 3/1994 | Rennex |
| 5,295,935 | A | 3/1994 | Wang |
| 5,298,002 | A | 3/1994 | Lin |
| 5,299,810 | A | 4/1994 | Pierce et al. |
| 5,299,992 | A | 4/1994 | Wilkinson |
| 5,299,993 | A | 4/1994 | Habing |
| 5,299,997 | A | 4/1994 | Chen |
| 5,301,154 | A | 4/1994 | Suga |
| 5,302,161 | A | 4/1994 | Loubert et al. |
| 5,302,162 | A | 4/1994 | Pasero |
| 5,303,885 | A | 4/1994 | Wade |
| 5,306,218 | A | 4/1994 | Huang Chen |
| 5,306,220 | A | 4/1994 | Kearney |
| 5,306,221 | A | 4/1994 | Itaru |
| 5,308,075 | A | 5/1994 | Theriault |
| 5,308,234 | A | 5/1994 | Nicke et al. |
| 5,308,296 | A | 5/1994 | Eckstein |
| 5,308,300 | A | 5/1994 | Chino et al. |
| 5,309,355 | A | 5/1994 | Lockwood |
| 5,310,392 | A | 5/1994 | Lo |
| 5,310,394 | A | 5/1994 | Kallios |
| 5,313,852 | A | 5/1994 | Arena |
| 5,313,942 | A | 5/1994 | Platzker |
| 5,314,389 | A | 5/1994 | Dotan |
| 5,314,390 | A | 5/1994 | Westing et al. |
| 5,314,391 | A | 5/1994 | Potash et al. |
| 5,314,392 | A | 5/1994 | Hawkins et al. |
| 5,314,394 | A | 5/1994 | Ronan |
| 5,316,534 | A | 5/1994 | Dalebout et al. |
| 5,318,487 | A | 6/1994 | Golen et al. |
| 5,318,490 | A | 6/1994 | Henderson et al. |
| 5,318,491 | A | 6/1994 | Houston |
| 5,318,495 | A | 6/1994 | Malynowsky |
| 5,320,343 | A | 6/1994 | McKinney |
| 5,320,588 | A | 6/1994 | Wanzer et al. |
| 5,320,591 | A | 6/1994 | Harmon et al. |
| 5,320,641 | A | 6/1994 | Riddle |
| 5,322,489 | A | 6/1994 | Webb et al. |
| 5,323,650 | A | 6/1994 | Fullen et al. |
| 5,323,784 | A | 6/1994 | Shu |

(56) References Cited

U.S. PATENT DOCUMENTS

| | | | |
|---|---|---|---|
| 5,324,242 | A | 6/1994 | Lo |
| 5,328,410 | A | 7/1994 | Amburgey et al. |
| 5,328,420 | A | 7/1994 | Allen |
| 5,328,422 | A | 7/1994 | Nichols |
| 5,328,428 | A | 7/1994 | Huang |
| 5,328,429 | A | 7/1994 | Potash et al. |
| 5,328,430 | A | 7/1994 | Vittone |
| 5,330,401 | A | 7/1994 | Walstead |
| 5,330,402 | A | 7/1994 | Johnson |
| 5,330,404 | A | 7/1994 | Lopeteguy et al. |
| 5,330,405 | A | 7/1994 | Habing et al. |
| 5,330,408 | A | 7/1994 | Westmoreland, Jr. |
| 5,334,120 | A | 8/1994 | Rasmussen |
| 5,335,188 | A | 8/1994 | Brisson |
| 5,336,142 | A | 8/1994 | Dalebout et al. |
| 5,336,143 | A | 8/1994 | Wu |
| 5,336,144 | A | 8/1994 | Keiser |
| 5,336,145 | A | 8/1994 | Keiser |
| 5,336,146 | A | 8/1994 | Piaget et al. |
| 5,336,148 | A | 8/1994 | Ish, III |
| 5,336,151 | A | 8/1994 | Van Ballegooie |
| 5,338,274 | A | 8/1994 | Jones |
| 5,338,277 | A | 8/1994 | Yang |
| 5,342,261 | A | 8/1994 | Johnston |
| 5,342,264 | A | 8/1994 | Gordon |
| 5,342,269 | A | 8/1994 | Huang |
| 5,342,271 | A | 8/1994 | Long |
| RE34,728 | E | 9/1994 | Blair et al. |
| 5,344,372 | A | 9/1994 | Hung |
| 5,344,374 | A | 9/1994 | Telle |
| 5,346,447 | A | 9/1994 | Stearns |
| 5,348,524 | A | 9/1994 | Grant |
| 5,350,344 | A | 9/1994 | Kissel |
| 5,350,345 | A | 9/1994 | Frey |
| 5,352,166 | A | 10/1994 | Chang |
| 5,352,167 | A | 10/1994 | Ulicny |
| 5,352,169 | A | 10/1994 | Eschenbach |
| 5,352,171 | A | 10/1994 | Lin |
| 5,352,174 | A | 10/1994 | Mason et al. |
| 5,353,452 | A | 10/1994 | Rulis |
| 5,354,248 | A | 10/1994 | Rawls et al. |
| 5,354,251 | A | 10/1994 | Sleamaker |
| 5,354,252 | A | 10/1994 | Habing |
| 5,354,253 | A | 10/1994 | Awbrey et al. |
| 5,356,003 | A | 10/1994 | Gretz et al. |
| 5,356,356 | A | 10/1994 | Hildebrandt et al. |
| 5,356,357 | A | 10/1994 | Wang et al. |
| 5,356,358 | A | 10/1994 | Chen |
| 5,356,360 | A | 10/1994 | Johns |
| 5,357,696 | A | 10/1994 | Gray |
| 5,358,461 | A | 10/1994 | Bailey, Jr. |
| 5,358,462 | A | 10/1994 | Calderone |
| D352,536 | S | 11/1994 | Byrd et al. |
| 5,359,986 | A | 11/1994 | Magrath, III et al. |
| 5,361,091 | A | 11/1994 | Hoarty et al. |
| 5,361,778 | A | 11/1994 | Seitz |
| 5,362,069 | A | 11/1994 | Hall-Tipping |
| 5,362,290 | A | 11/1994 | Huang |
| 5,362,295 | A | 11/1994 | Nurge |
| 5,362,296 | A | 11/1994 | Wang et al. |
| 5,362,298 | A | 11/1994 | Brown et al. |
| 5,364,060 | A | 11/1994 | Donovan et al. |
| 5,364,271 | A | 11/1994 | Aknin et al. |
| 5,364,327 | A | 11/1994 | Graham |
| 5,366,428 | A | 11/1994 | Liao |
| 5,366,432 | A | 11/1994 | Habing et al. |
| 5,368,042 | A | 11/1994 | O'Neal et al. |
| 5,368,532 | A | 11/1994 | Farnet |
| 5,368,536 | A | 11/1994 | Stodgell |
| 5,370,594 | A | 12/1994 | Grinblat |
| 5,372,556 | A | 12/1994 | Ropp |
| 5,372,559 | A | 12/1994 | Dalebout et al. |
| 5,372,560 | A | 12/1994 | Chang |
| 5,372,564 | A | 12/1994 | Spirito |
| 5,374,227 | A | 12/1994 | Webb |
| 5,374,230 | A | 12/1994 | Bonnaime |
| 5,375,068 | A | 12/1994 | Palmer et al. |
| 5,376,053 | A | 12/1994 | Ponder |
| 5,377,171 | A | 12/1994 | Schlup |
| 5,377,258 | A | 12/1994 | Bro |
| 5,378,212 | A | 1/1995 | Pin-Kuo |
| 5,378,216 | A | 1/1995 | Ish, III et al. |
| 5,380,258 | A | 1/1995 | Hawley, Jr. |
| 5,382,207 | A | 1/1995 | Skowronski et al. |
| 5,382,208 | A | 1/1995 | Hu |
| 5,382,209 | A | 1/1995 | Pasier |
| 5,383,827 | A | 1/1995 | Stern |
| 5,383,828 | A | 1/1995 | Sands et al. |
| 5,385,346 | A | 1/1995 | Carroll et al. |
| 5,385,519 | A | 1/1995 | Hsu |
| 5,385,520 | A | 1/1995 | Lepine et al. |
| 5,387,164 | A | 2/1995 | Brown, Jr. |
| 5,387,169 | A | 2/1995 | Wang |
| 5,387,170 | A | 2/1995 | Rawls et al. |
| 5,387,171 | A | 2/1995 | Casey et al. |
| 5,391,080 | A | 2/1995 | Bernacki |
| 5,391,132 | A | 2/1995 | Greenwald |
| 5,392,476 | A | 2/1995 | Williams |
| 5,394,922 | A | 3/1995 | Colson et al. |
| 5,396,340 | A | 3/1995 | Ishii et al. |
| 5,396,876 | A | 3/1995 | Liscio et al. |
| 5,397,287 | A | 3/1995 | Lindfors |
| 5,398,948 | A | 3/1995 | Mathis |
| 5,401,226 | A | 3/1995 | Stearns |
| 5,403,251 | A | 4/1995 | Belsito et al. |
| 5,403,252 | A | 4/1995 | Leon et al. |
| 5,403,253 | A | 4/1995 | Gaylord |
| 5,403,254 | A | 4/1995 | Lundin et al. |
| 5,403,255 | A | 4/1995 | Johnston |
| 5,403,256 | A | 4/1995 | Squires |
| 5,406,661 | A | 4/1995 | Pekar |
| 5,407,402 | A | 4/1995 | Brown et al. |
| 5,407,403 | A | 4/1995 | Coleman |
| 5,407,404 | A | 4/1995 | Killian et al. |
| 5,407,405 | A | 4/1995 | Oren |
| 5,407,408 | A | 4/1995 | Wilkinson |
| 5,407,411 | A | 4/1995 | Trainor |
| 5,407,414 | A | 4/1995 | Bass |
| 5,409,330 | A | 4/1995 | Naines et al. |
| 5,409,435 | A | 4/1995 | Daniels |
| 5,410,471 | A | 4/1995 | Alyfuku et al. |
| 5,410,472 | A | 4/1995 | Anderson |
| RE34,959 | E | 5/1995 | Potts |
| 5,410,971 | A | 5/1995 | Golden et al. |
| 5,413,546 | A | 5/1995 | Basile |
| 5,413,551 | A | 5/1995 | Wu |
| 5,415,608 | A | 5/1995 | Bode |
| 5,417,222 | A | 5/1995 | Dempsey et al. |
| 5,417,634 | A | 5/1995 | Habing |
| 5,417,643 | A | 5/1995 | Taylor |
| 5,419,562 | A | 5/1995 | Cromarty |
| 5,419,570 | A | 5/1995 | Bollotte |
| 5,419,571 | A | 5/1995 | Vaughan |
| 5,419,747 | A | 5/1995 | Piaget |
| 5,419,749 | A | 5/1995 | Morgenstein |
| 5,419,751 | A | 5/1995 | Byrd et al. |
| 5,421,795 | A | 6/1995 | Chen |
| 5,421,796 | A | 6/1995 | Jones et al. |
| 5,421,800 | A | 6/1995 | Mullen |
| 5,421,801 | A | 6/1995 | Davies, III et al. |
| 5,423,729 | A | 6/1995 | Eschenbach |
| 5,423,730 | A | 6/1995 | Hirsch |
| 5,423,731 | A | 6/1995 | Chen |
| 5,429,563 | A | 7/1995 | Engel et al. |
| 5,429,567 | A | 7/1995 | Gerschefske et al. |
| 5,429,568 | A | 7/1995 | Chen |
| 5,429,569 | A | 7/1995 | Gunnari |
| 5,431,612 | A | 7/1995 | Holden |
| 5,433,679 | A | 7/1995 | Szymczak et al. |
| 5,433,685 | A | 7/1995 | Winslow |
| 5,435,315 | A | 7/1995 | McPhee et al. |
| 5,435,798 | A | 7/1995 | Habing et al. |
| 5,435,799 | A | 7/1995 | Lundin |
| 5,435,801 | A | 7/1995 | Hung |

(56) References Cited

U.S. PATENT DOCUMENTS 5,437,289 A 8/1995 Liverance
5,437,589 A 8/1995 Habing
5,439,225 A 8/1995 Gvoich et al.
5,441,467 A 8/1995 Stevens
5,441,468 A 8/1995 Deckers et al.
5,443,435 A 8/1995 Wilkinson
5,445,583 A 8/1995 Habing
5,447,480 A 9/1995 Fulks
5,449,332 A 9/1995 Hervig
5,449,334 A 9/1995 Kingsbury
5,451,191 A 9/1995 Beenken
5,451,922 A 9/1995 Hamilton
5,452,269 A 9/1995 Cherdak
5,453,066 A 9/1995 Richter, Jr.
5,454,772 A 10/1995 Rodden
5,454,773 A 10/1995 Blanchard et al.
5,456,262 A 10/1995 Birnbaum
5,456,644 A 10/1995 Hecox et al.
5,456,648 A 10/1995 Edinburg
5,458,553 A 10/1995 Wu
5,460,379 A 10/1995 Cleland
5,460,586 A 10/1995 Wilkinson
5,462,051 A 10/1995 Oka et al.
5,462,503 A 10/1995 Benjamin et al.
5,462,504 A 10/1995 Trulaske et al.
5,464,378 A 11/1995 Yu
5,466,200 A 11/1995 Ulrich et al.
5,466,203 A 11/1995 Chen
5,467,874 A 11/1995 Whitaker
5,469,740 A 11/1995 French et al.
5,470,298 A 11/1995 Curtis
5,471,405 A 11/1995 Marsh
5,472,205 A 12/1995 Bouton
5,472,397 A 12/1995 Ammoscato et al.
5,472,399 A 12/1995 Szekely
5,474,077 A 12/1995 Suga
5,474,087 A 12/1995 Nashner
5,474,090 A 12/1995 Begun et al.
5,474,510 A 12/1995 Chen
5,476,428 A 12/1995 Potash et al.
5,476,430 A 12/1995 Lee et al.
5,478,295 A 12/1995 Fracchia
5,478,298 A 12/1995 Chen
5,480,212 A 1/1996 Marconet
5,482,472 A 1/1996 Garoni et al.
5,484,358 A 1/1996 Wang et al.
5,484,362 A 1/1996 Skowronski et al.
5,484,365 A 1/1996 Jones et al.
5,484,389 A 1/1996 Stark
5,486,001 A 1/1996 Baker
5,487,707 A 1/1996 Sharf et al.
5,489,249 A 2/1996 Brewer et al.
5,489,250 A 2/1996 Densmore et al.
5,490,818 A 2/1996 Haber et al.
5,492,514 A 2/1996 Daum
5,492,518 A 2/1996 Measom
5,492,520 A 2/1996 Brown
5,493,127 A 2/1996 Lloyd et al.
5,496,235 A 3/1996 Stevens
5,496,236 A 3/1996 Buonauito
5,496,238 A 3/1996 Taylor
5,496,239 A 3/1996 Kallman
5,496,244 A 3/1996 Caruthers
5,498,222 A 3/1996 Hur
5,498,223 A 3/1996 Iams et al.
5,499,956 A 3/1996 Habing et al.
5,499,959 A 3/1996 Holmes et al.
5,499,961 A 3/1996 Mattox
5,501,647 A 3/1996 Snyder
5,501,656 A 3/1996 Homma et al.
5,503,608 A 4/1996 Chang
5,505,011 A 4/1996 Bleimhofer
5,505,677 A 4/1996 Hinds
5,507,271 A 4/1996 Actor
5,507,710 A 4/1996 Chen
5,509,870 A 4/1996 Lloyd
5,510,828 A 4/1996 Lutterbach
5,512,025 A 4/1996 Dalebout et al.
5,512,029 A 4/1996 Barnard
5,514,053 A 5/1996 Hawkins et al.
5,514,059 A 5/1996 Romney
5,516,334 A 5/1996 Easton
5,518,471 A 5/1996 Hettinger et al.
5,518,473 A 5/1996 Miller
5,518,476 A 5/1996 Mcleon
5,518,477 A 5/1996 Simonson
5,518,483 A 5/1996 Oswald
5,518,486 A 5/1996 Sheeler
5,519,189 A 5/1996 Gibisch
5,520,599 A 5/1996 Chen
5,522,783 A 6/1996 Gordon
5,524,110 A 6/1996 Danneels et al.
5,524,637 A 6/1996 Erickson
5,527,239 A 6/1996 Abbondanza
5,527,245 A 6/1996 Dalebout et al.
5,527,249 A 6/1996 Harris
5,527,250 A 6/1996 Chen
5,527,253 A 6/1996 Wilkinson
5,529,554 A 6/1996 Eschenbach
5,529,560 A 6/1996 Davies, III et al.
5,531,658 A 7/1996 Liao
5,533,899 A 7/1996 Young
5,533,948 A 7/1996 Wilkinson
5,533,951 A 7/1996 Chang
5,533,952 A 7/1996 Schaber
5,535,664 A 7/1996 Rokowski
5,538,486 A 7/1996 France et al.
5,538,489 A 7/1996 Magid
5,540,642 A 7/1996 Sprague
5,542,420 A 8/1996 Goldman
5,542,672 A 8/1996 Meredith
5,542,892 A 8/1996 Buhler
5,545,112 A 8/1996 Densmore et al.
5,545,114 A 8/1996 Gvoich
5,547,439 A 8/1996 Rawls et al.
5,549,052 A 8/1996 Hoffman
5,549,530 A 8/1996 Fulks
5,549,532 A 8/1996 Kropp
5,549,533 A 8/1996 Olson et al.
5,549,536 A 8/1996 Clark
5,551,934 A 9/1996 Binette
5,551,937 A 9/1996 Kwo
5,554,033 A 9/1996 Bizzi et al.
5,554,083 A 9/1996 Chen
5,554,085 A 9/1996 Dalebout
5,554,086 A 9/1996 Habing et al.
5,556,362 A 9/1996 Whipps
5,556,369 A 9/1996 Roberts
5,558,608 A 9/1996 Hall
5,562,572 A 10/1996 Carmein
5,562,574 A 10/1996 Miller
5,562,577 A 10/1996 Nichols, Sr. et al.
5,563,487 A 10/1996 Davis
5,568,993 A 10/1996 Potzick
5,569,120 A 10/1996 Anjanappa et al.
5,569,128 A 10/1996 Dalebout
5,569,133 A 10/1996 Vittone
5,569,138 A 10/1996 Wang et al.
5,571,064 A 11/1996 Holm
5,572,643 A 11/1996 Judson
5,573,485 A 11/1996 Geschwender
5,575,740 A 11/1996 Piaget
5,576,951 A 11/1996 Lockwood
5,577,186 A 11/1996 Mann, II et al.
5,577,981 A 11/1996 Jarvik
5,577,987 A 11/1996 Brown
5,580,249 A 12/1996 Jacobsen et al.
5,580,340 A 12/1996 Yu
5,580,341 A 12/1996 Simonson
5,582,563 A 12/1996 Fan
5,582,565 A 12/1996 Soria
5,584,700 A 12/1996 Feldman et al.
5,584,779 A 12/1996 Knecht
5,584,784 A 12/1996 Wu

(56) References Cited

U.S. PATENT DOCUMENTS

| | | | |
|---|---|---|---|
| 5,585,583 | A | 12/1996 | Owen |
| 5,586,736 | A | 12/1996 | Mollet |
| 5,586,811 | A | 12/1996 | Tornero |
| 5,588,938 | A | 12/1996 | Schneider et al. |
| 5,588,942 | A | 12/1996 | Dillard |
| 5,590,128 | A | 12/1996 | Maloney et al. |
| 5,590,181 | A | 12/1996 | Hogan et al. |
| 5,590,893 | A | 1/1997 | Robinson et al. |
| 5,591,104 | A | 1/1997 | Andrus et al. |
| 5,591,106 | A | 1/1997 | Dalebout et al. |
| 5,591,107 | A | 1/1997 | Rodgers, Jr. |
| 5,591,908 | A | 1/1997 | Reid |
| 5,593,372 | A | 1/1997 | Rodgers, Jr. |
| 5,593,380 | A | 1/1997 | Bittikofer |
| 5,595,545 | A | 1/1997 | O'Brien |
| 5,595,556 | A | 1/1997 | Dalebout et al. |
| 5,595,559 | A | 1/1997 | Viel |
| 5,597,362 | A | 1/1997 | Lee |
| 5,597,375 | A | 1/1997 | Simonson |
| 5,598,849 | A | 2/1997 | Browne |
| 5,599,261 | A | 2/1997 | Easley et al. |
| 5,600,310 | A | 2/1997 | Whipple, III et al. |
| 5,601,518 | A | 2/1997 | Weintraub |
| 5,603,675 | A | 2/1997 | Wu |
| 5,603,678 | A | 2/1997 | Wilson |
| 5,605,336 | A | 2/1997 | Gaoiran |
| 5,605,524 | A | 2/1997 | Husted |
| 5,607,250 | A | 3/1997 | Tatterson et al. |
| 5,607,375 | A | 3/1997 | Dalebout |
| 5,609,278 | A | 3/1997 | Fresco |
| 5,613,216 | A | 3/1997 | Galler |
| 5,613,856 | A | 3/1997 | Hoover |
| 5,613,924 | A | 3/1997 | Lee |
| 5,613,928 | A | 3/1997 | Laudone |
| 5,616,103 | A | 4/1997 | Lee |
| 5,616,106 | A | 4/1997 | Abelbeck |
| 5,616,107 | A | 4/1997 | Simonson |
| 5,616,111 | A | 4/1997 | Randolph |
| 5,618,245 | A | 4/1997 | Trulaske et al. |
| 5,618,250 | A | 4/1997 | Butz |
| 5,619,412 | A | 4/1997 | Hapka |
| 5,619,991 | A | 4/1997 | Sloane |
| 5,620,402 | A | 4/1997 | Simonson |
| 5,620,403 | A | 4/1997 | Lundin |
| 5,622,527 | A | 4/1997 | Watterson et al. |
| 5,624,353 | A | 4/1997 | Naidus |
| 5,624,360 | A | 4/1997 | Wilkins |
| 5,624,361 | A | 4/1997 | Lai |
| 5,625,577 | A | 4/1997 | Kunii et al. |
| 5,626,539 | A | 5/1997 | Piaget |
| 5,626,546 | A | 5/1997 | Little |
| 5,626,548 | A | 5/1997 | Coyle |
| 5,628,715 | A | 5/1997 | Simonson |
| 5,628,716 | A | 5/1997 | Brice |
| 5,630,566 | A | 5/1997 | Case |
| 5,632,209 | A | 5/1997 | Sakakibara |
| 5,632,711 | A | 5/1997 | Hwang |
| 5,634,870 | A | 6/1997 | Wilkinson |
| 5,637,064 | A | 6/1997 | Olson et al. |
| 5,638,343 | A | 6/1997 | Ticknor |
| 5,643,142 | A | 7/1997 | Salerno et al. |
| 5,643,144 | A | 7/1997 | Trulaske |
| 5,643,146 | A | 7/1997 | Stark et al. |
| 5,643,147 | A | 7/1997 | Huang |
| 5,643,152 | A | 7/1997 | Simonson |
| 5,643,153 | A | 7/1997 | Nylen et al. |
| 5,643,157 | A | 7/1997 | Seliber |
| 5,643,162 | A | 7/1997 | Landers et al. |
| 5,645,509 | A | 7/1997 | Brewer et al. |
| 5,645,510 | A | 7/1997 | Wilkinson |
| 5,645,513 | A | 7/1997 | Haydocy et al. |
| 5,645,914 | A | 7/1997 | Horowitz |
| 5,649,882 | A | 7/1997 | Parikh et al. |
| 5,650,709 | A | 7/1997 | Rotunda et al. |
| 5,652,304 | A | 7/1997 | Calderon et al. |
| 5,652,824 | A | 7/1997 | Hirayama et al. |
| 5,653,662 | A | 8/1997 | Rodgers, Jr. |
| 5,653,669 | A | 8/1997 | Cheng |
| 5,655,945 | A | 8/1997 | Jani |
| 5,655,997 | A | 8/1997 | Greenberg et al. |
| 5,656,003 | A | 8/1997 | Robinson et al. |
| 5,658,227 | A | 8/1997 | Stearns |
| 5,659,691 | A | 8/1997 | Durward et al. |
| 5,662,557 | A | 9/1997 | Watterson et al. |
| 5,665,031 | A | 9/1997 | Hsieh |
| 5,665,033 | A | 9/1997 | Palmer |
| 5,665,041 | A | 9/1997 | Hsieh |
| 5,667,459 | A | 9/1997 | Su |
| 5,667,465 | A | 9/1997 | McCollum et al. |
| 5,669,455 | A | 9/1997 | Dietrich |
| 5,669,833 | A | 9/1997 | Stone |
| 5,669,857 | A | 9/1997 | Watterson et al. |
| 5,669,862 | A | 9/1997 | Sayman |
| 5,669,865 | A | 9/1997 | Gordon |
| 5,672,140 | A | 9/1997 | Watterson et al. |
| 5,674,156 | A | 10/1997 | Watterson et al. |
| 5,674,167 | A | 10/1997 | Piaget et al. |
| 5,674,453 | A | 10/1997 | Watterson et al. |
| 5,676,138 | A | 10/1997 | Zawilinski |
| 5,676,624 | A | 10/1997 | Watterson et al. |
| 5,679,047 | A | 10/1997 | Engel |
| 5,679,100 | A | 10/1997 | Charnitski |
| 5,679,101 | A | 10/1997 | Magid |
| 5,681,247 | A | 10/1997 | Webber |
| 5,681,249 | A | 10/1997 | Endelman |
| 5,683,332 | A | 11/1997 | Watterson et al. |
| 5,683,334 | A | 11/1997 | Webber |
| 5,685,804 | A | 11/1997 | Whan-Tong et al. |
| 5,685,810 | A | 11/1997 | Chung |
| 5,688,196 | A | 11/1997 | O'neil |
| 5,688,209 | A | 11/1997 | Trulaske et al. |
| 5,688,210 | A | 11/1997 | Chou |
| 5,688,212 | A | 11/1997 | Walker |
| 5,688,216 | A | 11/1997 | Mauriello |
| 5,690,582 | A | 11/1997 | Ulrich et al. |
| 5,690,587 | A | 11/1997 | Gruenangerl |
| 5,690,589 | A | 11/1997 | Rodgers, Jr. |
| 5,690,852 | A | 11/1997 | Saito et al. |
| 5,692,994 | A | 12/1997 | Eschenbach |
| 5,692,996 | A | 12/1997 | Widerman |
| 5,692,997 | A | 12/1997 | Stearns |
| 5,693,004 | A | 12/1997 | Carlson et al. |
| 5,695,400 | A | 12/1997 | Fennell, Jr. et al. |
| 5,695,434 | A | 12/1997 | Dalebout et al. |
| 5,695,436 | A | 12/1997 | Huang |
| 5,697,834 | A | 12/1997 | Heumann et al. |
| 5,702,323 | A | 12/1997 | Poulton |
| 5,702,325 | A | 12/1997 | Watterson et al. |
| 5,704,875 | A | 1/1998 | Tanabe |
| 5,704,879 | A | 1/1998 | Watterson et al. |
| 5,707,168 | A | 1/1998 | Sharon |
| 5,707,319 | A | 1/1998 | Riley |
| 5,708,355 | A | 1/1998 | Schrey |
| 5,709,428 | A | 1/1998 | Hugghins |
| 5,709,632 | A | 1/1998 | Socwell |
| 5,709,633 | A | 1/1998 | Sokol |
| 5,709,634 | A | 1/1998 | Pointer |
| 5,709,636 | A | 1/1998 | Vallone |
| 5,709,638 | A | 1/1998 | Mackert et al. |
| 5,710,884 | A | 1/1998 | Dedrick |
| 5,711,745 | A | 1/1998 | Yang |
| 5,711,746 | A | 1/1998 | Carlson |
| 5,711,749 | A | 1/1998 | Miller |
| 5,713,549 | A | 2/1998 | Shieh |
| 5,713,794 | A | 2/1998 | Shimojima et al. |
| 5,713,821 | A | 2/1998 | Nissen |
| 5,716,308 | A | 2/1998 | Lee |
| 5,718,657 | A | 2/1998 | Dalebout et al. |
| 5,718,660 | A | 2/1998 | Chen |
| 5,719,825 | A | 2/1998 | Dotter |
| 5,720,200 | A | 2/1998 | Anderson et al. |
| 5,720,474 | A | 2/1998 | Sugiyama |
| 5,720,702 | A | 2/1998 | Lee |
| 5,720,771 | A | 2/1998 | Snell |

(56) References Cited

U.S. PATENT DOCUMENTS 5,721,539 A 2/1998 Goetzl
5,722,418 A 3/1998 Bro
5,722,420 A 3/1998 Lee
5,722,917 A 3/1998 Olschansky et al.
5,722,920 A 3/1998 Bauer
5,722,921 A 3/1998 Simonson
5,722,922 A 3/1998 Watterson et al.
5,724,025 A 3/1998 Tavori
5,725,459 A 3/1998 Rexach
5,725,463 A 3/1998 Colonello et al.
5,730,236 A 3/1998 Miller et al.
5,733,227 A 3/1998 Lee
5,733,228 A 3/1998 Stevens
5,733,229 A 3/1998 Dalebout et al.
5,733,232 A 3/1998 Hsu
5,734,625 A 3/1998 Kondo
5,735,586 A 4/1998 Cheng
5,735,773 A 4/1998 Vittone
5,735,776 A 4/1998 Swezey
5,738,612 A 4/1998 Tsuda
5,738,616 A 4/1998 Robertson
5,739,457 A 4/1998 Devecka
5,741,205 A 4/1998 Doll et al.
5,743,193 A 4/1998 Kakuta et al.
5,743,832 A 4/1998 Sands et al.
5,743,833 A 4/1998 Watterson et al.
5,743,835 A 4/1998 Trotter
5,746,682 A 5/1998 Hung
5,746,687 A 5/1998 Vial et al.
5,746,688 A 5/1998 Prager
5,749,372 A 5/1998 Allen
5,749,668 A 5/1998 Mcilvain
5,749,787 A 5/1998 Jank
5,749,807 A 5/1998 Webb
5,749,809 A 5/1998 Lin
5,749,813 A 5/1998 Domzalski
5,752,879 A 5/1998 Berdut
5,752,883 A 5/1998 Butcher et al.
5,752,897 A 5/1998 Skowronski et al.
5,752,901 A 5/1998 Lee
5,754,765 A 5/1998 Danneels et al.
5,755,642 A 5/1998 Miller
5,755,645 A 5/1998 Miller et al.
5,755,646 A 5/1998 Chu
5,755,651 A 5/1998 Homyonfer
5,755,823 A 5/1998 Cleary
5,759,136 A 6/1998 Chen
5,759,139 A 6/1998 Wright
5,759,199 A 6/1998 Snell et al.
5,760,353 A 6/1998 Rapp
5,761,831 A 6/1998 Cho
5,762,503 A 6/1998 Hoo et al.
5,762,584 A 6/1998 Daniels
5,762,587 A 6/1998 Dalebout et al.
5,762,588 A 6/1998 Chen
5,766,118 A 6/1998 Conner
5,769,755 A 6/1998 Henry et al.
5,769,759 A 6/1998 Alter
5,769,762 A 6/1998 Towley, III et al.
5,771,152 A 6/1998 Crompton et al.
5,771,354 A 6/1998 Crawford
5,772,508 A 6/1998 Sugita et al.
5,772,522 A 6/1998 Nesbit
5,772,558 A 6/1998 Rodgers, Jr.
5,772,560 A 6/1998 Watterson et al.
5,772,563 A 6/1998 Lin
5,776,040 A 7/1998 Webb et al.
5,776,582 A 7/1998 Needham
5,777,678 A 7/1998 Ogata et al.
5,779,596 A 7/1998 Weber
5,779,599 A 7/1998 Chen
5,779,604 A 7/1998 Towley, III et al.
5,779,607 A 7/1998 Harris
5,782,639 A 7/1998 Beal
5,782,723 A 7/1998 Kuo
5,785,630 A 7/1998 Bobick et al.
5,785,631 A 7/1998 Heidecke
5,785,632 A 7/1998 Greenberg et al.
5,788,609 A 8/1998 Miller
5,788,610 A 8/1998 Eschenbach
5,788,611 A 8/1998 Kuo
5,788,616 A 8/1998 Polidi
5,788,618 A 8/1998 Joutras
5,790,785 A 8/1998 Klug et al.
5,792,027 A 8/1998 Gvoich
5,792,028 A 8/1998 Jarvie
5,792,029 A 8/1998 Gordon
5,792,031 A 8/1998 Alton
5,792,034 A 8/1998 Kozlovsky
5,794,210 A 8/1998 Goldhaber et al.
5,795,270 A 8/1998 Woods et al.
5,795,274 A 8/1998 Kasbohm
5,797,578 A 8/1998 Graffeo
5,797,639 A 8/1998 Zorzenon
5,797,805 A 8/1998 Lubell et al.
5,799,281 A 8/1998 Login et al.
5,800,310 A 9/1998 Jones
5,800,321 A 9/1998 Webber
5,800,323 A 9/1998 Ansel
5,803,870 A 9/1998 Buhler
5,803,874 A 9/1998 Wilkinson
5,803,877 A 9/1998 Franey
5,803,882 A 9/1998 Habing et al.
5,807,210 A 9/1998 Devlin
5,807,214 A 9/1998 Riazi
5,810,696 A 9/1998 Webb
5,810,697 A 9/1998 Joiner
5,810,698 A 9/1998 Hullett et al.
5,810,702 A 9/1998 Wilkinson
5,810,747 A 9/1998 Brudny et al.
5,813,142 A 9/1998 Demon
5,813,864 A 9/1998 Ikuta
5,813,945 A 9/1998 Bernacki
5,813,947 A 9/1998 Densmore
5,813,953 A 9/1998 Whipple
5,816,372 A 10/1998 Carlson et al.
5,816,443 A 10/1998 Bustos
5,816,981 A 10/1998 Hung
5,816,983 A 10/1998 Dawes et al.
5,820,478 A 10/1998 Wood et al.
5,820,525 A 10/1998 Riley
5,820,529 A 10/1998 Weintraub
5,820,532 A 10/1998 Oliver
5,823,618 A 10/1998 Fox et al.
5,823,913 A 10/1998 Aruin
5,825,983 A 10/1998 Park et al.
5,827,154 A 10/1998 Gill
5,827,155 A 10/1998 Jensen et al.
5,827,158 A 10/1998 Drecksel
5,829,771 A 11/1998 Hsu
5,830,107 A 11/1998 Brigliadoro
5,830,113 A 11/1998 Coody et al.
5,830,114 A 11/1998 Halfen et al.
5,833,577 A 11/1998 Hurt
5,833,582 A 11/1998 Chen
5,833,583 A 11/1998 Chuang
5,833,584 A 11/1998 Piaget et al.
5,833,587 A 11/1998 Strong et al.
5,836,770 A 11/1998 Powers
5,836,854 A 11/1998 Kuo
5,836,858 A 11/1998 Sharif
5,838,906 A 11/1998 Doyle et al.
5,839,990 A 11/1998 Virkkala
5,839,993 A 11/1998 Fox
5,839,997 A 11/1998 Roth et al.
5,842,956 A 12/1998 Strachan
5,842,961 A 12/1998 Davis
5,845,230 A 12/1998 Lamberson
5,846,166 A 12/1998 Kuo
5,848,396 A 12/1998 Gerace
5,848,954 A 12/1998 Stearns et al.
5,852,264 A 12/1998 Muller
5,854,833 A 12/1998 Hogan et al.
5,855,537 A 1/1999 Coody et al.

(56) References Cited

U.S. PATENT DOCUMENTS

| | | | |
|---|---|---|---|
| 5,855,538 | A | 1/1999 | Argabright |
| 5,857,939 | A | 1/1999 | Kaufman |
| 5,857,940 | A | 1/1999 | Husted |
| 5,857,941 | A | 1/1999 | Maresh |
| 5,857,942 | A | 1/1999 | Moon et al. |
| 5,857,943 | A | 1/1999 | Murray |
| 5,860,190 | A | 1/1999 | Cano |
| 5,860,893 | A | 1/1999 | Watterson et al. |
| 5,860,894 | A | 1/1999 | Dalebout et al. |
| 5,860,899 | A | 1/1999 | Rassman |
| 5,864,018 | A | 1/1999 | Morser et al. |
| 5,865,710 | A | 2/1999 | Wilson-Hyde |
| 5,865,714 | A | 2/1999 | Marlowe |
| 5,865,733 | A | 2/1999 | Malinouskas et al. |
| 5,868,108 | A | 2/1999 | Schmitz et al. |
| 5,868,648 | A | 2/1999 | Coody et al. |
| 5,868,653 | A | 2/1999 | Klasen |
| 5,871,421 | A | 2/1999 | Trulaske et al. |
| 5,871,424 | A | 2/1999 | Conner |
| 5,873,369 | A | 2/1999 | Laniado et al. |
| 5,876,095 | A | 3/1999 | Johnston |
| 5,876,310 | A | 3/1999 | Mackey et al. |
| 5,876,313 | A | 3/1999 | Krull |
| 5,879,247 | A | 3/1999 | Winter et al. |
| 5,879,270 | A | 3/1999 | Huish et al. |
| 5,879,271 | A | 3/1999 | Stearns et al. |
| 5,879,273 | A | 3/1999 | Wei |
| 5,879,276 | A | 3/1999 | Miller |
| 5,880,677 | A | 3/1999 | Lestician |
| 5,882,281 | A | 3/1999 | Stearns et al. |
| 5,885,196 | A | 3/1999 | Gvoich |
| 5,885,197 | A | 3/1999 | Barton |
| 5,888,172 | A | 3/1999 | Andrus et al. |
| 5,890,149 | A | 3/1999 | Schmonsees |
| 5,890,562 | A | 4/1999 | Bartels et al. |
| 5,890,906 | A | 4/1999 | Macri |
| 5,890,995 | A | 4/1999 | Bobick et al. |
| 5,890,996 | A | 4/1999 | Frame et al. |
| 5,890,997 | A | 4/1999 | Roth |
| 5,891,001 | A | 4/1999 | Carnes et al. |
| 5,891,003 | A | 4/1999 | Deac et al. |
| 5,891,004 | A | 4/1999 | Berry |
| 5,891,042 | A | 4/1999 | Sham et al. |
| 5,895,339 | A | 4/1999 | Maresh |
| 5,895,340 | A | 4/1999 | Keller |
| 5,895,342 | A | 4/1999 | Solland |
| 5,897,457 | A | 4/1999 | Mackovjak |
| 5,897,459 | A | 4/1999 | Habing et al. |
| 5,897,460 | A | 4/1999 | McBride et al. |
| 5,897,461 | A | 4/1999 | Socwell |
| 5,897,463 | A | 4/1999 | Maresh |
| 5,897,467 | A | 4/1999 | Maresh |
| 5,897,469 | A | 4/1999 | Yalch |
| 5,897,472 | A | 4/1999 | Thulasingam |
| 5,897,474 | A | 4/1999 | Romero |
| 5,899,833 | A | 5/1999 | Ryan et al. |
| 5,899,834 | A | 5/1999 | Dalebout et al. |
| 5,899,963 | A | 5/1999 | Hutchings |
| 5,902,214 | A | 5/1999 | Makikawa et al. |
| 5,904,398 | A | 5/1999 | Farricielli |
| 5,904,636 | A | 5/1999 | Chen |
| 5,904,638 | A | 5/1999 | Habing et al. |
| 5,905,442 | A | 5/1999 | Mosebrook et al. |
| 5,906,269 | A | 5/1999 | Zabron et al. |
| 5,906,494 | A | 5/1999 | Ogawa et al. |
| 5,906,564 | A | 5/1999 | Jacobsen |
| 5,906,566 | A | 5/1999 | Whitcomb |
| 5,906,581 | A | 5/1999 | Tsuda |
| 5,908,373 | A | 6/1999 | Pitre |
| 5,909,544 | A | 6/1999 | Anderson, II et al. |
| 5,910,070 | A | 6/1999 | Henry et al. |
| 5,910,072 | A | 6/1999 | Rawls et al. |
| 5,910,073 | A | 6/1999 | Conner |
| 5,911,044 | A | 6/1999 | Lo et al. |
| 5,911,132 | A | 6/1999 | Sloane |
| 5,911,687 | A | 6/1999 | Sato et al. |
| 5,913,310 | A | 6/1999 | Brown |
| 5,913,751 | A | 6/1999 | Eschenbach |
| 5,913,830 | A | 6/1999 | Miles |
| 5,916,063 | A | 6/1999 | Alessandri |
| 5,916,064 | A | 6/1999 | Eschenbach |
| 5,916,065 | A | 6/1999 | McBride et al. |
| 5,916,069 | A | 6/1999 | Wang |
| 5,917,405 | A | 6/1999 | Joao |
| 5,917,692 | A | 6/1999 | Schmitz et al. |
| 5,919,117 | A | 7/1999 | Thompson et al. |
| 5,919,118 | A | 7/1999 | Stearns |
| 5,921,891 | A | 7/1999 | Browne |
| 5,921,892 | A | 7/1999 | Easton |
| 5,921,896 | A | 7/1999 | Boland |
| 5,921,901 | A | 7/1999 | Palacios |
| 5,924,966 | A | 7/1999 | Havlovic |
| 5,925,001 | A | 7/1999 | Hoyt et al. |
| 5,927,780 | A | 7/1999 | Chandler |
| 5,928,116 | A | 7/1999 | Chiang |
| 5,929,748 | A | 7/1999 | Odinak |
| 5,929,782 | A | 7/1999 | Stark |
| 5,929,848 | A | 7/1999 | Albukerk et al. |
| 5,931,763 | A | 8/1999 | Alessandri |
| 5,931,767 | A | 8/1999 | Morales |
| 5,935,048 | A | 8/1999 | Krull |
| 5,937,387 | A | 8/1999 | Summerell et al. |
| 5,938,551 | A | 8/1999 | Warner |
| 5,938,565 | A | 8/1999 | Bernacki |
| 5,938,570 | A | 8/1999 | Maresh |
| 5,938,571 | A | 8/1999 | Stevens |
| 5,938,574 | A | 8/1999 | Webber |
| 5,938,575 | A | 8/1999 | Stearns |
| 5,940,502 | A | 8/1999 | Hirai et al. |
| 5,940,911 | A | 8/1999 | Wang |
| 5,941,797 | A | 8/1999 | Kashiwaguchi |
| 5,941,800 | A | 8/1999 | Laconis |
| 5,941,803 | A | 8/1999 | Chamberlain |
| 5,941,807 | A | 8/1999 | Cassidy |
| 5,943,794 | A | 8/1999 | Gelsomini |
| 5,944,638 | A | 8/1999 | Maresh |
| 5,944,641 | A | 8/1999 | Habing |
| 5,944,642 | A | 8/1999 | Krull |
| 5,947,868 | A | 9/1999 | Dugan |
| 5,947,869 | A | 9/1999 | Shea |
| 5,947,872 | A | 9/1999 | Ryan et al. |
| 5,951,444 | A | 9/1999 | Webber |
| 5,951,447 | A | 9/1999 | Butler |
| 5,951,449 | A | 9/1999 | Oppriecht |
| 5,954,106 | A | 9/1999 | Huang |
| 5,954,621 | A | 9/1999 | Joutras et al. |
| 5,956,509 | A | 9/1999 | Kevner |
| 5,957,699 | A | 9/1999 | Peterson et al. |
| 5,957,814 | A | 9/1999 | Eschenbach |
| 5,957,819 | A | 9/1999 | Cortesi |
| 5,961,423 | A | 10/1999 | Sellers |
| 5,961,428 | A | 10/1999 | Webber |
| 5,961,430 | A | 10/1999 | Zuckerman et al. |
| 5,961,561 | A | 10/1999 | Wakefield, II |
| 5,961,593 | A | 10/1999 | Gabber et al. |
| 5,964,684 | A | 10/1999 | Sokol |
| 5,964,701 | A | 10/1999 | Asada et al. |
| 5,967,944 | A | 10/1999 | Vittone et al. |
| 5,967,948 | A | 10/1999 | Carr |
| 5,967,950 | A | 10/1999 | Hsu |
| 5,967,954 | A | 10/1999 | Habing |
| 5,967,955 | A | 10/1999 | Westfall et al. |
| 5,967,975 | A | 10/1999 | Ridgeway |
| 5,970,340 | A | 10/1999 | Edgar |
| 5,971,892 | A | 10/1999 | Lee |
| 5,971,895 | A | 10/1999 | Habing |
| 5,971,902 | A | 10/1999 | Robertson et al. |
| 5,973,696 | A | 10/1999 | Agranat et al. |
| 5,976,039 | A | 11/1999 | Epel et al. |
| 5,976,061 | A | 11/1999 | Moon et al. |
| 5,976,083 | A | 11/1999 | Richardson et al. |
| 5,980,429 | A | 11/1999 | Nashner |
| 5,980,430 | A | 11/1999 | Wang |
| 5,980,432 | A | 11/1999 | Ahman |

(56) References Cited

U.S. PATENT DOCUMENTS 5,981,168 A 11/1999 Reiner et al.
5,984,798 A 11/1999 Gilmour
5,984,836 A 11/1999 Casali
5,984,839 A 11/1999 Corkum
5,989,161 A 11/1999 Wang et al.
5,989,163 A 11/1999 Rodgers, Jr.
5,989,164 A 11/1999 Kullman et al.
5,989,165 A 11/1999 Giannelli et al.
5,989,166 A 11/1999 Capizzo et al.
5,989,168 A 11/1999 See
5,990,405 A 11/1999 Auten et al.
5,991,143 A 11/1999 Wright et al.
5,993,356 A 11/1999 Houston et al.
5,993,358 A 11/1999 Gureghian et al.
5,993,359 A 11/1999 Eschenbach
5,993,362 A 11/1999 Ghobadi
5,995,868 A 11/1999 Dorfmeister et al.
5,997,447 A 12/1999 Giannelli et al.
5,997,450 A 12/1999 Wilkinson
5,997,476 A 12/1999 Brown
5,998,897 A 12/1999 Bosten et al.
6,002,982 A 12/1999 Fry
6,003,294 A 12/1999 Fitzgerald et al.
6,003,481 A 12/1999 Pischinger et al.
6,004,243 A 12/1999 Ewert
6,004,244 A 12/1999 Simonson
6,004,246 A 12/1999 Sencil
6,004,247 A 12/1999 Webber
6,006,379 A 12/1999 Hensley
6,007,268 A 12/1999 Whittington et al.
6,010,432 A 1/2000 Vawter
6,010,451 A 1/2000 Clawson
6,011,134 A 1/2000 Marks et al.
6,012,591 A 1/2000 Brandenberg
6,012,772 A 1/2000 Conde et al.
6,013,007 A 1/2000 Root et al.
6,013,009 A 1/2000 Karkanen
6,013,011 A 1/2000 Moore et al.
6,014,432 A 1/2000 Modney
6,014,634 A 1/2000 Scroggie et al.
6,015,367 A 1/2000 Scaramucci
6,015,368 A 1/2000 Clem
6,015,371 A 1/2000 Davitt
6,017,293 A 1/2000 Pfefferle
6,018,705 A 1/2000 Gaudet et al.
6,019,403 A 2/2000 Corbett
6,022,300 A 2/2000 Hightower
6,022,302 A 2/2000 McBride
6,024,677 A 2/2000 Siwertz
6,027,428 A 2/2000 Thomas et al.
6,027,430 A 2/2000 Stearns et al.
6,027,432 A 2/2000 Cheng
6,027,433 A 2/2000 Flynn
6,029,858 A 2/2000 Srokose
6,030,320 A 2/2000 Stearns
6,030,321 A 2/2000 Fuentes
6,030,323 A 2/2000 Fontenot
6,033,227 A 3/2000 Ishige
6,033,344 A 3/2000 Trulaske et al.
6,033,347 A 3/2000 Dalebout et al.
6,033,350 A 3/2000 Krull
6,036,622 A 3/2000 Gordon
6,036,625 A 3/2000 Woodruff
6,039,677 A 3/2000 Spletzer
6,039,678 A 3/2000 Dawson
6,042,512 A 3/2000 Eschenbach
6,042,514 A 3/2000 Abelbeck
6,042,515 A 3/2000 Wang
6,042,516 A 3/2000 Norton
6,042,518 A 3/2000 Hildebrandt et al.
6,042,519 A 3/2000 Shea
6,042,523 A 3/2000 Graham
6,045,487 A 4/2000 Miller
6,045,488 A 4/2000 Eschenbach
6,045,490 A 4/2000 Shafer
6,045,491 A 4/2000 McNergney
6,050,822 A 4/2000 Faughn
6,050,920 A 4/2000 Ehrenfried
6,050,921 A 4/2000 Wang
6,050,922 A 4/2000 Wang
6,050,923 A 4/2000 Yu
6,050,924 A 4/2000 Shea
6,050,942 A 4/2000 Rust et al.
6,053,737 A 4/2000 Babbitt et al.
6,053,816 A 4/2000 Immel
6,053,844 A 4/2000 Clem
6,053,847 A 4/2000 Stearns et al.
6,053,848 A 4/2000 Eschenbach
6,053,853 A 4/2000 Hinds
6,055,513 A 4/2000 Katz et al.
6,055,573 A 4/2000 Gardenswartz et al.
6,055,747 A 5/2000 Lombardino
6,056,670 A 5/2000 Shu et al.
6,056,678 A 5/2000 Giannelli et al.
6,059,576 A 5/2000 Brann
6,059,692 A 5/2000 Hickman
6,059,695 A 5/2000 Hung
6,059,698 A 5/2000 Mazor
6,059,701 A 5/2000 George et al.
6,063,009 A 5/2000 Stearns
6,065,572 A 5/2000 Schober et al.
6,066,075 A 5/2000 Poulton
6,066,077 A 5/2000 Horst
6,066,705 A 5/2000 Calderon et al.
6,068,578 A 5/2000 Wang
6,068,579 A 5/2000 Killian et al.
6,071,031 A 6/2000 Bailey
6,071,216 A 6/2000 Giannelli et al.
6,071,217 A 6/2000 Barnett
6,074,328 A 6/2000 Johnson
6,075,525 A 6/2000 Hsieh
6,077,196 A 6/2000 Eschenbach
6,077,198 A 6/2000 Eschenbach
6,077,199 A 6/2000 Hsu
6,077,200 A 6/2000 Lin
6,079,915 A 6/2000 Bosten et al.
6,080,091 A 6/2000 Habing et al.
6,082,346 A 7/2000 Andrews et al.
6,083,144 A 7/2000 Towley, III et al.
6,086,379 A 7/2000 Pendergast et al.
6,086,520 A 7/2000 Rodriquez
6,086,521 A 7/2000 Solland
6,090,014 A 7/2000 Eschenbach
6,090,016 A 7/2000 Kuo
6,090,017 A 7/2000 Wang
6,090,020 A 7/2000 Webber
6,095,951 A 8/2000 Skowronski et al.
6,095,954 A 8/2000 Svanberg
6,099,439 A 8/2000 Ryan et al.
6,099,442 A 8/2000 Krull
6,099,444 A 8/2000 Domenge
6,101,684 A 8/2000 Ginocchio
6,102,412 A 8/2000 Staffaroni
6,102,832 A 8/2000 Tani
6,102,836 A 8/2000 Person
6,102,837 A 8/2000 Hubbard
6,102,846 A 8/2000 Patton et al.
6,103,203 A 8/2000 Fischer
6,106,297 A 8/2000 Pollak et al.
6,106,437 A 8/2000 Brooks
6,106,439 A 8/2000 Boland
6,110,075 A 8/2000 Woodruff
6,110,076 A 8/2000 Hurt
6,110,077 A 8/2000 Yu
6,110,081 A 8/2000 Barrett
6,112,624 A 9/2000 Chen
6,113,188 A 9/2000 Stewart et al.
6,113,323 A 9/2000 Bosten et al.
6,113,518 A 9/2000 Maresh
6,113,522 A 9/2000 Montgomery
6,113,537 A 9/2000 Castano
6,113,564 A 9/2000 McGuire
6,117,049 A 9/2000 Lowe
6,120,421 A 9/2000 Kuo

(56) References Cited

U.S. PATENT DOCUMENTS 6,120,424 A 9/2000 Arline
6,122,340 A 9/2000 Darley et al.
6,123,646 A 9/2000 Colassi
6,123,647 A 9/2000 Mitchell
6,123,648 A 9/2000 Stevens
6,123,649 A 9/2000 Lee et al.
6,123,650 A 9/2000 Birrell
6,125,851 A 10/2000 Walker et al.
6,126,574 A 10/2000 Stearns et al.
6,126,575 A 10/2000 Wang
6,126,576 A 10/2000 Wang
6,126,577 A 10/2000 Chang
6,128,663 A 10/2000 Thomas
6,128,981 A 10/2000 Bondhus et al.
6,129,651 A 10/2000 Denaro
6,129,962 A 10/2000 Quigley et al.
6,132,314 A 10/2000 Aiki
6,132,337 A 10/2000 Krupka et al.
6,132,340 A 10/2000 Wang
6,132,347 A 10/2000 Alessandri
6,133,610 A 10/2000 Bolam et al.
6,135,924 A 10/2000 Gibbs et al.
6,135,925 A 10/2000 Liu
6,135,926 A 10/2000 Lee
6,135,927 A 10/2000 Lo
6,142,870 A 11/2000 Wada et al.
6,142,912 A 11/2000 Profaci
6,142,913 A 11/2000 Ewert
6,142,914 A 11/2000 Crawford et al.
6,142,915 A 11/2000 Eschenbach
6,146,313 A 11/2000 Whan-Tong et al.
6,146,315 A 11/2000 Schonenberger
6,148,262 A 11/2000 Fry
6,149,551 A 11/2000 Pyles et al.
6,149,552 A 11/2000 Chen
6,149,556 A 11/2000 Jordan
6,149,558 A 11/2000 Chen
6,149,559 A 11/2000 Mackey
6,151,586 A 11/2000 Brown
6,152,854 A 11/2000 Carmein
6,152,856 A 11/2000 Studor et al.
6,152,859 A 11/2000 Stearns
6,152,864 A 11/2000 Giannelli et al.
6,159,131 A 12/2000 Pfeffer
6,162,151 A 12/2000 Tani et al.
6,162,153 A 12/2000 Perez, Jr.
6,162,183 A 12/2000 Hoover
6,162,189 A 12/2000 Girone et al.
6,163,451 A 12/2000 Chiu
6,165,107 A 12/2000 Birrell
6,165,110 A 12/2000 Gajda
6,168,551 B1 1/2001 Mcguinness
6,168,557 B1 1/2001 Liao
6,171,186 B1 1/2001 Kurosawa et al.
6,171,216 B1 1/2001 Wang
6,171,218 B1 1/2001 Shea
6,172,178 B1 1/2001 Koning et al.
6,174,265 B1 1/2001 Alessandri
6,174,267 B1 1/2001 Dalebout
6,174,268 B1 1/2001 Novak
6,175,608 B1 1/2001 Pyles et al.
6,175,994 B1 1/2001 Nicoletti
6,176,241 B1 1/2001 Blau et al.
6,176,814 B1 1/2001 Ryan et al.
6,179,746 B1 1/2001 Delman
6,179,748 B1 1/2001 Barr
6,179,753 B1 1/2001 Barker et al.
6,181,647 B1 1/2001 Tipton et al.
6,183,259 B1 2/2001 Macri et al.
6,183,397 B1 2/2001 Stearns et al.
6,183,400 B1 2/2001 Pope
6,183,401 B1 2/2001 Krull
6,183,403 B1 2/2001 Dunn
6,183,425 B1 2/2001 Whalen
6,186,145 B1 2/2001 Brown
6,186,290 B1 2/2001 Carlson
6,186,460 B1 2/2001 Lin
6,186,926 B1 2/2001 Ellis
6,186,927 B1 2/2001 Krull
6,186,928 B1 2/2001 Chen
6,186,929 B1 2/2001 Endelman et al.
6,189,846 B1 2/2001 Wang
6,190,289 B1 2/2001 Pyles et al.
6,193,631 B1 2/2001 Hickman
6,193,635 B1 2/2001 Webber et al.
6,196,952 B1 3/2001 Chen
6,196,954 B1 3/2001 Chen
6,198,394 B1 3/2001 Jacobsen et al.
6,199,732 B1 3/2001 Swetish
6,203,473 B1 3/2001 Atwood
6,203,474 B1 3/2001 Jones
6,206,795 B1 3/2001 Ou
6,206,804 B1 3/2001 Maresh
6,210,305 B1 4/2001 Eschenbach
6,211,451 B1 4/2001 Tohgi et al.
6,213,919 B1 4/2001 Wang
6,213,923 B1 4/2001 Cameron et al.
6,215,870 B1 4/2001 Hirai et al.
6,217,483 B1 4/2001 Kallassy
6,217,487 B1 4/2001 Reinert
6,217,493 B1 4/2001 Spletzer
6,217,495 B1 4/2001 Yalch
6,220,865 B1 4/2001 Macri et al.
6,220,990 B1 4/2001 Crivello
6,220,992 B1 4/2001 Shafik
6,220,995 B1 4/2001 Chen
6,221,451 B1 4/2001 Lauer et al.
6,221,667 B1 4/2001 Reiner et al.
6,224,387 B1 5/2001 Jones
6,224,516 B1 5/2001 Disch
6,224,519 B1 5/2001 Doolittle
6,225,977 B1 5/2001 Li
6,227,968 B1 5/2001 Suzuki et al.
6,228,003 B1 5/2001 Hald et al.
6,230,047 B1 5/2001 McHugh
6,230,460 B1 5/2001 Huyett
6,230,501 B1 5/2001 Bailey, Sr. et al.
6,231,481 B1 5/2001 Brock
6,231,482 B1 5/2001 Thompson
6,231,489 B1 5/2001 McBride et al.
6,231,946 B1 5/2001 Brown, Jr. et al.
6,234,935 B1 5/2001 Chu
6,234,936 B1 5/2001 Wang
6,234,941 B1 5/2001 Chu
6,237,583 B1 5/2001 Ripley et al.
6,238,322 B1 5/2001 Hsu
6,241,524 B1 6/2001 Aoshima et al.
6,241,553 B1 6/2001 Hsia
6,241,638 B1 6/2001 Hurt
6,244,987 B1 6/2001 Ohsuga et al.
6,244,988 B1 6/2001 Delman
6,244,992 B1 6/2001 James
6,244,995 B1 6/2001 Prsala
6,245,001 B1 6/2001 Siaperas
6,251,047 B1 6/2001 Stearns et al.
6,251,048 B1 6/2001 Kaufman
6,251,052 B1 6/2001 Simonson
6,252,153 B1 6/2001 Toyama
6,254,513 B1 7/2001 Takenaka et al.
6,254,514 B1 7/2001 Maresh et al.
6,254,515 B1 7/2001 Carman et al.
6,254,516 B1 7/2001 Giannelli et al.
6,259,944 B1 7/2001 Margulis et al.
6,260,970 B1 7/2001 Horn
6,261,022 B1 7/2001 Dalebout et al.
6,261,209 B1 7/2001 Coody
6,264,272 B1 7/2001 Jones et al.
6,264,586 B1 7/2001 Webber
6,264,588 B1 7/2001 Ellis
6,267,710 B1 7/2001 Liu
6,267,711 B1 7/2001 Hinds
6,273,842 B1 8/2001 Wang
6,273,843 B1 8/2001 Lo
6,276,749 B1 8/2001 Okazawa et al.

(56) References Cited

U.S. PATENT DOCUMENTS 6,277,054 B1 8/2001 Kuo
6,277,056 B1 8/2001 McBride et al.
6,278,378 B1 8/2001 Feiner et al.
6,280,361 B1 8/2001 Harvey et al.
6,280,362 B1 8/2001 Dalebout et al.
6,280,367 B1 8/2001 Arsenault
6,282,816 B1 9/2001 Rosendahl
6,283,760 B1 9/2001 Wakamoto
6,283,859 B1 9/2001 Carlson et al.
6,283,896 B1 9/2001 Grunfeld
6,287,239 B1 9/2001 Hernandez
6,287,240 B1 9/2001 Trabbic
6,287,241 B1 9/2001 Ellis
6,290,630 B1 9/2001 Boland
6,292,688 B1 9/2001 Patton
6,293,375 B1 9/2001 Chen
6,293,802 B1 9/2001 Ahlgren
6,293,892 B1 9/2001 Slawinski et al.
6,299,959 B1 10/2001 Squires et al.
6,302,815 B1 10/2001 Shishido et al.
6,302,826 B1 10/2001 Lee
6,302,828 B1 10/2001 Martin et al.
6,302,829 B1 10/2001 Schmidt
6,302,830 B1 10/2001 Stearns
6,302,833 B1 10/2001 Ellis et al.
6,306,108 B1 10/2001 Butler
6,307,167 B1 10/2001 Kajio et al.
6,308,565 B1 10/2001 French
6,309,331 B1 10/2001 Raymond
6,312,363 B1 11/2001 Watterson et al.
6,312,366 B1 11/2001 Prusick
6,313,363 B1 11/2001 Joly et al.
6,314,058 B1 11/2001 Lee
6,314,667 B1 11/2001 Rife et al.
6,315,486 B1 11/2001 Lunz
6,315,702 B1 11/2001 Ikonomopoulos
6,317,151 B1 11/2001 Ohsuga et al.
6,319,178 B1 11/2001 Webber
6,319,179 B1 11/2001 Hinds
6,322,059 B1 11/2001 Kelm et al.
6,322,451 B1 11/2001 Miura
6,322,481 B1 11/2001 Krull
6,322,483 B1 11/2001 Rotella
6,325,745 B1 12/2001 Yu
6,325,746 B1 12/2001 Wang
6,328,325 B1 12/2001 Greenwood
6,328,676 B1 12/2001 Alessandri
6,328,677 B1 12/2001 Drapeau
6,334,624 B1 1/2002 Giglio
6,335,100 B1 1/2002 Tominaga et al.
6,336,891 B1 1/2002 Fedrigon et al.
6,338,701 B1 1/2002 Webber
6,340,340 B1 1/2002 Stearns
6,342,028 B1 1/2002 De Sane
6,344,986 B1 2/2002 Jain et al.
6,345,197 B1 2/2002 Fabrizio
6,347,603 B1 2/2002 Felger
6,347,731 B1 2/2002 Burger
6,348,028 B1 2/2002 Cragg
6,350,218 B1 2/2002 Dalebout et al.
6,350,219 B1 2/2002 Hobson
6,350,221 B1 2/2002 Krull
6,352,494 B2 3/2002 McAlonan
6,356,856 B1 3/2002 Damen et al.
6,357,077 B1 3/2002 Jones, Jr. et al.
6,360,408 B1 3/2002 Dykstra et al.
6,361,476 B1 3/2002 Eschenbach
6,368,251 B1 4/2002 Casler
6,368,252 B1 4/2002 Stearns
6,368,254 B1 4/2002 Wall
6,369,313 B2 4/2002 Devecka
6,371,123 B1 4/2002 Stark et al.
6,371,738 B2 4/2002 Jones
6,371,850 B1 4/2002 Sonoda
6,371,895 B1 4/2002 Endelman et al.
6,375,580 B1 4/2002 Schmidt
6,379,287 B1 4/2002 Slawinski et al.
6,379,289 B1 4/2002 Gossie
6,382,627 B1 5/2002 Lundberg
6,383,120 B1 5/2002 Lo
6,385,651 B2 5/2002 Dancs et al.
6,387,016 B1 5/2002 Lo
6,387,018 B1 5/2002 Krull
6,387,019 B1 5/2002 Krull
6,387,022 B1 5/2002 Smith
6,387,024 B1 5/2002 Monti et al.
6,390,923 B1 5/2002 Yoshitomi et al.
6,390,927 B1 5/2002 Cleveland, III
6,390,953 B1 5/2002 Maresh
6,390,955 B1 5/2002 Wang
6,394,239 B1 5/2002 Carlson
6,394,935 B1 5/2002 Lake
6,394,936 B1 5/2002 Voris
6,394,938 B1 5/2002 Tornabene
6,397,797 B1 6/2002 Kolmanovsky et al.
6,398,695 B2 6/2002 Miller
6,402,520 B1 6/2002 Freer
6,402,558 B1 6/2002 Hung-Ju et al.
6,402,666 B2 6/2002 Krull
6,404,418 B1 6/2002 Leem
6,405,077 B1 6/2002 Birnbaum et al.
6,409,513 B1 6/2002 Kawamura et al.
6,409,632 B1 6/2002 Eschenbach
6,409,633 B1 6/2002 Abelbeck
6,413,196 B1 7/2002 Crowson
6,413,197 B2 7/2002 McKechnie et al.
6,416,442 B1 7/2002 Stearns et al.
6,416,444 B1 7/2002 Lim
6,416,446 B1 7/2002 Krull
6,416,447 B1 7/2002 Harmon
6,418,394 B1 7/2002 Puolakanaho et al.
6,419,611 B1 7/2002 Levine et al.
6,421,358 B1 7/2002 Stimmel et al.
6,422,976 B1 7/2002 Eschenbach
6,422,977 B1 7/2002 Eschenbach
6,422,979 B1 7/2002 Krull
6,422,980 B1 7/2002 Simonson
6,422,981 B1 7/2002 Riser
6,422,983 B1 7/2002 Weck
6,427,805 B1 8/2002 Gibson et al.
6,428,449 B1 8/2002 Apseloff
6,428,450 B1 8/2002 Ho
6,430,997 B1 8/2002 French et al.
6,432,026 B1 8/2002 Wang
6,435,466 B1 8/2002 Adams
6,436,007 B1 8/2002 Eschenbach
6,436,008 B1 8/2002 Skowronski et al.
6,436,013 B1 8/2002 Krull
6,440,013 B1 8/2002 Brown
6,440,042 B2 8/2002 Eschenbach
6,440,045 B1 8/2002 Gaston
6,443,521 B1 9/2002 Nye et al.
6,443,875 B1 9/2002 Golen, Jr. et al.
6,443,877 B1 9/2002 Hoecht
6,443,878 B1 9/2002 Webber
6,446,745 B1 9/2002 Lee
6,447,424 B1 9/2002 Ashby et al.
6,447,430 B1 9/2002 Webb et al.
6,447,432 B1 9/2002 Krull
6,450,284 B1 9/2002 Sakyo et al.
6,450,922 B1 9/2002 Henderson et al.
6,450,923 B1 9/2002 Vatti
6,450,925 B1 9/2002 Kuo
6,450,928 B1 9/2002 Larkins, Jr.
6,454,050 B2 9/2002 Gibson et al.
6,454,682 B1 9/2002 Kuo
6,455,960 B1 9/2002 Trago et al.
6,458,060 B1 10/2002 Watterson et al.
6,458,061 B2 10/2002 Simonson
6,461,275 B1 10/2002 Wang et al.
6,461,279 B1 10/2002 Kuo
6,461,284 B1 10/2002 Francavilla
6,463,385 B1 10/2002 Fry
6,464,618 B1 10/2002 Shea

(56) References Cited

U.S. PATENT DOCUMENTS

| | | | |
|---|---|---|---|
| 6,466,460 | B1 | 10/2002 | Rein et al. |
| 6,468,189 | B2 | 10/2002 | Alessandri |
| 6,471,622 | B1 | 10/2002 | Hammer et al. |
| 6,471,624 | B1 | 10/2002 | Voris |
| 6,473,483 | B2 | 10/2002 | Pyles |
| 6,474,193 | B1 | 11/2002 | Farney |
| 6,475,115 | B1 | 11/2002 | Candito |
| 6,475,121 | B2 | 11/2002 | Wang |
| 6,475,122 | B2 | 11/2002 | Wu |
| 6,478,721 | B1 | 11/2002 | Hunter |
| 6,478,736 | B1 | 11/2002 | Mault |
| 6,482,128 | B1 | 11/2002 | Michalow |
| 6,482,130 | B1 | 11/2002 | Pasero et al. |
| 6,482,132 | B2 | 11/2002 | Eschenbach |
| 6,482,134 | B1 | 11/2002 | Rasmussen |
| 6,482,139 | B1 | 11/2002 | Haag |
| 6,484,062 | B1 | 11/2002 | Kim |
| 6,485,397 | B1 | 11/2002 | Manderbacka |
| 6,488,020 | B1 | 12/2002 | Rosas-Magallan |
| 6,488,599 | B2 | 12/2002 | Nye |
| 6,488,612 | B2 | 12/2002 | Sechrest et al. |
| 6,491,268 | B1 | 12/2002 | Channer et al. |
| 6,491,609 | B2 | 12/2002 | Webber |
| 6,491,610 | B1 | 12/2002 | Henn |
| 6,493,652 | B1 | 12/2002 | Ohlenbusch et al. |
| 6,494,814 | B1 | 12/2002 | Wang |
| 6,494,817 | B2 | 12/2002 | Lake |
| 6,497,426 | B2 | 12/2002 | Vanpelt |
| 6,500,097 | B1 | 12/2002 | Hall |
| 6,500,101 | B1 | 12/2002 | Chen |
| 6,500,102 | B1 | 12/2002 | Domenge |
| 6,503,173 | B2 | 1/2003 | Clem |
| 6,505,503 | B1 | 1/2003 | Teresi et al. |
| 6,506,142 | B2 | 1/2003 | Itoh et al. |
| 6,510,760 | B2 | 1/2003 | Matsuo |
| 6,511,402 | B2 | 1/2003 | Shu et al. |
| 6,513,381 | B2 | 2/2003 | Fyfe et al. |
| 6,513,532 | B2 | 2/2003 | Mault et al. |
| 6,513,669 | B2 | 2/2003 | Ozawa et al. |
| 6,514,180 | B1 | 2/2003 | Rawls |
| 6,515,182 | B2 | 2/2003 | Hosokawa et al. |
| 6,515,593 | B1 | 2/2003 | Stark et al. |
| 6,520,531 | B1 | 2/2003 | Gien |
| 6,520,891 | B1 | 2/2003 | Stephens, Jr. |
| 6,524,226 | B2 | 2/2003 | Kushner |
| 6,527,674 | B1 | 3/2003 | Clem |
| 6,527,678 | B1 | 3/2003 | Wang |
| 6,527,683 | B2 | 3/2003 | Tolles |
| 6,527,685 | B2 | 3/2003 | Endelman et al. |
| 6,527,711 | B1 | 3/2003 | Stivoric et al. |
| 6,527,712 | B1 | 3/2003 | Brown et al. |
| 6,527,796 | B1 | 3/2003 | Magovern |
| 6,530,864 | B1 | 3/2003 | Parks |
| 6,533,707 | B2 | 3/2003 | Wang |
| 6,537,184 | B2 | 3/2003 | Kim |
| 6,537,185 | B1 | 3/2003 | Hur |
| 6,539,931 | B2 | 4/2003 | Trajkovic et al. |
| 6,540,650 | B1 | 4/2003 | Krull |
| 6,540,651 | B1 | 4/2003 | Aberton et al. |
| 6,543,247 | B2 | 4/2003 | Strauss |
| 6,544,146 | B1 | 4/2003 | Stearns et al. |
| 6,547,701 | B1 | 4/2003 | Eschenbach |
| 6,547,702 | B1 | 4/2003 | Heidecke |
| 6,551,217 | B2 | 4/2003 | Kaganovsky |
| 6,551,218 | B2 | 4/2003 | Goh |
| 6,551,220 | B1 | 4/2003 | Schroeder |
| 6,551,223 | B2 | 4/2003 | Cheng |
| 6,551,226 | B1 | 4/2003 | Webber et al. |
| 6,554,749 | B2 | 4/2003 | Iund et al. |
| 6,558,299 | B1 | 5/2003 | Slattery |
| 6,558,300 | B2 | 5/2003 | Deola |
| 6,558,301 | B1 | 5/2003 | Jackson |
| 6,558,302 | B2 | 5/2003 | Cluff |
| 6,560,903 | B1 | 5/2003 | Darley |
| 6,561,951 | B2 | 5/2003 | Cannon et al. |
| 6,561,955 | B1 | 5/2003 | Dreissigacker et al. |
| 6,561,956 | B1 | 5/2003 | Allison |
| 6,561,960 | B2 | 5/2003 | Webber |
| 6,563,489 | B1 | 5/2003 | Latypov et al. |
| 6,569,061 | B2 | 5/2003 | Stearns et al. |
| 6,569,062 | B2 | 5/2003 | Wang |
| 6,572,511 | B1 | 6/2003 | Volpe |
| 6,572,512 | B2 | 6/2003 | Anderson et al. |
| 6,572,513 | B1 | 6/2003 | Whan-Tong et al. |
| 6,575,878 | B1 | 6/2003 | Choy |
| 6,575,882 | B2 | 6/2003 | Chen |
| 6,575,885 | B1 | 6/2003 | Weck et al. |
| 6,579,210 | B1 | 6/2003 | Stearns et al. |
| 6,579,211 | B2 | 6/2003 | Wu |
| 6,579,213 | B1 | 6/2003 | Webber et al. |
| 6,579,214 | B2 | 6/2003 | Crump |
| 6,582,342 | B2 | 6/2003 | Kaufman |
| 6,582,344 | B2 | 6/2003 | Tang |
| 6,582,345 | B2 | 6/2003 | Roy |
| 6,585,622 | B1 | 7/2003 | Shum et al. |
| 6,585,624 | B1 | 7/2003 | Chen |
| 6,585,626 | B2 | 7/2003 | McBride |
| 6,589,138 | B2 | 7/2003 | Dyer et al. |
| 6,592,498 | B1 | 7/2003 | Trainor |
| 6,592,499 | B2 | 7/2003 | Parker |
| 6,592,502 | B1 | 7/2003 | Phillips |
| 6,595,905 | B2 | 7/2003 | McBride |
| 6,601,358 | B2 | 8/2003 | Panatta |
| 6,601,825 | B2 | 8/2003 | Bressner et al. |
| 6,602,191 | B2 | 8/2003 | Quy |
| 6,604,008 | B2 | 8/2003 | Chudley et al. |
| 6,604,023 | B1 | 8/2003 | Guzman |
| 6,604,419 | B2 | 8/2003 | Guzman |
| 6,605,020 | B1 | 8/2003 | Huang |
| 6,605,024 | B2 | 8/2003 | Stearns |
| 6,605,038 | B1 | 8/2003 | Teller et al. |
| 6,605,044 | B2 | 8/2003 | Bimbaum |
| 6,606,374 | B1 | 8/2003 | Rokoff et al. |
| 6,607,472 | B2 | 8/2003 | Toole |
| 6,609,478 | B2 | 8/2003 | Del Valle |
| 6,610,063 | B2 | 8/2003 | Kumar et al. |
| 6,611,789 | B1 | 8/2003 | Darley |
| 6,612,170 | B2 | 9/2003 | Brown |
| 6,612,492 | B1 | 9/2003 | Yen |
| 6,612,969 | B2 | 9/2003 | Eschenbach |
| 6,612,971 | B1 | 9/2003 | Morris |
| 6,616,578 | B2 | 9/2003 | Alessandri |
| 6,619,681 | B2 | 9/2003 | Gutierrez |
| 6,619,835 | B2 | 9/2003 | Kita |
| 6,620,079 | B2 | 9/2003 | Kuo |
| 6,623,407 | B2 | 9/2003 | Novak |
| 6,623,409 | B1 | 9/2003 | Abelbeck |
| 6,626,799 | B2 | 9/2003 | Watterson et al. |
| 6,626,800 | B1 | 9/2003 | Casler |
| 6,626,802 | B1 | 9/2003 | Rodgers, Jr. |
| 6,626,803 | B1 | 9/2003 | Oglesby et al. |
| 6,629,902 | B2 | 10/2003 | Murphy et al. |
| 6,629,908 | B2 | 10/2003 | Hamady |
| 6,629,909 | B1 | 10/2003 | Stearns et al. |
| 6,629,910 | B1 | 10/2003 | Krull |
| 6,632,160 | B2 | 10/2003 | LaFond et al. |
| 6,632,161 | B1 | 10/2003 | Nir |
| 6,634,992 | B1 | 10/2003 | Ogawa |
| 6,634,996 | B2 | 10/2003 | Jacobsen |
| 6,634,997 | B2 | 10/2003 | Breibart et al. |
| 6,634,998 | B2 | 10/2003 | Siaperas |
| 6,635,015 | B2 | 10/2003 | Sagel |
| 6,637,811 | B2 | 10/2003 | Zheng |
| 6,637,818 | B2 | 10/2003 | Williams |
| 6,638,160 | B2 | 10/2003 | Yoshitomi |
| 6,645,124 | B1 | 11/2003 | Clem |
| 6,645,125 | B1 | 11/2003 | Stearns et al. |
| 6,645,126 | B1 | 11/2003 | Martin et al. |
| 6,645,129 | B2 | 11/2003 | Eschenbach |
| 6,645,130 | B2 | 11/2003 | Webber |
| 6,648,353 | B1 | 11/2003 | Cabal |
| 6,648,798 | B2 | 11/2003 | Yoo |
| 6,648,800 | B2 | 11/2003 | Stearns et al. |
| 6,648,801 | B2 | 11/2003 | Stearns et al. |

(56) References Cited

U.S. PATENT DOCUMENTS

| | | | |
|---|---|---|---|
| 6,648,802 | B2 | 11/2003 | Ware |
| 6,652,419 | B1 | 11/2003 | Rota |
| 6,652,424 | B2 | 11/2003 | Dalebout |
| 6,652,425 | B1 | 11/2003 | Martin et al. |
| 6,652,426 | B2 | 11/2003 | Carter |
| 6,652,429 | B2 | 11/2003 | Bushnell |
| 6,652,431 | B1 | 11/2003 | Mattox |
| 6,652,432 | B2 | 11/2003 | Smith |
| 6,656,091 | B1 | 12/2003 | Abelbeck |
| 6,656,093 | B2 | 12/2003 | Chen |
| 6,659,916 | B1 | 12/2003 | Shea |
| 6,659,946 | B1 | 12/2003 | Batchelor et al. |
| 6,660,949 | B2 | 12/2003 | Kamino et al. |
| 6,661,136 | B1 | 12/2003 | Lee |
| 6,662,651 | B1 | 12/2003 | Roth |
| 6,663,127 | B2 | 12/2003 | Miller |
| 6,663,498 | B2 | 12/2003 | Stipan |
| 6,663,500 | B2 | 12/2003 | Huang |
| 6,666,796 | B1 | 12/2003 | MacCready, Jr. |
| 6,666,800 | B2 | 12/2003 | Krull |
| 6,668,678 | B1 | 12/2003 | Baba et al. |
| 6,669,600 | B2 | 12/2003 | Warner |
| 6,669,606 | B2 | 12/2003 | Krull |
| 6,669,607 | B2 | 12/2003 | Slawinski et al. |
| 6,669,609 | B2 | 12/2003 | Gerschefske et al. |
| 6,671,975 | B2 | 1/2004 | Hennessey |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,676,530 | B2 | 1/2004 | Lochtefeld |
| 6,676,569 | B1 | 1/2004 | Radow |
| 6,676,572 | B2 | 1/2004 | Wang |
| 6,676,573 | B2 | 1/2004 | Abelbeck et al. |
| 6,676,577 | B2 | 1/2004 | Stearns |
| 6,676,579 | B1 | 1/2004 | Lin |
| 6,677,299 | B2 | 1/2004 | Stern et al. |
| 6,679,816 | B1 | 1/2004 | Krull |
| 6,679,820 | B2 | 1/2004 | Barkus et al. |
| 6,681,014 | B1 | 1/2004 | Ghassabian |
| 6,681,704 | B1 | 1/2004 | Brookhiser |
| 6,681,728 | B2 | 1/2004 | Haghgooie |
| 6,682,460 | B2 | 1/2004 | Lo |
| 6,682,461 | B2 | 1/2004 | Wang |
| 6,685,169 | B2 | 2/2004 | Shim |
| 6,685,480 | B2 | 2/2004 | Nishimoto et al. |
| 6,685,600 | B1 | 2/2004 | Ullman |
| 6,685,601 | B1 | 2/2004 | Knapp |
| 6,685,602 | B2 | 2/2004 | Colosky, Jr. et al. |
| 6,685,607 | B1 | 2/2004 | Olson |
| 6,687,535 | B2 | 2/2004 | Hautala et al. |
| 6,689,019 | B2 | 2/2004 | Ohrt et al. |
| 6,689,020 | B2 | 2/2004 | Stearns |
| 6,689,023 | B2 | 2/2004 | Baumler |
| 6,689,025 | B2 | 2/2004 | Emick |
| 6,689,057 | B1 | 2/2004 | Shinsel et al. |
| 6,689,075 | B2 | 2/2004 | West |
| 6,691,839 | B1 | 2/2004 | El-Kassouf |
| 6,692,415 | B1 | 2/2004 | Winston |
| 6,692,417 | B2 | 2/2004 | Burrell |
| 6,695,620 | B1 | 2/2004 | Huang |
| 6,695,694 | B2 | 2/2004 | Ishikawa et al. |
| 6,695,799 | B2 | 2/2004 | Kitadou et al. |
| 6,698,110 | B1 | 3/2004 | Robbins |
| 6,699,146 | B1 | 3/2004 | Winter et al. |
| 6,699,159 | B2 | 3/2004 | Rouse |
| 6,699,161 | B1 | 3/2004 | Speas |
| 6,699,162 | B2 | 3/2004 | Chen |
| 6,700,788 | B2 | 3/2004 | Matsushita et al. |
| 6,701,271 | B2 | 3/2004 | Willner et al. |
| 6,702,719 | B1 | 3/2004 | Brown et al. |
| 6,702,723 | B2 | 3/2004 | Landfair |
| 6,702,726 | B2 | 3/2004 | Lin |
| 6,705,974 | B1 | 3/2004 | Tardif |
| 6,705,976 | B1 | 3/2004 | Piane, Jr. |
| 6,705,977 | B1 | 3/2004 | Ziak |
| 6,708,427 | B2 | 3/2004 | Sussmann et al. |
| 6,711,789 | B2 | 3/2004 | Ping |
| 6,712,737 | B1 | 3/2004 | Nusbaum |
| 6,712,740 | B2 | 3/2004 | Simonson |
| 6,716,139 | B1 | 4/2004 | Hosseinzadeh-Dolkhani |
| 6,716,142 | B2 | 4/2004 | Kuo |
| 6,716,144 | B1 | 4/2004 | Shifferaw |
| 6,719,667 | B2 | 4/2004 | Wong et al. |
| 6,719,669 | B1 | 4/2004 | Wang |
| 6,719,672 | B1 | 4/2004 | Ellis et al. |
| 6,719,674 | B2 | 4/2004 | Krull |
| 6,722,888 | B1 | 4/2004 | Macri et al. |
| 6,723,413 | B2 | 4/2004 | Walters |
| 6,726,113 | B2 | 4/2004 | Guo |
| 6,726,600 | B2 | 4/2004 | Miller |
| 6,726,601 | B1 | 4/2004 | Beutel |
| 6,726,602 | B2 | 4/2004 | Chang |
| 6,730,002 | B2 | 5/2004 | Hald et al. |
| 6,733,423 | B1 | 5/2004 | Chang |
| 6,733,424 | B2 | 5/2004 | Krull |
| 6,736,360 | B1 | 5/2004 | Buczek |
| 6,736,759 | B1 | 5/2004 | Stubbs et al. |
| 6,736,765 | B2 | 5/2004 | Wallace et al. |
| 6,736,766 | B1 | 5/2004 | Gallant |
| 6,738,274 | B2 | 5/2004 | Prasad et al. |
| 6,740,007 | B2 | 5/2004 | Gordon et al. |
| 6,740,009 | B1 | 5/2004 | Hall |
| 6,741,052 | B2 | 5/2004 | Fitzgibbon |
| 6,743,153 | B2 | 6/2004 | Watterson et al. |
| 6,746,247 | B2 | 6/2004 | Barton |
| 6,746,370 | B1 | 6/2004 | Fleming et al. |
| 6,746,371 | B1 | 6/2004 | Brown et al. |
| 6,746,380 | B2 | 6/2004 | Lien et al. |
| 6,746,381 | B2 | 6/2004 | Krull |
| 6,747,427 | B1 | 6/2004 | Carson |
| 6,749,432 | B2 | 6/2004 | French et al. |
| 6,749,536 | B1 | 6/2004 | Cuskaden et al. |
| 6,749,537 | B1 | 6/2004 | Hickman |
| 6,749,540 | B1 | 6/2004 | Pasero et al. |
| 6,749,542 | B2 | 6/2004 | Wu |
| 6,749,546 | B2 | 6/2004 | Yang |
| 6,749,547 | B2 | 6/2004 | Krull |
| 6,751,439 | B2 | 6/2004 | Tice et al. |
| 6,752,745 | B1 | 6/2004 | Davis |
| 6,755,770 | B2 | 6/2004 | Martens |
| 6,757,572 | B1 | 6/2004 | Forest |
| 6,758,790 | B1 | 7/2004 | Ellis |
| 6,758,791 | B1 | 7/2004 | Kuo |
| 6,758,792 | B1 | 7/2004 | Chang |
| 6,761,387 | B2 | 7/2004 | Sloss |
| 6,761,667 | B1 | 7/2004 | Cutler et al. |
| 6,761,672 | B1 | 7/2004 | Williams |
| 6,764,429 | B1 | 7/2004 | Michalow |
| 6,764,430 | B1 | 7/2004 | Fencel |
| 6,764,431 | B2 | 7/2004 | Yoss |
| 6,764,432 | B2 | 7/2004 | Hippensteel |
| 6,765,726 | B2 | 7/2004 | French et al. |
| 6,767,314 | B2 | 7/2004 | Thompson |
| 6,769,689 | B1 | 8/2004 | Shimomura et al. |
| 6,770,014 | B2 | 8/2004 | Amore |
| 6,770,015 | B2 | 8/2004 | Simonson |
| 6,776,740 | B1 | 8/2004 | Anderson et al. |
| 6,778,938 | B1 | 8/2004 | Ng et al. |
| 6,783,134 | B2 | 8/2004 | Geary |
| 6,783,482 | B2 | 8/2004 | Oglesby et al. |
| 6,786,415 | B2 | 9/2004 | Yiu |
| 6,786,821 | B2 | 9/2004 | Nobe et al. |
| 6,786,847 | B1 | 9/2004 | Morgan et al. |
| 6,786,848 | B2 | 9/2004 | Yamashita et al. |
| 6,786,850 | B2 | 9/2004 | Nizamuddin |
| 6,786,852 | B2 | 9/2004 | Watterson et al. |
| 6,790,162 | B1 | 9/2004 | Ellis et al. |
| 6,790,163 | B1 | 9/2004 | Van De Laarschot |
| 6,790,178 | B1 | 9/2004 | Mault et al. |
| 6,793,607 | B2 | 9/2004 | Neil |
| 6,793,609 | B1 | 9/2004 | Fan |
| 6,796,159 | B2 | 9/2004 | Kelm et al. |
| 6,796,925 | B2 | 9/2004 | Martinez et al. |
| 6,796,927 | B2 | 9/2004 | Toyama |

(56) References Cited

U.S. PATENT DOCUMENTS 6,798,378 B1 9/2004 Walters
6,800,050 B2 10/2004 Moavro
6,802,800 B1 10/2004 Hobson
6,807,869 B2 10/2004 Farringdon et al.
6,808,458 B1 10/2004 Jung
6,808,472 B1 10/2004 Hickman
6,808,473 B2 10/2004 Hisano et al.
6,808,475 B2 10/2004 Kehrbaum
6,811,516 B1 11/2004 Dugan
6,811,519 B2 11/2004 Kuo
6,817,117 B1 11/2004 Campbell
6,817,968 B2 11/2004 Galbraith et al.
6,817,979 B2 11/2004 Nihtilä
6,821,230 B2 11/2004 Dalebout et al.
6,823,036 B1 11/2004 Chen
6,823,327 B1 11/2004 Klug
6,824,210 B2 11/2004 Zheng
6,824,502 B1 11/2004 Huang
6,825,164 B1 11/2004 Stern et al.
6,825,876 B1 11/2004 Easwar et al.
6,827,669 B2 12/2004 Cohen et al.
6,827,670 B1 12/2004 Stark et al.
6,827,822 B2 12/2004 Tao et al.
6,830,540 B2 12/2004 Watterson
6,830,541 B2 12/2004 Wu
6,830,542 B2 12/2004 Ball
6,835,166 B1 12/2004 Stearns et al.
6,837,827 B1 1/2005 Lee et al.
6,837,829 B2 1/2005 Eschenbach
6,837,830 B2 1/2005 Eldridge
6,837,838 B2 1/2005 List
6,840,892 B1 1/2005 Wu
6,840,904 B2 1/2005 Goldberg
6,842,928 B2 1/2005 Yang et al.
6,843,732 B1 1/2005 Huang
6,843,757 B2 1/2005 Pan et al.
6,846,270 B1 1/2005 Etnyre
6,846,272 B2 1/2005 Rosenow et al.
6,849,032 B2 2/2005 Chu
6,852,068 B2 2/2005 Ogawa
6,852,069 B2 2/2005 Park
6,855,093 B2 2/2005 Anderson et al.
6,855,097 B2 2/2005 Krull
6,857,993 B2 2/2005 Yeh
6,859,215 B1 2/2005 Brown et al.
6,860,131 B2 3/2005 Armstrong et al.
6,860,836 B1 3/2005 Wu
6,860,839 B1 3/2005 Dice
6,860,841 B1 3/2005 Mortorano
6,863,641 B1 3/2005 Brown et al.
6,866,141 B2 3/2005 Saeki
6,866,613 B1 3/2005 Brown et al.
6,872,077 B2 3/2005 Yeager
6,872,168 B2 3/2005 Wang et al.
6,872,173 B2 3/2005 Krull
6,872,175 B2 3/2005 Lin
6,872,187 B1 3/2005 Stark et al.
6,875,157 B1 4/2005 Wang
6,875,160 B2 4/2005 Watterson et al.
6,876,496 B2 4/2005 French et al.
6,876,947 B1 4/2005 Darley et al.
6,878,099 B2 4/2005 Corbalis et al.
6,878,101 B2 4/2005 Colley
6,880,416 B2 4/2005 Koch
6,880,487 B2 4/2005 Reinkensmeyer et al.
6,881,176 B2 4/2005 Oishi et al.
6,882,955 B1 4/2005 Ohlenbusch et al.
6,885,971 B2 4/2005 Vock et al.
6,886,613 B1 5/2005 Zahdeh
6,886,645 B2 5/2005 Bise et al.
6,887,185 B1 5/2005 Kuo
6,887,190 B1 5/2005 Azari
6,893,381 B2 5/2005 Slawinski
6,893,383 B1 5/2005 Chang et al.
6,896,342 B1 5/2005 Cheng
6,896,645 B1 5/2005 Krull
6,899,657 B2 5/2005 Chuang
6,899,659 B2 5/2005 Anderson et al.
6,899,661 B1 5/2005 Krull
6,902,513 B1 6/2005 Mcclure
6,902,515 B2 6/2005 Howell et al.
6,902,516 B2 6/2005 Krull
6,905,440 B2 6/2005 Heppert
6,905,446 B2 6/2005 Greenland
6,908,416 B2 6/2005 Mercado et al.
6,908,417 B2 6/2005 Jackson
6,908,418 B2 6/2005 Saure
6,910,991 B2 6/2005 Matsumoto
6,910,992 B2 6/2005 Arguilez
6,913,562 B2 7/2005 Chen
6,913,563 B2 7/2005 Chen
6,915,271 B1 7/2005 Meyer et al.
6,916,278 B2 7/2005 Webber
6,918,858 B2 7/2005 Watterson et al.
6,918,859 B1 7/2005 Yeh
6,918,860 B1 7/2005 Nusbaum
6,918,861 B2 7/2005 Liao et al.
6,920,947 B2 7/2005 Kamen et al.
6,921,351 B1 7/2005 Hickman et al.
6,921,354 B1 7/2005 Shifferaw
6,921,355 B2 7/2005 Campanaro et al.
6,923,746 B1 8/2005 Skowronski et al.
6,923,747 B1 8/2005 Chu
6,923,748 B1 8/2005 Mauz
6,923,749 B1 8/2005 Smith
6,926,644 B2 8/2005 Chen
6,926,646 B1 8/2005 Nguyen
6,926,649 B2 8/2005 Slawinski
6,929,589 B1 8/2005 Bruggemann et al.
6,932,745 B1 8/2005 Ellis
6,932,748 B2 8/2005 Huang
6,934,658 B2 8/2005 Clabes et al.
6,936,007 B2 8/2005 Quy
6,937,289 B1 8/2005 Ranta et al.
6,939,271 B1 9/2005 Whan-Tong et al.
6,941,620 B1 9/2005 Hinds
6,942,599 B1 9/2005 Racine
6,944,294 B2 9/2005 Tsay
6,945,912 B2 9/2005 Levi
6,945,916 B2 9/2005 Schroeder
6,949,052 B2 9/2005 Millington
6,949,053 B1 9/2005 Stearns
6,949,054 B1 9/2005 Stearns
6,952,221 B1 10/2005 Holtz et al.
6,953,418 B1 10/2005 Chen
6,953,424 B2 10/2005 Kusumoto et al.
6,955,542 B2 10/2005 Roncalez et al.
6,960,156 B2 11/2005 Smith
6,964,632 B1 11/2005 Ko
6,964,633 B2 11/2005 Kolda
6,966,872 B2 11/2005 Eschenbach
6,971,972 B1 12/2005 Mcgovern
6,971,973 B2 12/2005 Cohen et al.
6,971,974 B2 12/2005 Bowman
6,971,975 B2 12/2005 Croft
6,971,978 B2 12/2005 Hyder
6,974,403 B2 12/2005 Wong et al.
6,974,404 B1 12/2005 Watterson et al.
6,974,405 B2 12/2005 Krull
6,975,910 B1 12/2005 Brown et al.
6,976,624 B2 12/2005 Hsiao
6,976,698 B2 12/2005 Kuiken
6,976,941 B2 12/2005 Britt
6,976,943 B1 12/2005 Hsiung
6,976,958 B2 12/2005 Quy
6,979,283 B2 12/2005 Pan
6,991,586 B2 1/2006 Lapcevic
6,991,588 B1 1/2006 Adams
6,993,270 B2 1/2006 Yoshioka et al.
6,994,306 B1 2/2006 Sweere et al.
6,994,657 B1 2/2006 Eschenbach
6,994,683 B1 2/2006 Starr
6,996,852 B1 2/2006 Cabrera
6,997,852 B2 2/2006 Watterson et al.

(56) References Cited

U.S. PATENT DOCUMENTS

| | | | |
|---|---|---|---|
| 6,997,853 | B1 | 2/2006 | Cuskaden et al. |
| 6,997,856 | B1 | 2/2006 | Krull |
| 7,001,288 | B2 | 2/2006 | Harrell |
| 7,003,122 | B2 | 2/2006 | Chen |
| 7,003,828 | B2 | 2/2006 | Roussy |
| 7,004,271 | B1 | 2/2006 | Kamen et al. |
| 7,004,887 | B2 | 2/2006 | Pan et al. |
| 7,004,888 | B1 | 2/2006 | Weng |
| 7,004,895 | B2 | 2/2006 | Perry |
| 7,008,352 | B2 | 3/2006 | Grossi |
| 7,008,356 | B2 | 3/2006 | Hung |
| 7,008,359 | B2 | 3/2006 | Fan et al. |
| 7,009,613 | B2 | 3/2006 | Goden |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,011,610 | B2 | 3/2006 | Wawrzyniak |
| 7,011,611 | B1 | 3/2006 | Ripley |
| 7,014,598 | B2 | 3/2006 | Fenelon et al. |
| 7,014,599 | B2 | 3/2006 | Ashley |
| 7,015,950 | B1 | 3/2006 | Pryor |
| 7,016,812 | B2 | 3/2006 | Aritsuka et al. |
| 7,020,508 | B2 | 3/2006 | Stivoric |
| 7,022,047 | B2 | 4/2006 | Cohen et al. |
| 7,022,048 | B1 | 4/2006 | Fernandez |
| 7,022,049 | B2 | 4/2006 | Ryan et al. |
| 7,022,051 | B2 | 4/2006 | Ota |
| 7,025,713 | B2 | 4/2006 | Dalebout |
| 7,029,425 | B2 | 4/2006 | Krull |
| 7,032,870 | B2 | 4/2006 | Sweere et al. |
| 7,033,176 | B2 | 4/2006 | Feldman |
| 7,033,269 | B2 | 4/2006 | Namba et al. |
| 7,033,306 | B2 | 4/2006 | Graber |
| 7,035,936 | B2 | 4/2006 | Fouquet |
| 7,037,241 | B2 | 5/2006 | Kuo |
| 7,037,246 | B2 | 5/2006 | Kim |
| 7,038,855 | B2 | 5/2006 | French et al. |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,041,049 | B1 | 5/2006 | Raniere |
| 7,044,066 | B1 | 5/2006 | Miller |
| 7,044,891 | B1 | 5/2006 | Rivera |
| 7,044,897 | B2 | 5/2006 | Myers et al. |
| 7,047,817 | B2 | 5/2006 | Lanham |
| 7,048,638 | B2 | 5/2006 | Novotny |
| 7,048,677 | B2 | 5/2006 | Mackert |
| 7,051,049 | B2 | 5/2006 | Samn |
| 7,052,426 | B2 | 5/2006 | Battat et al. |
| 7,052,440 | B2 | 5/2006 | Pyles et al. |
| 7,052,442 | B2 | 5/2006 | Watterson |
| 7,052,444 | B2 | 5/2006 | Webber |
| 7,052,446 | B2 | 5/2006 | Morris et al. |
| 7,055,899 | B2 | 6/2006 | Zhurong et al. |
| 7,056,265 | B1 | 6/2006 | Shea |
| 7,060,005 | B2 | 6/2006 | Carlsen et al. |
| 7,060,006 | B1 | 6/2006 | Watterson et al. |
| 7,060,007 | B2 | 6/2006 | Juva |
| 7,060,008 | B2 | 6/2006 | Watterson et al. |
| 7,060,011 | B1 | 6/2006 | Krull |
| 7,060,012 | B2 | 6/2006 | Howell et al. |
| 7,060,031 | B2 | 6/2006 | Webb et al. |
| 7,063,644 | B2 | 6/2006 | Albert et al. |
| 7,065,768 | B1 | 6/2006 | Janzig et al. |
| 7,066,865 | B2 | 6/2006 | Radow |
| 7,066,867 | B2 | 6/2006 | Krull |
| 7,070,415 | B2 | 7/2006 | Hojo et al. |
| 7,070,539 | B2 | 7/2006 | Brown et al. |
| 7,070,542 | B2 | 7/2006 | Reyes et al. |
| 7,070,545 | B2 | 7/2006 | Lull et al. |
| 7,072,789 | B2 | 7/2006 | Vock et al. |
| 7,073,417 | B2 | 7/2006 | Beauchamp |
| 7,073,852 | B1 | 7/2006 | Zheng |
| 7,077,788 | B2 | 7/2006 | Chang |
| 7,077,791 | B2 | 7/2006 | Krull |
| 7,081,069 | B2 | 7/2006 | Hsu |
| 7,081,073 | B1 | 7/2006 | Smith |
| 7,082,703 | B2 | 8/2006 | Greene et al. |
| 7,083,536 | B2 | 8/2006 | Lu et al. |
| 7,083,546 | B2 | 8/2006 | Zillig |
| 7,083,549 | B1 | 8/2006 | Fan |
| 7,083,554 | B1 | 8/2006 | Lo Presti |
| 7,083,582 | B2 | 8/2006 | Chen |
| 7,086,994 | B2 | 8/2006 | Turak et al. |
| 7,086,995 | B2 | 8/2006 | Reyes |
| 7,086,999 | B2 | 8/2006 | Jeneve et al. |
| 7,087,000 | B1 | 8/2006 | Walker |
| 7,087,003 | B1 | 8/2006 | Katterjohn |
| 7,087,005 | B2 | 8/2006 | Rouillard |
| 7,090,621 | B2 | 8/2006 | Loane |
| 7,090,622 | B2 | 8/2006 | Hetrick |
| 7,090,625 | B2 | 8/2006 | Chermack |
| 7,091,635 | B1 | 8/2006 | Gilliland et al. |
| 7,094,183 | B2 | 8/2006 | Hsieh |
| 7,094,184 | B1 | 8/2006 | Chen et al. |
| 7,094,185 | B2 | 8/2006 | Greenland |
| 7,097,591 | B2 | 8/2006 | Moon |
| 7,097,593 | B2 | 8/2006 | Chang |
| 7,097,601 | B1 | 8/2006 | Ronnow |
| 7,100,517 | B1 | 9/2006 | Godwin |
| 7,101,124 | B2 | 9/2006 | Keightley |
| 7,101,319 | B1 | 9/2006 | Potts |
| 7,101,330 | B2 | 9/2006 | Elbaz et al. |
| 7,104,926 | B2 | 9/2006 | Carlson |
| 7,104,930 | B2 | 9/2006 | Lo et al. |
| 7,104,937 | B2 | 9/2006 | Arbuckle |
| 7,108,636 | B1 | 9/2006 | Garcia |
| 7,108,641 | B2 | 9/2006 | Pertegaz-Esteban |
| 7,108,659 | B2 | 9/2006 | Ross et al. |
| 7,111,526 | B1 | 9/2006 | Flojo |
| 7,112,161 | B2 | 9/2006 | Maresh et al. |
| 7,112,163 | B2 | 9/2006 | Krull |
| 7,113,166 | B1 | 9/2006 | Rosenberg et al. |
| 7,115,073 | B2 | 10/2006 | Nizamuddin |
| 7,115,076 | B2 | 10/2006 | Oglesby et al. |
| 7,115,078 | B1 | 10/2006 | Kalember et al. |
| 7,115,080 | B2 | 10/2006 | Cockrill, Jr. et al. |
| 7,118,517 | B1 | 10/2006 | Hale |
| 7,121,980 | B2 | 10/2006 | Chen |
| 7,121,988 | B2 | 10/2006 | Walkerdine |
| 7,125,371 | B2 | 10/2006 | Henderson |
| 7,125,373 | B1 | 10/2006 | Garza |
| 7,128,692 | B2 | 10/2006 | Black |
| 7,128,693 | B2 | 10/2006 | Brown et al. |
| 7,128,696 | B1 | 10/2006 | Krull |
| 7,128,697 | B1 | 10/2006 | Krull |
| 7,128,701 | B1 | 10/2006 | Ketcham |
| 7,132,939 | B2 | 11/2006 | Tyndall et al. |
| 7,134,987 | B2 | 11/2006 | Goldstein |
| 7,137,644 | B2 | 11/2006 | Kimberley |
| 7,137,931 | B2 | 11/2006 | Liu |
| 7,137,932 | B2 | 11/2006 | Doudiet |
| 7,137,935 | B2 | 11/2006 | Clarke |
| 7,137,936 | B1 | 11/2006 | Shaw |
| 7,139,835 | B2 | 11/2006 | Fouquet et al. |
| 7,140,487 | B2 | 11/2006 | Motoda |
| 7,140,626 | B1 | 11/2006 | Keay |
| 7,141,003 | B2 | 11/2006 | Wu |
| 7,141,005 | B2 | 11/2006 | Wu |
| 7,141,008 | B2 | 11/2006 | Krull et al. |
| 7,147,591 | B2 | 12/2006 | McAvoy |
| 7,148,879 | B2 | 12/2006 | Amento et al. |
| 7,150,168 | B1 | 12/2006 | Kuo |
| 7,151,214 | B2 | 12/2006 | Barry |
| 7,153,244 | B2 | 12/2006 | Towley |
| 7,153,248 | B2 | 12/2006 | Chen |
| 7,156,776 | B2 | 1/2007 | Maser |
| 7,156,782 | B1 | 1/2007 | Krull |
| 7,156,783 | B2 | 1/2007 | Chen |
| 7,156,808 | B2 | 1/2007 | Quy |
| 7,156,809 | B2 | 1/2007 | Quy |
| 7,158,938 | B2 | 1/2007 | Labbe et al. |
| 7,163,488 | B2 | 1/2007 | Anders |

(56) References Cited

U.S. PATENT DOCUMENTS

| | | | |
|---|---|---|---|
| 7,163,489 | B1 | 1/2007 | Nelson |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,066 | B2 | 1/2007 | Webber |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,169,093 | B2 | 1/2007 | Simonson et al. |
| 7,170,016 | B2 | 1/2007 | Dumornay |
| 7,171,331 | B2 | 1/2007 | Vock et al. |
| 7,172,531 | B2 | 2/2007 | Rodgers, Jr. |
| 7,172,536 | B2 | 2/2007 | Liu |
| 7,172,538 | B2 | 2/2007 | Keiser |
| 7,175,193 | B2 | 2/2007 | Wu |
| 7,178,637 | B2 | 2/2007 | Asano et al. |
| 7,179,204 | B2 | 2/2007 | Anderson et al. |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,179,212 | B2 | 2/2007 | Hsiung et al. |
| 7,182,738 | B2 | 2/2007 | Bonutti et al. |
| 7,186,189 | B2 | 3/2007 | Huang |
| 7,187,961 | B2 | 3/2007 | Yamashita et al. |
| 7,188,439 | B2 | 3/2007 | DiBenedetto et al. |
| 7,189,190 | B2 | 3/2007 | Lamar et al. |
| 7,189,791 | B2 | 3/2007 | Solan |
| 7,192,387 | B2 | 3/2007 | Mendel |
| 7,192,388 | B2 | 3/2007 | Dalebout et al. |
| 7,192,389 | B2 | 3/2007 | Allison |
| 7,195,568 | B2 | 3/2007 | Huang |
| 7,196,491 | B2 | 3/2007 | Mayhew et al. |
| 7,197,029 | B1 | 3/2007 | Osterhout et al. |
| 7,200,517 | B2 | 4/2007 | Darley et al. |
| 7,201,705 | B2 | 4/2007 | Rodgers, Jr. |
| 7,201,707 | B1 | 4/2007 | Moon |
| 7,201,712 | B2 | 4/2007 | Tiahrt |
| 7,204,328 | B2 | 4/2007 | LoPresti |
| 7,204,790 | B2 | 4/2007 | Sleamaker |
| 7,207,929 | B2 | 4/2007 | Hamilton |
| 7,207,930 | B2 | 4/2007 | Bonutti |
| 7,211,029 | B2 | 5/2007 | Kau |
| 7,211,030 | B1 | 5/2007 | Cao |
| 7,214,167 | B2 | 5/2007 | Stearns |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,220 | B2 | 5/2007 | Stubbs |
| 7,220,221 | B2 | 5/2007 | Mosimann et al. |
| 7,223,209 | B2 | 5/2007 | Lee |
| 7,223,213 | B2 | 5/2007 | Golesh |
| 7,223,214 | B2 | 5/2007 | Chen |
| 7,223,215 | B2 | 5/2007 | Bastyr |
| 7,223,216 | B1 | 5/2007 | McBride |
| 7,224,326 | B2 | 5/2007 | Sefton |
| 7,225,282 | B1 | 5/2007 | Lyle |
| 7,225,565 | B2 | 6/2007 | DiBenedetto et al. |
| 7,225,694 | B2 | 6/2007 | Said |
| 7,226,402 | B1 | 6/2007 | Joya |
| 7,228,601 | B2 | 6/2007 | Thompson |
| 7,229,391 | B2 | 6/2007 | Francis |
| 7,232,404 | B2 | 6/2007 | Nelson |
| 7,234,200 | B2 | 6/2007 | Chase |
| 7,235,942 | B2 | 6/2007 | Nagaoka et al. |
| 7,236,154 | B1 | 6/2007 | Kerr et al. |
| 7,238,143 | B1 | 7/2007 | Sokolovos |
| 7,238,147 | B2 | 7/2007 | Mills et al. |
| 7,244,217 | B2 | 7/2007 | Rodgers, Jr. |
| 7,247,128 | B2 | 7/2007 | Oga |
| 7,249,540 | B1 | 7/2007 | Hacker et al. |
| 7,250,021 | B2 | 7/2007 | Leight |
| 7,250,022 | B2 | 7/2007 | Dalebout |
| 7,254,516 | B2 | 8/2007 | Case, Jr. et al. |
| 7,255,665 | B2 | 8/2007 | Ish, III |
| 7,255,666 | B2 | 8/2007 | Cardenas |
| 7,257,468 | B1 | 8/2007 | Costa et al. |
| 7,258,039 | B2 | 8/2007 | Lin |
| 7,258,651 | B2 | 8/2007 | Clarke |
| 7,259,906 | B1 | 8/2007 | Islam |
| 7,260,950 | B2 | 8/2007 | Choi et al. |
| 7,261,678 | B2 | 8/2007 | Crawford et al. |
| 7,264,554 | B2 | 9/2007 | Bentley |
| 7,264,578 | B1 | 9/2007 | Krull |
| 7,269,038 | B2 | 9/2007 | Shekhawat |
| 7,270,628 | B2 | 9/2007 | Campanaro |
| 7,276,017 | B2 | 10/2007 | Lin |
| 7,276,018 | B2 | 10/2007 | Studdard |
| 7,278,934 | B2 | 10/2007 | McBride et al. |
| 7,278,958 | B2 | 10/2007 | Morgan |
| 7,278,966 | B2 | 10/2007 | Hjelt et al. |
| 7,279,868 | B2 | 10/2007 | Lanni |
| 7,282,016 | B2 | 10/2007 | Simonson |
| 7,284,466 | B1 | 10/2007 | Ho |
| 7,285,075 | B2 | 10/2007 | Cutler et al. |
| 7,285,090 | B2 | 10/2007 | Stivoric et al. |
| 7,287,770 | B2 | 10/2007 | Drabant et al. |
| 7,288,053 | B2 | 10/2007 | Endelman et al. |
| 7,290,760 | B1 | 11/2007 | Lindsay |
| 7,291,096 | B2 | 11/2007 | Ho |
| 7,291,098 | B1 | 11/2007 | Krull |
| 7,291,100 | B2 | 11/2007 | Dodge |
| 7,292,151 | B2 | 11/2007 | Ferguson |
| 7,293,510 | B1 | 11/2007 | Siao |
| 7,294,094 | B1 | 11/2007 | Howle |
| 7,294,095 | B2 | 11/2007 | Charnitski |
| 7,294,100 | B2 | 11/2007 | Bull |
| 7,299,720 | B1 | 11/2007 | Schultz et al. |
| 7,300,390 | B1 | 11/2007 | Krull |
| 7,300,392 | B1 | 11/2007 | Curran |
| 7,303,508 | B2 | 12/2007 | Toyama et al. |
| 7,303,510 | B2 | 12/2007 | Gebhardt |
| 7,308,818 | B2 | 12/2007 | Considine et al. |
| 7,309,303 | B1 | 12/2007 | Proctor |
| 7,311,640 | B2 | 12/2007 | Baatz |
| 7,311,644 | B2 | 12/2007 | Hale |
| 7,314,438 | B1 | 1/2008 | Clark et al. |
| 7,316,633 | B2 | 1/2008 | Liao et al. |
| 7,318,810 | B1 | 1/2008 | Benson |
| 7,319,457 | B2 | 1/2008 | Lin et al. |
| 7,322,219 | B2 | 1/2008 | Armstrong et al. |
| 7,322,653 | B2 | 1/2008 | Dragusin |
| 7,322,906 | B2 | 1/2008 | Webber |
| 7,322,907 | B2 | 1/2008 | Bowser |
| 7,322,909 | B1 | 1/2008 | Loccarini |
| 7,328,119 | B1 | 2/2008 | Pryor |
| 7,329,212 | B2 | 2/2008 | Roque |
| 7,329,684 | B2 | 2/2008 | Mjalli et al. |
| 7,331,227 | B2 | 2/2008 | Kang et al. |
| 7,331,908 | B2 | 2/2008 | Olsen |
| 7,331,911 | B2 | 2/2008 | Webber et al. |
| 7,334,350 | B2 | 2/2008 | Ellis, III |
| 7,335,135 | B2 | 2/2008 | Wang |
| 7,335,139 | B2 | 2/2008 | Bartholomew et al. |
| 7,335,140 | B2 | 2/2008 | Webber et al. |
| 7,335,141 | B2 | 2/2008 | Piane, Jr. |
| 7,335,142 | B2 | 2/2008 | Towley, III et al. |
| 7,335,147 | B2 | 2/2008 | Jones |
| 7,336,178 | B2 | 2/2008 | Le |
| 7,341,545 | B2 | 3/2008 | Cao |
| 7,344,481 | B2 | 3/2008 | Watterson et al. |
| 7,344,488 | B2 | 3/2008 | Weck et al. |
| 7,346,935 | B1 | 3/2008 | Patterson |
| 7,347,806 | B2 | 3/2008 | Nakano et al. |
| 7,350,787 | B2 | 4/2008 | Voss |
| 7,352,365 | B2 | 4/2008 | Trachte |
| 7,354,380 | B2 | 4/2008 | Volpe, Jr. |
| 7,357,756 | B2 | 4/2008 | Demas |
| 7,357,758 | B2 | 4/2008 | Polk, III |
| 7,359,121 | B2 | 4/2008 | French et al. |
| 7,361,122 | B2 | 4/2008 | Porth |
| 7,361,123 | B1 | 4/2008 | Krull |

(56) References Cited

U.S. PATENT DOCUMENTS

| | | | |
|---|---|---|---|
| 7,361,125 | B2 | 4/2008 | Webber et al. |
| 7,361,127 | B2 | 4/2008 | Tremayne |
| 7,362,016 | B2 | 4/2008 | Cheng |
| 7,364,538 | B2 | 4/2008 | Aucamp |
| 7,365,647 | B2 | 4/2008 | Nativ |
| 7,366,921 | B2 | 4/2008 | Ranganathan |
| 7,367,926 | B2 | 5/2008 | Clark |
| 7,367,927 | B2 | 5/2008 | Krull |
| 7,367,957 | B2 | 5/2008 | Huang et al. |
| 7,369,121 | B2 | 5/2008 | Lane |
| 7,370,498 | B1 | 5/2008 | Miao |
| 7,372,485 | B1 | 5/2008 | Bodnar et al. |
| 7,373,820 | B1 | 5/2008 | James |
| 7,374,519 | B2 | 5/2008 | Naidus |
| 7,374,522 | B2 | 5/2008 | Arnold |
| 7,377,881 | B2 | 5/2008 | Moon |
| 7,377,882 | B2 | 5/2008 | Watterson |
| 7,377,886 | B2 | 5/2008 | Wu |
| 7,381,167 | B2 | 6/2008 | Duhamel |
| 7,383,081 | B2 | 6/2008 | Butt et al. |
| 7,384,013 | B2 | 6/2008 | Yen |
| 7,384,209 | B2 | 6/2008 | Muders et al. |
| 7,384,381 | B2 | 6/2008 | Webber et al. |
| 7,387,597 | B2 | 6/2008 | Krull |
| 7,387,867 | B2 | 6/2008 | Hasegawa et al. |
| 7,393,308 | B1 | 7/2008 | Huang |
| 7,396,319 | B1 | 7/2008 | Ellis |
| 7,398,151 | B1 | 7/2008 | Burrell et al. |
| 7,401,918 | B2 | 7/2008 | Howell et al. |
| 7,402,125 | B2 | 7/2008 | Wang |
| 7,402,145 | B1 | 7/2008 | Woggon |
| 7,404,232 | B2 | 7/2008 | Chase |
| 7,410,449 | B2 | 8/2008 | Yeh |
| 7,412,206 | B1 | 8/2008 | Hutchings et al. |
| 7,413,056 | B2 | 8/2008 | Gonzi et al. |
| 7,413,065 | B2 | 8/2008 | Gauthier |
| 7,413,530 | B2 | 8/2008 | Warner et al. |
| 7,413,532 | B1 | 8/2008 | Monsrud et al. |
| 7,413,533 | B2 | 8/2008 | Lin |
| 7,416,537 | B1 | 8/2008 | Stark et al. |
| 7,418,862 | B2 | 9/2008 | Gruben et al. |
| 7,425,189 | B1 | 9/2008 | Eschenbach |
| 7,428,760 | B2 | 9/2008 | McCrimmon |
| 7,429,235 | B2 | 9/2008 | Lin |
| 7,429,236 | B2 | 9/2008 | Dalebout et al. |
| 7,432,184 | B2 | 10/2008 | Hosokawa et al. |
| 7,432,454 | B1 | 10/2008 | Sze et al. |
| 7,432,677 | B2 | 10/2008 | Heydt et al. |
| 7,435,202 | B2 | 10/2008 | Daly et al. |
| 7,435,203 | B2 | 10/2008 | Anderson et al. |
| 7,435,205 | B2 | 10/2008 | Reyes et al. |
| 7,438,673 | B1 | 10/2008 | Jones |
| 7,448,823 | B2 | 11/2008 | Silva |
| 7,452,336 | B2 | 11/2008 | Thompson |
| 7,454,002 | B1 | 11/2008 | Gardner et al. |
| 7,455,621 | B1 | 11/2008 | Anthony |
| 7,455,622 | B2 | 11/2008 | Watterson et al. |
| 7,455,626 | B2 | 11/2008 | Trevino et al. |
| 7,455,628 | B1 | 11/2008 | Stearns |
| 7,455,633 | B2 | 11/2008 | Brown et al. |
| 7,461,825 | B2 | 12/2008 | Olivera |
| 7,462,135 | B2 | 12/2008 | Lo |
| 7,462,141 | B1 | 12/2008 | Raboin et al. |
| 7,465,257 | B1 | 12/2008 | Morgan, Jr. |
| 7,468,025 | B2 | 12/2008 | Hauser et al. |
| 7,470,234 | B1 | 12/2008 | Elhag et al. |
| 7,473,211 | B2 | 1/2009 | Lee |
| 7,475,613 | B2 | 1/2009 | Bailey |
| 7,475,641 | B2 | 1/2009 | Jin |
| 7,475,900 | B2 | 1/2009 | Cheng |
| 7,476,182 | B2 | 1/2009 | Denisco |
| 7,476,186 | B1 | 1/2009 | Steffee |
| 7,477,890 | B1 | 1/2009 | Narayanaswami |
| 7,478,794 | B1 | 1/2009 | Gohlke et al. |
| 7,480,512 | B2 | 1/2009 | Graham et al. |
| 7,482,050 | B2 | 1/2009 | Olson |
| 7,485,076 | B2 | 2/2009 | Lee |
| 7,485,077 | B2 | 2/2009 | Chen |
| 7,485,079 | B2 | 2/2009 | Brown et al. |
| 7,488,277 | B1 | 2/2009 | Knapp |
| 7,489,979 | B2 | 2/2009 | Rosenberg |
| 7,491,154 | B2 | 2/2009 | Yonehana et al. |
| 7,491,155 | B2 | 2/2009 | Fenelon et al. |
| 7,491,157 | B1 | 2/2009 | Lin |
| 7,491,159 | B2 | 2/2009 | Patterson |
| 7,494,450 | B2 | 2/2009 | Solomon |
| 7,494,454 | B2 | 2/2009 | Sheets |
| 7,497,784 | B2 | 3/2009 | Henry |
| 7,497,806 | B2 | 3/2009 | Duncan et al. |
| 7,497,814 | B1 | 3/2009 | Krull |
| 7,503,476 | B2 | 3/2009 | Bhavnani |
| 7,503,878 | B1 | 3/2009 | Amsbury et al. |
| 7,503,883 | B2 | 3/2009 | Madden |
| 7,507,183 | B2 | 3/2009 | Anderson |
| 7,507,186 | B2 | 3/2009 | Stearns |
| 7,507,187 | B2 | 3/2009 | Dyer et al. |
| 7,507,189 | B2 | 3/2009 | Krull |
| 7,507,190 | B2 | 3/2009 | Piane, Jr. |
| 7,510,508 | B2 | 3/2009 | Santomassimo et al. |
| 7,510,509 | B2 | 3/2009 | Hickman |
| 7,510,511 | B2 | 3/2009 | Von Detten |
| 7,511,710 | B2 | 3/2009 | Barrett |
| 7,517,303 | B2 | 4/2009 | Crawford et al. |
| 7,517,304 | B1 | 4/2009 | Swanson et al. |
| 7,519,327 | B2 | 4/2009 | White |
| 7,519,537 | B2 | 4/2009 | Rosenberg |
| 7,520,840 | B2 | 4/2009 | Shifferaw |
| 7,520,845 | B2 | 4/2009 | Towley, III et al. |
| 7,521,623 | B2 | 4/2009 | Bowen |
| 7,524,272 | B2 | 4/2009 | Bruck et al. |
| 7,525,293 | B1 | 4/2009 | Notohamiprodjo et al. |
| 7,532,977 | B2 | 5/2009 | Chen |
| 7,534,200 | B1 | 5/2009 | Martinez |
| 7,534,206 | B1 | 5/2009 | Lovitt et al. |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,551 | B2 | 5/2009 | Steffee |
| 7,537,552 | B2 | 5/2009 | Dalebout et al. |
| 7,539,487 | B2 | 5/2009 | Sinclair et al. |
| 7,540,828 | B2 | 6/2009 | Watterson et al. |
| 7,540,829 | B1 | 6/2009 | Lin |
| 7,540,832 | B2 | 6/2009 | Krull |
| 7,542,040 | B2 | 6/2009 | Templeman |
| 7,542,816 | B2 | 6/2009 | Rosenberg |
| 7,543,934 | B2 | 6/2009 | Howell et al. |
| 7,544,153 | B2 | 6/2009 | Trevino et al. |
| 7,547,255 | B2 | 6/2009 | Lochtefeld et al. |
| 7,549,938 | B2 | 6/2009 | Leighton et al. |
| 7,549,947 | B2 | 6/2009 | Hickman et al. |
| 7,549,949 | B2 | 6/2009 | Webber et al. |
| 7,553,260 | B2 | 6/2009 | Piaget et al. |
| 7,553,262 | B2 | 6/2009 | Piane, Jr. |
| 7,553,264 | B2 | 6/2009 | Carter |
| 7,553,267 | B1 | 6/2009 | Hauser |
| 7,556,590 | B2 | 7/2009 | Watterson et al. |
| 7,556,591 | B2 | 7/2009 | Chuang |
| 7,561,989 | B2 | 7/2009 | Banks et al. |
| 7,562,117 | B2 | 7/2009 | Rosenberg |
| 7,563,203 | B2 | 7/2009 | Dalebout et al. |
| 7,563,205 | B2 | 7/2009 | Alling |
| 7,563,208 | B1 | 7/2009 | Chen |
| 7,563,209 | B2 | 7/2009 | Webber et al. |
| 7,563,213 | B2 | 7/2009 | Grant |
| 7,563,214 | B2 | 7/2009 | Webber et al. |
| 7,563,235 | B2 | 7/2009 | Der Meer |
| 7,569,000 | B2 | 8/2009 | Wang |
| 7,569,004 | B2 | 8/2009 | Kolomeir |
| 7,569,005 | B2 | 8/2009 | Geeting |
| 7,571,517 | B2 | 8/2009 | Smith et al. |
| 7,572,206 | B2 | 8/2009 | Wilkins et al. |
| 7,575,536 | B1 | 8/2009 | Hickman |
| 7,575,537 | B2 | 8/2009 | Ellis |
| 7,575,538 | B1 | 8/2009 | Clark |

(56) References Cited

U.S. PATENT DOCUMENTS

| | | | |
|---|---|---|---|
| 7,577,522 | B2 | 8/2009 | Rosenberg |
| 7,578,771 | B1 | 8/2009 | Towley, III et al. |
| 7,578,772 | B2 | 8/2009 | Lippitt |
| 7,579,946 | B2 | 8/2009 | Case, Jr. |
| 7,584,673 | B2 | 9/2009 | Shimizu |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,585,262 | B1 | 9/2009 | Vayntraub |
| 7,585,263 | B2 | 9/2009 | Brown et al. |
| 7,586,032 | B2 | 9/2009 | Louis |
| 7,588,520 | B2 | 9/2009 | Nalley |
| 7,591,763 | B1 | 9/2009 | Fucci |
| 7,591,770 | B2 | 9/2009 | Stewart et al. |
| 7,591,773 | B2 | 9/2009 | Weir |
| 7,591,795 | B2 | 9/2009 | Whalen et al. |
| 7,594,873 | B2 | 9/2009 | Terao et al. |
| 7,594,877 | B2 | 9/2009 | Anderson et al. |
| 7,594,878 | B1 | 9/2009 | Joannou |
| 7,594,880 | B2 | 9/2009 | Webber |
| 7,594,881 | B2 | 9/2009 | Shifferaw |
| 7,597,656 | B2 | 10/2009 | Trees |
| 7,598,255 | B2 | 10/2009 | Dvorak |
| 7,601,096 | B2 | 10/2009 | Negrin |
| 7,601,097 | B2 | 10/2009 | Miyamaru et al. |
| 7,601,101 | B2 | 10/2009 | Jackson et al. |
| 7,601,105 | B1 | 10/2009 | Gipson, III et al. |
| 7,601,187 | B2 | 10/2009 | Webber |
| 7,602,301 | B1 | 10/2009 | Stirling et al. |
| 7,603,255 | B2 | 10/2009 | Case, Jr. et al. |
| 7,604,571 | B2 | 10/2009 | Wilkins et al. |
| 7,604,572 | B2 | 10/2009 | Stanford |
| 7,604,573 | B2 | 10/2009 | Dalebout |
| 7,604,576 | B2 | 10/2009 | Drechsler |
| 7,604,577 | B2 | 10/2009 | Lin |
| 7,604,578 | B2 | 10/2009 | Liu |
| 7,607,243 | B2 | 10/2009 | Berner, Jr. et al. |
| 7,608,015 | B2 | 10/2009 | Radow |
| 7,608,020 | B2 | 10/2009 | Mason |
| 7,608,021 | B1 | 10/2009 | Nalley |
| 7,608,023 | B2 | 10/2009 | Casagrande |
| 7,608,024 | B2 | 10/2009 | Sechrest et al. |
| 7,608,028 | B2 | 10/2009 | Pertegaz-Esteban |
| 7,611,445 | B2 | 11/2009 | Brown et al. |
| 7,611,448 | B2 | 11/2009 | Schiff |
| 7,611,450 | B2 | 11/2009 | Mancini |
| 7,614,639 | B2 | 11/2009 | Tholkes et al. |
| 7,614,981 | B2 | 11/2009 | Cao |
| 7,614,984 | B1 | 11/2009 | Krull |
| 7,614,991 | B2 | 11/2009 | Fox |
| 7,616,097 | B1 | 11/2009 | Whang |
| 7,618,345 | B2 | 11/2009 | Corbalis et al. |
| 7,618,346 | B2 | 11/2009 | Crawford et al. |
| 7,618,350 | B2 | 11/2009 | Dalebout et al. |
| 7,619,514 | B1 | 11/2009 | Stone |
| 7,621,847 | B2 | 11/2009 | Lamle |
| 7,621,850 | B2 | 11/2009 | Piaget et al. |
| 7,621,855 | B1 | 11/2009 | Krull |
| 7,621,856 | B1 | 11/2009 | Keith |
| 7,621,858 | B2 | 11/2009 | Sheron |
| 7,624,956 | B2 | 12/2009 | Steigert et al. |
| 7,624,967 | B1 | 12/2009 | Doebler et al. |
| 7,625,033 | B2 | 12/2009 | Michelau et al. |
| 7,625,314 | B2 | 12/2009 | Ungari |
| 7,625,315 | B2 | 12/2009 | Hickman |
| 7,625,316 | B1 | 12/2009 | Amsbury et al. |
| 7,625,319 | B2 | 12/2009 | Kang et al. |
| 7,625,321 | B2 | 12/2009 | Simonson et al. |
| 7,625,322 | B1 | 12/2009 | Krull |
| 7,625,323 | B1 | 12/2009 | Lin |
| 7,628,730 | B1 | 12/2009 | Watterson et al. |
| 7,628,732 | B1 | 12/2009 | Porszasz et al. |
| 7,628,733 | B2 | 12/2009 | Donner |
| 7,628,737 | B2 | 12/2009 | Kowallis et al. |
| 7,628,743 | B1 | 12/2009 | Flentye et al. |
| 7,630,201 | B2 | 12/2009 | Asahi |
| 7,631,382 | B2 | 12/2009 | DiBenedetto et al. |
| 7,632,221 | B1 | 12/2009 | Kolander |
| 7,637,847 | B1 | 12/2009 | Hickman |
| 7,637,850 | B2 | 12/2009 | Lin |
| 7,637,855 | B2 | 12/2009 | Bizzell |
| 7,639,520 | B1 | 12/2009 | Zansky et al. |
| 7,641,592 | B2 | 1/2010 | Roche |
| 7,641,598 | B2 | 1/2010 | Rodgers, Jr. |
| 7,643,895 | B2 | 1/2010 | Gupta et al. |
| 7,645,212 | B2 | 1/2010 | Ashby et al. |
| 7,645,213 | B2 | 1/2010 | Watterson |
| 7,645,214 | B2 | 1/2010 | Lull |
| 7,645,215 | B2 | 1/2010 | Gordon |
| 7,645,216 | B2 | 1/2010 | Edeker |
| 7,645,218 | B2 | 1/2010 | Potok et al. |
| 7,645,221 | B1 | 1/2010 | Curry |
| 7,647,196 | B2 | 1/2010 | Kahn et al. |
| 7,648,441 | B2 | 1/2010 | Silk |
| 7,648,443 | B2 | 1/2010 | Schenk |
| 7,648,446 | B2 | 1/2010 | Chiles et al. |
| 7,648,463 | B1 | 1/2010 | Elhag et al. |
| 7,648,858 | B2 | 1/2010 | Tang et al. |
| 7,650,987 | B2 | 1/2010 | Taniguchi et al. |
| 7,651,442 | B2 | 1/2010 | Carlson |
| 7,651,450 | B2 | 1/2010 | Wehrell |
| 7,654,229 | B2 | 2/2010 | Smith |
| 7,654,938 | B2 | 2/2010 | Webber et al. |
| 7,654,940 | B2 | 2/2010 | Webber et al. |
| 7,654,941 | B2 | 2/2010 | Lacher |
| 7,654,948 | B2 | 2/2010 | Kaplan et al. |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,662,065 | B1 | 2/2010 | Kahn et al. |
| 7,662,075 | B2 | 2/2010 | Isom |
| 7,662,282 | B2 | 2/2010 | Lee et al. |
| 7,665,794 | B2 | 2/2010 | Kachouh |
| 7,666,123 | B2 | 2/2010 | Giannelli |
| 7,670,263 | B2 | 3/2010 | Ellis |
| 7,670,269 | B2 | 3/2010 | Webber et al. |
| 7,670,270 | B2 | 3/2010 | Alessandri et al. |
| 7,674,185 | B2 | 3/2010 | Omidi |
| 7,674,205 | B2 | 3/2010 | Dalebout et al. |
| 7,674,206 | B2 | 3/2010 | Jones |
| 7,674,216 | B1 | 3/2010 | Bolling |
| 7,676,332 | B2 | 3/2010 | Damen |
| 7,677,518 | B2 | 3/2010 | Chouinard et al. |
| 7,677,723 | B2 | 3/2010 | Howell et al. |
| 7,678,023 | B1 | 3/2010 | Shea |
| 7,678,033 | B2 | 3/2010 | Tyree |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,683,252 | B2 | 3/2010 | Oliver et al. |
| 7,686,742 | B2 | 3/2010 | Tischler |
| 7,689,437 | B1 | 3/2010 | Teller et al. |
| 7,690,317 | B2 | 4/2010 | Beck et al. |
| 7,690,556 | B1 | 4/2010 | Kahn et al. |
| 7,691,031 | B2 | 4/2010 | Toyama et al. |
| 7,691,033 | B2 | 4/2010 | Rolli |
| 7,691,041 | B2 | 4/2010 | Abdo |
| 7,691,042 | B2 | 4/2010 | Pandozy |
| 7,691,069 | B2 | 4/2010 | Adams |
| 7,695,406 | B2 | 4/2010 | Waters |
| 7,695,409 | B2 | 4/2010 | Helie et al. |
| 7,695,414 | B2 | 4/2010 | Tiahrt |
| 7,698,101 | B2 | 4/2010 | Alten et al. |
| 7,698,359 | B2 | 4/2010 | Wray et al. |
| 7,699,752 | B1 | 4/2010 | Anderson |
| 7,699,753 | B2 | 4/2010 | Daikeler |
| 7,699,754 | B2 | 4/2010 | Schneider |
| 7,699,755 | B2 | 4/2010 | Feldman et al. |
| 7,702,781 | B2 | 4/2010 | Devolites |
| 7,703,974 | B2 | 4/2010 | Bouille |
| 7,704,191 | B2 | 4/2010 | Smith et al. |
| 7,704,192 | B2 | 4/2010 | Dyer et al. |
| 7,704,195 | B2 | 4/2010 | Alessandri et al. |

(56) References Cited

U.S. PATENT DOCUMENTS

| | | | |
|---|---|---|---|
| 7,704,197 | B2 | 4/2010 | Yu |
| 7,704,199 | B2 | 4/2010 | Koch |
| 7,705,230 | B2 | 4/2010 | Bowen |
| 7,706,547 | B2 | 4/2010 | Luo |
| 7,708,668 | B2 | 5/2010 | Rodgers, Jr. |
| 7,708,670 | B2 | 5/2010 | Bowser |
| 7,708,672 | B2 | 5/2010 | Gibson et al. |
| 7,713,171 | B1 | 5/2010 | Hickman |
| 7,713,172 | B2 | 5/2010 | Watterson et al. |
| 7,713,177 | B2 | 5/2010 | Lo |
| 7,717,825 | B2 | 5/2010 | Van Der Hoeven |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,829 | B2 | 5/2010 | Wang |
| 7,717,830 | B1 | 5/2010 | Charniga et al. |
| 7,717,832 | B2 | 5/2010 | Webber et al. |
| 7,717,833 | B1 | 5/2010 | Nelson et al. |
| 7,717,866 | B2 | 5/2010 | Damen |
| 7,722,503 | B1 | 5/2010 | Smith et al. |
| 7,722,507 | B2 | 5/2010 | Yoo |
| 7,722,509 | B2 | 5/2010 | Eder |
| 7,722,513 | B2 | 5/2010 | Habing |
| 7,725,362 | B2 | 5/2010 | Weathers, Jr. |
| 7,727,117 | B2 | 6/2010 | Feldman et al. |
| 7,727,125 | B2 | 6/2010 | Day |
| 7,728,214 | B2 | 6/2010 | Oliver et al. |
| 7,730,588 | B1 | 6/2010 | Bernier |
| 7,731,634 | B2 | 6/2010 | Stewart et al. |
| 7,731,635 | B2 | 6/2010 | Dyer |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,736,283 | B2 | 6/2010 | Webb |
| 7,736,286 | B2 | 6/2010 | Panaiotov |
| 7,739,076 | B1 | 6/2010 | Vock et al. |
| 7,740,562 | B2 | 6/2010 | Jones |
| 7,740,563 | B2 | 6/2010 | Dalebout et al. |
| 7,740,568 | B2 | 6/2010 | Webb |
| 7,740,570 | B2 | 6/2010 | Winston |
| 7,740,588 | B1 | 6/2010 | Sciarra |
| 7,741,975 | B2 | 6/2010 | Shum et al. |
| 7,745,716 | B1 | 6/2010 | Murphy |
| 7,747,671 | B2 | 6/2010 | Ku |
| 7,749,137 | B2 | 7/2010 | Watt et al. |
| 7,749,138 | B2 | 7/2010 | Wang |
| 7,749,140 | B1 | 7/2010 | Lindemeier et al. |
| 7,753,824 | B2 | 7/2010 | Wang |
| 7,753,825 | B2 | 7/2010 | Jaquish et al. |
| 7,753,830 | B1 | 7/2010 | Marsh et al. |
| 7,753,861 | B1 | 7/2010 | Kahn et al. |
| 7,757,346 | B2 | 7/2010 | Chase |
| 7,758,469 | B2 | 7/2010 | Dyer et al. |
| 7,758,470 | B2 | 7/2010 | Hirata et al. |
| 7,758,477 | B2 | 7/2010 | Prenatt |
| 7,758,478 | B2 | 7/2010 | Golesh et al. |
| 7,758,523 | B2 | 7/2010 | Collings et al. |
| 7,761,212 | B2 | 7/2010 | Takebayashi |
| 7,761,300 | B2 | 7/2010 | Klingler |
| 7,762,931 | B2 | 7/2010 | Fisher et al. |
| 7,762,932 | B2 | 7/2010 | Hetrick |
| 7,762,934 | B1 | 7/2010 | Munson, Jr. et al. |
| 7,762,935 | B2 | 7/2010 | Doble |
| 7,762,952 | B2 | 7/2010 | Lee et al. |
| 7,764,641 | B2 | 7/2010 | Pelton et al. |
| 7,764,990 | B2 | 7/2010 | Martikka et al. |
| 7,765,348 | B2 | 7/2010 | Dybsetter |
| 7,766,793 | B2 | 8/2010 | Hashimoto |
| 7,766,794 | B2 | 8/2010 | Oliver et al. |
| 7,766,797 | B2 | 8/2010 | Dalebout |
| 7,766,798 | B2 | 8/2010 | Hamilton |
| 7,766,802 | B2 | 8/2010 | Webber et al. |
| 7,770,181 | B2 | 8/2010 | Snover et al. |
| 7,771,319 | B1 | 8/2010 | Lannon |
| 7,771,325 | B2 | 8/2010 | Baker |
| 7,771,329 | B2 | 8/2010 | Dalebout et al. |
| 7,771,330 | B2 | 8/2010 | Towley |
| 7,771,371 | B2 | 8/2010 | Avni |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,775,945 | B2 | 8/2010 | Smith |
| 7,775,949 | B2 | 8/2010 | Bowser |
| 7,775,952 | B1 | 8/2010 | Curran et al. |
| 7,775,953 | B2 | 8/2010 | Wang |
| 7,780,577 | B2 | 8/2010 | Arnold |
| 7,780,578 | B2 | 8/2010 | Packham |
| 7,780,583 | B2 | 8/2010 | Brown |
| 7,780,585 | B1 | 8/2010 | Rivas |
| 7,785,232 | B2 | 8/2010 | Cole et al. |
| 7,789,800 | B1 | 9/2010 | Watterson et al. |
| 7,789,806 | B2 | 9/2010 | Yang |
| 7,789,816 | B2 | 9/2010 | Krietzman |
| 7,794,014 | B2 | 9/2010 | Beall et al. |
| 7,794,363 | B2 | 9/2010 | Wang |
| 7,794,371 | B2 | 9/2010 | Webber et al. |
| 7,795,824 | B2 | 9/2010 | Shen et al. |
| 7,798,942 | B2 | 9/2010 | Digiulio |
| 7,798,946 | B2 | 9/2010 | Dalebout et al. |
| 7,803,096 | B2 | 9/2010 | Mehta |
| 7,805,149 | B2 | 9/2010 | Werner et al. |
| 7,805,186 | B2 | 9/2010 | Pulkkinen et al. |
| 7,806,006 | B2 | 10/2010 | Phillips et al. |
| 7,806,780 | B1 | 10/2010 | Plunkett |
| 7,806,805 | B2 | 10/2010 | Barufka et al. |
| 7,806,806 | B2 | 10/2010 | Jaquish |
| 7,806,815 | B2 | 10/2010 | Fernandez |
| 7,809,153 | B2 | 10/2010 | Bravomalo et al. |
| 7,811,200 | B2 | 10/2010 | Yin-Liang Lai |
| 7,811,201 | B1 | 10/2010 | Mikan et al. |
| 7,811,202 | B2 | 10/2010 | Planke |
| 7,811,209 | B2 | 10/2010 | Crawford et al. |
| 7,811,213 | B2 | 10/2010 | Chen |
| 7,813,715 | B2 | 10/2010 | McKillop et al. |
| 7,815,548 | B2 | 10/2010 | Barre et al. |
| 7,815,549 | B2 | 10/2010 | Crawford et al. |
| 7,815,550 | B2 | 10/2010 | Watterson et al. |
| 7,815,552 | B2 | 10/2010 | Dibble et al. |
| 7,815,554 | B2 | 10/2010 | Gibson et al. |
| 7,819,779 | B2 | 10/2010 | Chang |
| 7,819,784 | B1 | 10/2010 | Caswell et al. |
| 7,819,785 | B2 | 10/2010 | Maiaro et al. |
| 7,822,547 | B2 | 10/2010 | Lindroos |
| 7,825,319 | B2 | 11/2010 | Turner |
| 7,827,000 | B2 | 11/2010 | Stirling et al. |
| 7,828,699 | B2 | 11/2010 | P Erez De Lazarraga |
| 7,828,703 | B1 | 11/2010 | Boesch |
| 7,830,570 | B2 | 11/2010 | Morita et al. |
| 7,833,129 | B2 | 11/2010 | Badarneh |
| 7,833,135 | B2 | 11/2010 | Radow |
| 7,833,138 | B1 | 11/2010 | Fulks |
| 7,833,141 | B2 | 11/2010 | Kulka |
| 7,837,161 | B2 | 11/2010 | Chase |
| 7,837,595 | B2 | 11/2010 | Rice |
| 7,837,596 | B2 | 11/2010 | Astilean |
| 7,837,598 | B1 | 11/2010 | Boozel, Jr. |
| 7,837,599 | B2 | 11/2010 | Kowalczewski et al. |
| 7,837,602 | B1 | 11/2010 | Drybread |
| 7,837,603 | B1 | 11/2010 | Carnell, Sr. |
| 7,839,058 | B1 | 11/2010 | Churchill et al. |
| 7,840,346 | B2 | 11/2010 | Huhtala et al. |
| 7,841,967 | B1 | 11/2010 | Kahn |
| 7,841,971 | B2 | 11/2010 | Smith |
| 7,841,973 | B2 | 11/2010 | Trancart |
| 7,842,038 | B2 | 11/2010 | Haddock et al. |
| 7,846,067 | B2 | 12/2010 | Hanoun |
| 7,846,070 | B2 | 12/2010 | Oglesby et al. |
| 7,846,080 | B2 | 12/2010 | Boren |
| 7,850,514 | B2 | 12/2010 | Weber |
| 7,850,537 | B2 | 12/2010 | Stern |
| 7,850,584 | B2 | 12/2010 | Uygan |
| 7,854,669 | B2 | 12/2010 | Marty et al. |

(56) References Cited

U.S. PATENT DOCUMENTS

| | | | |
|---|---|---|---|
| 7,854,690 | B2 | 12/2010 | Trevino et al. |
| 7,857,731 | B2 | 12/2010 | Hickman et al. |
| 7,857,732 | B2 | 12/2010 | Nielson |
| 7,857,736 | B2 | 12/2010 | Merrithew et al. |
| 7,862,475 | B2 | 1/2011 | Watterson |
| 7,862,476 | B2 | 1/2011 | Radow |
| 7,862,478 | B2 | 1/2011 | Watterson et al. |
| 7,862,483 | B2 | 1/2011 | Hendrickson et al. |
| 7,862,486 | B1 | 1/2011 | Watson |
| 7,862,487 | B2 | 1/2011 | Olson |
| 7,862,489 | B2 | 1/2011 | Savsek et al. |
| 7,867,088 | B2 | 1/2011 | Prum |
| 7,867,153 | B2 | 1/2011 | Roman |
| 7,871,355 | B2 | 1/2011 | Yeh |
| 7,871,357 | B2 | 1/2011 | Gibson et al. |
| 7,873,849 | B2 | 1/2011 | Mucignat et al. |
| 7,874,957 | B2 | 1/2011 | Hurwitz et al. |
| 7,874,961 | B2 | 1/2011 | McKee et al. |
| 7,874,963 | B2 | 1/2011 | Grind |
| 7,874,971 | B2 | 1/2011 | Reyes |
| 7,878,950 | B1 | 2/2011 | Bastian |
| 7,878,953 | B2 | 2/2011 | Webber et al. |
| 7,878,956 | B2 | 2/2011 | Kadar |
| 7,883,445 | B2 | 2/2011 | Olrik et al. |
| 7,883,448 | B2 | 2/2011 | Wang |
| 7,887,465 | B2 | 2/2011 | Uffelman |
| 7,887,468 | B2 | 2/2011 | Ross et al. |
| 7,887,469 | B1 | 2/2011 | Chen |
| 7,887,470 | B2 | 2/2011 | Chen |
| 7,887,471 | B2 | 2/2011 | Mcsorley |
| 7,892,148 | B1 | 2/2011 | Stauffer et al. |
| 7,892,149 | B2 | 2/2011 | Wu |
| 7,892,150 | B1 | 2/2011 | Colley |
| 7,892,155 | B2 | 2/2011 | Pearson et al. |
| 7,892,159 | B2 | 2/2011 | McVay et al. |
| 7,894,177 | B2 | 2/2011 | Rothkopf |
| 7,894,849 | B2 | 2/2011 | Kass et al. |
| 7,896,782 | B2 | 3/2011 | Tamari |
| 7,900,324 | B2 | 3/2011 | Ginocchio |
| 7,901,292 | B1 | 3/2011 | Uhlir et al. |
| 7,901,323 | B2 | 3/2011 | Olason et al. |
| 7,901,324 | B2 | 3/2011 | Kodama |
| 7,901,325 | B2 | 3/2011 | Henderson |
| 7,901,335 | B2 | 3/2011 | Webber et al. |
| 7,901,753 | B2 | 3/2011 | Carr |
| 7,905,817 | B2 | 3/2011 | Giannascoli et al. |
| 7,905,819 | B2 | 3/2011 | Alessandri et al. |
| 7,908,981 | B2 | 3/2011 | Agee |
| 7,909,740 | B2 | 3/2011 | Dalebout et al. |
| 7,909,741 | B2 | 3/2011 | Kim et al. |
| 7,909,742 | B2 | 3/2011 | Ish, III et al. |
| 7,909,743 | B1 | 3/2011 | Webber |
| 7,909,745 | B2 | 3/2011 | Mills et al. |
| 7,913,297 | B2 | 3/2011 | Wyld |
| 7,914,420 | B2 | 3/2011 | Daly et al. |
| 7,914,421 | B2 | 3/2011 | Weier et al. |
| 7,914,425 | B2 | 3/2011 | Hanoun |
| 7,914,468 | B2 | 3/2011 | Shalon et al. |
| 7,917,148 | B2 | 3/2011 | Rosenberg |
| 7,918,732 | B2 | 4/2011 | Van Noland |
| 7,918,768 | B2 | 4/2011 | Rogozinski |
| 7,918,769 | B2 | 4/2011 | Lamarque |
| 7,919,950 | B2 | 4/2011 | Uno et al. |
| 7,922,621 | B1 | 4/2011 | Hamada et al. |
| 7,922,631 | B2 | 4/2011 | Ish, III |
| 7,922,632 | B2 | 4/2011 | Chou |
| 7,922,633 | B2 | 4/2011 | Januszek |
| 7,922,635 | B2 | 4/2011 | Lull et al. |
| 7,927,253 | B2 | 4/2011 | Vincent |
| 7,927,257 | B2 | 4/2011 | Patel |
| 7,927,258 | B2 | 4/2011 | Irving et al. |
| 7,927,267 | B2 | 4/2011 | Splane |
| 7,931,563 | B2 | 4/2011 | Shaw et al. |
| 7,931,570 | B2 | 4/2011 | Hoffman |
| 7,934,983 | B1 | 5/2011 | Eisner |
| 7,935,026 | B2 | 5/2011 | Mcsorley |
| 7,935,032 | B1 | 5/2011 | Jackson |
| 7,935,038 | B2 | 5/2011 | Tyree |
| 7,938,751 | B2 | 5/2011 | Nicolas et al. |
| 7,938,752 | B1 | 5/2011 | Wang |
| 7,938,755 | B1 | 5/2011 | Dyer et al. |
| 7,938,760 | B1 | 5/2011 | Webber et al. |
| 7,938,761 | B2 | 5/2011 | Simonson |
| 7,941,945 | B2 | 5/2011 | Gerber |
| 7,942,783 | B2 | 5/2011 | Ochi |
| 7,942,788 | B2 | 5/2011 | Wu |
| 7,942,793 | B2 | 5/2011 | Mills et al. |
| 7,946,959 | B2 | 5/2011 | Shum et al. |
| 7,946,961 | B2 | 5/2011 | Blum et al. |
| 7,946,967 | B2 | 5/2011 | Berhanu |
| 7,946,968 | B2 | 5/2011 | Kjellberg |
| 7,949,295 | B2 | 5/2011 | Kumar et al. |
| 7,950,297 | B2 | 5/2011 | Moore et al. |
| 7,951,046 | B1 | 5/2011 | Barber, Jr. |
| 7,953,549 | B2 | 5/2011 | Graham et al. |
| 7,955,219 | B2 | 6/2011 | Birrell et al. |
| 7,955,235 | B2 | 6/2011 | Keiser |
| 7,959,124 | B2 | 6/2011 | Phifer et al. |
| 7,959,567 | B2 | 6/2011 | Stivoric et al. |
| 7,963,889 | B2 | 6/2011 | Badarneh et al. |
| 7,963,890 | B2 | 6/2011 | Webber et al. |
| 7,963,892 | B2 | 6/2011 | Poblete Castro et al. |
| 7,967,728 | B2 | 6/2011 | Zavadsky |
| 7,967,730 | B2 | 6/2011 | Crawford et al. |
| 7,967,734 | B1 | 6/2011 | Damian |
| 7,968,574 | B2 | 6/2011 | Hangauer, Jr. |
| 7,972,245 | B2 | 7/2011 | Temple et al. |
| 7,972,247 | B2 | 7/2011 | Daikeler |
| 7,972,249 | B1 | 7/2011 | Napalan |
| 7,973,231 | B2 | 7/2011 | Bowen |
| 7,974,889 | B2 | 7/2011 | Raimbeault |
| 7,976,437 | B1 | 7/2011 | Von Detten |
| 7,976,440 | B2 | 7/2011 | Webber et al. |
| 7,976,443 | B2 | 7/2011 | Krull |
| 7,976,445 | B2 | 7/2011 | Lalaoua |
| 7,976,518 | B2 | 7/2011 | Shaughnessy et al. |
| 7,978,081 | B2 | 7/2011 | Shears et al. |
| 7,980,996 | B2 | 7/2011 | Hickman |
| 7,981,000 | B2 | 7/2011 | Watterson et al. |
| 7,981,010 | B1 | 7/2011 | Webber et al. |
| 7,981,011 | B1 | 7/2011 | Batca |
| 7,981,012 | B1 | 7/2011 | Krull |
| 7,981,013 | B2 | 7/2011 | Krull |
| 7,985,164 | B2 | 7/2011 | Ashby |
| 7,985,166 | B2 | 7/2011 | Farnsworth et al. |
| 7,985,167 | B2 | 7/2011 | Nizam |
| 7,988,598 | B2 | 8/2011 | Trzecieski |
| 7,988,599 | B2 | 8/2011 | Ainsworth et al. |
| 7,988,600 | B2 | 8/2011 | Rodgers, Jr. |
| 7,988,604 | B2 | 8/2011 | Barnett |
| 7,988,605 | B1 | 8/2011 | Wyeroski |
| 7,992,879 | B2 | 8/2011 | Eisenberg et al. |
| 7,993,251 | B1 | 8/2011 | Webber et al. |
| 7,998,036 | B2 | 8/2011 | Ish, III |
| 7,998,038 | B2 | 8/2011 | Keiser |
| 7,998,042 | B2 | 8/2011 | Bowser et al. |
| 8,001,472 | B2 | 8/2011 | Gilley et al. |
| 8,002,671 | B1 | 8/2011 | Vigilia |
| 8,002,674 | B2 | 8/2011 | Piaget et al. |
| 8,002,678 | B1 | 8/2011 | Krull |
| 8,002,684 | B2 | 8/2011 | Laurent |
| 8,006,574 | B2 | 8/2011 | Meyer |
| 8,006,711 | B2 | 8/2011 | Pietrzak et al. |
| 8,007,407 | B2 | 8/2011 | Richter |
| 8,007,409 | B2 | 8/2011 | Elllis |
| 8,007,413 | B1 | 8/2011 | Wu |
| 8,007,415 | B1 | 8/2011 | Lundquist |
| 8,007,416 | B2 | 8/2011 | Arlie |
| 8,007,422 | B2 | 8/2011 | Zaccherini |
| 8,009,045 | B2 | 8/2011 | Cehelnik |
| RE42,698 | E | 9/2011 | Kuo et al. |
| 8,011,242 | B2 | 9/2011 | O'neill |
| 8,012,003 | B2 | 9/2011 | Sterchi et al. |
| 8,012,064 | B2 | 9/2011 | Martens |

(56) References Cited

U.S. PATENT DOCUMENTS

| | | | |
|---|---|---|---|
| 8,012,067 | B2 | 9/2011 | Joannou |
| 8,012,068 | B1 | 9/2011 | Malcolm |
| 8,012,071 | B2 | 9/2011 | Grisdale |
| 8,012,073 | B2 | 9/2011 | Barnett |
| 8,021,270 | B2 | 9/2011 | Eredita |
| 8,021,277 | B2 | 9/2011 | Baudhuin |
| 8,021,285 | B2 | 9/2011 | Kushnir |
| 8,025,607 | B2 | 9/2011 | Ranky et al. |
| 8,025,609 | B2 | 9/2011 | Giannelli et al. |
| 8,025,612 | B1 | 9/2011 | Buzzanco |
| 8,025,613 | B1 | 9/2011 | Wang |
| 8,028,443 | B2 | 10/2011 | Case, Jr. |
| 8,029,415 | B2 | 10/2011 | Ashby et al. |
| 8,029,418 | B2 | 10/2011 | Nishimura |
| 8,029,425 | B2 | 10/2011 | Bronston et al. |
| 8,033,959 | B2 | 10/2011 | Oleson et al. |
| 8,033,960 | B1 | 10/2011 | Dalebout et al. |
| 8,033,965 | B1 | 10/2011 | Krull |
| 8,033,967 | B2 | 10/2011 | Canali |
| 8,034,294 | B1 | 10/2011 | Goldberg |
| 8,037,017 | B2 | 10/2011 | Samn |
| 8,037,574 | B2 | 10/2011 | Chase |
| 8,038,117 | B2 | 10/2011 | Chen et al. |
| 8,038,577 | B2 | 10/2011 | Mcintosh |
| 8,040,117 | B2 | 10/2011 | Telefus |
| 8,040,758 | B1 | 10/2011 | Dickinson |
| 8,043,173 | B2 | 10/2011 | Menalagha et al. |
| 8,043,198 | B2 | 10/2011 | Zhou |
| 8,046,803 | B1 | 10/2011 | Lee |
| 8,047,965 | B2 | 11/2011 | Shea |
| 8,047,966 | B2 | 11/2011 | Dorogusker et al. |
| 8,047,970 | B2 | 11/2011 | Nalley |
| 8,052,580 | B2 | 11/2011 | Saalasti et al. |
| 8,052,584 | B2 | 11/2011 | Keiser |
| 8,055,469 | B2 | 11/2011 | Kulach et al. |
| 8,056,687 | B2 | 11/2011 | Golden et al. |
| 8,057,360 | B2 | 11/2011 | Shea |
| 8,057,361 | B2 | 11/2011 | McBride et al. |
| 8,057,366 | B2 | 11/2011 | Schippers |
| 8,057,367 | B2 | 11/2011 | Giannelli et al. |
| 8,057,368 | B1 | 11/2011 | Lyszczarz |
| 8,062,182 | B2 | 11/2011 | Somers |
| 8,062,192 | B1 | 11/2011 | Arstein |
| 8,062,196 | B1 | 11/2011 | Khubani |
| 8,063,776 | B2 | 11/2011 | Ruha |
| 8,065,185 | B2 | 11/2011 | Foladare et al. |
| 8,065,926 | B2 | 11/2011 | Meyer |
| 8,066,514 | B2 | 11/2011 | Clarke |
| 8,070,655 | B1 | 12/2011 | Napolitano |
| 8,070,657 | B2 | 12/2011 | Loach |
| 8,070,658 | B2 | 12/2011 | Giannelli et al. |
| 8,072,902 | B2 | 12/2011 | Moon |
| 8,075,453 | B1 | 12/2011 | Wilkinson |
| 8,078,426 | B2 | 12/2011 | Pipinich et al. |
| 8,079,273 | B2 | 12/2011 | Svenberg |
| 8,079,937 | B2 | 12/2011 | Bedell |
| 8,079,939 | B1 | 12/2011 | Wang |
| 8,079,941 | B2 | 12/2011 | Nortje |
| 8,082,029 | B2 | 12/2011 | Honda |
| 8,083,643 | B2 | 12/2011 | Ng et al. |
| 8,083,645 | B2 | 12/2011 | Asukai et al. |
| 8,083,693 | B1 | 12/2011 | McKeon et al. |
| 8,086,421 | B2 | 12/2011 | Case, Jr. et al. |
| 8,088,043 | B2 | 1/2012 | Andren et al. |
| 8,088,044 | B2 | 1/2012 | Tchao et al. |
| 8,092,351 | B1 | 1/2012 | Rodgers, Jr. |
| 8,092,352 | B2 | 1/2012 | Irving et al. |
| 8,092,381 | B2 | 1/2012 | Edwards |
| 8,096,925 | B2 | 1/2012 | Radding et al. |
| 8,096,926 | B1 | 1/2012 | Batca |
| 8,101,843 | B2 | 1/2012 | Turner |
| 8,103,379 | B2 | 1/2012 | Biba et al. |
| 8,103,517 | B2 | 1/2012 | Hinnebusch |
| 8,104,411 | B2 | 1/2012 | Fenton |
| 8,104,987 | B2 | 1/2012 | Johnson |
| 8,105,207 | B1 | 1/2012 | Lannon |
| 8,105,213 | B2 | 1/2012 | Stewart et al. |
| 8,106,563 | B2 | 1/2012 | Ritchey |
| 8,109,858 | B2 | 2/2012 | Redmann |
| 8,109,864 | B2 | 2/2012 | Tseng |
| 8,111,166 | B2 | 2/2012 | Flexer et al. |
| 8,112,281 | B2 | 2/2012 | Yeung et al. |
| 8,113,990 | B2 | 2/2012 | Kolman et al. |
| 8,113,991 | B2 | 2/2012 | Kutliroff |
| 8,113,994 | B2 | 2/2012 | Piaget et al. |
| 8,116,841 | B2 | 2/2012 | Bly et al. |
| 8,118,709 | B2 | 2/2012 | Mckirdy |
| 8,118,888 | B2 | 2/2012 | Molter |
| 8,121,785 | B2 | 2/2012 | Swisher et al. |
| 8,123,527 | B2 | 2/2012 | Holljes |
| 8,128,533 | B2 | 3/2012 | Nakagawa et al. |
| 8,128,537 | B2 | 3/2012 | Signorile et al. |
| 8,141,276 | B2 | 3/2012 | Ellis |
| 8,142,298 | B2 | 3/2012 | King et al. |
| 8,142,370 | B2 | 3/2012 | Weinberg et al. |
| 8,147,385 | B2 | 4/2012 | Crawford et al. |
| 8,147,386 | B2 | 4/2012 | Farnsworth et al. |
| 8,152,693 | B2 | 4/2012 | Nurmela et al. |
| 8,152,695 | B2 | 4/2012 | Riley et al. |
| 8,152,702 | B2 | 4/2012 | Pacheco |
| 8,157,706 | B2 | 4/2012 | Ainsworth et al. |
| 8,157,731 | B2 | 4/2012 | Teller et al. |
| 8,162,769 | B2 | 4/2012 | Henry |
| 8,162,804 | B2 | 4/2012 | Tagliabue |
| 8,162,857 | B2 | 4/2012 | Lanfermann et al. |
| 8,165,893 | B1 | 4/2012 | Goldberg et al. |
| 8,167,776 | B2 | 5/2012 | Lannon |
| 8,167,899 | B2 | 5/2012 | Justis et al. |
| 8,172,723 | B1 | 5/2012 | Yanev et al. |
| 8,172,729 | B2 | 5/2012 | Ellis |
| 8,172,882 | B2 | 5/2012 | Klyce et al. |
| 8,173,087 | B2 | 5/2012 | Wei et al. |
| 8,176,101 | B2 | 5/2012 | Rosenberg |
| 8,177,688 | B2 | 5/2012 | Burnfield et al. |
| 8,177,693 | B2 | 5/2012 | Webber et al. |
| 8,182,399 | B2 | 5/2012 | Davis et al. |
| 8,188,700 | B2 | 5/2012 | Tseng et al. |
| 8,188,868 | B2 | 5/2012 | Case, Jr. |
| 8,192,332 | B2 | 6/2012 | Baker et al. |
| 8,192,337 | B2 | 6/2012 | Birch |
| 8,192,338 | B2 | 6/2012 | Solow |
| 8,197,392 | B2 | 6/2012 | Silverman et al. |
| 8,200,323 | B2 | 6/2012 | Dibenedetto et al. |
| 8,206,266 | B2 | 6/2012 | Hall |
| 8,206,274 | B2 | 6/2012 | Svenberg et al. |
| 8,210,995 | B2 | 7/2012 | Reyes |
| 8,212,445 | B2 | 7/2012 | Ritchey |
| 8,213,908 | B2 | 7/2012 | Sangster et al. |
| 8,215,886 | B2 | 7/2012 | Campbell |
| 8,221,290 | B2 | 7/2012 | Vincent et al. |
| 8,221,292 | B2 | 7/2012 | Barker et al. |
| 8,221,295 | B2 | 7/2012 | Wilkins |
| 8,224,429 | B2 | 7/2012 | Prstojevich et al. |
| 8,225,024 | B2 | 7/2012 | Dybsetter |
| 8,231,506 | B2 | 7/2012 | Molyneux et al. |
| 8,235,724 | B2 | 8/2012 | Gilley et al. |
| 8,235,876 | B2 | 8/2012 | Reyes |
| 8,240,430 | B2 | 8/2012 | Downey |
| 8,241,118 | B2 | 8/2012 | Camhi |
| 8,241,182 | B2 | 8/2012 | Julskjaer et al. |
| 8,241,186 | B2 | 8/2012 | Brodess et al. |
| 8,241,187 | B2 | 8/2012 | Moon et al. |
| 8,249,686 | B2 | 8/2012 | Libbus et al. |
| 8,249,714 | B1 | 8/2012 | Hartman et al. |
| 8,251,874 | B2 | 8/2012 | Ashby et al. |
| 8,251,877 | B2 | 8/2012 | Rasmussen et al. |
| 8,253,586 | B1 | 8/2012 | Matak |
| 8,257,228 | B2 | 9/2012 | Quatrochi et al. |
| 8,260,667 | B2 | 9/2012 | Graham et al. |
| 8,260,858 | B2 | 9/2012 | Belz et al. |
| 8,262,546 | B1 | 9/2012 | Lashinske |
| 8,269,093 | B2 | 9/2012 | Naik et al. |
| 8,272,996 | B2 | 9/2012 | Weier |
| 8,275,143 | B2 | 9/2012 | Johnson |

(56) References Cited

U.S. PATENT DOCUMENTS

| | | | |
|---|---|---|---|
| 8,275,265 | B2 | 9/2012 | Kobyakov et al. |
| 8,276,434 | B2 | 10/2012 | Senoo |
| 8,280,259 | B2 | 10/2012 | George et al. |
| 8,286,954 | B2 | 10/2012 | Zheng |
| 8,287,434 | B2 | 10/2012 | Zavadsky et al. |
| 8,296,172 | B2 | 10/2012 | Marci et al. |
| 8,298,123 | B2 | 10/2012 | Hickman |
| 8,298,125 | B2 | 10/2012 | Colledge et al. |
| 8,302,213 | B2 | 11/2012 | Kriesel |
| 8,303,472 | B2 | 11/2012 | Bowser |
| 8,306,635 | B2 | 11/2012 | Pryor |
| 8,308,620 | B2 | 11/2012 | Lyszczarz |
| 8,308,794 | B2 | 11/2012 | Martinson et al. |
| 8,309,870 | B2 | 11/2012 | Peterson et al. |
| 8,310,468 | B2 | 11/2012 | Martin |
| 8,314,840 | B1 | 11/2012 | Funk |
| 8,315,636 | B2 | 11/2012 | Moon et al. |
| 8,315,823 | B2 | 11/2012 | Berme et al. |
| 8,317,659 | B2 | 11/2012 | Woodson |
| 8,317,663 | B2 | 11/2012 | Stewart et al. |
| 8,320,578 | B2 | 11/2012 | Kahn et al. |
| 8,321,004 | B2 | 11/2012 | Moon et al. |
| 8,323,156 | B2 | 12/2012 | Ozawa et al. |
| 8,323,157 | B2 | 12/2012 | Campanaro et al. |
| 8,323,159 | B2 | 12/2012 | Perry |
| 8,329,265 | B2 | 12/2012 | Cook |
| 8,332,544 | B1 | 12/2012 | Ralls et al. |
| 8,333,681 | B2 | 12/2012 | Schmidt |
| 8,337,335 | B2 | 12/2012 | Dugan |
| 8,341,557 | B2 | 12/2012 | Pisula et al. |
| 8,343,016 | B1 | 1/2013 | Astilean |
| 8,348,811 | B2 | 1/2013 | Kamins |
| 8,348,840 | B2 | 1/2013 | Heit et al. |
| 8,359,954 | B2 | 1/2013 | Johnson et al. |
| 8,360,785 | B2 | 1/2013 | Park et al. |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,363,913 | B2 | 1/2013 | Boushey et al. |
| 8,364,250 | B2 | 1/2013 | Moon et al. |
| 8,364,389 | B2 | 1/2013 | Dorogusker et al. |
| 8,368,329 | B1 | 2/2013 | Depew et al. |
| 8,369,936 | B2 | 2/2013 | Farringdon et al. |
| 8,371,990 | B2 | 2/2013 | Shea |
| 8,374,688 | B2 | 2/2013 | Libbus et al. |
| 8,376,910 | B2 | 2/2013 | Cheung et al. |
| 8,376,911 | B2 | 2/2013 | Ogg et al. |
| 8,378,647 | B2 | 2/2013 | Yonezawa et al. |
| 8,384,551 | B2 | 2/2013 | Ross et al. |
| 8,394,004 | B2 | 3/2013 | Towley, III |
| 8,394,005 | B2 | 3/2013 | Solow et al. |
| 8,395,366 | B2 | 3/2013 | Uno |
| 8,398,529 | B2 | 3/2013 | Ellis |
| 8,398,546 | B2 | 3/2013 | Pacione et al. |
| 8,403,816 | B2 | 3/2013 | Park |
| 8,403,845 | B2 | 3/2013 | Stivoric et al. |
| 8,407,623 | B2 | 3/2013 | Kerr et al. |
| 8,412,317 | B2 | 4/2013 | Mazar |
| 8,419,593 | B2 | 4/2013 | Ainsworth et al. |
| 8,429,223 | B2 | 4/2013 | Gilley et al. |
| 8,430,770 | B2 | 4/2013 | Dugan |
| 8,435,160 | B1 | 5/2013 | Clum |
| 8,437,824 | B2 | 5/2013 | Moon et al. |
| 8,444,537 | B1 | 5/2013 | Santoro |
| 8,446,275 | B2 | 5/2013 | Utter, II |
| 8,449,620 | B2 | 5/2013 | Hakansson et al. |
| 8,452,259 | B2 | 5/2013 | Ellis et al. |
| 8,454,437 | B2 | 6/2013 | Dugan |
| 8,454,483 | B1 | 6/2013 | Bradley et al. |
| 8,459,479 | B2 | 6/2013 | Yourist |
| 8,460,001 | B1 | 6/2013 | Chuang |
| 8,460,189 | B2 | 6/2013 | Libbus et al. |
| 8,467,979 | B2 | 6/2013 | Sobolewski |
| 8,470,190 | B2 | 6/2013 | Jeanne et al. |
| 8,475,338 | B2 | 7/2013 | Greenhill et al. |
| 8,475,346 | B2 | 7/2013 | Gerschefske et al. |
| 8,475,367 | B1 | 7/2013 | Yuen et al. |
| 8,475,370 | B2 | 7/2013 | McCombie et al. |
| 8,480,541 | B1 | 7/2013 | Brunts |
| 8,485,576 | B2 | 7/2013 | Melville et al. |
| 8,485,944 | B2 | 7/2013 | Drazan |
| 8,485,945 | B2 | 7/2013 | Leonhard |
| 8,485,946 | B2 | 7/2013 | Ross et al. |
| 8,485,947 | B2 | 7/2013 | Nizam |
| 8,485,950 | B2 | 7/2013 | Adams |
| 8,485,953 | B2 | 7/2013 | Chou |
| 8,485,982 | B2 | 7/2013 | Gavish et al. |
| 8,485,996 | B2 | 7/2013 | Bluman |
| 8,487,759 | B2 | 7/2013 | Hill |
| 8,491,446 | B2 | 7/2013 | Hinds et al. |
| 8,491,572 | B2 | 7/2013 | Martinson et al. |
| 8,493,757 | B2 | 7/2013 | Carletti et al. |
| 8,493,822 | B2 | 7/2013 | Lee et al. |
| 8,500,607 | B2 | 8/2013 | Vittone |
| 8,500,608 | B1 | 8/2013 | Bonomi |
| 8,503,086 | B2 | 8/2013 | French et al. |
| 8,505,597 | B2 | 8/2013 | Sharperson |
| 8,506,370 | B2 | 8/2013 | Homsi |
| 8,506,457 | B2 | 8/2013 | Baudhuin |
| 8,506,458 | B2 | 8/2013 | Dugan |
| 8,506,459 | B2 | 8/2013 | Cassidy et al. |
| 8,512,209 | B2 | 8/2013 | Guidi et al. |
| 8,512,210 | B2 | 8/2013 | Shauli |
| 8,512,212 | B2 | 8/2013 | Ish, III |
| 8,515,930 | B2 | 8/2013 | Hong |
| 8,516,723 | B2 | 8/2013 | Ferrigan et al. |
| 8,517,895 | B2 | 8/2013 | Shalev |
| 8,517,896 | B2 | 8/2013 | Robinette et al. |
| 8,517,899 | B2 | 8/2013 | Zhou |
| 8,523,743 | B1 | 9/2013 | Miles et al. |
| 8,523,789 | B2 | 9/2013 | Keiser |
| 8,527,038 | B2 | 9/2013 | Moon et al. |
| 8,527,101 | B2 | 9/2013 | Burris et al. |
| 8,529,414 | B2 | 9/2013 | Hobson |
| 8,529,415 | B2 | 9/2013 | Svenberg |
| 8,531,386 | B1 | 9/2013 | Hertz |
| 8,533,007 | B2 | 9/2013 | Egami et al. |
| 8,533,620 | B2 | 9/2013 | Hoffman et al. |
| 8,535,204 | B2 | 9/2013 | Stacey |
| 8,535,247 | B2 | 9/2013 | Williams |
| 8,537,017 | B2 | 9/2013 | Mack et al. |
| 8,538,333 | B2 | 9/2013 | Jain et al. |
| 8,538,723 | B2 | 9/2013 | Chang |
| 8,540,560 | B2 | 9/2013 | Crowley et al. |
| 8,540,607 | B2 | 9/2013 | Kissel et al. |
| 8,540,641 | B2 | 9/2013 | Kroll et al. |
| 8,543,185 | B2 | 9/2013 | Yuen et al. |
| 8,545,417 | B2 | 10/2013 | Banet et al. |
| 8,550,962 | B2 | 10/2013 | Piaget et al. |
| 8,550,964 | B2 | 10/2013 | Ish, III et al. |
| 8,552,859 | B2 | 10/2013 | Pakula et al. |
| 8,554,214 | B2 | 10/2013 | Sweeney et al. |
| 8,554,802 | B1 | 10/2013 | Barden et al. |
| 8,556,090 | B2 | 10/2013 | Chen |
| 8,556,216 | B2 | 10/2013 | Bandera |
| 8,556,778 | B1 | 10/2013 | Dugan |
| 8,556,780 | B2 | 10/2013 | Chen |
| 8,560,951 | B1 | 10/2013 | Snyder et al. |
| 8,562,489 | B2 | 10/2013 | Burton et al. |
| 8,562,496 | B2 | 10/2013 | Webber et al. |
| 8,564,235 | B2 | 10/2013 | Burris et al. |
| 8,568,278 | B2 | 10/2013 | Riley et al. |
| 8,568,279 | B2 | 10/2013 | Golesh |
| 8,568,280 | B2 | 10/2013 | Mendoza |
| 8,568,281 | B2 | 10/2013 | Beaulieu et al. |
| 8,569,963 | B2 | 10/2013 | Walters |
| 8,571,250 | B2 | 10/2013 | Royer |
| 8,571,880 | B2 | 10/2013 | Goldberg |
| 8,572,576 | B2 | 10/2013 | Elvanoglu et al. |
| 8,572,764 | B2 | 11/2013 | Thellmann |
| 8,572,820 | B2 | 11/2013 | Richards |
| 8,573,572 | B2 | 11/2013 | Bowen et al. |
| 8,573,982 | B1 | 11/2013 | Chuang |
| 8,574,131 | B2 | 11/2013 | Daly |

(56) References Cited

U.S. PATENT DOCUMENTS

| | | | |
|---|---|---|---|
| 8,579,767 | B2 | 11/2013 | Ellis et al. |
| 8,585,561 | B2 | 11/2013 | Watt et al. |
| 8,588,476 | B1 | 11/2013 | Spicola, Jr. |
| 8,590,120 | B2 | 11/2013 | Sakai |
| 8,591,386 | B2 | 11/2013 | Meyer |
| 8,591,387 | B2 | 11/2013 | Fife |
| 8,591,411 | B2 | 11/2013 | Banet et al. |
| 8,594,772 | B2 | 11/2013 | Eggenberger et al. |
| RE44,650 | E | 12/2013 | Anderson |
| 8,597,093 | B2 | 12/2013 | Engelberg et al. |
| 8,602,951 | B2 | 12/2013 | Morris |
| 8,602,997 | B2 | 12/2013 | Banet et al. |
| 8,605,048 | B2 | 12/2013 | Ye et al. |
| 8,607,562 | B2 | 12/2013 | Browne |
| 8,608,624 | B2 | 12/2013 | Shabodyash et al. |
| 8,610,593 | B2 | 12/2013 | Van Acht et al. |
| 8,613,689 | B2 | 12/2013 | Dyer et al. |
| 8,614,595 | B2 | 12/2013 | Acatrinei |
| 8,614,902 | B2 | 12/2013 | Pansier et al. |
| 8,615,377 | B1 | 12/2013 | Yuen et al. |
| 8,617,008 | B2 | 12/2013 | Marty et al. |
| 8,622,747 | B2 | 1/2014 | Chu et al. |
| 8,622,873 | B2 | 1/2014 | Mcgown |
| 8,628,333 | B2 | 1/2014 | Prinzel, III et al. |
| 8,628,453 | B2 | 1/2014 | Balakrishnan et al. |
| 8,631,544 | B1 | 1/2014 | Shotey et al. |
| 8,639,020 | B1 | 1/2014 | Kutliroff et al. |
| 8,647,239 | B1 | 2/2014 | Sokolovas |
| 8,647,240 | B2 | 2/2014 | Heidecke |
| 8,649,890 | B2 | 2/2014 | Martin |
| 8,651,030 | B2 | 2/2014 | Coffman |
| 8,652,010 | B2 | 2/2014 | Ellis et al. |
| 8,654,198 | B2 | 2/2014 | Pryor |
| 8,655,004 | B2 | 2/2014 | Prest et al. |
| 8,657,724 | B2 | 2/2014 | Yang |
| 8,662,901 | B2 | 3/2014 | Tzao et al. |
| 8,663,106 | B2 | 3/2014 | Stivoric et al. |
| 8,667,194 | B2 | 3/2014 | Dybsetter et al. |
| 8,668,630 | B2 | 3/2014 | Towley, III |
| 8,670,222 | B2 | 3/2014 | Rothkopf |
| 8,671,853 | B2 | 3/2014 | Flaherty |
| 8,672,852 | B2 | 3/2014 | Gavish |
| 8,676,170 | B2 | 3/2014 | Porrati et al. |
| 8,676,541 | B2 | 3/2014 | Schrock et al. |
| 8,678,897 | B2 | 3/2014 | Englert et al. |
| 8,678,979 | B2 | 3/2014 | Stark et al. |
| 8,684,925 | B2 | 4/2014 | Manicka et al. |
| 8,690,578 | B1 | 4/2014 | Nusbaum et al. |
| 8,690,735 | B2 | 4/2014 | Watterson et al. |
| 8,690,738 | B1 | 4/2014 | Astilian |
| 8,690,740 | B2 | 4/2014 | Yu |
| 8,696,527 | B2 | 4/2014 | Wu |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,702,574 | B2 | 4/2014 | Abranchess |
| 8,704,068 | B2 | 4/2014 | Bowen |
| 8,706,530 | B2 | 4/2014 | Ohnemus et al. |
| 8,708,842 | B2 | 4/2014 | Ganuza |
| 8,708,870 | B2 | 4/2014 | Nalley |
| 8,708,872 | B2 | 4/2014 | Giannelli et al. |
| 8,712,510 | B2 | 4/2014 | Quy |
| 8,714,346 | B2 | 5/2014 | Freitag |
| 8,715,140 | B1 | 5/2014 | Gertz |
| 8,715,143 | B2 | 5/2014 | Svenberg |
| 8,718,752 | B2 | 5/2014 | Libbus et al. |
| 8,719,202 | B1 | 5/2014 | Maeng |
| 8,721,507 | B2 | 5/2014 | Blancher |
| 8,727,946 | B2 | 5/2014 | Greenhill et al. |
| 8,727,947 | B2 | 5/2014 | Tagliabue |
| 8,734,157 | B1 | 5/2014 | Hummel, III |
| 8,734,296 | B1 | 5/2014 | Brumback et al. |
| 8,734,301 | B2 | 5/2014 | Remelius |
| 8,734,302 | B2 | 5/2014 | Hsieh |
| 8,734,304 | B2 | 5/2014 | Webber et al. |
| 8,734,308 | B1 | 5/2014 | Joslin |
| 8,738,321 | B2 | 5/2014 | Yuen et al. |
| 8,738,732 | B2 | 5/2014 | Karidi |
| 8,739,974 | B2 | 6/2014 | TeVault et al. |
| 8,740,751 | B2 | 6/2014 | Shum |
| 8,740,753 | B2 | 6/2014 | Olson et al. |
| 8,740,756 | B2 | 6/2014 | Shabodyash et al. |
| 8,740,802 | B2 | 6/2014 | Banet et al. |
| 8,740,807 | B2 | 6/2014 | Banet et al. |
| 8,744,803 | B2 | 6/2014 | Park et al. |
| 8,745,104 | B1 | 6/2014 | Rosenberg |
| 8,745,496 | B2 | 6/2014 | Gilley et al. |
| 8,747,330 | B2 | 6/2014 | Banet et al. |
| 8,749,380 | B2 | 6/2014 | Vock et al. |
| 8,758,201 | B2 | 6/2014 | Ashby et al. |
| 8,762,077 | B2 | 6/2014 | Redmond |
| 8,762,101 | B2 | 6/2014 | Yuen et al. |
| 8,762,167 | B2 | 6/2014 | Blander et al. |
| 8,762,313 | B2 | 6/2014 | Lahav et al. |
| 8,764,609 | B1 | 7/2014 | Elahmadie |
| 8,764,651 | B2 | 7/2014 | Tran |
| 8,768,769 | B2 | 7/2014 | Foladare et al. |
| 8,770,742 | B2 | 7/2014 | Howell et al. |
| 8,771,153 | B2 | 7/2014 | Dalebout et al. |
| 8,771,154 | B2 | 7/2014 | Fedriga |
| 8,771,206 | B2 | 7/2014 | Gettelman et al. |
| 8,775,454 | B2 | 7/2014 | Geer |
| 8,776,264 | B2 | 7/2014 | Kiernan |
| 8,777,815 | B2 | 7/2014 | Case, Jr. et al. |
| 8,777,820 | B2 | 7/2014 | Lo |
| 8,777,822 | B2 | 7/2014 | Agostini |
| 8,781,568 | B2 | 7/2014 | Dugan |
| 8,783,326 | B1 | 7/2014 | Vaninger et al. |
| 8,784,271 | B2 | 7/2014 | Brumback et al. |
| 8,784,273 | B2 | 7/2014 | Dugan |
| 8,784,274 | B1 | 7/2014 | Chuang |
| 8,784,275 | B2 | 7/2014 | Mikan et al. |
| 8,784,286 | B2 | 7/2014 | Reyes |
| 8,786,575 | B2 | 7/2014 | Miller |
| 8,790,220 | B2 | 7/2014 | Karvonen |
| 8,790,222 | B2 | 7/2014 | Burger |
| 8,790,259 | B2 | 7/2014 | Katra et al. |
| 8,795,138 | B1 | 8/2014 | Yeh et al. |
| 8,799,200 | B2 | 8/2014 | Lahav |
| 8,801,578 | B2 | 8/2014 | Corbalis et al. |
| 8,801,581 | B2 | 8/2014 | Lai et al. |
| 8,801,582 | B2 | 8/2014 | Huang et al. |
| 8,805,844 | B2 | 8/2014 | Schorzman et al. |
| 8,805,941 | B2 | 8/2014 | Barak et al. |
| 8,814,754 | B2 | 8/2014 | Weast et al. |
| 8,815,189 | B2 | 8/2014 | Arnold et al. |
| 8,821,350 | B2 | 9/2014 | Maertz |
| 8,821,351 | B2 | 9/2014 | Abuelsaad et al. |
| 8,821,354 | B1 | 9/2014 | Tabahi |
| 8,821,359 | B1 | 9/2014 | Kassel |
| 8,821,870 | B2 | 9/2014 | Robinson et al. |
| 8,823,314 | B2 | 9/2014 | Lumsden et al. |
| 8,824,166 | B2 | 9/2014 | Rohrbach |
| 8,824,697 | B2 | 9/2014 | Christoph |
| 8,825,445 | B2 | 9/2014 | Hoffman et al. |
| 8,827,870 | B2 | 9/2014 | Dyer et al. |
| 8,827,874 | B2 | 9/2014 | Nishimura |
| 8,827,879 | B2 | 9/2014 | Nicholas |
| 8,831,407 | B2 | 9/2014 | Meschter et al. |
| 8,831,538 | B2 | 9/2014 | Yuen |
| 8,837,174 | B2 | 9/2014 | Hosotani |
| 8,838,471 | B1 | 9/2014 | Shum et al. |
| 8,839,725 | B2 | 9/2014 | Kooistra |
| 8,840,075 | B2 | 9/2014 | Olson |
| 8,840,569 | B2 | 9/2014 | Flaction et al. |
| 8,845,497 | B2 | 9/2014 | Turner |
| 8,845,498 | B2 | 9/2014 | Webb |
| 8,845,499 | B1 | 9/2014 | Boatwright |
| 8,847,988 | B2 | 9/2014 | Geisner et al. |
| 8,851,565 | B2 | 10/2014 | Hontz et al. |
| 8,858,397 | B2 | 10/2014 | Ishii |
| 8,858,409 | B2 | 10/2014 | Trees |
| 8,861,860 | B2 | 10/2014 | Gupta |
| 8,864,587 | B2 | 10/2014 | Framel et al. |

(56) References Cited

U.S. PATENT DOCUMENTS 8,864,627 B2 10/2014 Bayerlein et al.
8,868,448 B2 10/2014 Freishtat et al.
8,870,720 B1 10/2014 Webber et al.
8,870,726 B2 10/2014 Watterson et al.
8,870,791 B2 10/2014 Sabatino
8,876,131 B1 11/2014 Gomes
8,876,661 B2 11/2014 Lu
8,876,668 B2 11/2014 Hendrickson et al.
8,876,674 B2 11/2014 Webb et al.
8,882,637 B2 11/2014 Ainsworth et al.
8,882,666 B1 11/2014 Goldberg et al.
8,888,583 B2 11/2014 Dugan et al.
8,888,660 B1 11/2014 Oteman
8,888,700 B2 11/2014 Banet et al.
8,892,999 B2 11/2014 Nims et al.
8,894,549 B2 11/2014 Colledge
8,894,551 B2 11/2014 Kerdjoudj
8,897,868 B2 11/2014 Mazar et al.
8,900,099 B1 12/2014 Boyette
8,902,714 B2 12/2014 Gossweiler, III et al.
8,903,671 B2 12/2014 Park et al.
8,908,894 B2 12/2014 Amento et al.
8,913,409 B2 12/2014 Hui et al.
8,915,823 B2 12/2014 McKirdy et al.
8,917,273 B2 12/2014 Hoebel
8,918,465 B2 12/2014 Barak
8,918,543 B2 12/2014 Karstens
8,920,291 B2 12/2014 Chen et al.
8,920,332 B2 12/2014 Hong et al.
8,920,343 B2 12/2014 Sabatino
8,922,498 B2 12/2014 Vesely
8,926,475 B2 1/2015 Lin et al.
8,926,479 B2 1/2015 Chen et al.
8,932,188 B2 1/2015 Svenberg
8,939,831 B2 1/2015 Dugan
8,943,002 B2 1/2015 Zelenko et al.
8,944,958 B1 2/2015 Brumback et al.
8,944,968 B2 2/2015 Baudhuin
8,945,328 B2 2/2015 Longinotti-Buitoni et al.
8,947,226 B2 2/2015 Dugan
8,951,106 B2 2/2015 Cowley
8,951,164 B2 2/2015 Morris et al.
8,951,168 B2 2/2015 Baudhuin
8,954,135 B2 2/2015 Yuen et al.
8,954,290 B2 2/2015 Yuen et al.
8,956,268 B2 2/2015 Huang et al.
8,956,290 B2 2/2015 Gilley et al.
8,956,303 B2 2/2015 Hong et al.
8,956,715 B2 2/2015 Kim
8,958,631 B2 2/2015 Kutliroff et al.
8,961,371 B2 2/2015 Sultan et al.
8,961,413 B2 2/2015 Teller et al.
8,961,414 B2 2/2015 Teller et al.
8,961,439 B2 2/2015 Yang et al.
8,965,348 B1 2/2015 Cronin
8,965,498 B2 2/2015 Katra et al.
8,965,541 B2 2/2015 Martinez et al.
8,965,732 B2 2/2015 Robinette et al.
8,968,155 B2 3/2015 Bird
8,968,161 B2 3/2015 Shapiro et al.
8,968,162 B2 3/2015 Jaguan
8,968,163 B1 3/2015 Vidmar
8,968,164 B2 3/2015 Giannelli
8,972,199 B2 3/2015 Liang
8,976,007 B2 3/2015 Dugan
8,977,194 B2 3/2015 Jain et al.
8,979,709 B2 3/2015 Toback et al.
8,979,765 B2 3/2015 Banet et al.
8,986,165 B2 3/2015 Ashby
8,986,807 B2 3/2015 Rodgers
8,986,808 B2 3/2015 George
8,990,045 B2 3/2015 Zhu et al.
8,990,732 B2 3/2015 Farrenkopf et al.
8,992,383 B2 3/2015 Bilang
8,992,387 B2 3/2015 Watterson et al.
8,992,392 B2 3/2015 Giannelli et al.
8,992,393 B2 3/2015 Reyes
8,996,978 B2 3/2015 Richstein et al.
9,005,085 B2 4/2015 Astilean
9,005,129 B2 4/2015 Venkatraman et al.
9,008,973 B2 4/2015 French
9,010,222 B2 4/2015 Peirce
9,011,156 B2 4/2015 Hallmark
9,011,291 B2 4/2015 Birrell
9,011,292 B2 4/2015 Weast et al.
9,011,293 B2 4/2015 Shavit et al.
9,011,299 B2 4/2015 Lien
9,011,301 B2 4/2015 Balandis et al.
9,015,952 B2 4/2015 Magosaki
9,017,230 B1 4/2015 Pitts
9,022,906 B1 5/2015 Nelson
9,022,907 B2 5/2015 Wang
9,026,927 B2 5/2015 Brumback et al.
9,028,368 B2 5/2015 Ashby et al.
9,028,381 B2 5/2015 Mestemaker
9,028,441 B2 5/2015 Kuhn
9,031,812 B2 5/2015 Roberts et al.
9,033,137 B2 5/2015 Koppes et al.
9,033,712 B2 5/2015 Vasin
9,037,578 B2 5/2015 Brust et al.
9,038,218 B1 5/2015 Heil et al.
9,038,549 B1 5/2015 Zebarjad
9,039,578 B2 5/2015 Dalebout
9,039,581 B2 5/2015 Chia et al.
9,039,614 B2 5/2015 Yuen et al.
9,042,596 B2 5/2015 Connor
9,044,637 B2 6/2015 Karl
9,050,486 B2 6/2015 Reed
9,050,491 B2 6/2015 Gordon et al.
9,050,497 B2 6/2015 Reyes
9,050,498 B2 6/2015 Lu et al.
9,052,798 B1 6/2015 Klassen et al.
9,055,868 B2 6/2015 Islam
9,063,026 B2 6/2015 Nassef
9,064,342 B2 6/2015 Yuen et al.
9,069,380 B2 6/2015 Rahman et al.
9,072,930 B2 7/2015 Ashby et al.
9,072,932 B2 7/2015 Piaget et al.
9,072,941 B2 7/2015 Duda et al.
9,078,708 B2 7/2015 Haas
9,079,068 B2 7/2015 Muehl
9,081,534 B2 7/2015 Yuen et al.
9,081,889 B2 7/2015 Ingrassia et al.
9,083,245 B2 7/2015 Zhao et al.
9,083,826 B2 7/2015 Lu et al.
9,084,565 B2 7/2015 Mason et al.
9,084,712 B2 7/2015 Roerdink et al.
9,084,912 B2 7/2015 Jaquish et al.
9,089,732 B2 7/2015 Andon et al.
9,089,733 B2 7/2015 Fisbein et al.
9,091,008 B2 7/2015 Mathieu
9,095,740 B2 8/2015 Wu
9,107,586 B2 8/2015 Tran
9,108,079 B2 8/2015 Solow et al.
9,108,081 B2 8/2015 Giannelli et al.
9,114,273 B2 8/2015 Kehoe
9,114,275 B2 8/2015 Lu et al.
9,114,276 B2 8/2015 Bayerlein et al.
9,119,983 B2 9/2015 Rhea
9,123,317 B2 9/2015 Watterson et al.
9,123,380 B2 9/2015 Holtz et al.
9,125,620 B2 9/2015 Walke
9,126,072 B2 9/2015 Watterson
9,126,076 B2 9/2015 Liang
9,128,981 B1 9/2015 Geer
9,132,051 B2 9/2015 Heil
9,132,330 B2 9/2015 Brendle
9,135,347 B2 9/2015 Damman et al.
9,137,309 B2 9/2015 Ananny et al.
9,138,607 B2 9/2015 Miranda
9,138,612 B2 9/2015 Breaux
9,138,614 B2 9/2015 Lu et al.
9,138,615 B2 9/2015 Olson et al.
9,141,087 B2 9/2015 Brown et al.

(56) References Cited

U.S. PATENT DOCUMENTS

| | | | |
|---|---|---|---|
| 9,143,881 | B2 | 9/2015 | Fan et al. |
| 9,144,703 | B2 | 9/2015 | Dalebout et al. |
| 9,144,709 | B2 | 9/2015 | Reich |
| 9,146,147 | B1 | 9/2015 | Bakhsh |
| 9,148,077 | B2 | 9/2015 | Henderson |
| 9,162,102 | B1 | 10/2015 | Eder et al. |
| 9,162,104 | B1 | 10/2015 | Lee |
| 9,162,106 | B1 | 10/2015 | Scheiman |
| 9,162,142 | B2 | 10/2015 | Shum et al. |
| 9,168,001 | B2 | 10/2015 | Stivoric et al. |
| 9,168,414 | B2 | 10/2015 | Liu et al. |
| 9,173,593 | B2 | 11/2015 | Banet et al. |
| 9,173,594 | B2 | 11/2015 | Banet et al. |
| 9,174,084 | B2 | 11/2015 | Morris et al. |
| 9,174,085 | B2 | 11/2015 | Foley |
| 9,178,635 | B2 | 11/2015 | Ben-Shlomo |
| 9,183,498 | B2 | 11/2015 | Landers |
| 9,186,537 | B2 | 11/2015 | Arnold et al. |
| 9,186,549 | B2 | 11/2015 | Watterson et al. |
| 9,186,552 | B1 | 11/2015 | Deal |
| 9,189,021 | B2 | 11/2015 | Jerauld |
| 9,192,800 | B1 | 11/2015 | Meyer et al. |
| 9,192,816 | B2 | 11/2015 | Molyneux et al. |
| 9,198,622 | B2 | 12/2015 | Kaleal et al. |
| 9,199,115 | B2 | 12/2015 | Yim et al. |
| 9,199,123 | B2 | 12/2015 | Solow |
| 9,201,405 | B2 | 12/2015 | Clarkson et al. |
| 9,201,458 | B2 | 12/2015 | Hunt et al. |
| 9,205,301 | B2 | 12/2015 | Cohen |
| 9,208,764 | B2 | 12/2015 | Ghosh et al. |
| 9,211,431 | B2 | 12/2015 | Hornback et al. |
| 9,211,440 | B2 | 12/2015 | Lagree |
| 9,213,803 | B2 | 12/2015 | Rolley |
| 9,220,940 | B2 | 12/2015 | Al Kuwari |
| 9,221,545 | B2 | 12/2015 | Popescu et al. |
| 9,223,936 | B2 | 12/2015 | Aragones et al. |
| 9,224,291 | B2 | 12/2015 | Moll-Carrillo et al. |
| 9,226,692 | B2 | 1/2016 | Haas |
| 9,227,101 | B2 | 1/2016 | Maguire |
| 9,229,476 | B2 | 1/2016 | Yanev et al. |
| 9,230,064 | B2 | 1/2016 | Yanev et al. |
| 9,233,269 | B2 | 1/2016 | Lannon |
| 9,241,635 | B2 | 1/2016 | Yuen et al. |
| 9,242,139 | B2 | 1/2016 | Holley |
| 9,242,142 | B2 | 1/2016 | Vincent et al. |
| 9,245,428 | B2 | 1/2016 | Weddle et al. |
| 9,247,543 | B2 | 1/2016 | Berlin et al. |
| 9,248,329 | B2 | 2/2016 | Heideman |
| 9,253,168 | B2 | 2/2016 | Panther |
| 9,254,099 | B2 | 2/2016 | Connor |
| 9,254,409 | B2 | 2/2016 | Dalebout et al. |
| 9,256,711 | B2 | 2/2016 | Horseman |
| 9,256,910 | B2 | 2/2016 | Goldberg |
| 9,257,054 | B2 | 2/2016 | Coza et al. |
| 9,258,670 | B2 | 2/2016 | Goyal et al. |
| 9,259,633 | B2 | 2/2016 | Meyers |
| 9,262,064 | B2 | 2/2016 | Yanev et al. |
| 9,263,967 | B2 | 2/2016 | McCune |
| 9,265,984 | B2 | 2/2016 | Huber |
| 9,269,119 | B2 | 2/2016 | Warner |
| 9,272,183 | B2 | 3/2016 | Quy |
| 9,272,186 | B2 | 3/2016 | Reich |
| 9,275,617 | B2 | 3/2016 | Regnier |
| 9,279,734 | B2 | 3/2016 | Walker |
| 9,283,429 | B2 | 3/2016 | Aragones et al. |
| 9,283,431 | B2 | 3/2016 | Marty |
| 9,288,298 | B2 | 3/2016 | Choudhary et al. |
| 9,289,063 | B2 | 3/2016 | Baugh et al. |
| 9,289,644 | B2 | 3/2016 | Carson |
| 9,289,674 | B2 | 3/2016 | Winsper et al. |
| 9,292,935 | B2 | 3/2016 | Koduri et al. |
| 9,295,302 | B1 | 3/2016 | Reed et al. |
| 9,295,422 | B2 | 3/2016 | Tai |
| 9,295,894 | B2 | 3/2016 | Papadopolous |
| 9,298,886 | B2 | 3/2016 | Homsi |
| 9,302,139 | B2 | 4/2016 | Lee |
| 9,305,141 | B2 | 4/2016 | Fabrizio |
| 9,308,409 | B2 | 4/2016 | Beaver et al. |
| 9,308,410 | B2 | 4/2016 | Beaver et al. |
| 9,308,415 | B2 | 4/2016 | Crawford et al. |
| 9,308,417 | B2 | 4/2016 | Grundy |
| 9,311,802 | B1 | 4/2016 | Chin et al. |
| 9,314,658 | B2 | 4/2016 | Kaye |
| 9,314,659 | B2 | 4/2016 | Gvoich |
| 9,314,666 | B2 | 4/2016 | Canavan et al. |
| 9,317,660 | B2 | 4/2016 | Burich et al. |
| 9,317,662 | B2 | 4/2016 | Bangera et al. |
| 9,318,030 | B2 | 4/2016 | Harris et al. |
| 9,320,457 | B2 | 4/2016 | Flaction et al. |
| 9,320,935 | B1 | 4/2016 | Paris |
| 9,320,938 | B1 | 4/2016 | Belmore |
| 9,320,940 | B2 | 4/2016 | Rainey |
| 9,327,159 | B1 | 5/2016 | Medina |
| 9,329,053 | B2 | 5/2016 | Lakovic et al. |
| 9,330,239 | B2 | 5/2016 | Koduri et al. |
| 9,330,544 | B2 | 5/2016 | Levesque et al. |
| 9,332,363 | B2 | 5/2016 | Jain et al. |
| 9,333,388 | B2 | 5/2016 | Lee et al. |
| 9,339,209 | B2 | 5/2016 | Banet et al. |
| 9,339,681 | B1 | 5/2016 | Nalley |
| 9,339,682 | B2 | 5/2016 | Braier et al. |
| 9,339,683 | B2 | 5/2016 | Dilli et al. |
| 9,339,691 | B2 | 5/2016 | Brammer |
| 9,339,692 | B2 | 5/2016 | Hashish |
| 9,345,947 | B2 | 5/2016 | Harris et al. |
| 9,349,280 | B2 | 5/2016 | Baldwin et al. |
| 9,350,598 | B2 | 5/2016 | Barak et al. |
| 9,352,181 | B2 | 5/2016 | O'Neil |
| 9,352,185 | B2 | 5/2016 | Hendrickson et al. |
| 9,352,186 | B2 | 5/2016 | Watterson |
| 9,352,187 | B2 | 5/2016 | Piaget et al. |
| 9,357,551 | B2 | 5/2016 | Gutman |
| 9,357,921 | B2 | 6/2016 | Chang et al. |
| 9,358,414 | B2 | 6/2016 | Dephouse |
| 9,358,422 | B2 | 6/2016 | Brontman |
| 9,358,426 | B2 | 6/2016 | Aragones et al. |
| 9,364,158 | B2 | 6/2016 | Banet et al. |
| 9,364,703 | B1 | 6/2016 | Kuka |
| 9,364,706 | B2 | 6/2016 | Lo |
| 9,364,708 | B2 | 6/2016 | Luger et al. |
| 9,364,714 | B2 | 6/2016 | Koduri et al. |
| 9,367,668 | B2 | 6/2016 | Flynt et al. |
| 9,369,178 | B2 | 6/2016 | Matsutani |
| 9,370,679 | B2 | 6/2016 | Lagree et al. |
| 9,370,687 | B2 | 6/2016 | Hao |
| 9,370,691 | B2 | 6/2016 | Nissila et al. |
| 9,374,279 | B2 | 6/2016 | Yuen et al. |
| 9,375,602 | B2 | 6/2016 | Krull |
| 9,375,629 | B2 | 6/2016 | Schieffer et al. |
| 9,377,314 | B2 | 6/2016 | Tseng et al. |
| 9,378,336 | B2 | 6/2016 | Ohnemus et al. |
| 9,381,420 | B2 | 7/2016 | Burroughs |
| 9,381,445 | B2 | 7/2016 | Ventura et al. |
| 9,385,810 | B2 | 7/2016 | Hazani |
| 9,387,355 | B1 | 7/2016 | Joya |
| 9,387,357 | B2 | 7/2016 | Mueller |
| 9,387,387 | B2 | 7/2016 | Dalebout |
| 9,389,057 | B2 | 7/2016 | Meschter et al. |
| 9,389,718 | B1 | 7/2016 | Letourneur |
| 9,389,754 | B2 | 7/2016 | Reese et al. |
| 9,390,229 | B1 | 7/2016 | Kahn et al. |
| 9,392,941 | B2 | 7/2016 | Powch et al. |
| 9,395,754 | B2 | 7/2016 | Cronin |
| 9,401,078 | B2 | 7/2016 | Barrett |
| 9,403,047 | B2 | 8/2016 | Olson |
| 9,403,048 | B2 | 8/2016 | Balandis et al. |
| 9,403,053 | B2 | 8/2016 | Kaiser et al. |
| 9,405,892 | B2 | 8/2016 | Baldwin et al. |
| 9,409,047 | B2 | 8/2016 | Kamenskikh |
| 9,409,050 | B2 | 8/2016 | Mintz |
| 9,409,052 | B2 | 8/2016 | Werner |
| 9,411,936 | B2 | 8/2016 | Landrum et al. |
| 9,411,940 | B2 | 8/2016 | Burroughs et al. |
| 9,415,257 | B2 | 8/2016 | Habing |

(56) References Cited

U.S. PATENT DOCUMENTS

| | | | |
|---|---|---|---|
| 9,420,083 | B2 | 8/2016 | Roberts et al. |
| 9,420,542 | B2 | 8/2016 | Henia |
| 9,421,422 | B2 | 8/2016 | Yuen et al. |
| 9,421,448 | B2 | 8/2016 | Tropper et al. |
| 9,422,018 | B2 | 8/2016 | Pelot et al. |
| 9,427,611 | B1 | 8/2016 | Balentine |
| 9,427,615 | B2 | 8/2016 | Pretz et al. |
| 9,430,043 | B1 | 8/2016 | Amento et al. |
| 9,430,920 | B2 | 8/2016 | Munro et al. |
| 9,439,574 | B2 | 9/2016 | McCombie et al. |
| 9,440,134 | B2 | 9/2016 | Nicora |
| 9,442,100 | B2 | 9/2016 | Connor |
| 9,446,288 | B1 | 9/2016 | Pazan |
| 9,451,897 | B2 | 9/2016 | Mazar et al. |
| 9,452,315 | B1 | 9/2016 | Murray et al. |
| 9,452,320 | B2 | 9/2016 | Yang |
| 9,455,623 | B2 | 9/2016 | Fan et al. |
| 9,455,784 | B2 | 9/2016 | Cune et al. |
| 9,457,219 | B2 | 10/2016 | Smith |
| 9,457,224 | B2 | 10/2016 | Giannelli et al. |
| 9,457,256 | B2 | 10/2016 | Aragones et al. |
| 9,460,421 | B2 | 10/2016 | Lai et al. |
| 9,462,844 | B2 | 10/2016 | Schrock et al. |
| 9,463,345 | B2 | 10/2016 | Simonetti |
| 9,463,349 | B1 | 10/2016 | Chang |
| 9,463,572 | B2 | 10/2016 | Parente |
| 9,468,382 | B2 | 10/2016 | Hanoun |
| 9,468,792 | B2 | 10/2016 | Simonetti |
| 9,468,793 | B2 | 10/2016 | Salmon |
| 9,468,794 | B2 | 10/2016 | Barton |
| 9,473,593 | B2 | 10/2016 | Wallace |
| 9,474,666 | B1 | 10/2016 | Smith |
| 9,474,925 | B1 | 10/2016 | Hsiung |
| 9,474,935 | B2 | 10/2016 | Abbondanza et al. |
| 9,477,303 | B2 | 10/2016 | Fleischmann et al. |
| 9,480,874 | B2 | 11/2016 | Cutler |
| 9,486,070 | B2 | 11/2016 | Labrosse et al. |
| 9,486,382 | B1 | 11/2016 | Boss |
| 9,486,658 | B2 | 11/2016 | Alexander |
| 9,491,562 | B2 | 11/2016 | Cronin |
| 9,495,015 | B1 | 11/2016 | Kahn et al. |
| 9,495,860 | B2 | 11/2016 | Lett |
| 9,498,066 | B2 | 11/2016 | Christianson et al. |
| 9,498,128 | B2 | 11/2016 | Jayalth et al. |
| 9,498,666 | B1 | 11/2016 | Boatwright |
| 9,498,668 | B2 | 11/2016 | Smith |
| 9,498,671 | B1 | 11/2016 | Softky |
| 9,498,704 | B1 | 11/2016 | Cohen et al. |
| 9,500,464 | B2 | 11/2016 | Coza |
| 9,504,414 | B2 | 11/2016 | Coza et al. |
| 9,505,241 | B2 | 11/2016 | Cuzin |
| 9,506,528 | B2 | 11/2016 | Tucker et al. |
| 9,506,529 | B2 | 11/2016 | Tucker et al. |
| 9,509,269 | B1 | 11/2016 | Rosenberg |
| 9,511,254 | B2 | 12/2016 | Netter |
| 9,511,259 | B2 | 12/2016 | Mountain |
| 9,511,864 | B2 | 12/2016 | Simpson |
| 9,517,378 | B2 | 12/2016 | Ashby et al. |
| 9,517,406 | B2 | 12/2016 | Shum et al. |
| 9,521,901 | B2 | 12/2016 | Dalebout |
| 9,526,937 | B2 | 12/2016 | Uygan |
| 9,529,385 | B2 | 12/2016 | Connor |
| 9,529,437 | B2 | 12/2016 | Kahn et al. |
| 9,532,002 | B2 | 12/2016 | Glass et al. |
| 9,532,734 | B2 | 1/2017 | Hoffman et al. |
| 9,533,228 | B2 | 1/2017 | Dugan |
| 9,535,505 | B2 | 1/2017 | Erkkila et al. |
| 9,536,449 | B2 | 1/2017 | Connor |
| 9,539,461 | B2 | 1/2017 | Ercanbrack |
| 9,540,071 | B2 | 1/2017 | Jordan et al. |
| 9,540,174 | B2 | 1/2017 | Josserond et al. |
| 9,545,535 | B2 | 1/2017 | Lagree |
| 9,545,540 | B1 | 1/2017 | Moschel |
| 9,545,541 | B2 | 1/2017 | Aragones et al. |
| 9,549,585 | B2 | 1/2017 | Amos et al. |
| 9,550,091 | B2 | 1/2017 | Emerson |
| 9,555,278 | B2 | 1/2017 | Kaye et al. |
| 9,555,280 | B2 | 1/2017 | Kaye et al. |
| 9,560,917 | B2 | 2/2017 | Roslund, Jr. |
| 9,563,336 | B2 | 2/2017 | Barak et al. |
| 9,563,700 | B2 | 2/2017 | Garmark et al. |
| 9,569,986 | B2 | 2/2017 | Levine et al. |
| 9,573,017 | B2 | 2/2017 | Chang |
| 9,579,534 | B2 | 2/2017 | Sutkowski et al. |
| 9,579,544 | B2 | 2/2017 | Watterson |
| 9,582,071 | B2 | 2/2017 | Baldwin et al. |
| 9,582,976 | B2 | 2/2017 | Chin et al. |
| 9,585,563 | B2 | 3/2017 | Mensinger et al. |
| 9,586,085 | B2 | 3/2017 | Arnold et al. |
| 9,586,090 | B2 | 3/2017 | Watterson et al. |
| 9,589,482 | B2 | 3/2017 | Baldwin et al. |
| 9,594,433 | B2 | 3/2017 | Baldwin et al. |
| 9,597,540 | B2 | 3/2017 | Arnold |
| 9,599,981 | B2 | 3/2017 | Crabtree |
| 9,600,079 | B2 | 3/2017 | Baldwin et al. |
| 9,602,210 | B2 | 3/2017 | Berlin et al. |
| 9,604,089 | B2 | 3/2017 | Cervone et al. |
| 9,604,092 | B2 | 3/2017 | Krull |
| 9,604,096 | B2 | 3/2017 | Arnold et al. |
| 9,604,099 | B2 | 3/2017 | Taylor |
| 9,604,757 | B2 | 3/2017 | Spivack et al. |
| 9,610,475 | B1 | 4/2017 | DeKnock et al. |
| 9,610,506 | B2 | 4/2017 | Dugan |
| 9,615,215 | B2 | 4/2017 | Yuen et al. |
| 9,615,785 | B2 | 4/2017 | Rocker et al. |
| 9,616,274 | B2 | 4/2017 | Wehrell |
| 9,616,276 | B2 | 4/2017 | Dalebout et al. |
| 9,616,281 | B2 | 4/2017 | Hsiung |
| 9,616,284 | B1 | 4/2017 | Aganyan |
| 9,616,292 | B2 | 4/2017 | Orfield |
| 9,621,959 | B2 | 4/2017 | Mountain |
| 9,622,537 | B2 | 4/2017 | Amos et al. |
| 9,623,285 | B1 | 4/2017 | Ruiz |
| 9,623,286 | B1 | 4/2017 | Chen |
| 9,628,286 | B1 | 4/2017 | Nguyen et al. |
| 9,630,048 | B2 | 4/2017 | Kaye et al. |
| 9,632,746 | B2 | 4/2017 | Keipert et al. |
| 9,636,539 | B1 | 5/2017 | Brumit |
| 9,636,540 | B2 | 5/2017 | Mueller et al. |
| 9,636,543 | B2 | 5/2017 | Dyer et al. |
| 9,636,567 | B2 | 5/2017 | Brammer et al. |
| 9,642,415 | B2 | 5/2017 | Pease et al. |
| 9,642,764 | B2 | 5/2017 | Kuehne et al. |
| 9,643,042 | B2 | 5/2017 | Madden |
| 9,646,137 | B2 | 5/2017 | Gilley et al. |
| 9,646,481 | B2 | 5/2017 | Messenger et al. |
| 9,647,758 | B2 | 5/2017 | Hazani |
| 9,649,524 | B2 | 5/2017 | Giunchi |
| 9,655,053 | B2 | 5/2017 | Park et al. |
| 9,656,115 | B2 | 5/2017 | Young |
| 9,656,144 | B2 | 5/2017 | Jafarifesharaki |
| 9,656,591 | B1 | 5/2017 | Dumenigo |
| 9,658,066 | B2 | 5/2017 | Yuen et al. |
| 9,661,355 | B2 | 5/2017 | Ho |
| 9,661,781 | B2 | 5/2017 | Anolik et al. |
| 9,665,046 | B2 | 5/2017 | Aoto et al. |
| 9,665,873 | B2 | 5/2017 | Ackland |
| 9,669,261 | B2 | 6/2017 | Eder |
| 9,672,196 | B2 | 6/2017 | Shachar et al. |
| 9,672,754 | B2 | 6/2017 | Yuen et al. |
| 9,673,904 | B2 | 6/2017 | Palanisamy et al. |
| 9,675,836 | B2 | 6/2017 | Babon |
| 9,678,626 | B2 | 6/2017 | Whang |
| 9,681,313 | B2 | 6/2017 | Malach |
| 9,682,267 | B2 | 6/2017 | Kaye et al. |
| 9,682,306 | B2 | 6/2017 | Lin et al. |
| 9,682,307 | B2 | 6/2017 | Dalebout |
| 9,687,689 | B2 | 6/2017 | Lin |
| 9,692,276 | B2 | 6/2017 | Oteman et al. |
| 9,692,844 | B2 | 6/2017 | Messenger et al. |
| RE46,481 | E | 7/2017 | Sako et al. |
| 9,694,234 | B2 | 7/2017 | Dalebout et al. |
| 9,694,247 | B2 | 7/2017 | Nurnberg |
| 9,697,740 | B2 | 7/2017 | Zhang et al. |

(56) References Cited

U.S. PATENT DOCUMENTS

| | | | |
|---|---|---|---|
| 9,700,752 | B1 | 7/2017 | Powers |
| 9,700,780 | B2 | 7/2017 | Riley et al. |
| 9,700,802 | B2 | 7/2017 | Dugan |
| 9,701,530 | B2 | 7/2017 | Kline |
| 9,707,435 | B1 | 7/2017 | Ferlito et al. |
| 9,707,441 | B2 | 7/2017 | Yang |
| 9,707,447 | B1 | 7/2017 | Lopez Babodilla |
| 9,710,711 | B2 | 7/2017 | Dibenedetto et al. |
| 9,712,629 | B2 | 7/2017 | Molettiere et al. |
| 9,713,739 | B2 | 7/2017 | Dalmia |
| 9,715,774 | B2 | 7/2017 | Baldwin et al. |
| 9,719,797 | B2 | 8/2017 | Fino et al. |
| 9,720,443 | B2 | 8/2017 | Malhotra |
| 9,720,912 | B2 | 8/2017 | Morimoto et al. |
| 9,723,381 | B2 | 8/2017 | Swanson |
| 9,723,393 | B2 | 8/2017 | Nguyen et al. |
| 9,724,553 | B2 | 8/2017 | Kaye et al. |
| 9,724,563 | B2 | 8/2017 | Schmidt |
| 9,724,589 | B2 | 8/2017 | Baudhuin |
| 9,728,059 | B2 | 8/2017 | Arnold et al. |
| 9,729,921 | B2 | 8/2017 | Kim et al. |
| 9,729,989 | B2 | 8/2017 | Marten |
| 9,730,025 | B2 | 8/2017 | Yuen et al. |
| 9,730,228 | B2 | 8/2017 | Harel |
| 9,730,619 | B2 | 8/2017 | Messenger et al. |
| 9,731,157 | B2 | 8/2017 | Loach |
| 9,731,158 | B1 | 8/2017 | Lo |
| 9,734,184 | B1 | 8/2017 | Lagace et al. |
| 9,734,477 | B2 | 8/2017 | Weast et al. |
| 9,737,261 | B2 | 8/2017 | Coza et al. |
| 9,737,747 | B1 | 8/2017 | Walsh et al. |
| 9,737,755 | B2 | 8/2017 | Dalebout |
| 9,743,861 | B2 | 8/2017 | Giedwoyn et al. |
| 9,750,454 | B2 | 9/2017 | Walke et al. |
| 9,756,895 | B2 | 9/2017 | Rice et al. |
| 9,757,605 | B2 | 9/2017 | Olson et al. |
| 9,757,611 | B1 | 9/2017 | Colburn |
| 9,763,581 | B2 | 9/2017 | Bonutti et al. |
| 9,764,184 | B2 | 9/2017 | Kueker et al. |
| 9,764,188 | B1 | 9/2017 | Aganyan et al. |
| 9,767,212 | B2 | 9/2017 | Lavi et al. |
| 9,769,522 | B2 | 9/2017 | Richardson |
| 9,772,612 | B2 | 9/2017 | McCarthy, III et al. |
| 9,775,123 | B2 | 9/2017 | Harel |
| 9,776,032 | B2 | 10/2017 | Moran et al. |
| 9,776,039 | B1 | 10/2017 | Xu |
| 9,776,042 | B2 | 10/2017 | Prokhorov |
| 9,778,280 | B2 | 10/2017 | Yuen et al. |
| 9,782,125 | B2 | 10/2017 | Berner, Jr. et al. |
| 9,782,625 | B1 | 10/2017 | Blum et al. |
| 9,789,362 | B1 | 10/2017 | Su et al. |
| 9,792,361 | B1 | 10/2017 | Geer |
| 9,795,818 | B2 | 10/2017 | Powell |
| 9,795,819 | B2 | 10/2017 | Wehrell |
| 9,795,822 | B2 | 10/2017 | Smith et al. |
| 9,795,827 | B2 | 10/2017 | Wiener et al. |
| 9,795,828 | B2 | 10/2017 | Andrade |
| 9,795,855 | B2 | 10/2017 | Jafarifesharaki |
| 9,797,920 | B2 | 10/2017 | Kahn et al. |
| 9,798,309 | B2 | 10/2017 | Tirpak |
| 9,801,547 | B2 | 10/2017 | Yuen et al. |
| 9,802,072 | B2 | 10/2017 | Wehrell |
| 9,802,075 | B2 | 10/2017 | Gvoich |
| 9,802,081 | B2 | 10/2017 | Ridgel et al. |
| 9,808,202 | B2 | 11/2017 | Wu et al. |
| 9,808,673 | B2 | 11/2017 | Robinson |
| 9,811,639 | B2 | 11/2017 | Aragones et al. |
| 9,814,920 | B1 | 11/2017 | Monterrey |
| 9,814,922 | B2 | 11/2017 | Moran et al. |
| 9,814,927 | B2 | 11/2017 | Forystek |
| 9,814,928 | B2 | 11/2017 | Taylor |
| 9,814,929 | B2 | 11/2017 | Moser |
| 9,814,930 | B2 | 11/2017 | Manzke et al. |
| 9,818,285 | B2 | 11/2017 | Clarke et al. |
| 9,819,561 | B2 | 11/2017 | Freishtat et al. |
| 9,819,754 | B2 | 11/2017 | Park et al. |
| 9,821,191 | B2 | 11/2017 | Abbondanza |
| 9,821,212 | B2 | 11/2017 | Kolman et al. |
| 9,824,110 | B2 | 11/2017 | Giudici et al. |
| 9,824,578 | B2 | 11/2017 | Burton et al. |
| 9,827,458 | B2 | 11/2017 | Dalton |
| 9,829,068 | B2 | 11/2017 | Marchetti |
| 9,829,327 | B2 | 11/2017 | Nagy et al. |
| 9,833,141 | B2 | 12/2017 | Kampman et al. |
| 9,833,654 | B1 | 12/2017 | Gant |
| 9,833,658 | B2 | 12/2017 | Wiener et al. |
| 9,838,736 | B2 | 12/2017 | Smith et al. |
| 9,839,804 | B2 | 12/2017 | Werner |
| 9,841,077 | B2 | 12/2017 | Modrezejewski et al. |
| 9,846,438 | B2 | 12/2017 | Rihn et al. |
| 9,849,330 | B2 | 12/2017 | Lagree |
| 9,849,333 | B2 | 12/2017 | Fung |
| 9,849,361 | B2 | 12/2017 | Coza et al. |
| 9,852,271 | B2 | 12/2017 | Aragones et al. |
| 9,858,307 | B2 | 1/2018 | Sultan et al. |
| 9,861,300 | B2 | 1/2018 | Gettelman et al. |
| 9,864,844 | B2 | 1/2018 | Durham et al. |
| 9,866,596 | B2 | 1/2018 | Das et al. |
| 9,868,006 | B1 | 1/2018 | Epler |
| 9,873,012 | B2 | 1/2018 | Huppee et al. |
| 9,878,201 | B1 | 1/2018 | Moschel |
| 9,880,805 | B1 | 1/2018 | Guralnick |
| 9,881,326 | B2 | 1/2018 | Gilley et al. |
| 9,882,736 | B2 | 1/2018 | Lett |
| 9,882,992 | B2 | 1/2018 | Baldwin et al. |
| 9,884,222 | B2 | 2/2018 | Chen |
| 9,884,224 | B2 | 2/2018 | Spoeth et al. |
| 9,885,575 | B2 | 2/2018 | Collin |
| 9,886,309 | B2 | 2/2018 | Alles et al. |
| 9,886,871 | B1 | 2/2018 | Rauhala et al. |
| 9,889,334 | B2 | 2/2018 | Ashby et al. |
| 9,892,417 | B2 | 2/2018 | Shachar et al. |
| 9,895,567 | B2 | 2/2018 | Lee |
| 9,895,570 | B2 | 2/2018 | Shah |
| 9,895,571 | B2 | 2/2018 | Wang |
| 9,901,766 | B2 | 2/2018 | Ross |
| 9,901,767 | B2 | 2/2018 | Kuo |
| 9,901,772 | B2 | 2/2018 | Crowley et al. |
| 9,901,780 | B2 | 2/2018 | DeLuca et al. |
| 9,901,805 | B2 | 2/2018 | Hughes, Jr. |
| 9,906,572 | B2 | 2/2018 | Wang et al. |
| 9,907,396 | B1 | 3/2018 | Labrosse et al. |
| 9,910,498 | B2 | 3/2018 | Kutliroff et al. |
| 9,914,003 | B2 | 3/2018 | Kuehne et al. |
| 9,914,011 | B2 | 3/2018 | Downey et al. |
| 9,914,014 | B2 | 3/2018 | Lagree et al. |
| 9,919,183 | B1 | 3/2018 | Moschel |
| 9,919,198 | B2 | 3/2018 | Romeo et al. |
| 9,921,726 | B1 | 3/2018 | Sculley et al. |
| 9,937,375 | B2 | 4/2018 | Zhu |
| 9,940,161 | B1 | 4/2018 | Kahn et al. |
| 9,940,682 | B2 | 4/2018 | Hoffman et al. |
| 9,943,159 | B1 | 4/2018 | Novikova |
| 9,943,719 | B2 | 4/2018 | Smith et al. |
| 9,943,722 | B2 | 4/2018 | Dalebout |
| 9,946,857 | B2 | 4/2018 | Beals |
| 9,948,349 | B2 | 4/2018 | Malach |
| 9,948,477 | B2 | 4/2018 | Marten |
| 9,950,205 | B2 | 4/2018 | Simonetti |
| 9,950,209 | B2 | 4/2018 | Yim et al. |
| 9,951,904 | B2 | 4/2018 | Perez et al. |
| 9,956,450 | B2 | 5/2018 | Bayerlein et al. |
| 9,959,902 | B2 | 5/2018 | McNamee |
| 9,960,980 | B2 | 5/2018 | Wilson |
| 9,962,081 | B2 | 5/2018 | Mensinger et al. |
| 9,962,305 | B2 | 5/2018 | Yamada et al. |
| 9,962,576 | B2 | 5/2018 | Anderson |
| 9,965,059 | B2 | 5/2018 | Myers et al. |
| 9,967,614 | B2 | 5/2018 | McCarthy, III |
| 9,968,816 | B2 | 5/2018 | Olson et al. |
| 9,968,821 | B2 | 5/2018 | Finlayson et al. |
| 9,968,823 | B2 | 5/2018 | Cutler |
| 9,974,997 | B2 | 5/2018 | Cei |
| 9,975,003 | B2 | 5/2018 | Molins et al. |

(56) References Cited

U.S. PATENT DOCUMENTS

| | | | |
|---|---|---|---|
| 9,977,874 | B2 | 5/2018 | Aragones et al. |
| 9,979,182 | B2 | 5/2018 | Lin et al. |
| 9,983,011 | B2 | 5/2018 | Mountain |
| 9,986,315 | B2 | 5/2018 | Oleson et al. |
| 9,987,513 | B2 | 6/2018 | Yim et al. |
| 9,987,517 | B1 | 6/2018 | Kuo |
| 9,989,507 | B2 | 6/2018 | Benn |
| 9,990,126 | B2 | 6/2018 | Chanyontpatanakul |
| 9,993,680 | B2 | 6/2018 | Gordon |
| 9,993,683 | B2 | 6/2018 | Moschel |
| 9,993,711 | B2 | 6/2018 | Moya Saez |
| 9,996,066 | B2 | 6/2018 | Beals |
| 10,004,656 | B2 | 6/2018 | Whalen et al. |
| 10,004,934 | B2 | 6/2018 | Pennington |
| 10,004,940 | B2 | 6/2018 | Badarneh |
| 10,004,945 | B2 | 6/2018 | Sauter |
| 10,008,090 | B2 | 6/2018 | Yuen et al. |
| 10,010,169 | B2 | 7/2018 | Grotenhuis |
| 10,010,745 | B1 | 7/2018 | Brumit |
| 10,013,986 | B1 | 7/2018 | Bhaya et al. |
| 10,015,216 | B2 | 7/2018 | Wang et al. |
| 10,016,646 | B2 | 7/2018 | Butler |
| 10,016,655 | B2 | 7/2018 | Lagree |
| 10,021,188 | B2 | 7/2018 | Oleson et al. |
| 10,022,583 | B2 | 7/2018 | Wang |
| 10,022,589 | B2 | 7/2018 | Case, Jr. et al. |
| 10,022,590 | B2 | 7/2018 | Foley et al. |
| 10,029,172 | B2 | 7/2018 | Galasso et al. |
| 10,035,010 | B1 | 7/2018 | Wagstaff |
| 10,036,443 | B2 | 7/2018 | Galasso et al. |
| 10,037,053 | B2 | 7/2018 | Malhotra |
| 10,038,952 | B2 | 7/2018 | Labrosse et al. |
| 10,039,952 | B2 | 8/2018 | Chang |
| 10,039,970 | B2 | 8/2018 | Lee et al. |
| 10,046,222 | B2 | 8/2018 | Hawkins, III et al. |
| 10,065,064 | B2 | 9/2018 | Smith et al. |
| 10,065,070 | B2 | 9/2018 | Huang |
| 10,070,816 | B2 | 9/2018 | Cowley et al. |
| 10,071,285 | B2 | 9/2018 | Smith et al. |
| 10,076,437 | B2 | 9/2018 | Plath |
| 10,086,254 | B2 | 10/2018 | Watterson |
| 2001/0001303 | A1 | 5/2001 | Ohsuga et al. |
| 2001/0008053 | A1 | 7/2001 | Belli |
| 2001/0024998 | A1 | 9/2001 | Novak |
| 2001/0027266 | A1 | 10/2001 | Hautala |
| 2001/0028350 | A1 | 10/2001 | Matsuoka et al. |
| 2001/0041647 | A1 | 11/2001 | Itoh |
| 2001/0049320 | A1 | 12/2001 | Cohen |
| 2001/0049470 | A1 | 12/2001 | Mault et al. |
| 2001/0051564 | A1 | 12/2001 | Iund |
| 2001/0051566 | A1 | 12/2001 | Krull |
| 2001/0053883 | A1 | 12/2001 | Yoshimura et al. |
| 2002/0004191 | A1 | 1/2002 | Tice et al. |
| 2002/0004439 | A1 | 1/2002 | Galbraith et al. |
| 2002/0013200 | A1 | 1/2002 | Sechrest |
| 2002/0013717 | A1 | 1/2002 | Ando |
| 2002/0016235 | A1 | 2/2002 | Ashby et al. |
| 2002/0019298 | A1 | 2/2002 | Eschenbach |
| 2002/0022551 | A1 | 2/2002 | Watterson et al. |
| 2002/0022555 | A1 | 2/2002 | Nesci |
| 2002/0022559 | A1 | 2/2002 | Krull |
| 2002/0024521 | A1 | 2/2002 | Goden |
| 2002/0025888 | A1 | 2/2002 | Germanton |
| 2002/0025891 | A1 | 2/2002 | Colosky et al. |
| 2002/0026130 | A1 | 2/2002 | West |
| 2002/0026292 | A1 | 2/2002 | Isami |
| 2002/0028733 | A1 | 3/2002 | Martens |
| 2002/0031756 | A1 | 3/2002 | Holtz |
| 2002/0035017 | A1 | 3/2002 | Pertegaz-Esteban |
| 2002/0039952 | A1 | 4/2002 | Clem |
| 2002/0042328 | A1 | 4/2002 | Yoo |
| 2002/0042912 | A1 | 4/2002 | Iijima |
| 2002/0043909 | A1 | 4/2002 | Nielsen |
| 2002/0045519 | A1 | 4/2002 | Watterson |
| 2002/0047867 | A1 | 4/2002 | Mault |
| 2002/0049123 | A1 | 4/2002 | Krull |
| 2002/0052268 | A1 | 5/2002 | Morcillo-Quintero |
| 2002/0054244 | A1 | 5/2002 | Holtz |
| 2002/0055419 | A1 | 5/2002 | Hinnebusch |
| 2002/0055420 | A1 | 5/2002 | Stearns et al. |
| 2002/0055422 | A1 | 5/2002 | Airmet |
| 2002/0055426 | A1 | 5/2002 | Krull |
| 2002/0055857 | A1 | 5/2002 | Mault |
| 2002/0060335 | A1 | 5/2002 | Edgar |
| 2002/0062236 | A1 | 5/2002 | Murashita |
| 2002/0066735 | A1 | 6/2002 | Hewlitt et al. |
| 2002/0068887 | A1 | 6/2002 | Kikumoto |
| 2002/0068991 | A1 | 6/2002 | Fitzsimmons, Jr. |
| 2002/0070954 | A1 | 6/2002 | Lang |
| 2002/0072436 | A1 | 6/2002 | Liu |
| 2002/0077219 | A1 | 6/2002 | Cohen |
| 2002/0077221 | A1 | 6/2002 | Dalebout et al. |
| 2002/0083122 | A1 | 6/2002 | Lemchen |
| 2002/0086779 | A1 | 7/2002 | Wilkinson |
| 2002/0088337 | A1 | 7/2002 | Devecka |
| 2002/0091043 | A1 | 7/2002 | Rexach |
| 2002/0091796 | A1 | 7/2002 | Higginson |
| 2002/0094914 | A1 | 7/2002 | Maresh et al. |
| 2002/0098957 | A1 | 7/2002 | Webber |
| 2002/0101880 | A1 | 8/2002 | Kim |
| 2002/0106617 | A1 | 8/2002 | Hersh |
| 2002/0107058 | A1 | 8/2002 | Namba et al. |
| 2002/0109710 | A1 | 8/2002 | Holtz |
| 2002/0111541 | A1 | 8/2002 | Bibl et al. |
| 2002/0115536 | A1 | 8/2002 | Hojo |
| 2002/0116266 | A1 | 8/2002 | Marshall |
| 2002/0119870 | A1 | 8/2002 | Chen |
| 2002/0128119 | A1 | 9/2002 | Arai |
| 2002/0128127 | A1 | 9/2002 | Chen |
| 2002/0132703 | A1 | 9/2002 | Martinez |
| 2002/0132706 | A1 | 9/2002 | Sleamaker |
| 2002/0137605 | A1 | 9/2002 | Olsen |
| 2002/0138023 | A1 | 9/2002 | Kume et al. |
| 2002/0142887 | A1 | 10/2002 | O'Malley |
| 2002/0142890 | A1 | 10/2002 | Ohrt |
| 2002/0147078 | A1 | 10/2002 | Wu |
| 2002/0151413 | A1 | 10/2002 | Dalebout |
| 2002/0155416 | A1 | 10/2002 | Barton |
| 2002/0156351 | A1 | 10/2002 | Sagel |
| 2002/0156387 | A1 | 10/2002 | Dardik |
| 2002/0160883 | A1 | 10/2002 | Dugan |
| 2002/0160891 | A1 | 10/2002 | Gallagher |
| 2002/0164929 | A1 | 11/2002 | Pinson |
| 2002/0169634 | A1 | 11/2002 | Nishi |
| 2002/0171070 | A1 | 11/2002 | Shim |
| 2002/0173407 | A1 | 11/2002 | Bowman |
| 2002/0187879 | A1 | 12/2002 | Ball |
| 2002/0193213 | A1 | 12/2002 | Batca |
| 2002/0193214 | A1 | 12/2002 | Ish |
| 2002/0193215 | A1 | 12/2002 | Cheng |
| 2002/0194604 | A1 | 12/2002 | Sanchez et al. |
| 2002/0198084 | A1 | 12/2002 | Stearns et al. |
| 2002/0198776 | A1 | 12/2002 | Nara |
| 2003/0004424 | A1 | 1/2003 | Birnbaum |
| 2003/0008731 | A1 | 1/2003 | Anderson et al. |
| 2003/0013072 | A1 | 1/2003 | Thomas |
| 2003/0017918 | A1 | 1/2003 | Webb et al. |
| 2003/0021273 | A1 | 1/2003 | Fouquet |
| 2003/0022765 | A1 | 1/2003 | Wu |
| 2003/0022770 | A1 | 1/2003 | Lee |
| 2003/0032528 | A1 | 2/2003 | Wu |
| 2003/0032531 | A1 | 2/2003 | Simonson |
| 2003/0032535 | A1 | 2/2003 | Wang |
| 2003/0033600 | A1 | 2/2003 | Cliff et al. |
| 2003/0040348 | A1 | 2/2003 | Martens |
| 2003/0041076 | A1 | 2/2003 | Lucovsky |
| 2003/0043986 | A1 | 3/2003 | Creamer et al. |
| 2003/0043989 | A1 | 3/2003 | Creamer et al. |
| 2003/0044021 | A1 | 3/2003 | Wilkinson |
| 2003/0045406 | A1 | 3/2003 | Stone |
| 2003/0060331 | A1 | 3/2003 | Polk |
| 2003/0060344 | A1 | 3/2003 | David |
| 2003/0060345 | A1 | 3/2003 | Piane |
| 2003/0063133 | A1 | 4/2003 | Foote et al. |

(56) References Cited

U.S. PATENT DOCUMENTS

2003/0065561 A1 4/2003 Brown et al.
2003/0069108 A1 4/2003 Rubinstein
2003/0073545 A1 4/2003 Liu
2003/0078138 A1 4/2003 Toyama
2003/0087737 A1 5/2003 Studdard
2003/0088196 A1 5/2003 Steve
2003/0089596 A1 5/2003 Tao et al.
2003/0092532 A1 5/2003 Giannelli et al.
2003/0092533 A1 5/2003 Hippensteel
2003/0092540 A1 5/2003 Gillen
2003/0092542 A1 5/2003 Bartholomew et al.
2003/0096675 A1 5/2003 Wang
2003/0096683 A1 5/2003 Fenelon
2003/0097878 A1 5/2003 Farringdon et al.
2003/0100406 A1 5/2003 Millington
2003/0100413 A1 5/2003 Huang
2003/0100415 A1 5/2003 Augustine et al.
2003/0104907 A1 6/2003 Sankrithi
2003/0104908 A1 6/2003 Tung
2003/0105390 A1 6/2003 Alessandri
2003/0114276 A1 6/2003 Schiff
2003/0114281 A1 6/2003 Mackert
2003/0115157 A1 6/2003 Circenis
2003/0115955 A1 6/2003 Keiser
2003/0119635 A1 6/2003 Arbuckle
2003/0122384 A1 7/2003 Swanson et al.
2003/0125165 A1 7/2003 Trevino
2003/0126593 A1 7/2003 Mault
2003/0128186 A1 7/2003 Laker
2003/0134714 A1 7/2003 Oishi et al.
2003/0134718 A1 7/2003 Kim
2003/0138761 A1 7/2003 Pesnell
2003/0139254 A1 7/2003 Chang
2003/0142951 A1 7/2003 Tsurugai
2003/0148853 A1 8/2003 Alessandri
2003/0148857 A1 8/2003 Yu
2003/0148862 A1 8/2003 Chen
2003/0149344 A1 8/2003 Nizan
2003/0153434 A1 8/2003 Dalebout
2003/0153436 A1 8/2003 Ho
2003/0153439 A1 8/2003 Krull
2003/0158014 A1 8/2003 Valentin-Sivico
2003/0158016 A1 8/2003 Kolda
2003/0158019 A1 8/2003 Giannelli
2003/0158024 A1 8/2003 Saure
2003/0163287 A1 8/2003 Vock et al.
2003/0165802 A1 9/2003 Murphy
2003/0166434 A1 9/2003 Lopez-Santillana et al.
2003/0171189 A1 9/2003 Kaufman
2003/0171190 A1 9/2003 Rice
2003/0171192 A1 9/2003 Wu
2003/0176261 A1 9/2003 Simonson et al.
2003/0176815 A1 9/2003 Baba et al.
2003/0181289 A1 9/2003 Oscar Moavro
2003/0181291 A1 9/2003 Ogawa
2003/0181293 A1 9/2003 Baatz
2003/0183027 A1 10/2003 Koch
2003/0186792 A1 10/2003 Keeler
2003/0195089 A1 10/2003 Schroeder
2003/0199368 A1 10/2003 Krull
2003/0207237 A1 11/2003 Glezerman
2003/0208113 A1 11/2003 Mault et al.
2003/0211449 A1 11/2003 Seiller
2003/0211916 A1 11/2003 Capuano
2003/0212536 A1 11/2003 Wang
2003/0214530 A1 11/2003 Wang
2003/0216227 A1 11/2003 Smith
2003/0216228 A1 11/2003 Rast
2003/0216229 A1 11/2003 Bastyr
2003/0216230 A1 11/2003 Wang
2003/0220143 A1 11/2003 Shteyn et al.
2003/0222419 A1 12/2003 Geary
2003/0224337 A1 12/2003 Shum et al.
2003/0227473 A1 12/2003 Shih
2003/0232703 A1 12/2003 Webber
2003/0232707 A1 12/2003 Dalebout et al.
2003/0236153 A1 12/2003 Pan et al.
2004/0005958 A1 1/2004 Kamen et al.
2004/0005959 A1 1/2004 Takizawa
2004/0005961 A1 1/2004 Iund
2004/0005965 A1 1/2004 Panatta
2004/0008220 A1 1/2004 Snyder et al.
2004/0009855 A1 1/2004 Webber
2004/0009856 A1 1/2004 Hammer
2004/0010420 A1 1/2004 Rooks
2004/0012335 A1 1/2004 Shon et al.
2004/0014014 A1 1/2004 Hess
2004/0014567 A1 1/2004 Mendel
2004/0014571 A1 1/2004 Haynes
2004/0018915 A1 1/2004 Reyes
2004/0018917 A1 1/2004 Corbalis
2004/0018918 A1 1/2004 Reyes
2004/0018920 A1 1/2004 Simonson
2004/0019654 A1 1/2004 Powers
2004/0021046 A1 2/2004 Hutchison
2004/0023759 A1 2/2004 Duncan et al.
2004/0023761 A1 2/2004 Emery
2004/0023762 A1 2/2004 Lull
2004/0023766 A1 2/2004 Slone
2004/0023778 A1 2/2004 Kusumoto et al.
2004/0025754 A1 2/2004 Dye
2004/0025993 A1 2/2004 Russell
2004/0027368 A1 2/2004 Snyder et al.
2004/0029645 A1 2/2004 Chen
2004/0030762 A1 2/2004 Silverthorne
2004/0033865 A1 2/2004 Wu
2004/0033866 A1 2/2004 Shapiro
2004/0043871 A1 3/2004 Chang
2004/0043873 A1 3/2004 Wilkinson et al.
2004/0046692 A1 3/2004 Robson
2004/0051392 A1 3/2004 Badarneh
2004/0053748 A1 3/2004 Lo et al.
2004/0053752 A1 3/2004 Yang
2004/0053756 A1 3/2004 Tremayne
2004/0054350 A1 3/2004 Shaughnessy
2004/0063549 A1 4/2004 Kuo
2004/0067821 A1 4/2004 Kehrbaum
2004/0067833 A1 4/2004 Talish
2004/0072652 A1 4/2004 Alessandri et al.
2004/0072659 A1 4/2004 Alessandri
2004/0072661 A1 4/2004 Krull
2004/0072662 A1 4/2004 Landfair
2004/0077462 A1 4/2004 Brown
2004/0077468 A1 4/2004 Myles
2004/0077975 A1 4/2004 Zimmerman
2004/0078208 A1 4/2004 Burwell
2004/0082444 A1 4/2004 Golesh
2004/0087420 A1 5/2004 Montesquieux
2004/0092367 A1 5/2004 Corbalis
2004/0095516 A1 5/2004 Rohlicek
2004/0097331 A1 5/2004 Zillig
2004/0097337 A1 5/2004 Chuang
2004/0097353 A1 5/2004 Mencis
2004/0100484 A1 5/2004 Barrett
2004/0102292 A1 5/2004 Pyles et al.
2004/0102931 A1 5/2004 Ellis
2004/0103146 A1 5/2004 Park
2004/0103432 A1 5/2004 Barrett
2004/0114768 A1 6/2004 Luo
2004/0116258 A1 6/2004 Hyder
2004/0116837 A1 6/2004 Yamaguchi
2004/0116899 A1 6/2004 Shaughnessy
2004/0117072 A1 6/2004 Takeda
2004/0117214 A1 6/2004 Shea
2004/0127285 A1 7/2004 Kavana
2004/0127334 A1 7/2004 Heppert
2004/0127335 A1 7/2004 Watterson
2004/0127336 A1 7/2004 Lapcevic
2004/0132586 A1 7/2004 Leighton et al.
2004/0132587 A1 7/2004 Leighton et al.
2004/0136750 A1 7/2004 Yoshioka et al.
2004/0138030 A1 7/2004 Wang
2004/0138032 A1 7/2004 Van Straaten
2004/0142799 A1 7/2004 Yeo

(56) References Cited

U.S. PATENT DOCUMENTS

2004/0142800 A1 7/2004 Gerschefske
2004/0142801 A1 7/2004 Lin
2004/0144626 A1 7/2004 Saeki
2004/0152566 A1 8/2004 Yeh
2004/0155622 A1 8/2004 Mayhew et al.
2004/0157546 A1 8/2004 Fantaay
2004/0157709 A1 8/2004 Olson
2004/0160336 A1 8/2004 Hoch
2004/0162188 A1 8/2004 Watterson
2004/0162189 A1 8/2004 Hickman
2004/0162191 A1 8/2004 Ercanbrack
2004/0162194 A1 8/2004 Habing
2004/0162196 A1 8/2004 Degroot
2004/0162198 A1 8/2004 Towley
2004/0163574 A1 8/2004 Schoenbach
2004/0166996 A1 8/2004 Kolda
2004/0166999 A1 8/2004 Dodge
2004/0171460 A1 9/2004 Park
2004/0171464 A1 9/2004 Ashby et al.
2004/0171465 A1 9/2004 Hald
2004/0176215 A1 9/2004 Gramaccioni
2004/0176217 A1 9/2004 Watterson
2004/0177531 A1 9/2004 Dibenedetto et al.
2004/0180719 A1 9/2004 Feldman
2004/0181972 A1 9/2004 Csorba
2004/0185988 A1 9/2004 Hsiung
2004/0186390 A1 9/2004 Ross et al.
2004/0192514 A1 9/2004 Piaget et al.
2004/0198555 A1 10/2004 Anderson
2004/0198559 A1 10/2004 Grossi
2004/0198569 A1 10/2004 Sanford-Schwentke
2004/0198571 A1 10/2004 Howell et al.
2004/0204294 A2 10/2004 Wilkinson
2004/0208943 A1 10/2004 Miketin
2004/0210661 A1 10/2004 Thompson
2004/0214693 A1 10/2004 Piaget et al.
2004/0215958 A1 10/2004 Ellis
2004/0220017 A1 11/2004 Gordon
2004/0220025 A1 11/2004 Krull
2004/0224740 A1 11/2004 Ball et al.
2004/0224825 A1 11/2004 Giannelli et al.
2004/0224827 A1 11/2004 Ashley
2004/0225239 A1 11/2004 Yamamoto
2004/0225532 A1 11/2004 Gadiyak
2004/0229730 A1 11/2004 Ainsworth
2004/0230138 A1 11/2004 Inoue et al.
2004/0242378 A1 12/2004 Pan
2004/0242379 A1 12/2004 Juva
2004/0242380 A1 12/2004 Kuivala
2004/0242388 A1 12/2004 Kusminsky
2004/0248699 A1 12/2004 Colley
2004/0248713 A1 12/2004 Campanaro
2004/0254020 A1 12/2004 Dragusin
2004/0256524 A1 12/2004 Beck et al.
2004/0259689 A1 12/2004 Wilkins et al.
2004/0260191 A1 12/2004 Stubbs
2004/0266587 A1 12/2004 Miller
2004/0266591 A1 12/2004 Alessandri
2004/0266961 A1 12/2004 Solan
2005/0003338 A1 1/2005 Norcott et al.
2005/0003931 A1 1/2005 Mills et al.
2005/0003933 A1 1/2005 Kau
2005/0003938 A1 1/2005 Henderson
2005/0008992 A1 1/2005 Westergaard et al.
2005/0009668 A1 1/2005 Savettiere
2005/0009672 A1 1/2005 Yeh
2005/0012622 A1 1/2005 Sutton
2005/0013433 A1 1/2005 Ghassabian
2005/0013658 A1 1/2005 Muders et al.
2005/0014571 A1 1/2005 Varner
2005/0014616 A1 1/2005 Tiahrt
2005/0015281 A1 1/2005 Clark et al.
2005/0020887 A1 1/2005 Goldberg
2005/0023292 A1 2/2005 Market et al.
2005/0026750 A1 2/2005 Oglesby et al.
2005/0026811 A1 2/2005 Mjalli
2005/0032610 A1 2/2005 Nelson
2005/0032611 A1 2/2005 Webber
2005/0037898 A1 2/2005 Chang
2005/0037904 A1 2/2005 Chang
2005/0038698 A1 2/2005 Lukose
2005/0038699 A1 2/2005 Lillibridge
2005/0043145 A1 2/2005 Anderson et al.
2005/0043146 A1 2/2005 Lo et al.
2005/0043155 A1 2/2005 Yannitte
2005/0044210 A1 2/2005 Ku
2005/0044984 A1 3/2005 Jones
2005/0048461 A1 3/2005 Lahteenmaki
2005/0049117 A1 3/2005 Rodgers
2005/0049121 A1 3/2005 Dalebout
2005/0049123 A1 3/2005 Dalebout et al.
2005/0054492 A1 3/2005 Neff
2005/0054940 A1 3/2005 Almen
2005/0060238 A1 3/2005 Gravina et al.
2005/0061587 A1 3/2005 Tsai
2005/0062841 A1 3/2005 Rivera-Cintron
2005/0064994 A1 3/2005 Matsumoto
2005/0065003 A1 3/2005 Klotzki
2005/0071462 A1 3/2005 Bodin et al.
2005/0071463 A1 3/2005 Bodin et al.
2005/0075213 A1 4/2005 Arick
2005/0075222 A1 4/2005 Adley
2005/0075903 A1 4/2005 Piccionelli
2005/0079905 A1 4/2005 Martens
2005/0079961 A1 4/2005 Dalebout
2005/0085348 A1 4/2005 Kiefer
2005/0085352 A1 4/2005 Baxter
2005/0090770 A1 4/2005 Chen
2005/0096187 A1 5/2005 Hsu
2005/0096189 A1 5/2005 Chen
2005/0096196 A1 5/2005 Webber
2005/0096197 A1 5/2005 Webber
2005/0096198 A1 5/2005 Webber
2005/0101458 A1 5/2005 Huang
2005/0101463 A1 5/2005 Chen
2005/0102172 A1 5/2005 Sirmans, Jr.
2005/0107216 A1 5/2005 Lee et al.
2005/0107220 A1 5/2005 Wang
2005/0107226 A1 5/2005 Monda
2005/0107723 A1 5/2005 Wehman et al.
2005/0107726 A1 5/2005 Oyen
2005/0112601 A1 5/2005 Hassibi
2005/0113158 A1 5/2005 Sterchi et al.
2005/0113223 A1 5/2005 Dovner et al.
2005/0113652 A1 5/2005 Stark et al.
2005/0113723 A1 5/2005 Ueyama
2005/0124463 A1 6/2005 Yeo et al.
2005/0124471 A1 6/2005 Wilkinson
2005/0129253 A1 6/2005 Chen
2005/0129903 A1 6/2005 Carr
2005/0130807 A1 6/2005 Cutler
2005/0130814 A1 6/2005 Nitta et al.
2005/0131319 A1 6/2005 Der Meer
2005/0132838 A1 6/2005 Lin
2005/0143226 A1 6/2005 Heidecke
2005/0143228 A1 6/2005 Lee
2005/0143230 A1 6/2005 Dalebout
2005/0148398 A1 7/2005 Lochtefeld et al.
2005/0148439 A1 7/2005 Wu
2005/0148440 A1 7/2005 Denton
2005/0148442 A1 7/2005 Watterson
2005/0148443 A1 7/2005 Watterson
2005/0148445 A1 7/2005 Carle
2005/0159273 A1 7/2005 Chen
2005/0159277 A1 7/2005 Mcvay
2005/0159278 A1 7/2005 Mcvay
2005/0159712 A1 7/2005 Andersen
2005/0160141 A1 7/2005 Galley
2005/0164832 A1 7/2005 Maschke
2005/0164837 A1 7/2005 Anderson
2005/0164838 A1 7/2005 Watterson
2005/0164839 A1 7/2005 Watterson
2005/0164853 A1 7/2005 Naidus
2005/0167907 A1 8/2005 Curkendall et al.

(56) References Cited

U.S. PATENT DOCUMENTS

2005/0170935 A1 8/2005 Manser
2005/0170936 A1 8/2005 Quinn
2005/0170937 A1 8/2005 van Straaten
2005/0172311 A1 8/2005 Hjelt et al.
2005/0176560 A1 8/2005 Chen
2005/0178210 A1 8/2005 Lanham
2005/0181347 A1 8/2005 Barnes et al.
2005/0181911 A1 8/2005 Porth
2005/0181916 A1 8/2005 Frost et al.
2005/0187075 A1 8/2005 Bellamy
2005/0187082 A1 8/2005 Bowser
2005/0187704 A1 8/2005 Peters
2005/0192162 A1 9/2005 Pan
2005/0192163 A1 9/2005 Pan et al.
2005/0195094 A1 9/2005 White
2005/0196737 A1 9/2005 Mann
2005/0202862 A1 9/2005 Shuman et al.
2005/0202934 A1 9/2005 Olrik et al.
2005/0209051 A1 9/2005 Santomassimo et al.
2005/0209052 A1 9/2005 Ashby
2005/0209056 A1 9/2005 Daly
2005/0209060 A1 9/2005 Lull
2005/0209062 A1 9/2005 Anderson et al.
2005/0209887 A1 9/2005 Pollner
2005/0210169 A1 9/2005 Chou
2005/0212202 A1 9/2005 Meyer
2005/0213442 A1 9/2005 Sako
2005/0215335 A1 9/2005 Marquardt
2005/0215397 A1 9/2005 Watterson
2005/0221962 A1 10/2005 Warner et al.
2005/0227811 A1 10/2005 Shum et al.
2005/0227820 A1 10/2005 Dyer et al.
2005/0227826 A1 10/2005 Oga
2005/0227831 A1 10/2005 Mills
2005/0227832 A1 10/2005 Wu
2005/0228245 A1 10/2005 Quy
2005/0228883 A1 10/2005 Brown
2005/0229367 A1 10/2005 Thompson
2005/0233859 A1 10/2005 Takai
2005/0233861 A1 10/2005 Hickman
2005/0233866 A1 10/2005 Miyamaru et al.
2005/0233871 A1 10/2005 Anders
2005/0233873 A1 10/2005 Chen
2005/0238182 A1 10/2005 Shih et al.
2005/0239600 A1 10/2005 Liang
2005/0239601 A1 10/2005 Thomas
2005/0239607 A1 10/2005 Chang
2005/0239612 A1 10/2005 Keiser
2005/0240444 A1 10/2005 Wooten
2005/0245365 A1 11/2005 Rolli
2005/0245370 A1 11/2005 Boland
2005/0245431 A1 11/2005 Demmer et al.
2005/0248713 A1 11/2005 Hirosue et al.
2005/0250619 A1 11/2005 Daikeler et al.
2005/0250622 A1 11/2005 Chang
2005/0261609 A1 11/2005 Collings et al.
2005/0266961 A1 12/2005 Shum et al.
2005/0269601 A1 12/2005 Tsubaki
2005/0272561 A1 12/2005 Cammerata
2005/0272562 A1 12/2005 Alessandri et al.
2005/0272575 A1 12/2005 Melegati
2005/0272577 A1 12/2005 Olson
2005/0274188 A1 12/2005 Cabanis et al.
2005/0277520 A1 12/2005 Van Waes
2005/0277525 A1 12/2005 Liu
2005/0281963 A1 12/2005 Cook
2005/0283051 A1 12/2005 Chen
2005/0283911 A1 12/2005 Roussy
2005/0288155 A1 12/2005 Yang
2005/0288954 A1 12/2005 McCarthy et al.
2006/0003869 A1 1/2006 Huang et al.
2006/0003876 A1 1/2006 Duhamel
2006/0003877 A1 1/2006 Harmon
2006/0004265 A1 1/2006 Pulkkinen et al.
2006/0006005 A1 1/2006 Dumornay
2006/0009332 A1 1/2006 Jones
2006/0013351 A1 1/2006 Crider
2006/0019224 A1 1/2006 Behar et al.
2006/0019804 A1 1/2006 Young
2006/0019806 A1 1/2006 Mikulski
2006/0020174 A1 1/2006 Matsumura
2006/0020556 A1 1/2006 Hamnen
2006/0020990 A1 1/2006 McEneaney
2006/0021155 A1 2/2006 Lang et al.
2006/0025287 A1 2/2006 Chermack
2006/0030462 A1 2/2006 Ish
2006/0030465 A1 2/2006 Johnson
2006/0033392 A1 2/2006 Ritchey
2006/0034161 A1 2/2006 Muller
2006/0035757 A1 2/2006 Flick et al.
2006/0035758 A1 2/2006 Rogozinski
2006/0035764 A1 2/2006 Webber
2006/0035768 A1 2/2006 Kowallis
2006/0035772 A1 2/2006 Golesh et al.
2006/0035774 A1 2/2006 Marks
2006/0040244 A1 2/2006 Kain
2006/0040246 A1 2/2006 Ding et al.
2006/0040793 A1 2/2006 Martens
2006/0040797 A1 2/2006 Chang
2006/0040798 A1 2/2006 Weier et al.
2006/0040810 A1 2/2006 Chu
2006/0046807 A1 3/2006 Sanchez
2006/0046898 A1 3/2006 Harvey
2006/0046905 A1 3/2006 Doody, Jr.
2006/0047447 A1 3/2006 Brady et al.
2006/0052220 A1 3/2006 Jackson et al.
2006/0052222 A1 3/2006 Cardenas
2006/0053586 A1 3/2006 Chase
2006/0053587 A1 3/2006 Chase
2006/0058155 A1 3/2006 Kumar
2006/0058158 A1 3/2006 McAvoy
2006/0058162 A1 3/2006 Vieno et al.
2006/0063644 A1 3/2006 Yang
2006/0063980 A1 3/2006 Hwang et al.
2006/0068978 A1 3/2006 Moon
2006/0069102 A1 3/2006 Leban et al.
2006/0075544 A1 4/2006 Kriesel
2006/0079800 A1 4/2006 Martikka et al.
2006/0084422 A1 4/2006 Huang et al.
2006/0084551 A1 4/2006 Volpe, Jr.
2006/0084556 A1 4/2006 Payne
2006/0084851 A1 4/2006 Lee et al.
2006/0089238 A1 4/2006 Huang et al.
2006/0094569 A1 5/2006 Day
2006/0094570 A1 5/2006 Schneider
2006/0097453 A1 5/2006 Feldman
2006/0100069 A1 5/2006 Dibble et al.
2006/0100070 A1 5/2006 Abdo
2006/0100546 A1 5/2006 Silk
2006/0104047 A1 5/2006 Guzman
2006/0105888 A1 5/2006 Piane, Jr.
2006/0105889 A1 5/2006 Webb
2006/0111944 A1 5/2006 Sirmans, Jr.
2006/0116253 A1 6/2006 Nizam
2006/0116254 A1 6/2006 Webber
2006/0116558 A1 6/2006 Jang
2006/0122034 A1 6/2006 Chen
2006/0122035 A1 6/2006 Felix
2006/0122038 A1 6/2006 Chou Lin
2006/0122044 A1 6/2006 Ho
2006/0122468 A1 6/2006 Tavor
2006/0122474 A1 6/2006 Teller et al.
2006/0123814 A1 6/2006 Choi et al.
2006/0128534 A1 6/2006 Roque
2006/0128540 A1 6/2006 Engle
2006/0129432 A1 6/2006 Choi et al.
2006/0132070 A1 6/2006 Heydt et al.
2006/0135274 A1 6/2006 Henry
2006/0135322 A1 6/2006 Rocker
2006/0142665 A1 6/2006 Garay et al.
2006/0148622 A1 7/2006 Chen
2006/0151303 A1 7/2006 Motoda
2006/0155576 A1 7/2006 Deluz
2006/0160639 A1 7/2006 Klein

(56) References Cited

U.S. PATENT DOCUMENTS

2006/0160665 A1 7/2006 Tai
2006/0160666 A1 7/2006 Wang
2006/0160667 A1 7/2006 Oglesby et al.
2006/0160677 A1 7/2006 Piane, Jr.
2006/0160681 A1 7/2006 McBride et al.
2006/0161455 A1 7/2006 Anastasia
2006/0161621 A1 7/2006 Rosenberg
2006/0161656 A1 7/2006 Sorvisto
2006/0161850 A1 7/2006 Seaberg
2006/0166737 A1 7/2006 Bentley
2006/0166790 A1 7/2006 Wang
2006/0166791 A1 7/2006 Liao
2006/0166798 A1 7/2006 Nelson
2006/0166799 A1 7/2006 Boland et al.
2006/0172862 A1 8/2006 Badarneh et al.
2006/0173556 A1 8/2006 Rosenberg
2006/0173828 A1 8/2006 Rosenberg
2006/0179044 A1 8/2006 Rosenberg
2006/0179056 A1 8/2006 Rosenberg
2006/0183602 A1 8/2006 Astilean
2006/0183980 A1 8/2006 Yang
2006/0184427 A1 8/2006 Singh
2006/0186197 A1 8/2006 Rosenberg
2006/0189439 A1 8/2006 Baudhuin
2006/0189440 A1 8/2006 Gravagne
2006/0189458 A1 8/2006 Walkerdine
2006/0189460 A1 8/2006 Katterjohn
2006/0189462 A1 8/2006 Pearson et al.
2006/0189854 A1 8/2006 Webb et al.
2006/0194679 A1 8/2006 Hatcher
2006/0195361 A1 8/2006 Rosenberg
2006/0198613 A1 9/2006 Lee
2006/0199155 A1 9/2006 Mosher
2006/0199706 A1 9/2006 Wehrell
2006/0203972 A1 9/2006 Hays
2006/0205349 A1 9/2006 Passier et al.
2006/0205564 A1 9/2006 Peterson
2006/0205568 A1 9/2006 Huang
2006/0205569 A1 9/2006 Watterson
2006/0205571 A1 9/2006 Krull
2006/0217231 A1 9/2006 Parks et al.
2006/0217236 A1 9/2006 Watterson
2006/0217240 A1 9/2006 White
2006/0217242 A1 9/2006 Karpachev
2006/0217245 A1 9/2006 Golesh et al.
2006/0218253 A1 9/2006 Hays
2006/0223635 A1 10/2006 Rosenberg
2006/0223637 A1 10/2006 Rosenberg
2006/0223674 A1 10/2006 Korkie
2006/0223680 A1 10/2006 Chang
2006/0223681 A1 10/2006 Loane
2006/0224051 A1 10/2006 Teller et al.
2006/0228683 A1 10/2006 Jianping
2006/0229058 A1 10/2006 Rosenberg
2006/0229163 A1 10/2006 Waters
2006/0229164 A1 10/2006 Einav
2006/0229170 A1 10/2006 Ozawa et al.
2006/0232147 A1 10/2006 Cheng
2006/0234832 A1 10/2006 Toyama et al.
2006/0234840 A1 10/2006 Watson
2006/0240947 A1 10/2006 Qu
2006/0240951 A1 10/2006 Wang
2006/0240956 A1 10/2006 Piane, Jr.
2006/0240959 A1 10/2006 Huang
2006/0244187 A1 11/2006 Downey
2006/0247095 A1 11/2006 Rummerfield
2006/0247098 A1 11/2006 Raniere
2006/0247107 A1 11/2006 Carter
2006/0247109 A1 11/2006 Powell
2006/0248965 A1 11/2006 Wyatt
2006/0250524 A1 11/2006 Roche
2006/0251638 A1 11/2006 Guenzler-Pukall
2006/0252600 A1 11/2006 Grogan
2006/0252602 A1 11/2006 Brown
2006/0252608 A1 11/2006 Kang et al.
2006/0252612 A1 11/2006 Sofun
2006/0253010 A1 11/2006 Brady et al.
2006/0253210 A1 11/2006 Rosenberg
2006/0256007 A1 11/2006 Rosenberg
2006/0256008 A1 11/2006 Rosenberg
2006/0258513 A1 11/2006 Routley
2006/0258515 A1 11/2006 Kang et al.
2006/0258519 A1 11/2006 Ardito, III et al.
2006/0259275 A1 11/2006 Maschke
2006/0259574 A1 11/2006 Rosenberg
2006/0262752 A1 11/2006 Moore et al.
2006/0264299 A1 11/2006 Farinelli et al.
2006/0264306 A1 11/2006 Tischler
2006/0264730 A1 11/2006 Stivoric et al.
2006/0265469 A1 11/2006 Estrade
2006/0269251 A1 11/2006 Hsu
2006/0270522 A1 11/2006 Yonehana et al.
2006/0271286 A1 11/2006 Rosenberg
2006/0276306 A1 12/2006 Pan et al.
2006/0279294 A1 12/2006 Cehelnik
2006/0281603 A1 12/2006 Hickman
2006/0281605 A1 12/2006 Lo
2006/0281608 A1 12/2006 Tumminello
2006/0283050 A1 12/2006 Carnes et al.
2006/0287089 A1 12/2006 Addington et al.
2006/0287147 A1 12/2006 Kriesel
2006/0287161 A1 12/2006 Dalebout
2006/0287163 A1 12/2006 Wang
2006/0288846 A1 12/2006 Logan
2006/0293156 A1 12/2006 Trees
2006/0293608 A1 12/2006 Rothman et al.
2006/0293617 A1 12/2006 Einav et al.
2007/0000154 A1 1/2007 Dibenedetto
2007/0004561 A1 1/2007 Yoo
2007/0004562 A1 1/2007 Pan et al.
2007/0004565 A1 1/2007 Gebhardt
2007/0004569 A1 1/2007 Cao
2007/0004736 A1 1/2007 Kubo
2007/0005395 A1 1/2007 Singh
2007/0006489 A1 1/2007 Case, Jr. et al.
2007/0010383 A1 1/2007 Pertegaz-Esteban
2007/0011027 A1 1/2007 Melendez
2007/0011391 A1 1/2007 Kim et al.
2007/0011920 A1 1/2007 DiBenedetto et al.
2007/0013655 A1 1/2007 Rosenberg et al.
2007/0014422 A1 1/2007 Wesemann et al.
2007/0015635 A1 1/2007 Donner
2007/0015636 A1 1/2007 Molter
2007/0015644 A1 1/2007 Aucamp
2007/0015752 A1 1/2007 Hangauer, Jr.
2007/0016444 A1 1/2007 Holkkola
2007/0016930 A1 1/2007 Wesemann
2007/0017025 A1 1/2007 Myer
2007/0018465 A1 1/2007 Vassilakos
2007/0021280 A1 1/2007 Tyree
2007/0026958 A1 2/2007 Barasch et al.
2007/0026999 A1 2/2007 Merolle et al.
2007/0027000 A1 2/2007 Shirai et al.
2007/0027002 A1 2/2007 Clark et al.
2007/0027003 A1 2/2007 Clark
2007/0028749 A1 2/2007 Basson
2007/0032345 A1 2/2007 Padmanabhan
2007/0032351 A1 2/2007 Reyes
2007/0032353 A1 2/2007 Wilkins et al.
2007/0032481 A1 2/2007 Dvorak
2007/0033012 A1 2/2007 Rosenberg
2007/0033068 A1 2/2007 Rao
2007/0033069 A1 2/2007 Rao
2007/0037667 A1 2/2007 Gordon
2007/0037676 A1 2/2007 Denisco
2007/0038038 A1 2/2007 Stivoric et al.
2007/0038137 A1 2/2007 Arand et al.
2007/0038153 A1 2/2007 Basson
2007/0042866 A1 2/2007 Skilken
2007/0042868 A1 2/2007 Fisher
2007/0042878 A1 2/2007 Lundquist
2007/0049384 A1 3/2007 King et al.
2007/0049461 A1 3/2007 Kim et al.
2007/0049462 A1 3/2007 Asukai et al.

(56) References Cited

U.S. PATENT DOCUMENTS

2007/0049464 A1 3/2007 Chou
2007/0049465 A1 3/2007 Wu
2007/0049466 A1 3/2007 Hubbard
2007/0049470 A1 3/2007 Pyles et al.
2007/0051369 A1 3/2007 Choi
2007/0054778 A1 3/2007 Blanarovich
2007/0054790 A1 3/2007 Dodge et al.
2007/0057001 A1 3/2007 Wang
2007/0060408 A1 3/2007 Schultz et al.
2007/0060446 A1 3/2007 Asukai et al.
2007/0060449 A1 3/2007 Lo
2007/0060450 A1 3/2007 Lo
2007/0060451 A1 3/2007 Lucas
2007/0060898 A1 3/2007 Shaughnessy
2007/0061314 A1 3/2007 Rosenberg
2007/0063033 A1 3/2007 Silverbrook et al.
2007/0066448 A1 3/2007 Pan et al.
2007/0072156 A1 3/2007 Kaufman et al.
2007/0072748 A1 3/2007 Lee
2007/0072752 A1 3/2007 Koch
2007/0074617 A1 4/2007 Vergo
2007/0075127 A1 4/2007 Rosenberg
2007/0079691 A1 4/2007 Turner
2007/0083095 A1 4/2007 Rippo et al.
2007/0083323 A1 4/2007 Rosenberg
2007/0083975 A1 4/2007 Senegal
2007/0087908 A1 4/2007 Pan et al.
2007/0087918 A1 4/2007 Towley et al.
2007/0087920 A1 4/2007 Dachraoui et al.
2007/0093360 A1 4/2007 Neff
2007/0093369 A1 4/2007 Bocchicchio
2007/0099780 A1 5/2007 Bowser
2007/0100595 A1 5/2007 Earles
2007/0100666 A1 5/2007 Stivoric et al.
2007/0106484 A1 5/2007 Sweatman et al.
2007/0109491 A1 5/2007 Howell et al.
2007/0111753 A1 5/2007 Vock
2007/0111858 A1 5/2007 Dugan
2007/0111866 A1 5/2007 McVay et al.
2007/0117680 A1 5/2007 Neff
2007/0117683 A1 5/2007 Ercanbrack et al.
2007/0117693 A1 5/2007 Ilioi
2007/0122786 A1 5/2007 Relan et al.
2007/0123389 A1 5/2007 Martin
2007/0123390 A1 5/2007 Mathis
2007/0123395 A1 5/2007 Ellis
2007/0123396 A1 5/2007 Ellis
2007/0124762 A1 5/2007 Chickering et al.
2007/0129220 A1 6/2007 Bardha
2007/0129907 A1 6/2007 Demon
2007/0131409 A1 6/2007 Asahi
2007/0135264 A1 6/2007 Rosenberg
2007/0135272 A1 6/2007 Stuckey
2007/0135276 A1 6/2007 Alessandri
2007/0135279 A1 6/2007 Purdy et al.
2007/0135738 A1 6/2007 Bonutti
2007/0136093 A1 6/2007 Rankin et al.
2007/0137307 A1 6/2007 Gruben
2007/0137331 A1 6/2007 Kachouh
2007/0140403 A1 6/2007 Yuguchi et al.
2007/0141871 A1 6/2007 Scherer et al.
2007/0142175 A1 6/2007 Morgan
2007/0142177 A1 6/2007 Simms et al.
2007/0142179 A1 6/2007 Terao et al.
2007/0142183 A1 6/2007 Chang
2007/0142187 A1 6/2007 Kolomeir
2007/0146347 A1 6/2007 Rosenberg
2007/0149362 A1 6/2007 Lee et al.
2007/0149363 A1 6/2007 Wang
2007/0149364 A1 6/2007 Blau
2007/0150188 A1 6/2007 Rosenberg
2007/0151489 A1 7/2007 Byrne
2007/0153639 A1 7/2007 Lafever
2007/0155277 A1 7/2007 Amitai et al.
2007/0155495 A1 7/2007 Goo
2007/0155589 A1 7/2007 Feldman
2007/0155600 A1 7/2007 Cunningham
2007/0156335 A1 7/2007 McBride et al.
2007/0161459 A1 7/2007 Watson
2007/0161466 A1 7/2007 Oglesby et al.
2007/0161468 A1 7/2007 Yanagisawa et al.
2007/0161470 A1 7/2007 Berryman
2007/0161472 A1 7/2007 Drechsler
2007/0161480 A1 7/2007 Trancart
2007/0167291 A1 7/2007 Kuo
2007/0167292 A1 7/2007 Kuo
2007/0167293 A1 7/2007 Nally
2007/0167299 A1 7/2007 Simonson et al.
2007/0167300 A1 7/2007 Krull
2007/0169381 A1 7/2007 Gordon
2007/0173355 A1 7/2007 Klein
2007/0173384 A1 7/2007 Sechrest et al.
2007/0173392 A1 7/2007 Stanford
2007/0176035 A1 8/2007 Campbell
2007/0179023 A1 8/2007 Dyer
2007/0179030 A1 8/2007 Slawinski
2007/0179359 A1 8/2007 Goodwin
2007/0180737 A1 8/2007 DiBenedetto et al.
2007/0184944 A1 8/2007 Huang
2007/0184953 A1 8/2007 Luberski et al.
2007/0189544 A1 8/2007 Rosenberg
2007/0190508 A1 8/2007 Dalton
2007/0191141 A1 8/2007 Weber
2007/0191190 A1 8/2007 Kuo
2007/0191197 A1 8/2007 Vittone
2007/0197193 A1 8/2007 Zhou
2007/0197274 A1 8/2007 Dugan
2007/0197345 A1 8/2007 Wallace et al.
2007/0197346 A1 8/2007 Seliber
2007/0197353 A1 8/2007 Hundley
2007/0197920 A1 8/2007 Adams
2007/0201727 A1 8/2007 Birrell et al.
2007/0202992 A1 8/2007 Grasshoff
2007/0203001 A1 8/2007 Krull
2007/0203004 A1 8/2007 Campanaro et al.
2007/0204430 A1 9/2007 Chase
2007/0207733 A1 9/2007 Wong et al.
2007/0207902 A1 9/2007 Tiahrt
2007/0208392 A1 9/2007 Kuschner et al.
2007/0208530 A1 9/2007 Vock
2007/0213110 A1 9/2007 Rosenberg
2007/0213126 A1 9/2007 Deutsch et al.
2007/0213178 A1 9/2007 Lemmela
2007/0213183 A1 9/2007 Menektchiev
2007/0213185 A1 9/2007 Habing
2007/0214630 A1 9/2007 Kim
2007/0218432 A1 9/2007 Glass
2007/0219057 A1 9/2007 Fleishman
2007/0219058 A1 9/2007 Fleishman
2007/0219059 A1 9/2007 Schwartz
2007/0219062 A1 9/2007 Rodgers
2007/0219066 A1 9/2007 Wang
2007/0219068 A1 9/2007 Korfmacher
2007/0219074 A1 9/2007 Pride
2007/0219457 A1 9/2007 Lo
2007/0225118 A1 9/2007 Giorno
2007/0225119 A1 9/2007 Schenk
2007/0225120 A1 9/2007 Schenk
2007/0225126 A1 9/2007 Yoo
2007/0225127 A1 9/2007 Pan et al.
2007/0225136 A1 9/2007 Roman
2007/0225622 A1 9/2007 Huang et al.
2007/0232450 A1 10/2007 Hanoun
2007/0232453 A1 10/2007 Hanoun
2007/0232461 A1 10/2007 Jenkins et al.
2007/0232462 A1 10/2007 Webber
2007/0232463 A1 10/2007 Wu
2007/0233743 A1 10/2007 Rosenberg
2007/0239479 A1 10/2007 Arrasvuori
2007/0243974 A1 10/2007 Li
2007/0243975 A1 10/2007 Gearon
2007/0245258 A1 10/2007 Ginggen et al.
2007/0245612 A1 10/2007 Tresenfeld
2007/0247320 A1 10/2007 Morahan

(56) References Cited

U.S. PATENT DOCUMENTS

2007/0249467 A1 10/2007 Hong et al.
2007/0249468 A1 10/2007 Chen
2007/0254778 A1 11/2007 Ashby
2007/0254785 A1 11/2007 Lin
2007/0259759 A1 11/2007 Sumners et al.
2007/0259763 A1 11/2007 McKeown et al.
2007/0260184 A1 11/2007 Justis et al.
2007/0260255 A1 11/2007 Haddock et al.
2007/0260482 A1 11/2007 Nurmela
2007/0265146 A1 11/2007 Kowalczewski
2007/0270284 A1 11/2007 Lin
2007/0270294 A1 11/2007 Sheets
2007/0270663 A1 11/2007 Ng et al.
2007/0270667 A1 11/2007 Coppi et al.
2007/0270721 A1 11/2007 Ananny et al.
2007/0270726 A1 11/2007 Chou
2007/0271065 A1 11/2007 Gupta et al.
2007/0271116 A1 11/2007 Wysocki et al.
2007/0271387 A1 11/2007 Lydon et al.
2007/0272011 A1 11/2007 Chapa, Jr.
2007/0275825 A1 11/2007 O'brien
2007/0275826 A1 11/2007 Niemimaki et al.
2007/0275830 A1 11/2007 Lee
2007/0276870 A1 11/2007 Rosenberg
2007/0281828 A1 12/2007 Rice
2007/0281831 A1 12/2007 Wang
2007/0281836 A1 12/2007 Gearon
2007/0283853 A1 12/2007 Sun
2007/0284495 A1 12/2007 Charles
2007/0287141 A1 12/2007 Milner
2007/0287597 A1 12/2007 Cameron
2007/0287600 A1 12/2007 Prenatt
2007/0287601 A1 12/2007 Burck et al.
2007/0287606 A1 12/2007 Mac Millan
2007/0287611 A1 12/2007 Januszek
2007/0287930 A1 12/2007 Sutton
2007/0288204 A1 12/2007 Gienke et al.
2007/0288251 A1 12/2007 Ebrom et al.
2007/0288331 A1 12/2007 Ebrom et al.
2007/0288476 A1 12/2007 Flanagan, III
2007/0288969 A1 12/2007 Prum
2007/0293377 A1 12/2007 Webber
2007/0293378 A1 12/2007 Webber
2007/0293781 A1 12/2007 Sims et al.
2007/0296313 A1 12/2007 Wang
2007/0298405 A1 12/2007 Ebrom
2007/0298935 A1 12/2007 Badarneh
2007/0298937 A1 12/2007 Shah
2007/0298941 A1 12/2007 Egger
2007/0298945 A1 12/2007 Mehta
2007/0298947 A1 12/2007 Eksteen
2008/0001772 A1 1/2008 Saito
2008/0001866 A1 1/2008 Martin
2008/0004162 A1 1/2008 Chen
2008/0005276 A1 1/2008 Frederick
2008/0009275 A1 1/2008 Werner
2008/0015061 A1 1/2008 Klein
2008/0015087 A1 1/2008 Negrin
2008/0015088 A1 1/2008 Del Monaco
2008/0015094 A1 1/2008 Casagrande
2008/0018211 A1 1/2008 Dye
2008/0020898 A1 1/2008 Pyles et al.
2008/0020902 A1 1/2008 Arnold
2008/0020907 A1 1/2008 Lin
2008/0020911 A1 1/2008 Castello Neto
2008/0020912 A1 1/2008 Dalebout et al.
2008/0026658 A1 1/2008 Kriesel
2008/0026838 A1 1/2008 Dunstan et al.
2008/0027337 A1 1/2008 Dugan
2008/0027673 A1 1/2008 Trumm
2008/0032864 A1 2/2008 Hakki
2008/0032865 A1 2/2008 Wu
2008/0032870 A1 2/2008 Wu
2008/0032871 A1 2/2008 Yeh
2008/0032873 A1 2/2008 Towley
2008/0037375 A1 2/2008 Ellner et al.
2008/0039301 A1 2/2008 Halbridge
2008/0039302 A1 2/2008 Grant
2008/0045384 A1 2/2008 Matsubara
2008/0046246 A1 2/2008 Ayman Hakki
2008/0051256 A1 2/2008 Ashby et al.
2008/0051258 A1 2/2008 Schmehl et al.
2008/0051260 A1 2/2008 Simonson
2008/0051261 A1 2/2008 Lewis
2008/0051919 A1 2/2008 Sakai et al.
2008/0051993 A1 2/2008 Graham
2008/0057889 A1 3/2008 Jan
2008/0058169 A1 3/2008 Fox
2008/0058170 A1 3/2008 Giannascoli et al.
2008/0058172 A1 3/2008 Tyree
2008/0058176 A1 3/2008 Webber et al.
2008/0058177 A1 3/2008 Webber
2008/0059064 A1 3/2008 Werner
2008/0062818 A1 3/2008 Plancon et al.
2008/0064571 A1 3/2008 Lee
2008/0064576 A1 3/2008 Tyree
2008/0067302 A1 3/2008 Olivera
2008/0068559 A1 3/2008 Howell et al.
2008/0070755 A1 3/2008 Mckee
2008/0070756 A1 3/2008 Chu
2008/0070761 A1 3/2008 Lin
2008/0070765 A1 3/2008 Brown et al.
2008/0070766 A1 3/2008 Brown et al.
2008/0076637 A1 3/2008 Gilley et al.
2008/0076969 A1 3/2008 Kraft
2008/0076972 A1 3/2008 Dorogusker et al.
2008/0077489 A1 3/2008 Gilley et al.
2008/0077619 A1 3/2008 Gilley et al.
2008/0082311 A1 4/2008 Meijer et al.
2008/0085819 A1 4/2008 Yang et al.
2008/0085820 A1 4/2008 Majkrzak
2008/0085821 A1 4/2008 Webb
2008/0086318 A1 4/2008 Gilley et al.
2008/0089551 A1 4/2008 Heather et al.
2008/0096726 A1 4/2008 Riley et al.
2008/0096735 A1 4/2008 Grider
2008/0096745 A1 4/2008 Perry
2008/0097633 A1 4/2008 Jochelson et al.
2008/0098797 A1 5/2008 Considine
2008/0103023 A1 5/2008 Chung
2008/0103024 A1 5/2008 Habing
2008/0103030 A1 5/2008 Watson et al.
2008/0103034 A1 5/2008 Mihara et al.
2008/0108481 A1 5/2008 Limma
2008/0108483 A1 5/2008 Fife
2008/0108917 A1 5/2008 Joutras et al.
2008/0109121 A1 5/2008 Takeda
2008/0109243 A1 5/2008 Ebrom et al.
2008/0109295 A1 5/2008 McConochie et al.
2008/0109310 A1 5/2008 Ebrom et al.
2008/0109841 A1 5/2008 Healther et al.
2008/0109851 A1 5/2008 Healther et al.
2008/0119332 A1 5/2008 Roman
2008/0119333 A1 5/2008 Bowser
2008/0119337 A1 5/2008 Wilkins
2008/0120436 A1 5/2008 Cowgill et al.
2008/0129825 A1 6/2008 DeAngelis et al.
2008/0132386 A1 6/2008 Helie
2008/0132389 A1 6/2008 Webber
2008/0132391 A1 6/2008 Edeker
2008/0132798 A1 6/2008 Hong et al.
2008/0139370 A1 6/2008 Charnitski
2008/0141135 A1 6/2008 Mason et al.
2008/0146334 A1 6/2008 Kil
2008/0146336 A1 6/2008 Feldman
2008/0146416 A1 6/2008 Mueller et al.
2008/0146418 A1 6/2008 Summers
2008/0146890 A1 6/2008 LeBoeuf et al.
2008/0146892 A1 6/2008 LeBoeuf et al.
2008/0147502 A1 6/2008 Baker
2008/0153670 A1 6/2008 Mckirdy
2008/0153671 A1 6/2008 Ogg et al.
2008/0153676 A1 6/2008 Krietzman
2008/0153677 A1 6/2008 Webber et al.

(56) References Cited

U.S. PATENT DOCUMENTS

2008/0153682 A1 6/2008 Chen et al.
2008/0155077 A1 6/2008 James
2008/0161168 A1 7/2008 Hsiao
2008/0161170 A1 7/2008 Lumpee
2008/0161653 A1 7/2008 Lin et al.
2008/0167535 A1 7/2008 Stivoric et al.
2008/0167536 A1 7/2008 Teller
2008/0167958 A1 7/2008 Balmadur Anstalt
2008/0171636 A1 7/2008 Usui et al.
2008/0171640 A1 7/2008 Chang
2008/0171922 A1 7/2008 Teller
2008/0171945 A1 7/2008 Dotter
2008/0172328 A1 7/2008 Ajilian
2008/0176655 A1 7/2008 James
2008/0176713 A1 7/2008 Olivera Brizzio
2008/0176717 A1 7/2008 Wang
2008/0176718 A1 7/2008 Wang
2008/0176721 A1 7/2008 Boren
2008/0176722 A1 7/2008 Steffee
2008/0179214 A1 7/2008 Hall
2008/0182685 A1 7/2008 Marty et al.
2008/0182724 A1 7/2008 Guthrie
2008/0182731 A1 7/2008 Vittone
2008/0182732 A1 7/2008 Webber et al.
2008/0183049 A1 7/2008 Karkanias et al.
2008/0183052 A1 7/2008 Teller
2008/0187689 A1 8/2008 Dierkens et al.
2008/0188354 A1 8/2008 Pauws et al.
2008/0188362 A1 8/2008 Chen
2008/0189733 A1 8/2008 Apostolopoulos
2008/0190745 A1 8/2008 Taniguchi et al.
2008/0191864 A1 8/2008 Wolfson
2008/0195258 A1 8/2008 Schendel
2008/0200287 A1 8/2008 Marty et al.
2008/0200310 A1 8/2008 Tagliabue
2008/0200312 A1 8/2008 Tagliabue
2008/0200314 A1 8/2008 Dalebout et al.
2008/0200778 A1 8/2008 Taskinen
2008/0200853 A1 8/2008 Tielve
2008/0204225 A1 8/2008 Kitchen
2008/0207401 A1 8/2008 Harding
2008/0207402 A1 8/2008 Fisher et al.
2008/0207407 A1 8/2008 Yeh
2008/0207415 A1 8/2008 Tsai
2008/0214358 A1 9/2008 Ogg et al.
2008/0214359 A1 9/2008 Niva et al.
2008/0214365 A1 9/2008 Webber et al.
2008/0214367 A1 9/2008 Webber et al.
2008/0214903 A1 9/2008 Orbach
2008/0214971 A1 9/2008 Talish
2008/0216717 A1 9/2008 Jones
2008/0218307 A1 9/2008 Schoettle
2008/0220941 A1 9/2008 Shaw
2008/0224988 A1 9/2008 Whang
2008/0227607 A1 9/2008 Nizam
2008/0228110 A1 9/2008 Berme
2008/0229875 A1 9/2008 Ray
2008/0234023 A1 9/2008 Mullahkhel et al.
2008/0234110 A1 9/2008 Webber et al.
2008/0234111 A1 9/2008 Packham
2008/0234113 A1 9/2008 Einav
2008/0242510 A1 10/2008 Topel
2008/0242511 A1 10/2008 Munoz et al.
2008/0242512 A1 10/2008 Kim
2008/0242513 A1 10/2008 Skilken et al.
2008/0242520 A1 10/2008 Hubbard
2008/0244870 A1 10/2008 Chase
2008/0245944 A1 10/2008 Chase
2008/0248926 A1 10/2008 Cole et al.
2008/0248929 A1 10/2008 Webber et al.
2008/0248935 A1 10/2008 Solow
2008/0249736 A1 10/2008 Prstojevich
2008/0250729 A1 10/2008 Kriesel
2008/0253378 A1 10/2008 Curry
2008/0254420 A1 10/2008 Nerenberg
2008/0254947 A1 10/2008 Mackay
2008/0255430 A1 10/2008 Alexandersson et al.
2008/0255794 A1 10/2008 Levine
2008/0261636 A1 10/2008 Lau et al.
2008/0261774 A1 10/2008 Fisher
2008/0261776 A1 10/2008 Skiba
2008/0261785 A1 10/2008 Albanese
2008/0262381 A1 10/2008 Kolen
2008/0262392 A1 10/2008 Ananny et al.
2008/0267444 A1 10/2008 Simons-Nikolova et al.
2008/0269016 A1 10/2008 Ungari et al.
2008/0269017 A1 10/2008 Ungari
2008/0273008 A1 11/2008 Chang
2008/0279896 A1 11/2008 Heinen
2008/0280731 A1 11/2008 Dalebout
2008/0280732 A1 11/2008 Jones
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0287270 A1 11/2008 Carter
2008/0293023 A1 11/2008 Diehl
2008/0295129 A1 11/2008 Laut
2008/0296883 A1 12/2008 Burkhardtsmaier
2008/0300109 A1 12/2008 Karkanias et al.
2008/0300110 A1 12/2008 Smith et al.
2008/0300114 A1 12/2008 Dalebout
2008/0300115 A1 12/2008 Erlandson
2008/0300116 A1 12/2008 Eder
2008/0300118 A1 12/2008 Wehrell
2008/0300914 A1 12/2008 Karkanias et al.
2008/0305934 A1 12/2008 Medina
2008/0305936 A1 12/2008 Cao
2008/0306762 A1 12/2008 James
2008/0312039 A1 12/2008 Bucay-Bissu
2008/0312041 A1 12/2008 Schwabe et al.
2008/0312047 A1 12/2008 Feng
2008/0312052 A1 12/2008 Krietzman
2008/0315371 A1 12/2008 Tang et al.
2008/0318737 A1 12/2008 Chu
2008/0318738 A1 12/2008 Chen
2008/0318743 A1 12/2008 Bizzell
2008/0318744 A1 12/2008 Barra
2008/0319787 A1 12/2008 Stivoric
2008/0319796 A1 12/2008 Stivoric
2008/0319855 A1 12/2008 Stivoric
2009/0001831 A1 1/2009 Cho et al.
2009/0005224 A1 1/2009 Davis et al.
2009/0017991 A1 1/2009 Hung
2009/0018000 A1 1/2009 Brown
2009/0023553 A1 1/2009 Shim
2009/0023554 A1 1/2009 Shim
2009/0023556 A1 1/2009 Daly
2009/0023562 A1 1/2009 Lamarque
2009/0024233 A1 1/2009 Shirai et al.
2009/0027925 A1 1/2009 Kanouda et al.
2009/0028005 A1 1/2009 You et al.
2009/0029831 A1 1/2009 Weier
2009/0029834 A1 1/2009 Isom
2009/0036276 A1 2/2009 Loach
2009/0036277 A1 2/2009 Ish, III et al.
2009/0040231 A1 2/2009 Sano et al.
2009/0040301 A1 2/2009 Sandler et al.
2009/0041298 A1 2/2009 Sandler et al.
2009/0042174 A1 2/2009 Aries
2009/0042696 A1 2/2009 Wang
2009/0042698 A1 2/2009 Wang
2009/0043531 A1 2/2009 Kahn et al.
2009/0047645 A1 2/2009 Dibenedetto et al.
2009/0048044 A1 2/2009 Oleson et al.
2009/0048073 A1 2/2009 Roimicher
2009/0048074 A1 2/2009 Kamins
2009/0048079 A1 2/2009 Nalley
2009/0048493 A1 2/2009 James et al.
2009/0048939 A1 2/2009 Williams
2009/0049092 A1 2/2009 Capio et al.
2009/0053682 A1 2/2009 Stern
2009/0054207 A1 2/2009 Lin et al.
2009/0054214 A1 2/2009 Kadar

(56) References Cited

U.S. PATENT DOCUMENTS

2009/0054751 A1 2/2009 Babashan et al.
2009/0061870 A1 3/2009 Finkelstein et al.
2009/0062072 A1 3/2009 Packham
2009/0062598 A1 3/2009 Haisma et al.
2009/0069156 A1 3/2009 Kurunmäki et al.
2009/0069159 A1 3/2009 Wang
2009/0069722 A1 3/2009 Flaction et al.
2009/0075781 A1 3/2009 Schwarzberg et al.
2009/0075784 A1 3/2009 Hoggan
2009/0075793 A1 3/2009 Trainor
2009/0076335 A1 3/2009 Schwarzberg et al.
2009/0076903 A1 3/2009 Schwarzberg et al.
2009/0080808 A1 3/2009 Hagen
2009/0082176 A1 3/2009 Watterson et al.
2009/0082880 A1 3/2009 Saunders
2009/0085873 A1 4/2009 Betts et al.
2009/0088248 A1 4/2009 Stevens
2009/0088299 A1 4/2009 Chen
2009/0088301 A1 4/2009 Alling
2009/0093319 A1 4/2009 Omidi
2009/0093341 A1 4/2009 James
2009/0093347 A1 4/2009 Wang
2009/0098980 A1 4/2009 Waters
2009/0098981 A1 4/2009 Del Giorno
2009/0100718 A1 4/2009 Gerber
2009/0105047 A1 4/2009 Guidi et al.
2009/0105052 A1 4/2009 Dalebout et al.
2009/0105548 A1 4/2009 Bart
2009/0105560 A1 4/2009 Solomon
2009/0109346 A1 4/2009 Viarani et al.
2009/0111656 A1 4/2009 Sullivan et al.
2009/0111658 A1 4/2009 Juan
2009/0111664 A1 4/2009 Kau
2009/0111665 A1 4/2009 Wang
2009/0111666 A1 4/2009 Wang
2009/0111670 A1 4/2009 Williams
2009/0117890 A1 5/2009 Jacobsen et al.
2009/0118098 A1 5/2009 Yeh
2009/0118099 A1 5/2009 Fisher
2009/0118103 A1 5/2009 Ellis
2009/0118105 A1 5/2009 Schiff
2009/0119032 A1 5/2009 Meyer
2009/0120208 A1 5/2009 Meyer
2009/0120210 A1 5/2009 Phillips et al.
2009/0124460 A1 5/2009 Chen
2009/0124463 A1 5/2009 Chen
2009/0124464 A1 5/2009 Kastelic
2009/0124465 A1 5/2009 Wang
2009/0124466 A1 5/2009 Zhang
2009/0124470 A1 5/2009 Yu
2009/0128342 A1 5/2009 Cohen
2009/0128516 A1 5/2009 Rimon et al.
2009/0131225 A1 5/2009 Burdea
2009/0131230 A1 5/2009 Cole
2009/0131231 A1 5/2009 Smith
2009/0137367 A1 5/2009 Hendrickson et al.
2009/0137370 A1 5/2009 Kushnir
2009/0143201 A1 6/2009 Uygan
2009/0144080 A1 6/2009 Gray et al.
2009/0144084 A1 6/2009 Neumaier
2009/0144639 A1 6/2009 Nims et al.
2009/0149299 A1 6/2009 Tchao et al.
2009/0149302 A1 6/2009 Thuma
2009/0149721 A1 6/2009 Yang
2009/0150178 A1 6/2009 Sutton et al.
2009/0156363 A1 6/2009 Guidi et al.
2009/0156364 A1 6/2009 Simeoni
2009/0158871 A1 6/2009 Chuo
2009/0163262 A1 6/2009 Kang
2009/0163323 A1 6/2009 Bocchicchio
2009/0163326 A1 6/2009 Wang
2009/0163327 A1 6/2009 Huang et al.
2009/0163331 A1 6/2009 Lacher
2009/0163334 A1 6/2009 Gibson et al.
2009/0170663 A1 7/2009 Cox et al.
2009/0170667 A1 7/2009 Irving et al.
2009/0170668 A1 7/2009 Giannelli et al.
2009/0170669 A1 7/2009 Giannelli et al.
2009/0170672 A1 7/2009 Mcmullen
2009/0170675 A1 7/2009 Giannelli et al.
2009/0171229 A1 7/2009 Saldarelli
2009/0174558 A1 7/2009 White
2009/0176526 A1 7/2009 Altman
2009/0176581 A1 7/2009 Barnes et al.
2009/0176625 A1 7/2009 Giannelli et al.
2009/0176628 A1 7/2009 Radding et al.
2009/0177068 A1 7/2009 Stivoric et al.
2009/0180646 A1 7/2009 Vulfson et al.
2009/0181826 A1 7/2009 Turner
2009/0181829 A1 7/2009 Wu
2009/0181830 A1 7/2009 Wu
2009/0181831 A1 7/2009 Kuo
2009/0181833 A1 7/2009 Cassidy
2009/0186748 A1 7/2009 Golesh et al.
2009/0186749 A1 7/2009 Zhou
2009/0191988 A1 7/2009 Klein
2009/0192391 A1 7/2009 Lovitt et al.
2009/0192871 A1 7/2009 Deacon et al.
2009/0193344 A1 7/2009 Smyers
2009/0193796 A1 8/2009 Wei et al.
2009/0195350 A1 8/2009 Tsern et al.
2009/0196417 A1 8/2009 Beaver et al.
2009/0197739 A1 8/2009 Hashimoto
2009/0197740 A1 8/2009 Julskjaer et al.
2009/0197745 A1 8/2009 Olson
2009/0203501 A1 8/2009 Rodgers, Jr.
2009/0204422 A1 8/2009 James
2009/0204668 A1 8/2009 Huang
2009/0205482 A1 8/2009 Shirai et al.
2009/0209393 A1 8/2009 Crater et al.
2009/0210078 A1 8/2009 Crowley
2009/0215594 A1 8/2009 Panaiotov
2009/0216629 A1 8/2009 James
2009/0217178 A1 8/2009 Niyogi et al.
2009/0221404 A1 9/2009 Dorogusker et al.
2009/0221405 A1 9/2009 Wang
2009/0221407 A1 9/2009 Hauk
2009/0227424 A1 9/2009 Hirata et al.
2009/0227428 A1 9/2009 Tamari
2009/0227429 A1 9/2009 Baudhuin
2009/0227432 A1 9/2009 Pacheco
2009/0232420 A1 9/2009 Eisenberg et al.
2009/0233769 A1 9/2009 Pryor
2009/0233771 A1 9/2009 Quatrochi et al.
2009/0238400 A1 9/2009 Im
2009/0239714 A1 9/2009 Sellers
2009/0240858 A1 9/2009 Takebayashi
2009/0246746 A1 10/2009 Roerdink et al.
2009/0247366 A1 10/2009 Frumer
2009/0247376 A1 10/2009 Merrithew et al.
2009/0253109 A1 10/2009 Anvari
2009/0253554 A1 10/2009 Mcintosh
2009/0257323 A1 10/2009 Soltani
2009/0258710 A1 10/2009 Quatrochi et al.
2009/0258758 A1 10/2009 Hickman
2009/0258763 A1 10/2009 Richter
2009/0262088 A1 10/2009 Moll-Carrillo et al.
2009/0263772 A1 10/2009 Root
2009/0264258 A1 10/2009 Lo
2009/0264260 A1 10/2009 Piaget et al.
2009/0265649 A1 10/2009 Schlossberg et al.
2009/0267783 A1 10/2009 Vock et al.
2009/0269728 A1 10/2009 Verstegen et al.
2009/0270226 A1 10/2009 Watterson
2009/0270234 A1 10/2009 Alessandri et al.
2009/0270743 A1 10/2009 Dugan
2009/0278707 A1 11/2009 Biggins et al.
2009/0280964 A1 11/2009 Lin
2009/0282080 A1 11/2009 Schlossberg et al.
2009/0286653 A1 11/2009 Wiber
2009/0292178 A1 11/2009 Ellis et al.
2009/0293319 A1 12/2009 Avni
2009/0298649 A1 12/2009 Dyer et al.
2009/0305852 A1 12/2009 Svenberg

(56) References Cited

U.S. PATENT DOCUMENTS

2009/0309891 A1 12/2009 Karkanias et al.
2009/0312151 A1 12/2009 Thieberger
2009/0312158 A1 12/2009 Trevino et al.
2009/0312658 A1 12/2009 Thieberger
2010/0003573 A1 1/2010 Jeanne et al.
2010/0003647 A1 1/2010 Brown et al.
2010/0004104 A1 1/2010 Gustafson
2010/0005624 A1 1/2010 Swearingen
2010/0009809 A1 1/2010 Carrington
2010/0009810 A1 1/2010 Trzecieski
2010/0015585 A1 1/2010 Baker
2010/0016127 A1 1/2010 Farnsworth et al.
2010/0016129 A1 1/2010 Chou
2010/0016742 A1 1/2010 James
2010/0017402 A1 1/2010 Fleming et al.
2010/0019593 A1 1/2010 Ritchey et al.
2010/0022354 A1 1/2010 Fisher
2010/0024590 A1 2/2010 O'neill
2010/0031803 A1 2/2010 Lozada et al.
2010/0032533 A1 2/2010 Chen et al.
2010/0034665 A1 2/2010 Zhong et al.
2010/0035726 A1 2/2010 Fisher et al.
2010/0036736 A1 2/2010 McGee et al.
2010/0038149 A1 2/2010 Corel
2010/0041000 A1 2/2010 Glass
2010/0041516 A1 2/2010 Kodama
2010/0041526 A1 2/2010 Bowser et al.
2010/0048358 A1 2/2010 Tchao et al.
2010/0048368 A1 2/2010 Donofrio
2010/0050082 A1 2/2010 Katz et al.
2010/0056339 A1 3/2010 Chen
2010/0056340 A1 3/2010 Ellis
2010/0056345 A1 3/2010 Liu
2010/0056876 A1 3/2010 Ellis
2010/0062818 A1 3/2010 Haughay, Jr. et al.
2010/0062904 A1 3/2010 Crawford et al.
2010/0062914 A1 3/2010 Splane
2010/0063426 A1 3/2010 Planke
2010/0064255 A1 3/2010 Rottler et al.
2010/0068684 A1 3/2010 Sabel
2010/0069202 A1 3/2010 Olsen
2010/0075812 A1 3/2010 Piaget et al.
2010/0076278 A1 3/2010 van der Zande et al.
2010/0077564 A1 4/2010 Saier et al.
2010/0079291 A1 4/2010 Kroll et al.
2010/0081116 A1 4/2010 Barasch et al.
2010/0081548 A1 4/2010 Labedz
2010/0087298 A1 4/2010 Zaccherini
2010/0087701 A1 4/2010 Berka et al.
2010/0088023 A1 4/2010 Werner
2010/0093492 A1 4/2010 Watterson et al.
2010/0093493 A1 4/2010 Eldridge
2010/0099437 A1 4/2010 Moerdijk
2010/0099541 A1 4/2010 Patel
2010/0099954 A1 4/2010 Dickinson et al.
2010/0105527 A1 4/2010 Johnson
2010/0105530 A1 4/2010 Inaizumi
2010/0112536 A1 5/2010 Claassen
2010/0113222 A1 5/2010 Radow
2010/0113223 A1 5/2010 Chiles et al.
2010/0113948 A1 5/2010 Yang et al.
2010/0120585 A1 5/2010 Quy
2010/0125026 A1 5/2010 Zavadsky et al.
2010/0125029 A1 5/2010 Nielson et al.
2010/0125183 A1 5/2010 Vayalattu et al.
2010/0130337 A1 5/2010 Stewart
2010/0137049 A1 6/2010 Epstein
2010/0137105 A1 6/2010 McLaughlin
2010/0137106 A1 6/2010 Oshima et al.
2010/0137114 A1 6/2010 Keiser
2010/0144500 A1 6/2010 Canali
2010/0144501 A1 6/2010 Berhanu
2010/0146055 A1 6/2010 Hannuksela
2010/0152546 A1 6/2010 Behan et al.
2010/0156625 A1 6/2010 Ruha
2010/0156760 A1 6/2010 Cheswick
2010/0160013 A1 6/2010 Sanders
2010/0160014 A1 6/2010 Galasso et al.
2010/0160115 A1 6/2010 Morris et al.
2010/0164579 A1 7/2010 Acatrinei
2010/0167801 A1 7/2010 Karkanias et al.
2010/0167876 A1 7/2010 Cheng
2010/0167883 A1 7/2010 Grind
2010/0173276 A1 7/2010 Vasin
2010/0173755 A1 7/2010 P Erez De Lazarraga
2010/0173759 A1 7/2010 Lalaoua
2010/0175634 A1 7/2010 Chang et al.
2010/0178981 A1 7/2010 Holcomb
2010/0179032 A1 7/2010 Perry
2010/0179035 A1 7/2010 Carnahan
2010/0179883 A1 7/2010 Devolites
2010/0182436 A1 7/2010 Boman et al.
2010/0184565 A1 7/2010 Avellino
2010/0184568 A1 7/2010 Schippers
2010/0184570 A1 7/2010 Cheng
2010/0188405 A1 7/2010 Haughay et al.
2010/0190610 A1 7/2010 Pryor
2010/0190615 A1 7/2010 Baker et al.
2010/0191462 A1 7/2010 Kobuya et al.
2010/0192715 A1 8/2010 Vauchel et al.
2010/0197462 A1 8/2010 Piane, Jr.
2010/0197465 A1 8/2010 Stevenson
2010/0204013 A1 8/2010 Chen
2010/0208038 A1 8/2010 Kutliroff et al.
2010/0208082 A1 8/2010 Buchner et al.
2010/0210418 A1 8/2010 Park
2010/0211439 A1 8/2010 Marci et al.
2010/0216536 A1 8/2010 Gagner
2010/0216599 A1 8/2010 Watterson
2010/0216600 A1 8/2010 Noffsinger
2010/0216603 A1 8/2010 Somers
2010/0216607 A1 8/2010 Mueller
2010/0216610 A1 8/2010 Gedeon-Janvier
2010/0217096 A1 8/2010 Nanikashvili
2010/0217099 A1 8/2010 Leboeuf
2010/0217102 A1 8/2010 LeBoeuf et al.
2010/0222165 A1 9/2010 Nurnberg et al.
2010/0222178 A1 9/2010 Shea
2010/0222179 A1 9/2010 Temple et al.
2010/0222182 A1 9/2010 Park
2010/0227542 A1 9/2010 Goldmann
2010/0227740 A1 9/2010 Liu
2010/0233664 A1 9/2010 Wroclawsky
2010/0234184 A1 9/2010 Le Page
2010/0234185 A1 9/2010 Watt et al.
2010/0234193 A1 9/2010 Friedman
2010/0234693 A1 9/2010 Srinivasan et al.
2010/0235667 A1 9/2010 Mucignat et al.
2010/0240458 A1 9/2010 Gaiba et al.
2010/0240493 A1 9/2010 Wang
2010/0240495 A1 9/2010 Law
2010/0240945 A1 9/2010 Bikko
2010/0241018 A1 9/2010 Vogel
2010/0243514 A1 9/2010 Samain et al.
2010/0247081 A1 9/2010 Victoria Pons
2010/0248899 A1 9/2010 Bedell et al.
2010/0248900 A1 9/2010 Ashby
2010/0248901 A1 9/2010 Martens
2010/0248917 A1 9/2010 Reyes
2010/0251454 A1 10/2010 Kiernan
2010/0255884 A1 10/2010 Konkka et al.
2010/0255955 A1 10/2010 Hickman
2010/0255959 A1 10/2010 Dalebout et al.
2010/0255965 A1 10/2010 Chen
2010/0259043 A1 10/2010 Balsamo
2010/0261580 A1 10/2010 Lannon
2010/0267524 A1 10/2010 Stewart et al.
2010/0271367 A1 10/2010 Vaden et al.
2010/0273610 A1 10/2010 Johnson
2010/0274100 A1 10/2010 Behar
2010/0279822 A1 11/2010 Ford
2010/0279823 A1 11/2010 Waters
2010/0281463 A1 11/2010 Estrade
2010/0283601 A1 11/2010 Tai et al.

(56) References Cited

U.S. PATENT DOCUMENTS

2010/0285933 A1 11/2010 Nalley
2010/0285935 A1 11/2010 Barnett
2010/0289466 A1 11/2010 Telefus
2010/0289772 A1 11/2010 Miller
2010/0292050 A1 11/2010 DiBenedetto et al.
2010/0292056 A1 11/2010 Birch
2010/0292599 A1 11/2010 Oleson et al.
2010/0292600 A1 11/2010 Dibenedetto et al.
2010/0298098 A1 11/2010 Ercan
2010/0298104 A1 11/2010 Turner
2010/0298106 A1 11/2010 Bowser
2010/0298655 A1 11/2010 McCombie et al.
2010/0298656 A1 11/2010 McCombie et al.
2010/0298661 A1 11/2010 McCombie et al.
2010/0300272 A1 12/2010 Scherf
2010/0302142 A1 12/2010 French
2010/0302250 A1 12/2010 Hoebel
2010/0304931 A1 12/2010 Stumpf
2010/0304932 A1 12/2010 Kolman et al.
2010/0304934 A1 12/2010 Woodson
2010/0304938 A1 12/2010 Olson
2010/0304939 A1 12/2010 Svenberg
2010/0304940 A1 12/2010 Svenberg
2010/0311552 A1 12/2010 Sumners
2010/0312596 A1 12/2010 Saffari et al.
2010/0317488 A1 12/2010 Cartaya
2010/0317496 A1 12/2010 Abranchess
2010/0320956 A1 12/2010 Lumsden et al.
2010/0323852 A1 12/2010 Locsin
2010/0324387 A1 12/2010 Moon
2010/0327603 A1 12/2010 Suaan
2010/0331151 A1 12/2010 Signorile et al.
2010/0331153 A1 12/2010 Johnson
2011/0000024 A1 1/2011 Johnson et al.
2011/0003663 A1 1/2011 Chiu et al.
2011/0003664 A1 1/2011 Richard
2011/0009240 A1 1/2011 Chiu et al.
2011/0009249 A1 1/2011 Campanaro et al.
2011/0015039 A1 1/2011 Shea
2011/0015041 A1 1/2011 Shea
2011/0015468 A1 1/2011 Aarts et al.
2011/0021319 A1 1/2011 Nissila et al.
2011/0021323 A1 1/2011 Wu
2011/0021953 A1 1/2011 Sanematsu et al.
2011/0028277 A1 2/2011 Merli
2011/0028282 A1 2/2011 Sbragia
2011/0028286 A1 2/2011 Nortje
2011/0032105 A1 2/2011 Hoffman et al.
2011/0034300 A1 2/2011 Hall
2011/0039659 A1 2/2011 Kim et al.
2011/0045956 A1 2/2011 Colledge
2011/0046519 A1 2/2011 Raheman
2011/0048141 A1 3/2011 Svenberg
2011/0053131 A1 3/2011 Regnier
2011/0054242 A1 3/2011 Bender
2011/0054270 A1 3/2011 Derchak
2011/0054272 A1 3/2011 Derchak
2011/0054359 A1 3/2011 Sazonov et al.
2011/0054809 A1 3/2011 Templeman
2011/0056328 A1 3/2011 Ko
2011/0061515 A1 3/2011 Turner
2011/0061840 A1 3/2011 Goldmann
2011/0063114 A1 3/2011 Ikoyan
2011/0065371 A1 3/2011 Leff
2011/0065373 A1 3/2011 Goldmann
2011/0065504 A1 3/2011 Dugan et al.
2011/0066056 A1 3/2011 Huang
2011/0067361 A1 3/2011 Sloan
2011/0072955 A1 3/2011 Turner
2011/0073743 A1 3/2011 Shamie
2011/0075835 A1 3/2011 Hill
2011/0077055 A1 3/2011 Pakula et al.
2011/0077128 A1 3/2011 Hamada et al.
2011/0082006 A1 4/2011 Ishii
2011/0082007 A1 4/2011 Birrell
2011/0082010 A1 4/2011 Dyer
2011/0082011 A1 4/2011 Ellis
2011/0082013 A1 4/2011 Bastian
2011/0082015 A1 4/2011 Dreissigacker et al.
2011/0082017 A1 4/2011 Arlie
2011/0082397 A1 4/2011 Alberts
2011/0086707 A1 4/2011 Loveland
2011/0087076 A1 4/2011 Brynelsen et al.
2011/0087137 A1 4/2011 Hanoun
2011/0087445 A1 4/2011 Sobolewski
2011/0087446 A1 4/2011 Redmond
2011/0090092 A1 4/2011 Birrell et al.
2011/0091842 A1 4/2011 Dugan
2011/0092779 A1 4/2011 Chang et al.
2011/0093100 A1 4/2011 Ramsay
2011/0096764 A1 4/2011 Tunioli et al.
2011/0098157 A1 4/2011 Whalen et al.
2011/0098615 A1 4/2011 Whalen et al.
2011/0105278 A1 5/2011 Fabbri
2011/0105279 A1 5/2011 Herranen
2011/0105920 A1 5/2011 Haataja
2011/0106597 A1 5/2011 Ferdman et al.
2011/0109283 A1 5/2011 Kapels et al.
2011/0111925 A1 5/2011 Hobson
2011/0112771 A1 5/2011 French
2011/0117529 A1 5/2011 Barash
2011/0118084 A1 5/2011 Tsai et al.
2011/0118086 A1 5/2011 Radow
2011/0118089 A1 5/2011 Ellis
2011/0118090 A1 5/2011 Ellis
2011/0119027 A1 5/2011 Zhu et al.
2011/0124466 A1 5/2011 Nishimura
2011/0124469 A1 5/2011 Uhlir
2011/0124476 A1 5/2011 Holley
2011/0124978 A1 5/2011 Williams
2011/0125063 A1 5/2011 Shalon et al.
2011/0131005 A1 6/2011 Ueshima et al.
2011/0136627 A1 6/2011 Williams
2011/0140904 A1 6/2011 Kashi
2011/0143769 A1 6/2011 Jones et al.
2011/0143890 A1 6/2011 Reyes
2011/0143898 A1 6/2011 Trees
2011/0152032 A1 6/2011 Barnett
2011/0152033 A1 6/2011 Yang
2011/0152037 A1 6/2011 Tsou
2011/0152038 A1 6/2011 Freitag
2011/0152039 A1 6/2011 Hendrickson et al.
2011/0152635 A1 6/2011 Morris et al.
2011/0152696 A1 6/2011 Ryan
2011/0163206 A1 7/2011 Bandera
2011/0163939 A1 7/2011 Tam et al.
2011/0164044 A1 7/2011 Huang
2011/0164175 A1 7/2011 Chung et al.
2011/0165995 A1 7/2011 Paulus
2011/0165996 A1 7/2011 Paulus
2011/0165997 A1 7/2011 Reich
2011/0165998 A1 7/2011 Lau et al.
2011/0167447 A1 7/2011 Wong
2011/0172058 A1 7/2011 Deaconu
2011/0172059 A1 7/2011 Watterson et al.
2011/0172060 A1 7/2011 Morales et al.
2011/0172068 A1 7/2011 Tyson, III
2011/0175744 A1 7/2011 Englert et al.
2011/0175989 A1 7/2011 Islam
2011/0176943 A1 7/2011 Tran et al.
2011/0177919 A1 7/2011 Tamari
2011/0177921 A1 7/2011 Olson
2011/0179068 A1 7/2011 O'brien
2011/0181420 A1 7/2011 Mack et al.
2011/0183307 A1 7/2011 Shum et al.
2011/0184225 A1 7/2011 Whitall et al.
2011/0184247 A1 7/2011 Contant et al.
2011/0185309 A1 7/2011 Challinor et al.
2011/0188269 A1 8/2011 Hosotani
2011/0188668 A1 8/2011 Donaldson
2011/0188980 A1 8/2011 Pumroy
2011/0190096 A1 8/2011 Clarke
2011/0191123 A1 8/2011 Buzynski
2011/0195819 A1 8/2011 Shaw

(56) References Cited

U.S. PATENT DOCUMENTS

2011/0195825 A1 8/2011 Liester
2011/0197157 A1 8/2011 Hoffman et al.
2011/0199393 A1 8/2011 Nurse et al.
2011/0199799 A1 8/2011 Hui et al.
2011/0201476 A1 8/2011 Solomon
2011/0201481 A1 8/2011 Lo
2011/0202236 A1 8/2011 Galasso et al.
2011/0205164 A1 8/2011 Hansen et al.
2011/0207584 A1 8/2011 Webber et al.
2011/0214148 A1 9/2011 Gossweiler, III et al.
2011/0218086 A1 9/2011 Boren
2011/0221672 A1 9/2011 Osterhout et al.
2011/0222375 A1 9/2011 Tsubata et al.
2011/0224057 A1 9/2011 Wu
2011/0224058 A1 9/2011 Webber et al.
2011/0224498 A1 9/2011 Banet et al.
2011/0227268 A1 9/2011 Zheng
2011/0229862 A1 9/2011 Parikh
2011/0230732 A1 9/2011 Edman et al.
2011/0237396 A1 9/2011 Lu
2011/0237399 A1 9/2011 Toback
2011/0237405 A1 9/2011 Reyes
2011/0237407 A1 9/2011 Kaleal
2011/0238217 A1 9/2011 Kume
2011/0240403 A1 10/2011 Meillet
2011/0245633 A1 10/2011 Goldberg et al.
2011/0247530 A1 10/2011 Coffman
2011/0251021 A1 10/2011 Zavadsky et al.
2011/0251023 A1 10/2011 Fedriga
2011/0251033 A1 10/2011 Blancher
2011/0252597 A1 10/2011 Burris et al.
2011/0256988 A1 10/2011 Weier et al.
2011/0257797 A1 10/2011 Burris et al.
2011/0263384 A1 10/2011 Drazan
2011/0263385 A1 10/2011 Shea
2011/0264305 A1 10/2011 Choe
2011/0267196 A1 11/2011 Hu et al.
2011/0269517 A1 11/2011 Englert et al.
2011/0269604 A1 11/2011 Tseng
2011/0270135 A1 11/2011 Dooley
2011/0275482 A1 11/2011 Brodess et al.
2011/0275489 A1 11/2011 Apau
2011/0275496 A1 11/2011 Chou
2011/0275499 A1 11/2011 Eschenbach
2011/0276312 A1 11/2011 Shalon et al.
2011/0281249 A1 11/2011 Gammell et al.
2011/0281691 A1 11/2011 Ellis
2011/0283188 A1 11/2011 Farrenkopf et al.
2011/0283231 A1 11/2011 Richstein et al.
2011/0287905 A1 11/2011 Reyes
2011/0295083 A1 12/2011 Doelling et al.
2011/0306480 A1 12/2011 Beaulieu et al.
2011/0308919 A1 12/2011 Hahn
2011/0311955 A1 12/2011 Forsten et al.
2011/0312473 A1 12/2011 Chu et al.
2011/0312475 A1 12/2011 Towley, III
2011/0319229 A1 12/2011 Corbalis et al.
2011/0319230 A1 12/2011 Brendle
2011/0320380 A1 12/2011 Zahn et al.
2012/0004074 A1 1/2012 Schelzig
2012/0004075 A1 1/2012 Kissel et al.
2012/0004080 A1 1/2012 Webb
2012/0010053 A1 1/2012 Bayerlein et al.
2012/0015778 A1 1/2012 Lee et al.
2012/0015779 A1 1/2012 Powch et al.
2012/0015784 A1 1/2012 Reed
2012/0015787 A2 1/2012 Crawley
2012/0020135 A1 1/2012 McCune
2012/0021873 A1 1/2012 Brunner
2012/0021875 A1 1/2012 Karl
2012/0021876 A1 1/2012 Hsiung
2012/0021877 A1 1/2012 Lundquist et al.
2012/0024237 A1 2/2012 Rice
2012/0028761 A1 2/2012 Dorogusker et al.
2012/0029666 A1 2/2012 Crowley et al.
2012/0032896 A1 2/2012 Vesely
2012/0035024 A1 2/2012 Price
2012/0035487 A1 2/2012 Werner et al.
2012/0036557 A1 2/2012 Li
2012/0046144 A1 2/2012 Lin et al.
2012/0050818 A1 3/2012 Watanabe
2012/0053024 A1 3/2012 Mendoza
2012/0055718 A1 3/2012 Chen
2012/0065031 A1 3/2012 Buzzanco
2012/0065034 A1 3/2012 Loach
2012/0071301 A1 3/2012 Kaylor et al.
2012/0078127 A1 3/2012 McDonald et al.
2012/0079429 A1 3/2012 Stathacopoulos et al.
2012/0079529 A1 3/2012 Harris et al.
2012/0081531 A1 4/2012 DeAngelis et al.
2012/0083395 A1 4/2012 Carson
2012/0083396 A1 4/2012 Aquino
2012/0083669 A1 4/2012 Abujbara
2012/0083705 A1 4/2012 Yuen et al.
2012/0084807 A1 4/2012 Thompson et al.
2012/0084811 A1 4/2012 Thompson
2012/0084812 A1 4/2012 Thompson et al.
2012/0088633 A1 4/2012 Crafton
2012/0088634 A1 4/2012 Heidecke
2012/0088638 A1 4/2012 Lull
2012/0088640 A1 4/2012 Wissink
2012/0090446 A1 4/2012 Moreno
2012/0092327 A1 4/2012 Adhikari
2012/0094809 A1 4/2012 Nishimura
2012/0096357 A1 4/2012 Folgner et al.
2012/0096405 A1 4/2012 Seo
2012/0105867 A1 5/2012 Komatsu
2012/0108914 A1 5/2012 Bravomalo
2012/0113029 A1 5/2012 Ye et al.
2012/0115682 A1 5/2012 Homsi
2012/0115689 A1 5/2012 Dalebout et al.
2012/0115691 A1 5/2012 Munroe
2012/0115695 A1 5/2012 Watterson et al.
2012/0116550 A1 5/2012 Hoffman et al.
2012/0116684 A1 5/2012 Ingrassia et al.
2012/0116806 A1 5/2012 Stark et al.
2012/0122063 A1 5/2012 Chen et al.
2012/0125559 A1 5/2012 Fadell et al.
2012/0129139 A1 5/2012 Partovi
2012/0129653 A1 5/2012 Shalev
2012/0132877 A1 5/2012 Wang
2012/0133192 A1 5/2012 Simpson
2012/0142503 A1 6/2012 Sevadjian
2012/0143358 A1 6/2012 Adams et al.
2012/0149996 A1 6/2012 Stivoric et al.
2012/0153015 A1 6/2012 Gomez et al.
2012/0157265 A1 6/2012 Kao
2012/0158238 A1 6/2012 Daley
2012/0159563 A1 6/2012 Gomez et al.
2012/0165162 A1 6/2012 Lu
2012/0165703 A1 6/2012 Bottum
2012/0169603 A1 7/2012 Peterson et al.
2012/0174608 A1 7/2012 Kumamoto et al.
2012/0174833 A1 7/2012 Early
2012/0178590 A1 7/2012 Lu
2012/0178591 A1 7/2012 Remelius
2012/0178596 A1 7/2012 Vittone
2012/0179278 A1 7/2012 Riley et al.
2012/0183939 A1 7/2012 Aragones et al.
2012/0183940 A1 7/2012 Aragones et al.
2012/0187012 A1 7/2012 TeVault et al.
2012/0190502 A1 7/2012 Paulus et al.
2012/0190504 A1 7/2012 Lee et al.
2012/0202656 A1 8/2012 Dorsay
2012/0208153 A1 8/2012 Bolla et al.
2012/0212505 A1 8/2012 Burroughs et al.
2012/0214590 A1 8/2012 Newhouse et al.
2012/0216524 A1 8/2012 Browne
2012/0217758 A1 8/2012 Chen
2012/0218184 A1 8/2012 Wissmar
2012/0220434 A1 8/2012 Lien
2012/0225412 A1 9/2012 Wagner
2012/0225758 A1 9/2012 Shaw
2012/0228385 A1 9/2012 Deluca

(56) References Cited

U.S. PATENT DOCUMENTS

2012/0230504 A1 9/2012 Kuroda
2012/0233002 A1 9/2012 Abujbara
2012/0237906 A9 9/2012 Glass
2012/0237911 A1 9/2012 Watterson
2012/0238411 A1 9/2012 McBride et al.
2012/0238418 A1 9/2012 Reyes
2012/0238800 A1 9/2012 Naujokat et al.
2012/0238851 A1 9/2012 Kamen et al.
2012/0242774 A1 9/2012 Numano et al.
2012/0248263 A1 10/2012 Grotenhuis
2012/0251983 A1 10/2012 Golden
2012/0252580 A1 10/2012 Dugan
2012/0252642 A1 10/2012 Chen
2012/0253234 A1 10/2012 Yang et al.
2012/0253485 A1 10/2012 Weast et al.
2012/0253487 A1 10/2012 Dugan
2012/0253489 A1 10/2012 Dugan
2012/0263892 A1 10/2012 Rodger
2012/0264575 A1 10/2012 Towley, III
2012/0268592 A1 10/2012 Aragones et al.
2012/0270705 A1 10/2012 Lo
2012/0271121 A1 10/2012 Della Torre et al.
2012/0271143 A1 10/2012 Aragones et al.
2012/0277040 A1 11/2012 Vincent et al.
2012/0277068 A1 11/2012 Zhou et al.
2012/0277070 A1 11/2012 Sienna
2012/0277891 A1 11/2012 Aragones et al.
2012/0283071 A1 11/2012 Nalley
2012/0283074 A1 11/2012 Hutchins
2012/0285986 A1 11/2012 Irvin
2012/0289386 A1 11/2012 Yu
2012/0290109 A1 11/2012 Engelberg et al.
2012/0293141 A1 11/2012 Zhang et al.
2012/0295764 A1 11/2012 Brammer
2012/0295774 A1 11/2012 Dalebout et al.
2012/0296455 A1 11/2012 Ohnemus et al.
2012/0298017 A1 11/2012 Chen
2012/0300515 A1 11/2012 Carletti et al.
2012/0302408 A1 11/2012 Burger
2012/0306643 A1 12/2012 Dugan
2012/0313776 A1 12/2012 Utter, II
2012/0315986 A1 12/2012 Walling
2012/0315987 A1 12/2012 Walling
2012/0316406 A1 12/2012 Rahman et al.
2012/0316455 A1 12/2012 Rahman et al.
2012/0316456 A1 12/2012 Rahman et al.
2012/0316458 A1 12/2012 Rahman et al.
2012/0317024 A1 12/2012 Rahman et al.
2012/0319604 A1 12/2012 Walters
2012/0322625 A1 12/2012 Park
2012/0322628 A1 12/2012 Gautier
2012/0322629 A1 12/2012 Webb
2012/0323496 A1 12/2012 Burroughs
2012/0326873 A1 12/2012 Utter, II
2012/0329027 A1 12/2012 Lewolt
2012/0329611 A1 12/2012 Bouchard
2012/0329615 A1 12/2012 Jeong
2013/0002533 A1 1/2013 Burroughs et al.
2013/0004010 A1 1/2013 Royer
2013/0009993 A1 1/2013 Horseman
2013/0011818 A1 1/2013 Shum et al.
2013/0014155 A1 1/2013 Clarke et al.
2013/0015945 A1 1/2013 Chang
2013/0017888 A1 1/2013 King et al.
2013/0017929 A1 1/2013 Hendrickson et al.
2013/0018494 A1 1/2013 Amini
2013/0018668 A1 1/2013 Goldberg et al.
2013/0023933 A1 1/2013 Haas
2013/0029807 A1 1/2013 Amsel
2013/0034671 A1 2/2013 George
2013/0035209 A1 2/2013 Gilley et al.
2013/0035219 A1 2/2013 Williams
2013/0035220 A1 2/2013 Adams
2013/0035612 A1 2/2013 Mason et al.
2013/0040271 A1 2/2013 Rytky et al.
2013/0040783 A1 2/2013 Duda et al.
2013/0041590 A1 2/2013 Burich et al.
2013/0041617 A1 2/2013 Pease et al.
2013/0044521 A1 2/2013 Zhao et al.
2013/0050973 A1 2/2013 Rohrbach
2013/0053218 A1 2/2013 Barker
2013/0053220 A1 2/2013 Monaco
2013/0053222 A1 2/2013 Lo
2013/0053717 A1 2/2013 Vandine et al.
2013/0053990 A1 2/2013 Ackland
2013/0065680 A1 3/2013 Zavadsky
2013/0073093 A1 3/2013 Songkakul
2013/0083003 A1 4/2013 Perez et al.
2013/0085038 A1 4/2013 Fischer
2013/0090212 A1 4/2013 Wang
2013/0090216 A1 4/2013 Jackson
2013/0092647 A1 4/2013 Chen
2013/0095959 A1 4/2013 Marty
2013/0095978 A1 4/2013 Sauter
2013/0097635 A1 4/2013 Yerli
2013/0102443 A1 4/2013 Lundquist et al.
2013/0105565 A1 5/2013 Kamprath
2013/0106684 A1 5/2013 Weast et al.
2013/0108995 A1 5/2013 DePasqua et al.
2013/0110264 A1 5/2013 Weast et al.
2013/0116091 A1 5/2013 Fritz
2013/0116092 A1 5/2013 Martinez et al.
2013/0116093 A1 5/2013 Kehoe
2013/0116095 A1 5/2013 Hsieh
2013/0116514 A1 5/2013 Kroner et al.
2013/0116605 A1 5/2013 Dephouse
2013/0123073 A1 5/2013 Olson et al.
2013/0123083 A1 5/2013 Sip
2013/0127636 A1 5/2013 Aryanpur et al.
2013/0129217 A1 5/2013 Gupta
2013/0130868 A1 5/2013 Hou
2013/0130869 A1 5/2013 Hou
2013/0135115 A1 5/2013 Johnson et al.
2013/0137552 A1 5/2013 Kemp et al.
2013/0139736 A1 6/2013 Flaherty
2013/0141235 A1 6/2013 Utter, II
2013/0143721 A1 6/2013 Dalebout
2013/0144464 A1 6/2013 Dorogusker et al.
2013/0147411 A1 6/2013 Pang et al.
2013/0148861 A1 6/2013 Ferlatte et al.
2013/0150214 A1 6/2013 Wu
2013/0154441 A1 6/2013 Redmond
2013/0158368 A1 6/2013 Pacione et al.
2013/0165195 A1 6/2013 Watterson
2013/0165297 A1 6/2013 Daly
2013/0172152 A1 7/2013 Watterson
2013/0173156 A1 7/2013 Wither et al.
2013/0174273 A1 7/2013 Grab et al.
2013/0177884 A1 7/2013 Root
2013/0178334 A1 7/2013 Brammer
2013/0178338 A1 7/2013 Ross
2013/0178346 A1 7/2013 Lin
2013/0182781 A1 7/2013 Matsutani
2013/0184843 A1 7/2013 Ellis et al.
2013/0185003 A1 7/2013 Carbeck et al.
2013/0190136 A1 7/2013 Watterson
2013/0190143 A1 7/2013 Greenhill et al.
2013/0190657 A1 7/2013 Flaction et al.
2013/0191034 A1 7/2013 Weast et al.
2013/0193655 A1 8/2013 Kaye et al.
2013/0196821 A1 8/2013 Watterson et al.
2013/0196822 A1 8/2013 Watterson et al.
2013/0196826 A1 8/2013 Colledge
2013/0196827 A1 8/2013 Chang
2013/0203557 A1 8/2013 Su
2013/0203561 A1 8/2013 Lee et al.
2013/0208576 A1 8/2013 Loree, IV et al.
2013/0209972 A1 8/2013 Carter et al.
2013/0210578 A1 8/2013 Birrell
2013/0210581 A1 8/2013 Watterson et al.
2013/0210582 A1 8/2013 Del Toro et al.
2013/0211858 A1 8/2013 Ohnemus et al.
2013/0216982 A1 8/2013 Bennett et al.
2013/0216990 A1 8/2013 Chu et al.

(56) References Cited

U.S. PATENT DOCUMENTS

2013/0225373 A1 8/2013 Poat
2013/0225377 A1 8/2013 Lee et al.
2013/0228063 A1 9/2013 Turner
2013/0228422 A1 9/2013 Mathieu
2013/0231219 A1 9/2013 Huang
2013/0231224 A1 9/2013 Svenberg
2013/0231226 A1 9/2013 Bonutti
2013/0231575 A1 9/2013 Erkkila et al.
2013/0233097 A1 9/2013 Hayner
2013/0237383 A1 9/2013 Chen
2013/0241696 A1 9/2013 Fabrizio
2013/0245966 A1 9/2013 Burroughs et al.
2013/0260965 A1 10/2013 Chia et al.
2013/0263418 A1 10/2013 Johnson
2013/0267385 A1 10/2013 Watterson et al.
2013/0267386 A1 10/2013 Her
2013/0267392 A1 10/2013 Miranda
2013/0273509 A1 10/2013 Mutti
2013/0274040 A1 10/2013 Coza et al.
2013/0274064 A1 10/2013 Liang
2013/0274067 A1 10/2013 Watterson et al.
2013/0274069 A1 10/2013 Watterson et al.
2013/0274071 A1 10/2013 Wang
2013/0274074 A1 10/2013 Ghandour
2013/0274075 A1 10/2013 Habing et al.
2013/0274587 A1 10/2013 Coza et al.
2013/0274635 A1 10/2013 Coza et al.
2013/0274904 A1 10/2013 Coza et al.
2013/0280682 A1 10/2013 Levine et al.
2013/0282157 A1 10/2013 Shin et al.
2013/0282447 A1 10/2013 Himanen et al.
2013/0288223 A1 10/2013 Watterson et al.
2013/0289932 A1 10/2013 Baechler
2013/0290364 A1 10/2013 Minvielle
2013/0296144 A1 11/2013 Gvoich
2013/0297642 A1 11/2013 Minvielle
2013/0298019 A1 11/2013 Henderson
2013/0303334 A1 11/2013 Adhami
2013/0303837 A1 11/2013 Berka et al.
2013/0310221 A1 11/2013 Zuber
2013/0310230 A1 11/2013 Norris
2013/0310658 A1 11/2013 Ricks
2013/0316830 A1 11/2013 Sedzin et al.
2013/0324368 A1 12/2013 Aragones et al.
2013/0325394 A1 12/2013 Yuen et al.
2013/0328416 A1 12/2013 Whitworth et al.
2013/0337974 A1 12/2013 Yanev et al.
2013/0337980 A1 12/2013 Himmelrick et al.
2013/0337981 A1 12/2013 Habing
2013/0338802 A1 12/2013 Winsper et al.
2013/0345978 A1 12/2013 Lush et al.
2013/0346043 A1 12/2013 Mewes et al.
2014/0005009 A1 1/2014 Giannelli
2014/0005811 A1 1/2014 Mikan et al.
2014/0011645 A1 1/2014 Johnson et al.
2014/0026788 A1 1/2014 Kallio et al.
2014/0031174 A1 1/2014 Huang
2014/0031181 A1 1/2014 Agostini
2014/0031703 A1 1/2014 Rayner et al.
2014/0038781 A1 2/2014 Foley
2014/0039329 A1 2/2014 Kampman et al.
2014/0039840 A1 2/2014 Yuen et al.
2014/0045656 A1 2/2014 Zhang
2014/0052280 A1 2/2014 Yuen et al.
2014/0056461 A1 2/2014 Afshar
2014/0058806 A1 2/2014 Guenette et al.
2014/0066264 A1 3/2014 Haddon
2014/0069838 A1 3/2014 Minvielle
2014/0073488 A1 3/2014 Wu
2014/0074265 A1 3/2014 Arginsky
2014/0077494 A1 3/2014 Sutkowski
2014/0080678 A1 3/2014 Wu
2014/0081436 A1 3/2014 Cowley
2014/0085077 A1 3/2014 Luna et al.
2014/0087923 A1 3/2014 Warren
2014/0089836 A1 3/2014 Damani et al.
2014/0094941 A1 4/2014 Ellis et al.
2014/0099614 A1 4/2014 Hu et al.
2014/0100464 A1 4/2014 Kaleal et al.
2014/0102340 A1 4/2014 Kooistra
2014/0106322 A1 4/2014 Durand
2014/0106943 A1 4/2014 Simonetti
2014/0106948 A1 4/2014 Agostini
2014/0106949 A1 4/2014 Mestemaker
2014/0113776 A1 4/2014 Jaguan
2014/0113779 A1 4/2014 Loach
2014/0121066 A1 5/2014 Huang et al.
2014/0121071 A1 5/2014 Strom et al.
2014/0121072 A1 5/2014 Ercanbrack
2014/0121471 A1 5/2014 Walker
2014/0125618 A1 5/2014 Panther et al.
2014/0129240 A1 5/2014 Zhang
2014/0134582 A1 5/2014 Konishi
2014/0135173 A1 5/2014 Watterson
2014/0135593 A1 5/2014 Jayalth et al.
2014/0135631 A1 5/2014 Brumback et al.
2014/0139450 A1 5/2014 Levesque et al.
2014/0141396 A1 5/2014 Spratt
2014/0142403 A1 5/2014 Brumback et al.
2014/0145935 A1 5/2014 Sztuk
2014/0147829 A1 5/2014 Jerauld
2014/0150042 A1 5/2014 Pacor et al.
2014/0156041 A1 6/2014 Martin
2014/0156084 A1 6/2014 Rahman et al.
2014/0156228 A1 6/2014 Molettiere et al.
2014/0156308 A1 6/2014 Ohnemus et al.
2014/0156645 A1 6/2014 Brust et al.
2014/0162230 A1 6/2014 Akopian
2014/0162854 A1 6/2014 Watterson
2014/0162856 A1 6/2014 Kramer
2014/0163429 A1 6/2014 Tropper et al.
2014/0164611 A1 6/2014 Molettiere et al.
2014/0171266 A1 6/2014 Hawkins, III et al.
2014/0171272 A1 6/2014 Hawkins, III et al.
2014/0172873 A1 6/2014 Varoglu et al.
2014/0173660 A1 6/2014 Correa et al.
2014/0180480 A1 6/2014 Lee et al.
2014/0187383 A1 7/2014 Martin
2014/0194260 A1 7/2014 Campanaro et al.
2014/0195103 A1 7/2014 Nassef
2014/0197946 A1 7/2014 Park et al.
2014/0200122 A1 7/2014 Hallmark
2014/0200691 A1 7/2014 Lee et al.
2014/0203943 A1 7/2014 Kates
2014/0205980 A1 7/2014 Braier et al.
2014/0206506 A1 7/2014 Huang
2014/0212857 A1 7/2014 Sullivan et al.
2014/0213416 A1 7/2014 Wang
2014/0214446 A1 7/2014 Pera, Jr.
2014/0220514 A1 8/2014 Waldron et al.
2014/0221160 A1 8/2014 Hardy et al.
2014/0221168 A1 8/2014 Chen
2014/0221175 A1 8/2014 Liu
2014/0221784 A1 8/2014 Pacione et al.
2014/0221854 A1 8/2014 Wai
2014/0222173 A1 8/2014 Giedwoyn et al.
2014/0228118 A1 8/2014 Hardy et al.
2014/0228175 A1 8/2014 Lemos et al.
2014/0228181 A1 8/2014 Powell
2014/0228649 A1 8/2014 Rayner et al.
2014/0235409 A1 8/2014 Salmon
2014/0235411 A1 8/2014 Dailey
2014/0235937 A1 8/2014 Plath
2014/0249440 A1 9/2014 Banet
2014/0257535 A1 9/2014 Morris et al.
2014/0257537 A1 9/2014 Stroupe et al.
2014/0265072 A1 9/2014 Chiu
2014/0265690 A1 9/2014 Henderson
2014/0266939 A1 9/2014 Baringer et al.
2014/0270375 A1 9/2014 Canavan et al.
2014/0272894 A1 9/2014 Grimes et al.
2014/0273858 A1 9/2014 Panther et al.
2014/0274564 A1 9/2014 Greenbaum
2014/0274574 A1 9/2014 Shorten

(56) References Cited

U.S. PATENT DOCUMENTS

2014/0274579 A1 9/2014 Olson
2014/0274596 A1 9/2014 Krull
2014/0274600 A1 9/2014 Dalebout et al.
2014/0275852 A1 9/2014 Hong et al.
2014/0275854 A1 9/2014 Venkatraman et al.
2014/0277637 A1 9/2014 Ventura et al.
2014/0278139 A1 9/2014 Hong et al.
2014/0278218 A1 9/2014 Chang
2014/0278220 A1 9/2014 Yuen
2014/0287886 A1 9/2014 Patti
2014/0288390 A1 9/2014 Hong et al.
2014/0288438 A1 9/2014 Venkatraman et al.
2014/0288680 A1 9/2014 Hoffman et al.
2014/0308629 A1 10/2014 Dugan
2014/0309085 A1 10/2014 Watterson et al.
2014/0309087 A1 10/2014 Uygan
2014/0309092 A1 10/2014 De Michele
2014/0316192 A1 10/2014 de Zambotti et al.
2014/0335490 A1 11/2014 Baarman et al.
2014/0336796 A1 11/2014 Agnew
2014/0338120 A1 11/2014 Baugh et al.
2014/0349257 A1 11/2014 Connor
2014/0351150 A1 11/2014 Ainsworth et al.
2014/0357457 A1 12/2014 Boekema
2014/0358012 A1 12/2014 Richards et al.
2014/0358473 A1 12/2014 Goel et al.
2014/0360413 A1 12/2014 Schenk
2014/0363797 A1 12/2014 Hu et al.
2014/0363800 A1 12/2014 Harris et al.
2014/0371887 A1 12/2014 Hoffman et al.
2014/0380167 A1 12/2014 Bloch et al.
2015/0001048 A1 1/2015 Koppes et al.
2015/0003621 A1 1/2015 Trammell
2015/0004579 A1 1/2015 Shelton
2015/0004580 A1 1/2015 Shum et al.
2015/0011362 A1 1/2015 Oh et al.
2015/0016623 A1 1/2015 Trammell
2015/0018989 A1 1/2015 Chen
2015/0019135 A1 1/2015 Kacyvenski et al.
2015/0025660 A1 1/2015 Prassler et al.
2015/0031964 A1 1/2015 Bly et al.
2015/0038300 A1 2/2015 Forhan et al.
2015/0044648 A1 2/2015 White et al.
2015/0048807 A1 2/2015 Fan et al.
2015/0051051 A1 2/2015 Liu et al.
2015/0059257 A1 3/2015 Beaver et al.
2015/0065273 A1 3/2015 Lake
2015/0065301 A1 3/2015 Oteman
2015/0069738 A1 3/2015 Knight
2015/0072842 A1 3/2015 Segal
2015/0079562 A1 3/2015 Yeh et al.
2015/0081209 A1 3/2015 Yeh et al.
2015/0081210 A1 3/2015 Yeh et al.
2015/0082408 A1 3/2015 Yeh et al.
2015/0087478 A1 3/2015 Zhang et al.
2015/0092972 A1 4/2015 Lai et al.
2015/0097700 A1 4/2015 Holthouse
2015/0099952 A1 4/2015 Lain
2015/0105220 A1 4/2015 Hong
2015/0105881 A1 4/2015 Guerrero et al.
2015/0106868 A1 4/2015 Lo
2015/0111708 A1 4/2015 Smith
2015/0118657 A1 4/2015 Shrake et al.
2015/0119197 A1 4/2015 Liu
2015/0126348 A1 5/2015 Kaye et al.
2015/0126873 A1 5/2015 Connor
2015/0135284 A1 5/2015 Bogard
2015/0141202 A1 5/2015 Ellis et al.
2015/0148204 A1 5/2015 Sleppy
2015/0151160 A1 6/2015 Balakrishnan et al.
2015/0154452 A1 6/2015 Bentley et al.
2015/0157918 A1 6/2015 Tracy
2015/0165259 A1 6/2015 Huppee et al.
2015/0165269 A1 6/2015 Herrala et al.
2015/0165270 A1 6/2015 Allos
2015/0168365 A1 6/2015 Connor
2015/0181314 A1 6/2015 Swanson
2015/0182773 A1 7/2015 Olson
2015/0182782 A1 7/2015 Cutler
2015/0186609 A1 7/2015 Utter, II
2015/0190679 A1 7/2015 Carbone
2015/0192929 A1 7/2015 Rihn et al.
2015/0199494 A1 7/2015 Koduri et al.
2015/0201722 A1 7/2015 Brouard
2015/0202487 A1 7/2015 Wu
2015/0209610 A1 7/2015 Dalebout et al.
2015/0209617 A1 7/2015 Hsiao
2015/0224363 A1 8/2015 Clark et al.
2015/0238801 A1 8/2015 Meredith
2015/0238806 A1 8/2015 Mintz
2015/0238815 A1 8/2015 Lee
2015/0246751 A1 9/2015 Spivack et al.
2015/0248844 A1 9/2015 Ellis et al.
2015/0250304 A1 9/2015 Dalebout
2015/0250420 A1 9/2015 Longinotti-Buitoni et al.
2015/0251047 A1 9/2015 Maanitty
2015/0251048 A1 9/2015 Dalebout
2015/0251055 A1 9/2015 Ashby
2015/0253210 A1 9/2015 Ashby et al.
2015/0255002 A1 9/2015 Harris
2015/0258382 A1 9/2015 Nolan et al.
2015/0258384 A1 9/2015 Suzuki
2015/0262459 A1 9/2015 Munro et al.
2015/0265903 A1 9/2015 Kolen et al.
2015/0269354 A1 9/2015 Klassen
2015/0272262 A1 10/2015 Escamilla
2015/0272473 A1 10/2015 Zafiroglu
2015/0273267 A1 10/2015 Manzke
2015/0273272 A1 10/2015 Wang
2015/0283420 A1 10/2015 Chang
2015/0283421 A1 10/2015 Gaylord
2015/0288926 A1 10/2015 Glass et al.
2015/0290490 A1 10/2015 Badarneh
2015/0295397 A1 10/2015 Lin et al.
2015/0296020 A1 10/2015 Granqvist et al.
2015/0297932 A1 10/2015 Wehrell
2015/0297936 A1 10/2015 Madden
2015/0305961 A1 10/2015 Broerman et al.
2015/0306456 A1 10/2015 Pasini et al.
2015/0310062 A1 10/2015 Wang et al.
2015/0314184 A1 11/2015 Moya Saez
2015/0318015 A1 11/2015 Bose et al.
2015/0320588 A1 11/2015 Connor
2015/0324751 A1 11/2015 Orenstein et al.
2015/0327804 A1 11/2015 Lefever et al.
2015/0331449 A1 11/2015 Ng
2015/0335288 A1 11/2015 Toth et al.
2015/0335941 A1 11/2015 Lo
2015/0339946 A1 11/2015 Pacione et al.
2015/0342815 A1 12/2015 Watson
2015/0346994 A1 12/2015 Chanyontpatanakul
2015/0351690 A1 12/2015 Toth et al.
2015/0352396 A1 12/2015 Dalebout
2015/0352401 A1 12/2015 Johnson
2015/0352402 A1 12/2015 Arnold et al.
2015/0352404 A1 12/2015 Schwenger
2015/0360073 A1 12/2015 Moran et al.
2015/0360133 A1 12/2015 MacCallum et al.
2015/0364026 A1 12/2015 Rubin et al.
2015/0364058 A1 12/2015 Lagree
2015/0366746 A1 12/2015 Ashby
2015/0367158 A1 12/2015 Pretz et al.
2015/0367176 A1 12/2015 Bejestan et al.
2015/0369326 A1 12/2015 Modrezejewski et al.
2015/0370320 A1 12/2015 Connor
2015/0375028 A1 12/2015 Oteman et al.
2015/0379239 A1 12/2015 Basta et al.
2015/0379891 A1 12/2015 Wallace
2015/0381736 A1 12/2015 Seltzer
2016/0001123 A1 1/2016 Parrish, Jr.
2016/0008650 A1 1/2016 Jue et al.
2016/0012749 A1 1/2016 Connor
2016/0016035 A1 1/2016 Hao
2016/0018119 A1 1/2016 Desmet et al.

(56) References Cited

U.S. PATENT DOCUMENTS

2016/0023043 A1 1/2016 Grundy
2016/0027325 A1 1/2016 Malhotra
2016/0038785 A1 2/2016 Netter
2016/0047446 A1 2/2016 Hung
2016/0051184 A1 2/2016 Wisbey et al.
2016/0051857 A1 2/2016 Rasner
2016/0058245 A1 3/2016 Smith et al.
2016/0059077 A1 3/2016 Paul et al.
2016/0059078 A1 3/2016 Liao
2016/0059079 A1 3/2016 Watterson
2016/0061300 A1 3/2016 Aoto et al.
2016/0063615 A1 3/2016 Watterson
2016/0066818 A1 3/2016 Cowley et al.
2016/0067537 A1 3/2016 Bayerlein et al.
2016/0071014 A1 3/2016 Brand et al.
2016/0074691 A1 3/2016 Pearce et al.
2016/0074701 A1 3/2016 Wiener
2016/0074705 A1 3/2016 Wiener
2016/0077547 A1 3/2016 Aimone et al.
2016/0089559 A1 3/2016 Smith et al.
2016/0089560 A1 3/2016 Smith et al.
2016/0089569 A1 3/2016 Blahnik
2016/0089575 A1 3/2016 Smith et al.
2016/0096064 A1 4/2016 Gatti
2016/0101311 A1 4/2016 Workman
2016/0107019 A1 4/2016 Shah
2016/0107029 A1 4/2016 Kim et al.
2016/0112684 A1 4/2016 Connor
2016/0114205 A1 4/2016 Giunchi
2016/0114211 A1 4/2016 Schmidt
2016/0121156 A1 5/2016 Bach
2016/0121161 A1 5/2016 Mountain
2016/0136483 A1 5/2016 Reich
2016/0148535 A1 5/2016 Ashby
2016/0148536 A1 5/2016 Ashby
2016/0151603 A1 6/2016 Shouldice et al.
2016/0157740 A1 6/2016 Kampman et al.
2016/0166872 A1 6/2016 Cervone et al.
2016/0166881 A1 6/2016 Ridgel et al.
2016/0171110 A1 6/2016 Gao et al.
2016/0175643 A1 6/2016 Kueker et al.
2016/0184625 A1 6/2016 Chang
2016/0184635 A1 6/2016 Kwon
2016/0193518 A1 7/2016 Baxter
2016/0199683 A1 7/2016 Shamlin
2016/0206248 A1 7/2016 Sartor et al.
2016/0206922 A1 7/2016 Dalebout et al.
2016/0211841 A1 7/2016 Harrison
2016/0219968 A1 8/2016 Martin
2016/0232811 A9 8/2016 Connor
2016/0249365 A1 8/2016 Harel
2016/0250514 A1 9/2016 Gvoich
2016/0250519 A1 9/2016 Watterson
2016/0253918 A1 9/2016 Watterson
2016/0256082 A1 9/2016 Ely et al.
2016/0256728 A1 9/2016 Tang
2016/0256745 A1 9/2016 Brammer
2016/0263426 A1 9/2016 Mueller et al.
2016/0278487 A1 9/2016 Postolek
2016/0279462 A1 9/2016 Sutherland
2016/0279470 A1 9/2016 Hampton
2016/0287930 A1 10/2016 Moser
2016/0296053 A1 10/2016 Bakhsh
2016/0303414 A1 10/2016 Werner
2016/0303421 A1 10/2016 Tyger et al.
2016/0317861 A1 11/2016 Dalebout
2016/0317866 A1 11/2016 Fung
2016/0319850 A1 11/2016 Kamen et al.
2016/0321075 A1 11/2016 Catherwood et al.
2016/0321932 A1 11/2016 Mitchell
2016/0346586 A1 12/2016 Pullins et al.
2016/0346598 A1 12/2016 Manzke et al.
2016/0346616 A1 12/2016 Kirby et al.
2016/0346617 A1 12/2016 Sprugo
2016/0351070 A1 12/2016 Aillon-Sohl
2016/0367851 A1 12/2016 Astilean et al.
2016/0367857 A1 12/2016 Aragones et al.
2016/0371998 A1 12/2016 Fazeel
2016/0375307 A1 12/2016 Durham
2016/0375308 A1 12/2016 Anderson
2017/0007886 A1 1/2017 Alessandri
2017/0011210 A1 1/2017 Cheong et al.
2017/0014661 A1 1/2017 Lin
2017/0020440 A1 1/2017 Flitsch et al.
2017/0021218 A1 1/2017 Peritz
2017/0036106 A1 2/2017 Stechschulte et al.
2017/0050069 A1 2/2017 Ky
2017/0050074 A1 2/2017 Olson
2017/0050102 A1 2/2017 Kelly
2017/0056711 A1 3/2017 Dalebout et al.
2017/0056712 A1 3/2017 Johnson
2017/0056715 A1 3/2017 Dalebout et al.
2017/0056716 A1 3/2017 Cutler
2017/0056726 A1 3/2017 Dalebout
2017/0063567 A1 3/2017 Tanaka et al.
2017/0065187 A1 3/2017 Hsieh et al.
2017/0065851 A1 3/2017 Deluca et al.
2017/0065852 A1 3/2017 Cygan et al.
2017/0065947 A1 3/2017 Haney et al.
2017/0068782 A1 3/2017 Pillai et al.
2017/0082983 A1 3/2017 Katzer et al.
2017/0093451 A1 3/2017 Chen et al.
2017/0097717 A1 4/2017 Anisetti et al.
2017/0100636 A1 4/2017 Umetsu et al.
2017/0104425 A1 4/2017 Meloche
2017/0106227 A1 4/2017 Lalaoua
2017/0106240 A1 4/2017 Chuang
2017/0113093 A1 4/2017 Bellavista et al.
2017/0120102 A1 5/2017 Chen
2017/0128783 A1 5/2017 Hasegawa et al.
2017/0128784 A1 5/2017 Molins et al.
2017/0136280 A1 5/2017 Lee
2017/0136288 A1 5/2017 Huang
2017/0136289 A1 5/2017 Frank
2017/0136291 A1 5/2017 Huang
2017/0136293 A1 5/2017 Caccia
2017/0136301 A1 5/2017 Cameron
2017/0136339 A1 5/2017 Habiche
2017/0144051 A1 5/2017 Oleson et al.
2017/0164876 A1 6/2017 Hyde et al.
2017/0165523 A1 6/2017 Chou
2017/0165552 A1 6/2017 Martin
2017/0173394 A1 6/2017 Rider
2017/0180535 A1 6/2017 Esenwein et al.
2017/0189745 A1 7/2017 Hamilton et al.
2017/0193578 A1 7/2017 Watterson
2017/0197103 A1 7/2017 Rau et al.
2017/0216660 A1 8/2017 Lernihan
2017/0225034 A1 8/2017 Kass et al.
2017/0235922 A1 8/2017 Weast et al.
2017/0239509 A1 8/2017 Wang
2017/0252599 A1 9/2017 Wang
2017/0252623 A1 9/2017 Sharifi
2017/0252641 A1 9/2017 Morimura et al.
2017/0266481 A1 9/2017 Dalebout
2017/0266483 A1 9/2017 Dalebout et al.
2017/0266503 A1 9/2017 Watterson et al.
2017/0266532 A1 9/2017 Watterson
2017/0266533 A1 9/2017 Dalebout
2017/0266534 A1 9/2017 Watterson
2017/0266535 A1 9/2017 Watterson
2017/0270820 A1 9/2017 Ashby
2017/0274237 A1 9/2017 Chang
2017/0274242 A1 9/2017 Corbalis
2017/0311817 A9 11/2017 Hsieh
2017/0319906 A1 11/2017 Chang
2017/0326411 A1 11/2017 Watterson
2017/0333755 A1 11/2017 Rider
2017/0340917 A1 11/2017 Chang
2017/0354846 A1 12/2017 Von Rueckmann
2017/0361145 A1 12/2017 Olson et al.
2017/0364661 A1 12/2017 Hamilton et al.
2017/0365048 A1 12/2017 Hamilton et al.
2017/0367480 A1 12/2017 Dickerson et al.

(56) References Cited

U.S. PATENT DOCUMENTS

| | | | |
|---|---|---|---|
| 2017/0368442 | A1 | 12/2017 | Baudhuin |
| 2018/0001135 | A1 | 1/2018 | Powell |
| 2018/0008865 | A9 | 1/2018 | Lannon et al. |
| 2018/0036572 | A1 | 2/2018 | Hsu |
| 2018/0036585 | A1 | 2/2018 | Powell |
| 2018/0056111 | A1 | 3/2018 | Chiang et al. |
| 2018/0084817 | A1 | 3/2018 | Capell et al. |
| 2018/0085622 | A1 | 3/2018 | Ivan |
| 2018/0085630 | A1 | 3/2018 | Capell et al. |
| 2018/0085654 | A1 | 3/2018 | Black et al. |
| 2018/0089396 | A1 | 3/2018 | Capell et al. |
| 2018/0092603 | A1 | 4/2018 | Duan et al. |
| 2018/0099116 | A1 | 4/2018 | Ashby |
| 2018/0099179 | A1 | 4/2018 | Chatterton |
| 2018/0099180 | A1 | 4/2018 | Wilkinson |
| 2018/0099181 | A1 | 4/2018 | Powell et al. |
| 2018/0099184 | A1 | 4/2018 | Eder |
| 2018/0099205 | A1 | 4/2018 | Watterson |
| 2018/0104533 | A1 | 4/2018 | Powell et al. |
| 2018/0109838 | A1 | 4/2018 | Garcia et al. |
| 2018/0111018 | A1 | 4/2018 | Lee |
| 2018/0111034 | A1 | 4/2018 | Watterson |
| 2018/0116599 | A1 | 5/2018 | Bastide et al. |
| 2018/0117383 | A1 | 5/2018 | Workman |
| 2018/0117385 | A1 | 5/2018 | Watterson |
| 2018/0117388 | A1 | 5/2018 | Porter |
| 2018/0117419 | A1 | 5/2018 | Jackson |
| 2018/0140886 | A1 | 5/2018 | Hetrick et al. |
| 2018/0147440 | A1 | 5/2018 | Lin |
| 2018/0154205 | A1 | 6/2018 | Watterson |
| 2018/0154206 | A1 | 6/2018 | Kim |
| 2018/0154208 | A1 | 6/2018 | Powell et al. |
| 2018/0256933 | A1 | 9/2018 | Olson |

FOREIGN PATENT DOCUMENTS

| | | | |
|---|---|---|---|
| CN | 1658929 | | 8/2005 |
| CN | 1708333 | | 12/2005 |
| CN | 201516258 | | 6/2010 |
| CN | 201410258 | Y | 2/2014 |
| CN | 10488413 | | 9/2015 |
| CN | 105848733 | | 8/2016 |
| EP | 2969058 | | 1/2016 |
| EP | 3086865 | A1 | 11/2016 |
| SU | 1533710 | | 1/1990 |
| WO | 1997006859 | | 2/1997 |
| WO | 2002053234 | A1 | 7/2002 |
| WO | 2007015096 | A3 | 2/2007 |
| WO | 2014153158 | | 9/2014 |
| WO | 2015/100429 | | 7/2015 |

OTHER PUBLICATIONS

*Nautilus, Inc.* v. *ICON Health & Fitness, Inc.*, Civil Case No. IPR2017-01363, Final Written Decision dated Nov. 28, 2018; 29 pages.

U.S. Appl. No. 61/920,834, filed Dec. 26, 2013, titled "Magnetic Resistance Mechanism in a Cable Machine", 31 pages.

Exxentric, Movie Archives, obtained from The Wayback Machine for http://exxentric.com/movies/ accessed for Aug. 19, 2015.

International Search Report & Written Opinion for PCT Application No. PCT/US2014/072390, dated Mar. 27, 2015, 9 pages.

Supplemental European Search Report for European Application No. 14874303, dated May 10, 2017, 6 pages.

*Nautilus, Inc.* v. *ICON Health & Fitness, Inc.*, Civil Case No. IPR2017-01363, Petition for Inter Partes Review of U.S. Pat. No. 9,403,047, filed May 5, 2017.

*Nautilus, Inc.* v. *ICON Health & Fitness, Inc.*, Civil Case No. IPR2017-01363, Olson, U.S. Pat. No. 9,403,047, (Petition Ex. 1001).

*Nautilus, Inc.* v. *ICON Health & Fitness, Inc.*, Civil Case No. IPR2017-01363, Sleamaker, U.S. Pat. No. 5,354,251 (Petition Ex. 1002).

*Nautilus, Inc.* v. *ICON Health & Fitness, Inc.*, Civil Case No. IPR2017-01363, Hanoun, U.S. Publication No. 2007-0232452 (Petition Ex. 1003).

*Nautilus, Inc.* v. *ICON Health & Fitness, Inc.*, Civil Case No. IPR2017-01363, Six-Pak, Printed Publication TuffStuff Fitness Six-Pak Trainer Owner's Manual (Petition Ex 1004).

*Nautilus, Inc.* v. *ICON Health & Fitness, Inc.*, Civil Case No. IPR2017-01363, Ehrenfried, U.S. Pat. No. 5,738,611 (Petition Ex. 1005).

*Nautilus, Inc.* v. *ICON Health & Fitness, Inc.*, Civil Case No. IPR2017-01363, Kleinman, International Publication No. WO2008/152627 (Petition Ex. 1006).

*Nautilus, Inc.* v. *ICON Health & Fitness, Inc.*, Civil Case No. IPR2017-01363, Declaration of Lee Rawls, (Petition Ex. 1007).

*Nautilus, Inc.* v. *ICON Health & Fitness, Inc.*, Civil Case No. IPR2017-01363, U.S. Pat. No. 9,403,047 File history, (Petition Ex. 1008).

*Nautilus, Inc.* v. *ICON Health & Fitness, Inc.*, Civil Case No. IPR2017-01363, U.S. Appl. No. 61/920,834, (Petition Ex. 1009).

*Nautilus, Inc.* v. *ICON Health & Fitness, Inc.*, Civil Case No. IPR2017-01363, Declaration of Christopher Butler (Petition Ex. 1010).

*Nautilus, Inc.* v. *ICON Health & Fitness, Inc.*, Civil Case No. IPR2017-01363, Petitioner's Power of Attorney, filed May 5, 2017.

*Nautilus, Inc.* v. *ICON Health & Fitness, Inc.*, Civil Case No. IPR2017-01363, Mandatory Notice to Patent Owner, filed May 19, 2017.

*Nautilus, Inc.* v. *ICON Health & Fitness, Inc.*, Civil Case No. IPR2017-01363, Power of Attorney, filed May 19, 2017.

*Nautilus, Inc.* v. *ICON Health & Fitness, Inc.*, Civil Case No. IPR2017-01363, Notice of Accord Filing Date, filed Jun. 9, 2017.

U.S. Appl. No. 61/786,007, filed Mar. 14, 2013, titled "Strength Training Apparatus with Flywheel and Related Methods", 28 pages.

International Search Report & Written Opinion for PCT Application No. PCT/US2014/029353, dated Aug. 4, 2014, 9 pages.

Supplemental European Search Report for European Application No. 14768130, dated Oct. 11, 2016, 9 pages.

U.S. Appl. No. 15/976,496, filed May 10, 2018, titled "Magnetic Resistance Mechanism in a Cable Machine", 36 pages.

*Nautilus, Inc.* v. *ICON Health & Fitness, Inc.*, Civil Case No. IPR2017-01407, Petition for Inter Partes Review of U.S. Pat. No. 9,616,276 (Claims 1-4, 7-10), filed May 5, 2017.

*Nautilus, Inc.* v. *ICON Health & Fitness, Inc.*, Civil Case No. IPR2017-01407, Dalebout et al., U.S. Pat. No. 9,616,276, (Petition Ex. 1001).

*Nautilus, Inc.* v. *ICON Health & Fitness, Inc.*, Civil Case No. IPR2017-01407, Wu, U.S. Publication No. 20030171192, (Petition Ex. 1002).

*Nautilus, Inc.* v. *ICON Health & Fitness, Inc.*, Civil Case No. IPR2017-01407, Webb, U.S. Publication No. 20030017918, (Petition Ex. 1003).

*Nautilus, Inc.* v. *ICON Health & Fitness, Inc.*, Civil Case No. IPR2017-01407, Watson, U.S. Publication No. 20060234840, (Petition Ex. 1004).

*Nautilus, Inc.* v. *ICON Health & Fitness, Inc.*, Civil Case No. IPR2017-01407, Jones, U.S. Pat. No. 4,798,378, (Petition Ex. 1005).

*Nautilus, Inc.* v. *ICON Health & Fitness, Inc.*, Civil Case No. IPR2017-01407, Zhou et al., U.S. Pat. No. 8,517,899, (Petition Ex. 1006).

*Nautilus, Inc.* v. *ICON Health & Fitness, Inc.*, Civil Case No. IPR2017-01407, Loach, U.S. Publication No. WO2007015096, (Petition Ex. 1007).

*Nautilus, Inc.* v. *ICON Health & Fitness, Inc.*, Civil Case No. IPR2017-01407, Rawls Declaration, Part 1 & 2, (Petition Ex. 1008).

*Nautilus, Inc.* v. *ICON Health & Fitness, Inc.*, Civil Case No. IPR2017-01407, U.S. Pat. No. 9,616,276 File History, (Petition Ex. 1009).

*Nautilus, Inc.* v. *ICON Health & Fitness, Inc.*, Civil Case No. IPR2017-01407, U.S. Appl. No. 61/786,007 File History, (Petition Ex. 1010).

(56) References Cited

OTHER PUBLICATIONS

*Nautilus, Inc.* v. *ICON Health & Fitness, Inc.*, Civil Case No. IPR2017-01407, Sawicky, U.S. Pat. No. 5,042,798, (Petition Ex. 1011).
*Nautilus, Inc.* v. *ICON Health & Fitness, Inc.*, Civil Case No. IPR2017-01407, Petitioner's Power of Attorney, filed May 5, 2017.
*Nautilus, Inc.* v. *ICON Health & Fitness, Inc.*, Civil Case No. IPR2017-01407, Mandatory Notice to Patent Owner, filed May 19, 2017.
*Nautilus, Inc.* v. *ICON Health & Fitness, Inc.*, Civil Case No. IPR2017-01407, Power of Attorney, filed May 19, 2017.
*Nautilus, Inc.* v. *ICON Health & Fitness, Inc.*, Civil Case No. IPR2017-01407, Notice of Accord Filing Date, filed Jun. 6, 2017.
*Nautilus, Inc.* v. *ICON Health & Fitness, Inc.*, Civil Case No. IPR2017-01408, Petition for Inter Partes Review of U.S. Pat. No. 9,616,276 (Claims 1-20) filed May 5, 2017.
*Nautilus, Inc.* v. *ICON Health & Fitness, Inc.*, Civil Case No. IPR2017-01408, Dalebout et al., U.S. Pat. No. 9,616,276, (Petition Ex. 1001).
*Nautilus, Inc.* v. *ICON Health & Fitness, Inc.*, Civil Case No. IPR2017-01408, Wu, U.S. Publication No. 20030171192, (Petition Ex. 1002).
*Nautilus, Inc.* v. *ICON Health & Fitness, Inc.*, Civil Case No. IPR2017-01408, Webb, U.S. Publication No. 20030017918, (Petition Ex. 1003).
*Nautilus, Inc.* v. *ICON Health & Fitness, Inc.*, Civil Case No. IPR2017-01408, Watson, U.S. Publication No. 20060234840, (Petition Ex. 1004).
*Nautilus, Inc.* v. *ICON Health & Fitness, Inc.*, Civil Case No. IPR2017-01408, Jones, U.S. Pat. No. 4,798,378, (Petition Ex. 1005).
*Nautilus, Inc.* v. *ICON Health & Fitness, Inc.*, Civil Case No. IPR2017-01408, Zhou et al., U.S. Pat. No. 8,517,899, (Petition Ex. 1006).
*Nautilus, Inc.* v. *ICON Health & Fitness, Inc.*, Civil Case No. IPR2017-01408, Loach, U.S. Publication No. WO2007015096, (Petition Ex. 1007).
*Nautilus, Inc.* v. *ICON Health & Fitness, Inc.*, Civil Case No. IPR2017-01408, Rawls Declaration, Part 1 & 2, (Petition Ex. 1008).
*Nautilus, Inc.* v. *ICON Health & Fitness, Inc.*, Civil Case No. IPR2017-01408, U.S. Pat. No. 9,616,276 File History, (Petition Ex. 1009).
*Nautilus, Inc.* v. *ICON Health & Fitness, Inc.*, Civil Case No. IPR2017-01408, U.S. Appl. No. 61/786,007 File History, (Petition Ex. 1010).
*Nautilus, Inc.* v. *ICON Health & Fitness, Inc.*, Civil Case No. IPR2017-01408, Sawicky, U.S. Pat. No. 5,042,798, (Petition Ex. 1011).
*Nautilus, Inc.* v. *ICON Health & Fitness, Inc.*, Civil Case No. IPR2017-01408, Petitioner's Power of Attorney, filed May 5, 2017.
*Nautilus, Inc.* v. *ICON Health & Fitness, Inc.*, Civil Case No. IPR2017-01408, Mandatory Notice to Patent Owner, filed May 19, 2017.
*Nautilus, Inc.* v. *ICON Health & Fitness, Inc.*, Civil Case No. IPR2017-01408, Power of Attorney, filed May 19, 2017.
*Nautilus, Inc.* v. *ICON Health & Fitness, Inc.*, Civil Case No. IPR2017-01408, Notice of Accord Filing Date, filed Jun. 6, 2017.
Chinese Office Action for Chinese Patent Application No. 201480003701.9 dated Apr. 6, 2016.
Chinese Search Report for Chinese Patent Application No. 2014800708329 dated Jun. 2, 2017.
*Nautilus, Inc.* v. *ICON Health & Fitness, Inc.*, Civil Case No. IPR2017-01363, Declaration of Tyson Hottinger in Support of Motion for Admission Pro Hac Vice, filed Feb. 1, 2018 (Ex 2001).
*Nautilus, Inc.* v. *ICON Health & Fitness, Inc.*, Civil Case No. IPR2017-01363, Transcript of Deposition of R. Lee Rawls, filed Mar. 5, 2018 (Ex 2002).
*Nautilus, Inc.* v. *ICON Health & Fitness, Inc.*, Civil Case No. IPR2017-01363, Order Conduct of Proceedings, filed May 7, 2018 (Paper 20).
*Nautilus, Inc.* v. *ICON Health & Fitness, Inc.*, Civil Case No. IPR2017-01407, Decision Institution of Inter Partes Review, filed Dec. 4, 2017 (Paper 6).
*Nautilus, Inc.* v. *ICON Health & Fitness, Inc.*, Civil Case No. IPR2017-01407, Scheduling Order, filed Dec. 4, 2017 (Paper 7).
*Nautilus, Inc.* v. *ICON Health & Fitness, Inc.*, Civil Case No. IPR2017-01407, Order, filed Jan. 19, 2018 (Paper 8).
*Nautilus, Inc.* v. *ICON Health & Fitness, Inc.*, Civil Case No. IPR2017-01407, Patent Owner's Notice of Deposition of R. Lee Rawls, filed Jan. 19, 2018 (Paper 9).
*Nautilus, Inc.* v. *ICON Health & Fitness, Inc.*, Civil Case No. IPR2017-01407, Unopposed Motion for Pro Hac Vice Admission of Tyson Hottinger, filed Feb. 1, 2018 (Paper 10).
*Nautilus, Inc.* v. *ICON Health & Fitness, Inc.*, Civil Case No. IPR2017-01407, Patent Owner's Current Exhibit List, filed Feb. 1, 2018 (Paper 11).
*Nautilus, Inc.* v. *ICON Health & Fitness, Inc.*, Civil Case No. IPR2017-01407, Patent Owner's Updated Notice of Deposition of R. Lee Rawls, filed Feb. 1, 2018 (Paper 12).
*Nautilus, Inc.* v. *ICON Health & Fitness, Inc.*, Civil Case No. IPR2017-01407, Order Granting Motion of Pro Hac Vice Admission of Mr. Hottinger, filed Feb. 12, 2018 (Paper 13).
*Nautilus, Inc.* v. *ICON Health & Fitness, Inc.*, Civil Case No. IPR2017-01407, Petitioner's Updated Mandatory Notices, filed Feb. 20, 2018 (Paper 14).
*Nautilus, Inc.* v. *ICON Health & Fitness, Inc.*, Civil Case No. IPR2017-01407, Petitioner's Updated Power of Attorney, filed Feb. 20, 2018 (Paper 15).
*Nautilus, Inc.* v. *ICON Health & Fitness, Inc.*, Civil Case No. IPR2017-01407, Patent Owner's Motion to Amend, filed Mar. 5, 2018 (Paper 16).
*Nautilus, Inc.* v. *ICON Health & Fitness, Inc.*, Civil Case No. IPR2017-01407, Current Exhibit List of Patent Owner, filed Mar. 5, 2018 (Paper 17).
*Nautilus, Inc.* v. *ICON Health & Fitness, Inc.*, Civil Case No. IPR2017-01407, Order Conduct of Proceedings 37 C.F.R. Sec 42.5, filed Apr. 27, 2018 (Paper 18).
*Nautilus, Inc.* v. *ICON Health & Fitness, Inc.*, Civil Case No. IPR2017-01407, Order Conduct of Proceedings 37 C.F.R. Sec 42.5, filed May 7, 2018 (Paper 19).
*Nautilus, Inc.* v. *ICON Health & Fitness, Inc.*, Civil Case No. IPR2017-01408, Declaration of Tyson Hottinger in Support of Motion for Admission Pro Hac Vice, (Patent Owner Ex. 2001).
*Nautilus, Inc.* v. *ICON Health & Fitness, Inc.*, Civil Case No. IPR2017-01408, Claim Listing of Proposed Substitute Claims for Patent Owner Motion to Amend, (Patent Owner Ex. 2002).
*Nautilus, Inc.* v. *ICON Health & Fitness, Inc.*, Civil Case No. IPR2017-01408, Specification of U.S. Pat. No. 9,616,276, (Patent Owner Ex. 2003).
*Nautilus, Inc.* v. *ICON Health & Fitness, Inc.*, Civil Case No. IPR2017-01408, Drawings of U.S. Pat. No. 9,616,276, (Patent Owner Ex. 2004).
*Nautilus, Inc.* v. *ICON Health & Fitness, Inc.*, Civil Case No. IPR2017-01408, Specification of U.S. Pat. No. 9,254,409 (Patent Owner Ex. 2005).
*Nautilus, Inc.* v. *ICON Health & Fitness, Inc.*, Civil Case No. IPR2017-01408, Drawings of U.S. Pat. No. 9,254,409 (Patent Owner Ex. 2006).
*Nautilus, Inc.* v. *ICON Health & Fitness, Inc.*, Civil Case No. IPR2017-01408, Provisional Patent Specification of U.S. Appl. No. 61/786,007, (Patent Owner Ex. 2007).
*Nautilus, Inc.* v. *ICON Health & Fitness, Inc.*, Civil Case No. IPR2017-01408, Provisional Patent Drawings of U.S. Appl. No. 61/786,007, (Patent Owner Ex. 2008).
*Nautilus, Inc.* v. *ICON Health & Fitness, Inc.*, Civil Case No. IPR2017-01408, Specification of U.S. Appl. No. 13/754,361 (Patent Owner Ex. 2009).
*Nautilus, Inc.* v. *ICON Health & Fitness, Inc.*, Civil Case No. IPR2017-01408, Drawings of U.S. Appl. No. 13/754,361 (Patent Owner Ex. 2010).
*Nautilus, Inc.* v. *ICON Health & Fitness, Inc.*, Civil Case No. IPR2017-01408, Webster Dictionary p. 2211 (Merriam-Webster, Inc. 1961, 2002) (Ex. 3001).

(56) References Cited

OTHER PUBLICATIONS

*Nautilus, Inc.* v. *ICON Health & Fitness, Inc.*, Civil Case No. IPR2017-01408, Patent Owner Preliminary Response to Petition, filed Sep. 5, 2017 (Paper 6).
*Nautilus, Inc.* v. *ICON Health & Fitness, Inc.*, Civil Case No. IPR2017-01408, Decision Institution of Inter Partes Review, filed Dec. 4, 2017 (Paper 7).
*Nautilus, Inc.* v. *ICON Health & Fitness, Inc.*, Civil Case No. IPR2017-01408, Scheduling Order, filed Dec. 4, 2017 (Paper 8).
*Nautilus, Inc.* v. *ICON Health & Fitness, Inc.*, Civil Case No. IPR2017-01408, Order Conduct of Proceeding, filed Jan. 19, 2018 (Paper 9).
*Nautilus, Inc.* v. *ICON Health & Fitness, Inc.*, Civil Case No. IPR2017-01408, Patent Owner's Notice of Deposition of R. Lee Rawls, filed Jan. 19, 2018 (Paper 10).
*Nautilus, Inc.* v. *ICON Health & Fitness, Inc.*, Civil Case No. IPR2017-01408, Unopposed Motion for Pro Hac Vice Admission of Tyson Hottinger, filed Feb. 1, 2018 (Paper 11).
*Nautilus, Inc.* v. *ICON Health & Fitness, Inc.*, Civil Case No. IPR2017-01408, Current Exhibit List for Patent Owner, filed Feb. 1, 2018 (Paper 12).
*Nautilus, Inc.* v. *ICON Health & Fitness, Inc.*, Civil Case No. IPR2017-01408, Patent Owner's Updated Notice of Deposition of R. Lee Rawls, Feb. 1, 2018 (Paper 13).
*Nautilus, Inc.* v. *ICON Health & Fitness, Inc.*, Civil Case No. IPR2017-01408, Order Granting Motion for Pro Hac Vice Admission, filed Feb. 12, 2018 (Paper 14).
*Nautilus, Inc.* v. *ICON Health & Fitness, Inc.*, Civil Case No. IPR2017-01408, Petitioner's Updated Mandatory Notices, filed Feb. 20, 2018 (Paper 15).
*Nautilus, Inc.* v. *ICON Health & Fitness, Inc.*, Civil Case No. IPR2017-01408, Petitioner's Updated Power of Attorney, filed Feb. 20, 2018 (Paper 16).
*Nautilus, Inc.* v. *ICON Health & Fitness, Inc.*, Civil Case No. IPR2017-01408, Patent Owners Motion to Amend, filed Mar. 5, 2018 (Paper 17).
*Nautilus, Inc.* v. *ICON Health & Fitness, Inc.*, Civil Case No. IPR2017-01408, Current Exhibit List of Patent Owner, filed Mar. 5, 2018 (Paper 18).
*Nautilus, Inc.* v. *ICON Health & Fitness, Inc.*, Civil Case No. IPR2017-01408, Order Conduct of Proceedings, filed Apr. 27, 2018 (Paper 19).
*Nautilus, Inc.* v. *ICON Health & Fitness, Inc.*, Civil Case No. IPR2017-01408, Order Conduct of Proceedings, filed May 7, 2018 (Paper 20).
*Nautilus, Inc.* v. *ICON Health & Fitness, Inc.*, Civil Case No. IPR2017-01408, Specification of U.S. Appl. No. 15/019,088, (Patent Owner Ex. 2003).
*Nautilus, Inc.* v. *ICON Health & Fitness, Inc.*, Civil Case No. IPR2017-01408, Drawings of U.S. Appl. No. 15/019,088, (Patent Owner Ex. 2004).
*Nautilus, Inc.* v. *ICON Health & Fitness, Inc.*, Civil Case No. IPR2017-01408, Specification of U.S. Appl. No. 14/213,793, (Patent Owner Ex. 2005).
*Nautilus, Inc.* v. *ICON Health & Fitness, Inc.*, Civil Case No. IPR2017-01408, Drawings of U.S. Appl. No. 14/213,793, (Patent Owner Ex. 2006).
*Nautilus, Inc.* v. *ICON Health & Fitness, Inc.*, Civil Case No. IPR2017-01408, Specification of U.S. Appl. No. 61/786,007, (Patent Owner Ex. 2007).
*Nautilus, Inc.* v. *ICON Health & Fitness, Inc.*, Civil Case No. IPR2017-01408, Drawings of U.S. Appl. No. 61/786,007, (Patent Owner Ex. 2008).
*Nautilus, Inc.* v. *ICON Health& Fitness, Inc.*, Civil Case No. IPR2017-01363, Petitioner's Reply in Support of Petition for Inter Partes Review; filed Jun. 4, 2018; 18 pages (paper 21).
*Nautilus, Inc.* v. *ICON Health& Fitness, Inc.*, Civil Case No. IPR2017-01363, Petitioner's Motion for Pro Hac Vice Admission, filed Jun. 6, 2018; 5 pages (paper 22).
*Nautilus, Inc.* v. *ICON Health& Fitness, Inc.*, Civil Case No. IPR2017-01363, Affidavit of Lane M. Polozola in support of Petitioner's Motion of Pro Hac Vice Admission Under 37 C.F.R. 42.10(c), filed Jun. 6, 2018, 4 pages (Exhibit 1011).
*Nautilus, Inc.* v. *ICON Health& Fitness, Inc.*, Civil Case No. IPR2017-01363, Order granting Motion for Pro Hac Vice Admission-37 C.F.R. 42.10(c), filed Jun. 14, 2018; 4 pages (paper 23).
*Nautilus, Inc.* v. *ICON Health& Fitness, Inc.*, Civil Case No. IPR2017-01363, Petitioner's Updated Mandatory Notices, filed Jun. 20, 2018; 4 pages (paper 24).
*Nautilus, Inc.* v. *ICON Health& Fitness, Inc.*, Civil Case No. IPR2017-01363, Petitioner's Updated Power of Attorney, filed Jun. 20, 2018; 3 pages (paper 25).
*Nautilus, Inc.* v. *ICON Health& Fitness, Inc.*, Civil Case No. IPR2017-01363, Petitioner's Request for Oral Argument, filed Jul. 25, 2018; 4 pages; (paper 26).
*Nautilus, Inc.* v. *ICON Health& Fitness, Inc.*, Civil Case No. IPR2017-01363, Patent Owner's Request for Oral Argument, filed Jul. 25, 2018; 4 pages (paper 27).
*Nautilus, Inc.* v. *ICON Health& Fitness, Inc.*, Civil Case No. IPR2017-01363, Order 37 C.F.R. 42.70, filed Aug. 14, 2018, 5 pages (paper 28).
*Nautilus, Inc.* v. *ICON Health& Fitness, Inc.*, Civil Case No. IPR2017-01363, Current Exhibit List of Patent Owner, filed Aug. 24, 2018, 3 pages (paper 29).
*Nautilus, Inc.* v. *ICON Health& Fitness, Inc.*, Civil Case No. IPR2017-01363, Order Conduct of Proceedings 37 C.F.R. 42.5, filed Aug. 24, 2018, 4 pages (paper 30).
*Nautilus, Inc.* v. *ICON Health& Fitness, Inc.*, Civil Case No. IPR2017-01363, Petitioner's Updated Exhibit List, filed Aug. 24, 2018, 4 pages (paper 31).
*Nautilus, Inc.* v. *ICON Health& Fitness, Inc.*, Civil Case No. IPR2017-01363; Petitioner's Oral Argument Demonstrative Exhibits, filed Aug. 24, 2018, 31 pages (exhibit 1012).
*Nautilus, Inc.* v. *ICON Health& Fitness, Inc.*, Civil Case No. IPR2017-01363; Patent Owner Demonstrative Exhibits; filed Aug. 24, 2018, 10 pages (exhibit 2003).
*Nautilus, Inc.* v. *ICON Health& Fitness, Inc.*, Civil Case No. IPR2017-01407, Petitioner's Motion for Pro Hac Vice Admission, filed Jun. 6, 2018, 5 pages (paper 21).
*Nautilus, Inc.* v. *ICON Health& Fitness, Inc.*, Civil Case No. IPR2017-01407, Patent Owner's Objections to Evidence, filed Jun. 7, 2018, 5 pages (paper 22).
*Nautilus, Inc.* v. *ICON Health& Fitness, Inc.*, Civil Case No. IPR2017-01407, Patent Owner's Notice of Deposition of Christopher Cox, filed Jun. 13, 2018, 3 pages (paper 23).
*Nautilus, Inc.* v. *ICON Health& Fitness, Inc.*, Civil Case No. IPR2017-01407, Order-Granting Motion for Pro Hac Vice Admission, filed Jun. 14, 2018, 4 pages (paper 24).
*Nautilus, Inc.* v. *ICON Health& Fitness, Inc.*, Civil Case No. IPR2017-01407, Petitioner's Updated Mandatory Notices, filed Jun. 20, 2018, 4 pages, (paper 25).
*Nautilus, Inc.* v. *ICON Health& Fitness, Inc.*, Civil Case No. IPR2017-01407, Petitioner's Updated Power of Attorney, filed Jun. 20, 2018, 3 pages, (paper 26).
*Nautilus, Inc.* v. *ICON Health& Fitness, Inc.*, Civil Case No. IPR2017-01407, Patent Owner's Reply to Petitioners Opposition to Motions to Amend, filed Jul. 5, 2018, 28 pages, (paper 27).
*Nautilus, Inc.* v. *ICON Health& Fitness, Inc.*, Civil Case No. IPR2017-01407, Current Exhibit List for Patent Owner, filed Jul. 5, 2018, 4 pages, (paper 28).
*Nautilus, Inc.* v. *ICON Health& Fitness, Inc.*, Civil Case No. IPR2017-01407, Patent Owners Updated Mandatory Notices, filed Jul. 5, 2018, 4 pages, (paper 29).
*Nautilus, Inc.* v. *ICON Health& Fitness, Inc.*, Civil Case No. IPR2017-01407, Petitioner's Notice of Deposition Scott Ganaja, filed Jul. 11, 2018, 3 pages (paper 30).
*Nautilus, Inc.* v. *ICON Health& Fitness, Inc.*, Civil Case No. IPR2017-01407, Joint Notice of Stipulation to Modify Scheduling Order, filed Jul. 12, 2018, 3 pages, (paper 31).
*Nautilus, Inc.* v. *ICON Health& Fitness, Inc.*, Civil Case No. IPR2017-01407, Petitioner's Objections to Evidence, filed Jul. 12, 2018, 4 pages (paper 32).

(56) References Cited

OTHER PUBLICATIONS

*Nautilus, Inc.* v. *ICON Health& Fitness, Inc.*, Civil Case No. IPR2017-01407, Petitioner's Amended Notice of Deposition Scott Ganaja, filed Jul. 12, 2018, 3 pages (paper 33).
*Nautilus, Inc.* v. *ICON Health& Fitness, Inc.*, Civil Case No. IPR2017-01407, Order Conduct of Proceeding 37 C.F.R. 42.5, filed Jul. 20, 2018, 5 pages, (paper 34).
*Nautilus, Inc.* v. *ICON Health& Fitness, Inc.*, Civil Case No. IPR2017-01407, Petitioner's Sur-Reply ISO Opposition to Motions to Amend, filed Aug. 1, 2018, 19 pages, (paper 35).
*Nautilus, Inc.* v. *ICON Health& Fitness, Inc.*, Civil Case No. IPR2017-01407, Joint Notice of Stipulation to Modify Scheduling Order, filed Aug. 3, 2018, 3 pages (paper 36).
*Nautilus, Inc.* v. *ICON Health& Fitness, Inc.*, Civil Case No. IPR2017-01407, Order Conduct of the Proceeding, filed Aug. 7, 2018, 4 pages (paper 37).
*Nautilus, Inc.* v. *ICON Health& Fitness, Inc.*, Civil Case No. IPR2017-01407, Patent Owner's Objections to Petitioners Sur Reply, filed Aug. 8, 2018, 5 pages (paper 38).
*Nautilus, Inc.* v. *ICON Health& Fitness, Inc.*, Civil Case No. IPR2017-01407, Patent Owner's Request for Oral Argument, filed Aug. 10, 2018, 4 pages, (paper 39).
*Nautilus, Inc.* v. *ICON Health& Fitness, Inc.*, Civil Case No. IPR2017-01407, Petitioner's Request for Oral Argument, filed Aug. 10, 2018, 4 pages, (paper 40).
*Nautilus, Inc.* v. *ICON Health& Fitness, Inc.*, Civil Case No. IPR2017-01407, Patent Owner's Motion to Exclude Evidence, filed Aug. 10, 2018, 11 pages (paper 41).
*Nautilus, Inc.* v. *ICON Health& Fitness, Inc.*, Civil Case No. IPR2017-01407, Order 37 C.F.R. 42.70, filed Aug. 14, 2018, 5 pages (paper 42).
*Nautilus, Inc.* v. *ICON Health& Fitness, Inc.*, Civil Case No. IPR2017-01407, Petitioner's Opposition to Patent Owner's Motion to Exclude, filed Aug. 16, 2018, 18 pages (paper 44).
*Nautilus, Inc.* v. *ICON Health& Fitness, Inc.*, Civil Case No. IPR2017-01407, Patent Owner's Reply in support of Motion to Exclude, filed Aug. 22, 2018, 8 pages, (paper 45).
*Nautilus, Inc.* v. *ICON Health& Fitness, Inc.*, Civil Case No. IPR2017-01407, Current Exhibit List of Patent Owner, filed Aug. 24, 2018, 4 pages (paper 46).
*Nautilus, Inc.* v. *ICON Health& Fitness, Inc.*, Civil Case No. IPR2017-01407, Order re Po Sur-Rebuttal at Hearing, filed Aug. 24, 2018, 4 pages (paper 47).
*Nautilus, Inc.* v. *ICON Health& Fitness, Inc.*, Civil Case No. IPR2017-01407, Exhibit 1012—U.S. Pat. No. 8,585,561 (Watt), filed Jun. 4, 2018, 32 pages.
*Nautilus, Inc.* v. *ICON Health& Fitness, Inc.*, Civil Case No. IPR2017-01407, Exhibit 1013—U.S. Pat. No. 9,044,635 (Lull), filed Jun. 4, 2018, 21 pages.
*Nautilus, Inc.* v. *ICON Health& Fitness, Inc.*, Civil Case No. IPR2017-01407, Exhibit 1014—U.S. Pat. No. 7,740,563 (Dalebout), filed Jun. 4, 2018, 31 pages.
*Nautilus, Inc.* v. *ICON Health& Fitness, Inc.*, Civil Case No. IPR2017-01407, Exhibit 1015—US20020055418A1 (Pyles), filed Jun. 4, 2018, 9 pages.
*Nautilus, Inc.* v. *ICON Health& Fitness, Inc.*, Civil Case No. IPR2017-01407, Exhibit 1016—US20120258433A1 (Hope), filed Jun. 4, 2018, 51 pages.
*Nautilus, Inc.* v. *ICON Health& Fitness, Inc.*, Civil Case No. IPR2017-01407, Exhibit 1017—U.S. Pat. No. 7,771,320 (Riley), filed Jun. 4, 2018, 44 pages.
*Nautilus, Inc.* v. *ICON Health& Fitness, Inc.*, Civil Case No. IPR2017-01407, Exhibit 1018—Declaration of Christopher Cox in Support of Petitioners Oppositions to Patent Owners Motions to Amend, filed Jun. 4, 2018, 739 pages.
*Nautilus, Inc.* v. *ICON Health& Fitness, Inc.*, Civil Case No. IPR2017-01407, Exhibit 1019—Affidavit of Lane M. Polozola in Support of Petitioners Motion for Pro Hac Vice Admission, filed Jun. 6, 2018, 4 pages.
*Nautilus, Inc.* v. *ICON Health& Fitness, Inc.*, Civil Case No. IPR2017-01407, Exhibit 1020—S. Ganaja Depo Transcript, filed Aug. 1, 2018, 58 pages.
*Nautilus, Inc.* v. *ICON Health& Fitness, Inc.*, Civil Case No. IPR2017-01407, Exhibit 1021—Petitioner's Demonstrative Exhibits, filed Aug. 24, 2018, 92 pages.
*Nautilus, Inc.* v. *ICON Health& Fitness, Inc.*, Civil Case No. IPR2017-01407, Exhibit 2011—Declaration of Scott Ganaja in Support of Patent Owner's Reply to Petitioners Opposition to Patent Owners Motion to Amend, filed Jul. 5, 2018, 42 pages.
*Nautilus, Inc.* v. *ICON Health& Fitness, Inc.*, Civil Case No. IPR2017-01407, Exhibit 2012—Declaration of Richard Ferraro in Support of Patent Owner's Reply to Petitioners Opposition to Patent Owners Motion to Amend, filed Jul. 5, 2018, 35 pages.
*Nautilus, Inc.* v. *ICON Health& Fitness, Inc.*, Civil Case No. IPR2017-01407, Exhibit 2013—Cox, Christopher Depo Transcript 2018 06 26, filed Jul. 5, 2018, 26 pages.
*Nautilus, Inc.* v. *ICON Health& Fitness, Inc.*, Civil Case No. IPR2017-01407, Exhibit 2014—Patent Owner Demonstrative Exhibits, filed Aug. 24, 2018, 21 pages.
*Nautilus, Inc.* v. *ICON Health& Fitness, Inc.*, Civil Case No. IPR2017-01408, Petitioner's Opposition to Patent Owner's Motion to Amend, filed Jun. 4, 2018, 44 pages (paper 21).
*Nautilus, Inc.* v. *ICON Health& Fitness, Inc.*, Civil Case No. IPR2017-01408, Petitioners Motion for Pro Hac Vice Admission, filed Jun. 6, 2018, 5 pages (paper 22).
*Nautilus, Inc.* v. *ICON Health& Fitness, Inc.*, Civil Case No. IPR2017-01408, Patent Owner's Objections to Evidence, filed Jun. 7, 2018, 5 pages (paper 23).
*Nautilus, Inc.* v. *ICON Health& Fitness, Inc.*, Civil Case No. IPR2017-01408, Declaration R. Lee Rawls, Part 1, dated May 12, 2017, 447 pages, (paper 24).
*Nautilus, Inc.* v. *ICON Health& Fitness, Inc.*, Civil Case No. IPR2017-01408, Declaration R. Lee Rawls, Part 2, dated May 12, 2017, 216 pages, (paper 24).
*Nautilus, Inc.* v. *ICON Health& Fitness, Inc.*, Civil Case No. IPR2017-01408, Order granting Motion for Pro Hac Vice Admission, filed Jun. 14, 2018, 4 pages (paper 25).
*Nautilus, Inc.* v. *ICON Health& Fitness, Inc.*, Civil Case No. IPR2017-01408, Petitioner's Updated Mandatory Notices, filed Jun. 20, 2018, 4 pages, (paper 26).
*Nautilus, Inc.* v. *ICON Health& Fitness, Inc.*, Civil Case No. IPR2017-01408, Petitioner's Updated Power of Attorney, filed Jun. 20, 2018, 3 pages, (paper 27).
*Nautilus, Inc.* v. *ICON Health& Fitness, Inc.*, Civil Case No. IPR2017-01408, Patent Owner's Reply to Opposition to Motions to Amend, filed Jul. 5, 2018, 28 pages, (paper 28).
*Nautilus, Inc.* v. *ICON Health& Fitness, Inc.*, Civil Case No. IPR2017-01408, Current Exhibit List of Patent Owner, filed Jul. 5, 2018, 4 pages, (paper 29).
*Nautilus, Inc.* v. *ICON Health& Fitness, Inc.*, Civil Case No. IPR2017-01408, Patent Owner's Updated Mandatory Notices, filed Jul. 5, 2018, 4 pages, (paper 30).
*Nautilus, Inc.* v. *ICON Health& Fitness, Inc.*, Civil Case No. IPR2017-01408, Petitioner's Notice of Deposition of Scott Ganaja, filed Jul. 11, 2018, 3 pages (paper 31).
*Nautilus, Inc.* v. *ICON Health& Fitness, Inc.*, Civil Case No. IPR2017-01408, Joint Notice of Stipulation to Modify Scheduling Order, filed Jul. 12, 2018, 3 pages (paper 32).
*Nautilus, Inc.* v. *ICON Health& Fitness, Inc.*, Civil Case No. IPR2017-01408, Petitioner's Objections to Patent Owner's Evidence, filed Jul. 12, 2018, 4 pages, (paper 33).
*Nautilus, Inc.* v. *ICON Health& Fitness, Inc.*, Civil Case No. IPR2017-01408, Petitioner's Amended Notice of Deposition of Scott Ganaja, filed Jul. 12, 2018, 3 pages, (paper 34).
*Nautilus, Inc.* v. *ICON Health& Fitness, Inc.*, Civil Case No. IPR2017-01408, Order — Conduct of the Proceeding, 37 C.F.R. 42.5, filed Jul. 20, 2018, 5 pages (paper 35).
*Nautilus, Inc.* v. *ICON Health& Fitness, Inc.*, Civil Case No. IPR2017-01408, Petitioner's Sur-Reply in Support of Opposition to Patent Owners Motions to Amend, filed Aug. 1, 2018, 19 pages, (paper 36).

(56) References Cited

OTHER PUBLICATIONS

*Nautilus, Inc.* v. *ICON Health& Fitness, Inc.*, Civil Case No. IPR2017-01408, Joint Notice of Stipulation to Modify Scheduling Order, filed Aug. 3, 2018, 3 pages (paper 37).
*Nautilus, Inc.* v. *ICON Health& Fitness, Inc.*, Civil Case No. IPR2017-01408, Order—Conduct of the Proceeding, 37 C.F.R. 42.5, filed Aug. 7, 2018, 4 pages (paper 38).
*Nautilus, Inc.* v. *ICON Health& Fitness, Inc.*, Civil Case No. IPR2017-01408, Patent Owner's Objections to Petitioners Sur Reply, filed Aug. 2, 2018, 5 pages, (paper 39).
*Nautilus, Inc.* v. *ICON Health& Fitness, Inc.*, Civil Case No. IPR2017-01408, Patent Owner's Request for Oral Argument, filed Aug. 10, 2018, 4 pages, (paper 40).
*Nautilus, Inc.* v. *ICON Health& Fitness, Inc.*, Civil Case No. IPR2017-01408, Petitioner's Request for Oral Argument, filed Aug. 10, 2018, 4 pages, (paper 41).
*Nautilus, Inc.* v. *ICON Health& Fitness, Inc.*, Civil Case No. IPR2017-01408, Patent Owner's Motion to Exclude Evidence, filed Aug. 10, 2018, 11 pages (paper 42).
*Nautilus, Inc.* v. *ICON Health& Fitness, Inc.*, Civil Case No. IPR2017-01408, Order—Oral Hearing 37 C.F.R. 42.70, filed Aug. 14, 2018, 5 pages (paper 43).
*Nautilus, Inc.* v. *ICON Health& Fitness, Inc.*, Civil Case No. IPR2017-01408, Petitioner's Opposition to Patent Owner's Motion to Exclude Evidence, filed Aug. 16, 2018, 18 pages (paper 44).
*Nautilus, Inc.* v. *ICON Health& Fitness, Inc.*, Civil Case No. IPR2017-01408, Patent Owners Reply in Support of its Motion to Exclude, filed Aug. 22, 2018, 8 pages, (paper 46).
*Nautilus, Inc.* v. *ICON Health& Fitness, Inc.*, Civil Case No. IPR2017-01408, Current Exhibit List of Patent Owner, filed Aug. 24, 2018, 4 pages (paper 47).
*Nautilus, Inc.* v. *ICON Health& Fitness, Inc.*, Civil Case No. IPR2017-01408, Order Conduct of the Proceedings —37 C.F.R. 42.5, filed Aug. 24, 2018, 4 pages, (paper 48).
*Nautilus, Inc.* v. *ICON Health& Fitness, Inc.*, Civil Case No. IPR2017-01408, Petitioner's Updated Exhibit List, filed Aug. 24, 2018, 5 pages, (paper 49).
*Nautilus, Inc.* v. *ICON Health& Fitness, Inc.*, Civil Case No. IPR2017-01408, Exhibit 1012—U.S. Pat. No. 8,585,561 (Watt), filed Jun. 4, 2018, 32 pages.
*Nautilus, Inc.* v. *ICON Health& Fitness, Inc.*, Civil Case No. IPR2017-01408, Exhibit 1013—U.S. Pat. No. 9,044,635 (Lull), filed Jun. 4, 2018, 21 pages.
*Nautilus, Inc.* v. *ICON Health& Fitness, Inc.*, Civil Case No. IPR2017-01408, Exhibit 1014—U.S. Pat. No. 7,740,563 (Dalebout), filed Jun. 4, 2018, 31 pages.
*Nautilus, Inc.* v. *ICON Health& Fitness, Inc.*, Civil Case No. IPR2017-01408, Exhibit 1015—US20020055418A1 (Pyles), filed Jun. 4, 2018, 9 pages.
*Nautilus, Inc.* v. *ICON Health& Fitness, Inc.*, Civil Case No. IPR2017-01408, Exhibit 1016—US20120258433A1 (Hope), filed Jun. 4, 2018, 51 pages.
*Nautilus, Inc.* v. *ICON Health& Fitness, Inc.*, Civil Case No. IPR2017-01408, Exhibit 1017—U.S. Pat. No. 7,771,320 (Riley), filed Jun. 4, 2018, 44 pages.
*Nautilus, Inc.* v. *ICON Health& Fitness, Inc.*, Civil Case No. IPR2017-01408, Exhibit 1018—Declaration of Christopher Cox in Support of Petitioners Oppositions to Patent Owners Motions to Amend, filed Jun. 4, 2018, 739 pages.
*Nautilus, Inc.* v. *ICON Health& Fitness, Inc.*, Civil Case No. IPR2017-01408, Exhibit 1019—Affidavit of Lane M. Polozola in Support of Petitioners Motion for Pro Hac Vice Admission, filed Jun. 6, 2018, 4 pages.
*Nautilus, Inc.* v. *ICON Health& Fitness, Inc.*, Civil Case No. IPR2017-01408, Exhibit 1020—Scott Ganaja Depo Transcript, filed Aug. 1, 2018, 58 pages.
*Nautilus, Inc.* v. *ICON Health& Fitness, Inc.*, Civil Case No. IPR2017-01408, Exhibit 1021—Petitioner's Demonstrative Exhibits, filed Aug. 24, 2018, 92 pages.
*Nautilus, Inc.* v. *ICON Health& Fitness, Inc.*, Civil Case No. IPR2017-01408, Exhibit 2011—Declaration of Scott Ganaja in Support of Patent Owner's Reply to Petitioner's Opposition to Patent Owner's Motion to Amend, filed Jul. 5, 2018, 42 pages.
*Nautilus, Inc.* v. *ICON Health& Fitness, Inc.*, Civil Case No. IPR2017-01408, Exhibit 2012—Declaration of Richard Ferraro in Support of Patent Owner's Reply to Petitioner's Opposition to Patent Owner's Motion to Amend, filed Jul. 5, 2018, 35 pages.
*Nautilus, Inc.* v. *ICON Health& Fitness, Inc.*, Civil Case No. IPR2017-01408, Exhibit 2013—Cox, Christopher Depo Transcript 2018 06 26, filed Jul. 5, 2018, 26 pages.
*Nautilus, Inc.* v. *ICON Health& Fitness, Inc.*, Civil Case No. IPR2017-01408, Exhibit 2014—Patent Owner's Demonstrative Exhibits, filed Aug. 24, 2018, 21 pages.
European Patent Office, Article 94(3) Epc Communication dated Jul. 10, 2018, issued in European Patent Application No. 14768130. Aug. 1126, 3 pages.
*Nautilus, Inc.* v. *ICON Health& Fitness, Inc.*, Civil Case No. IPR2017-01407—Petitioner's Updated Exhibit List, filed Aug. 24, 2018, (paper 48) 5 pages.
*Nautilus, Inc.* v. *ICON Health& Fitness, Inc.*, Civil Case No's. IPR2017-01407, Final Written Decision dated Dec. 3, 2018; (paper 50) 81 pages.
*Nautilus, Inc.* v. *ICON Health& Fitness, Inc.*, Civil Case No's. IPR2017-01408, Final Written Decision dated Dec. 3, 2018; (paper 51) 82 pages.
United States Patent and Trademark Office; International Search Report and Written Opinion issued in application No. PCT/US2015/034665; dated Oct. 8, 2015 (14 pages).

STRENGTH TRAINING APPARATUS WITH FLYWHEEL AND RELATED METHODS

CROSS REFERENCE TO RELATED APPLICATIONS

This application is a continuation of U.S. application Ser. No. 15/019,088, filed on 9 Feb. 2016, now U.S. Pat. No. 9,616,276, which is a continuation of U.S. application Ser. No. 14/213,793, filed on 14 Mar. 2014, now U.S. Pat. No. 9,254,409, which claims priority to U.S. Provisional Patent application 61/786,007, filed on Mar. 14, 2013. Each of the aforementioned applications is incorporated herein by reference in its entirety.

TECHNICAL FIELD

The present disclosure relates to exercise equipment. More particularly, the present disclosure relates to strength training equipment including a flywheel and to related methods.

BACKGROUND

While there are numerous exercise activities that one may participate in, exercise may be broadly broken into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. Such exercise usually includes low or moderate resistance to the movement of the individual. For example, aerobic exercise includes activities such as walking, running, jogging, swimming or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups or a series of short sprints.

When exercising at home or in a gym, aerobic and anaerobic exercise usually involves the use of different types of equipment. For example, aerobic exercise usually involves equipment such as treadmills, ellipticals and bicycles (traditional and stationary) while anaerobic exercise often involves the use of free weights, weight stacks, or other cable and pulley resistance-type systems.

Often, individuals will plan their work-out routines to include both aerobic and anaerobic activities. For example, a person may do anaerobic exercises (e.g., weight lifting and other strength training exercises) on two or three days of the week while doing aerobic exercising (e.g., running, bicycling) on the remaining days of the week. In other instances, an individual may do both aerobic and anaerobic activities during the same day.

One of the difficulties in integrating both aerobic and anaerobic activities is the ability of an individual to efficiently and effectively track their progress. For example, many individuals use aerobic exercise equipment such as a treadmill or an elliptical machine to automatically track the calories that they've burned while using such equipment. However, it is more difficult to track or calculate such information when doing strength training exercises.

A couple of examples of equipment that has tried to combine aerobic exercising with anaerobic exercising are described in U.S. Pat. No. 5,527,245 to Dalebout et al. and U.S. Pat. No. 7,740,563 to Dalebout et al. These patents describe a resistance-type strength training apparatus combined with, in one instance, a treadmill, and in another instance an elliptical device.

In view of the foregoing, it would be desirable to provide the ability to track one's progress during exercise in a manner that is applicable to both aerobic and anaerobic activities and which is simple and effective. Additionally, it is a general desire in the industry to provide exercise equipment with new features and enhanced performance.

SUMMARY

In one aspect of the disclosure, a strength training apparatus includes a base member and a tower structure coupled with the base member.

In one or more other aspects that may be combined with any of the aspects herein, may further include at least one arm that is pivotally coupled with the tower structure.

In one or more other aspects that may be combined with any of the aspects herein, may further include a flywheel and a cable and pulley system associated with the at least one arm, wherein displacement of at least one cable of the cable and pulley system affects rotation of the flywheel.

In one or more other aspects that may be combined with any of the aspects herein, may further include a braking mechanism associated with a flywheel and configured to apply a selected resistance to the rotation of the flywheel.

In one or more other aspects that may be combined with any of the aspects herein, may further include a braking mechanism including a magnetic braking mechanism.

In one or more other aspects that may be combined with any of the aspects herein, may further include a torque sensor associated with the flywheel.

In one or more other aspects that may be combined with any of the aspects herein, may further include a console having at least one input device and at least one output device.

In one or more other aspects that may be combined with any of the aspects herein, may further include the console in communication with the braking mechanism, wherein the at least one input device controls the amount of resistance applied to the flywheel by the braking mechanism.

In one or more other aspects that may be combined with any of the aspects herein, may further include the console in communication with the torque sensor, wherein the at least one output device provides an indication of the amount of work expended by a user upon rotation of the flywheel.

In one or more other aspects that may be combined with any of the aspects herein, may further include the at least one output device provides the indication of the amount of work expended in units of watts.

In one or more other aspects that may be combined with any of the aspects herein, may further include the strength training apparatus includes a drive mechanism associated with the flywheel.

In one or more other aspects that may be combined with any of the aspects herein, may further include a clutch mechanism coupled with the flywheel by way of a drive belt.

In one or more other aspects that may be combined with any of the aspects herein, may further include the clutch mechanism enabling the rotation of the flywheel in a first rotational direction upon the displacement of the at least one cable in a first defined direction, but has no effect on the flywheel upon displacement of the at least one cable in a second defined direction, the second defined direction being the opposite of the first defined direction.

In one or more other aspects that may be combined with any of the aspects herein, may further include the drive mechanism having a drive chain coupled with the cable and pulley system, wherein the drive chain extends about a plurality of sprockets including at least one sprocket that is displaceable relative to the tower.

In one or more other aspects that may be combined with any of the aspects herein, may further include at least one biasing member coupled with the at least one displaceable sprocket.

In one or more other aspects that may be combined with any of the aspects herein, may further include an embodiment where the at least one arm includes a pair of arms, wherein the cable and pulley system includes a first pulley coupled with a first arm of the pair of arms with a first cable extending through the first pulley and a second pulley coupled with the second arm with a second cable extending through the second pulley.

In one or more other aspects that may be combined with any of the aspects herein, may further include the pair of arms maintained in a fixed angular position relative to each other.

In another aspect of the disclosure, a method of conducting strength training includes applying a force to a cable and displacing the cable in a first direction and affecting rotation of a flywheel upon displacement of the cable.

In one or more other aspects that may be combined with any of the aspects herein, may further include a resistance applied to the flywheel and the torque applied to the flywheel being measured, such as by way of a sensor.

In one or more other aspects that may be combined with any of the aspects herein, may further include calculating the work performed, in watts, based at least in part on the measured torque.

In one or more other aspects that may be combined with any of the aspects herein, may further include applying resistance to the flywheel by applying resistance using a magnetic brake.

In one or more other aspects that may be combined with any of the aspects herein, may further include the resistance applied by the magnetic brake being selectively varied.

In one or more other aspects that may be combined with any of the aspects herein, may further include applying a force to a cable including pulling the cable through a pulley, and selectively positioning the pulley at one of a variety of positions prior to pulling the cable through the pulley.

In one or more other aspects that may be combined with any of the aspects herein, may further include a method of tracking work expended during exercising including conducting an aerobic exercise activity and determining the work expended during the aerobic exercise activity and expressing the work expended in units of watts.

In one or more other aspects that may be combined with any of the aspects herein, may further include an embodiment where an anaerobic exercise activity is conducted and the work expended during the anaerobic exercise activity is determined and expressed in units of watts.

In one or more other aspects that may be combined with any of the aspects herein, may further include summing the amount of work expended during the aerobic activity and the amount of work expended during the anaerobic activity.

BRIEF DESCRIPTION OF THE DRAWINGS

The accompanying drawings illustrate various embodiments of the present methods and systems and are a part of the specification. The illustrated embodiments are merely examples of the present systems and methods and do not limit the scope thereof.

Throughout the drawings, identical reference numbers designate similar, but not necessarily identical, elements.

DETAILED DESCRIPTION

Figure 1:
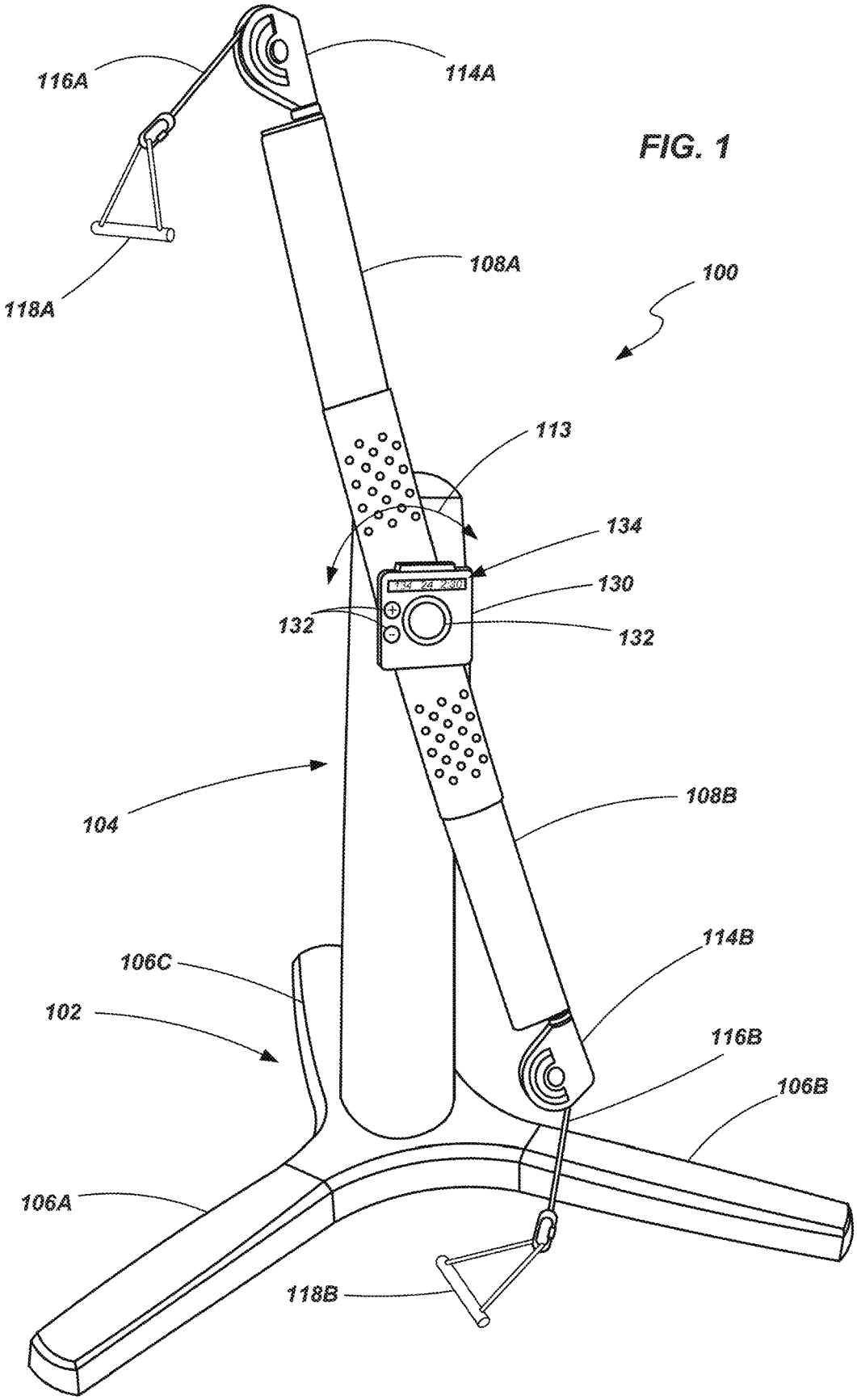
FIG. 1 is a perspective view of a strength training apparatus.
Figure 2:
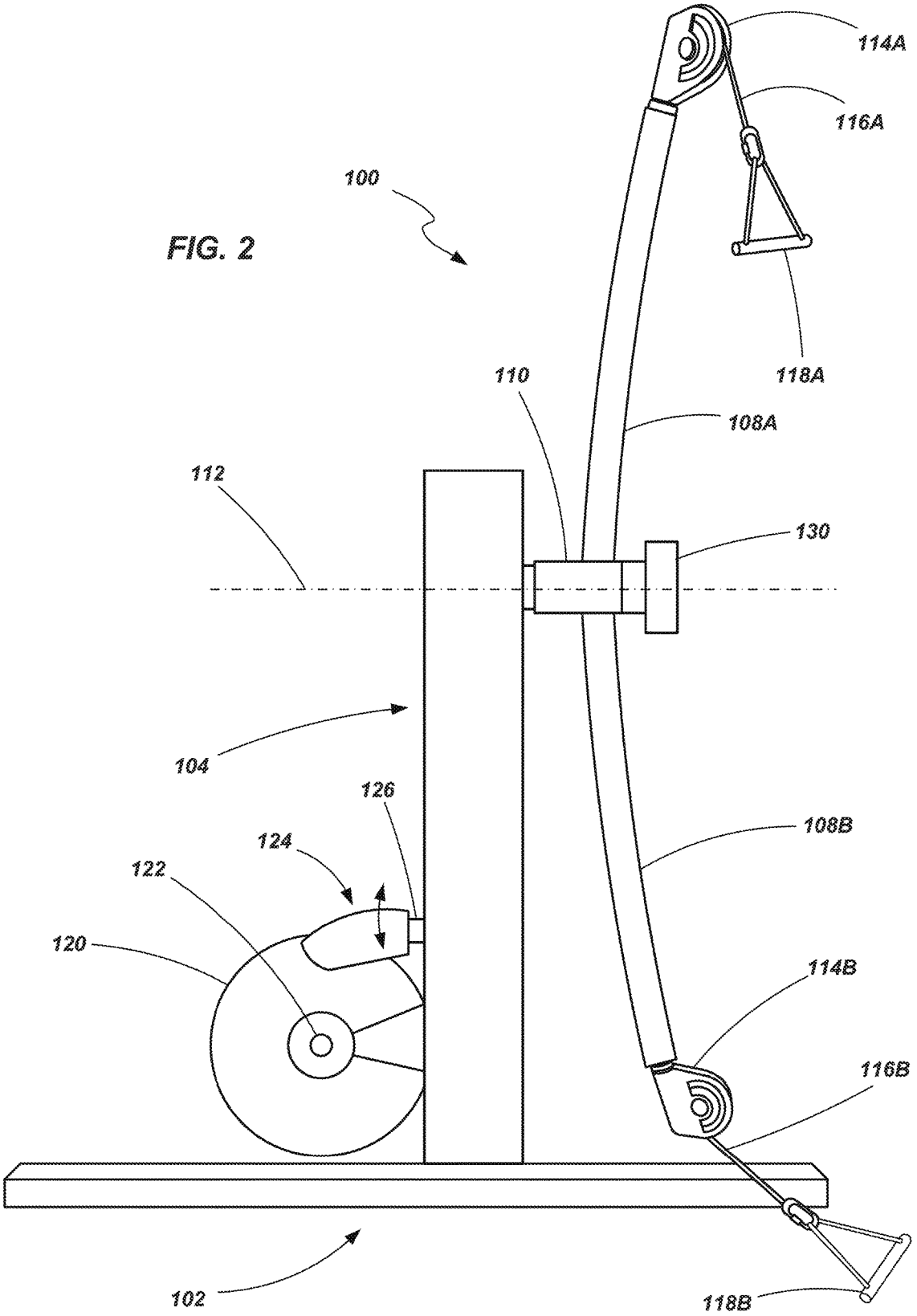
FIG. 2 is a first side view of the strength training apparatus shown in FIG. 1.
Figure 3:
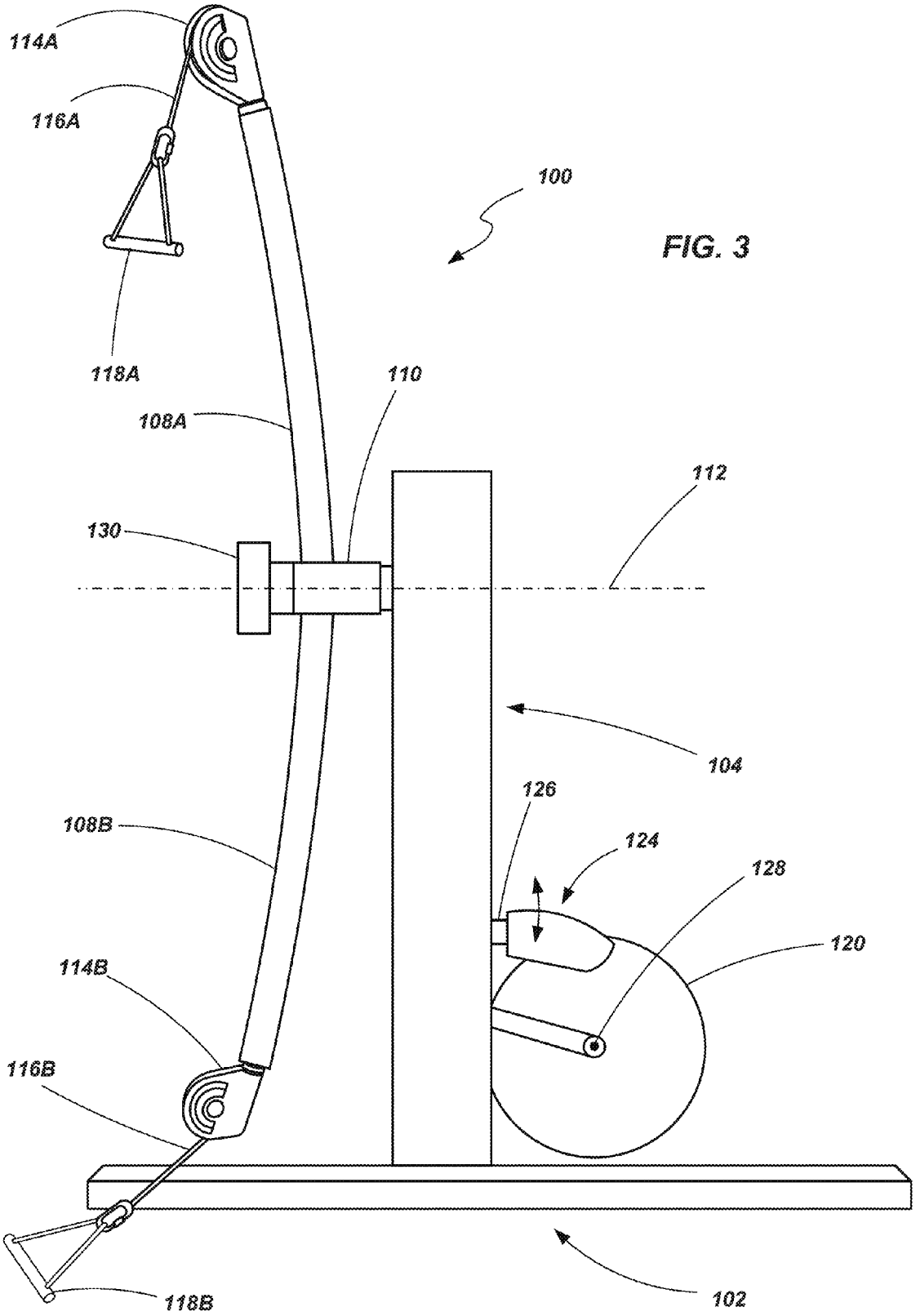
FIG. 3 is another side view of the strength training apparatus shown in FIG. 1.

Referring to FIGS. 1-3, a strength training apparatus 100 is provided. The apparatus 100, according to certain embodiments, includes a base member 102 and a tower 104 or support structure coupled to, and extending upward from, the base member 102. The base may be configured to include a plurality of legs 106A-106C extending away from each other to provide a stable base or platform for the apparatus 100 and to support the apparatus 100 when forces are applied to it by someone using the apparatus 100 to exercise. In the embodiment shown in FIGS. 1-3, the base member 102 includes three legs. However, it is noted that other configurations are contemplated.

A pair of arms 108A and 108B are pivotally coupled to the tower 104 by way of a bearing 110 or other mechanical structure. The bearing 110 enables the arms 108A and 108B to rotate about a defined axis 112 (FIGS. 2 and 3) relative to the tower 104 and base member 102 as indicated by directional arrow 113 (FIG. 1). In one embodiment, the arms 108A and 108B may be configured to maintain a constant angular relationship relative to each other as they are rotated about the axis 112 (e.g., they may continually extend in substantially opposite directions from each other). In another embodiment, each arm 108A and 108B may be selectively positionable (manually, or by a motor or other actuator (not shown)) independent of the other so that they may be positioned at any of a variety of angles relative to each other.

The apparatus 100 also includes a pair of pulleys 114A and 114B, one being pivotally coupled to the end of each arm 108A and 108B. Cables 116A and 116B extend through each pulley 114A and 114B and are coupled with handles 118A and 118B. As will be described in further detail below, the handles 118A and 118B, the cables 116A and 116B and the pulleys 114A and 114B are part of a cable/pulley system that provides resistance to an individual that is using the apparatus 100 for strength training.

As seen in FIGS. 2 and 3, a flywheel 120 is coupled to either the base member 102 or the tower 104 (or to both) and configured to rotate about a shaft 122. A resistance or braking mechanism 124 is positioned adjacent the flywheel 120 and is selectively adjustable so as to apply a desired level of resistance to the rotation of the flywheel 120. Various types of braking mechanisms may be used including, in one embodiment, straps or pads that apply friction to the flywheel 120. In one embodiment, a magnetic brake (sometimes referred to as an eddy current brake) may be used to provide an adjustable level of resistance applied to the flywheel 120.

When the braking mechanism 124 is configured as a magnetic mechanism it may include an arm 126 that is pivotally coupled with the tower 104 and which contains a plurality of magnets arranged to provide a desired magnetic flux. As the arm 126 is rotated relative to tower 104 (and, thus, the flywheel 120), the magnetic flux through which the flywheel 120 rotates changes, thereby altering the amount of rotational resistance experienced by the flywheel 120.

The flywheel 120, when configured to interact with a magnetic braking mechanism, may include ferrous components, non-ferrous components, or both. In one embodiment, the flywheel 120 may include a relatively dense ferrous component to impart a desired level of rotational inertia to the flywheel 120. The flywheel 120 may also include a nonferrous component to provide increased braking resistance when used with a magnetic brake mechanism. For example, one embodiment may include a portion that is formed of cast iron (a ferrous material) to provide the desired rotational inertia with another portion formed of an aluminum material (to provide increased braking response to the magnetic mechanism). One such configuration of a flywheel, as well as an associated magnetic braking mechanism, is described by U.S. Patent Application Publication No. 2012/0088638 to Lull (application Ser. No. 13/267,719), the disclosure of which is incorporated by reference herein in its entirety.

A torque sensor 128 may be associated with the shaft 122 to determine the amount of torque applied to the flywheel 120 by a drive mechanism (discussed below). Various types of torque sensors may be utilized. One example of a torque sensor includes that which is described in U.S. Pat. No. 7,011,326 to Schroeder et al., the disclosure of which is incorporated by reference herein in its entirety. Another example of a torque sensor includes that which is described in U.S. Pat. No. 7,584,673 to Shimizu, the disclosure of which is incorporated by reference herein in its entirety.

The apparatus further includes a control panel 130 which may be located adjacent the bearing 110 or some other convenient location (e.g., on the tower 104). The control panel 130 may include various input devices 132 (e.g., buttons, switches or dials) and output devices 134 (e.g., LED lights, displays, alarms) to provide means of interaction with a user of the apparatus 100. The control panel 130 may further include connections for communication with other devices. The controller may include a processor and memory to provide various functions in controlling components of the apparatus 100 (e.g., the braking mechanism), in communicating with various components (e.g., the torque sensor) and making certain calculations as will be discussed below.

In one example, one of the input devices 132 of the control panel 130 may be used to set a desired resistance level that is to be applied to the flywheel 120 by controlling an actuating member associated with the braking mechanism 124. An output device 134 (e.g., a display) may indicate the current or selected level of resistance. An output device 134 of the control panel 130 may also provide an indication of the amount of work performed within a period of time calculated, for example, based on the torque applied to the flywheel 120 as measured by the torque sensor 128.

Figure 4A:
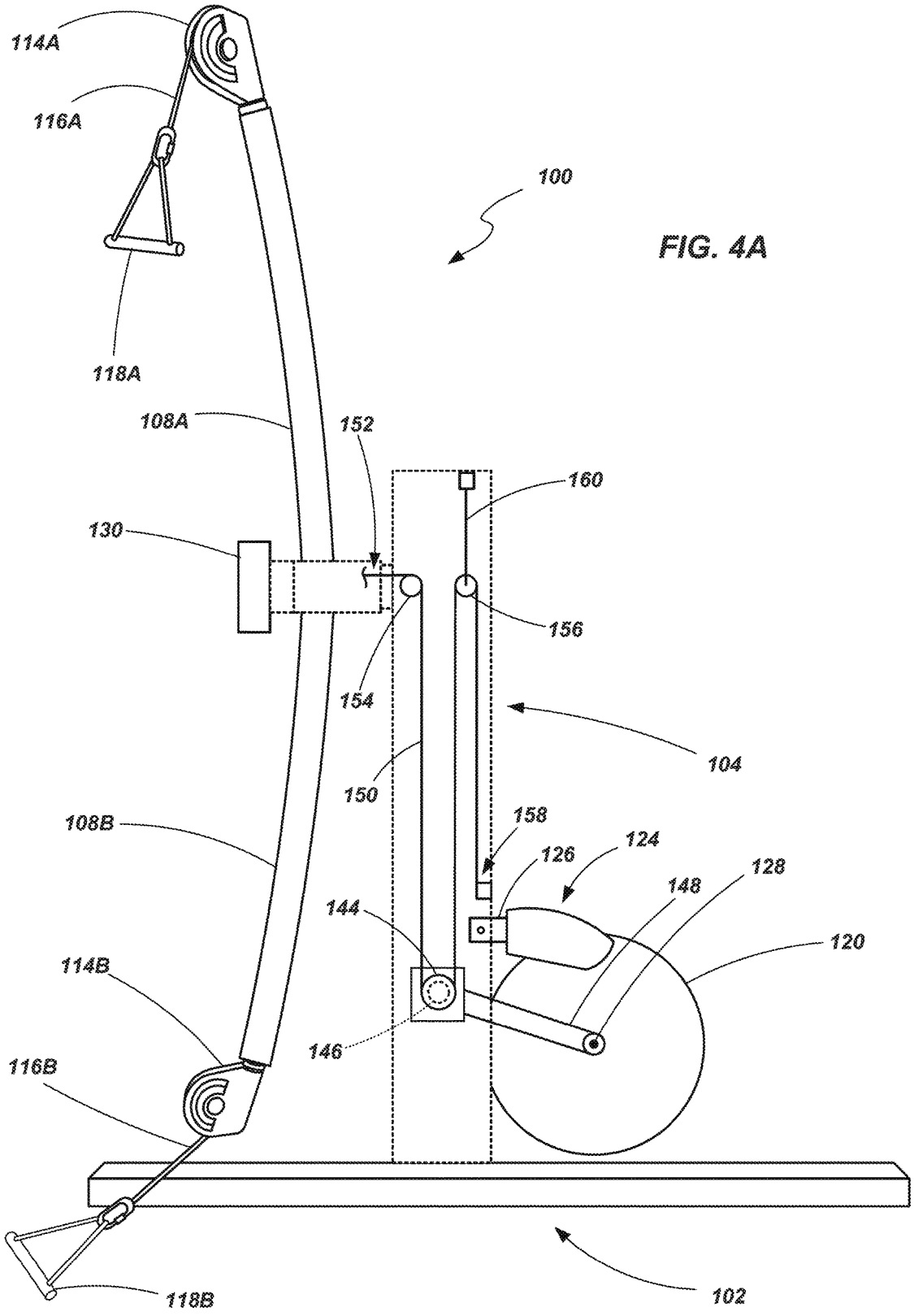
FIGS. 4A and 4B show a side view and a rear view, respectively, of the apparatus shown in FIG. 1, including various components, when the apparatus is in a first state.
Figure 4B:
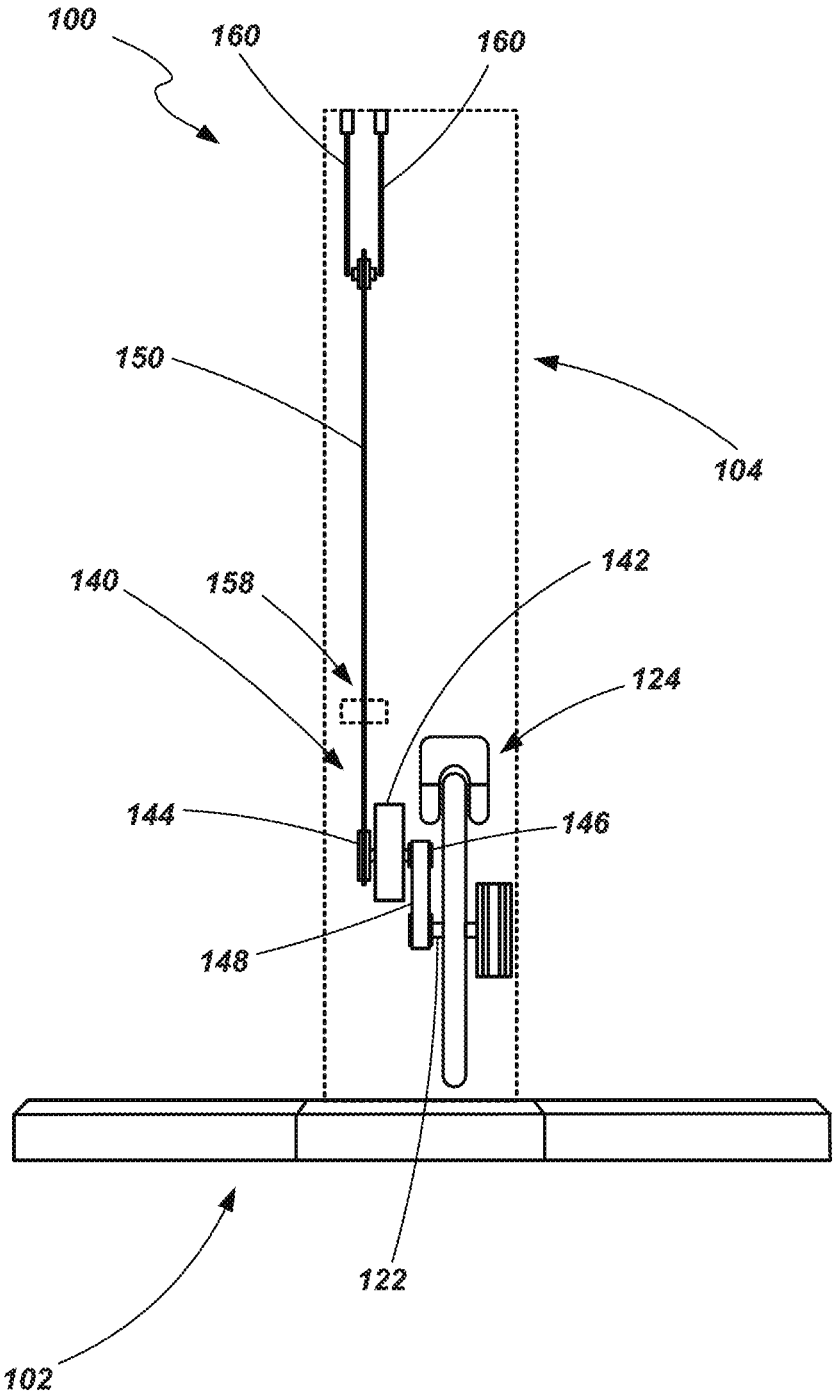

Referring now to FIGS. 4A and 4B, a side view and a rear view of the apparatus 100 is shown with various components which may be disposed within the tower 104 or otherwise arranged to assist in driving flywheel 120. It is noted that FIG. 4B does not depict the arms 108A and 108B (and associated components) for purposes of clarity and convenience. A drive mechanism 140 may include a clutch mechanism 142 having an input shaft 144 and an output shaft 146. A drive belt 148 (or drive chain or other similar drive structure) may extend about the output shaft 146 and also about the shaft 122 of the flywheel 120 (or associated pulleys coupled with the shafts). The clutch mechanism 142 is configured such that, when the input shaft 144 is rotated in a first specified direction, the output shaft 146 is likewise rotated in a specified direction displacing the drive belt 148 and, ultimately, driving the flywheel 120 in a desired direction. However, if the input shaft 144 is rotated in a second direction, opposite that of the first direction, it has no effect on the output shaft 146. Rather, the output shaft 146 is enabled to continue rotating in its initially specified direction and does not reverse directions. It is noted that, in other embodiments, the clutch mechanism 142 may be coupled directly to the flywheel 120.

A drive chain 150 (or drive belt or cable or other appropriate structure) has a first end 152 that is coupled to the cables 116A and 116B that extend through pulleys 114A and 114B and either extend through, or adjacent to, the arms 108A and 108B. The drive chain 150 extends through several pulleys or sprockets including, for example, a first sprocket 154, the input shaft 144 (or an associated pulley or sprocket coupled therewith) and a second sprocket 156. A second end 158 of the drive chain 150 may be fixed, for example, to a frame or other component associated with the tower 104. In the embodiment shown in FIGS. 4A and 4B, the first sprocket 154 is rotatable about an axis which is fixed relative to the tower 104. The second sprocket 156 is rotatable about an axis which is displaceable relative to the tower 104. For example, one or more biasing members 160 may be coupled between the second sprocket 156 and the tower 104 (or some component thereof) enabling the second sprocket 156 to be displaced relative to the tower 104. Guide members may be used to help constrain or control the displacement of the sprocket along a desired path.

Figure 5A:
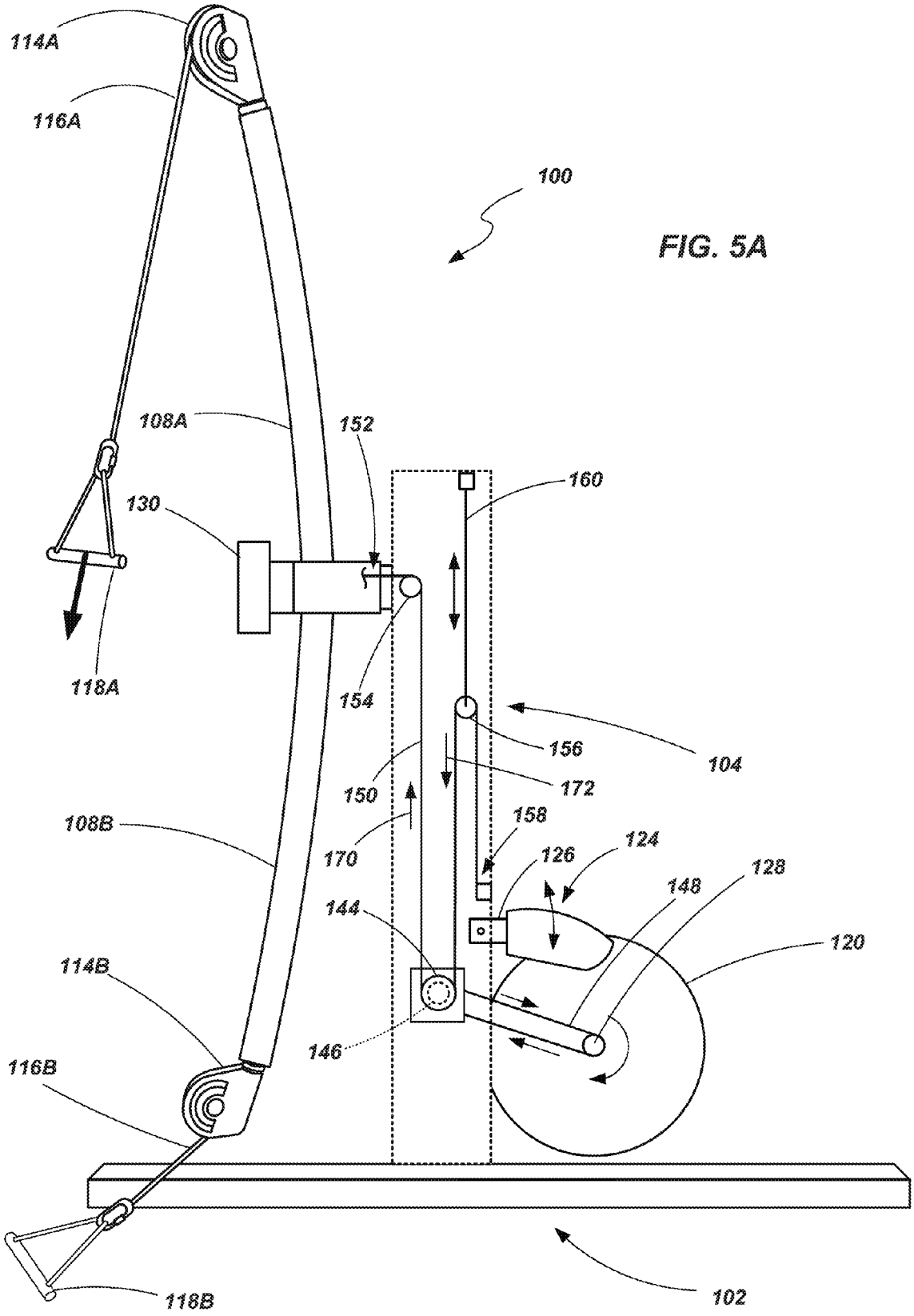
FIGS. 5A and 5B show a side view and a rear view, respectively, of the apparatus shown in FIG. 1, including various components, when the apparatus is in a second state.
Figure 5B:
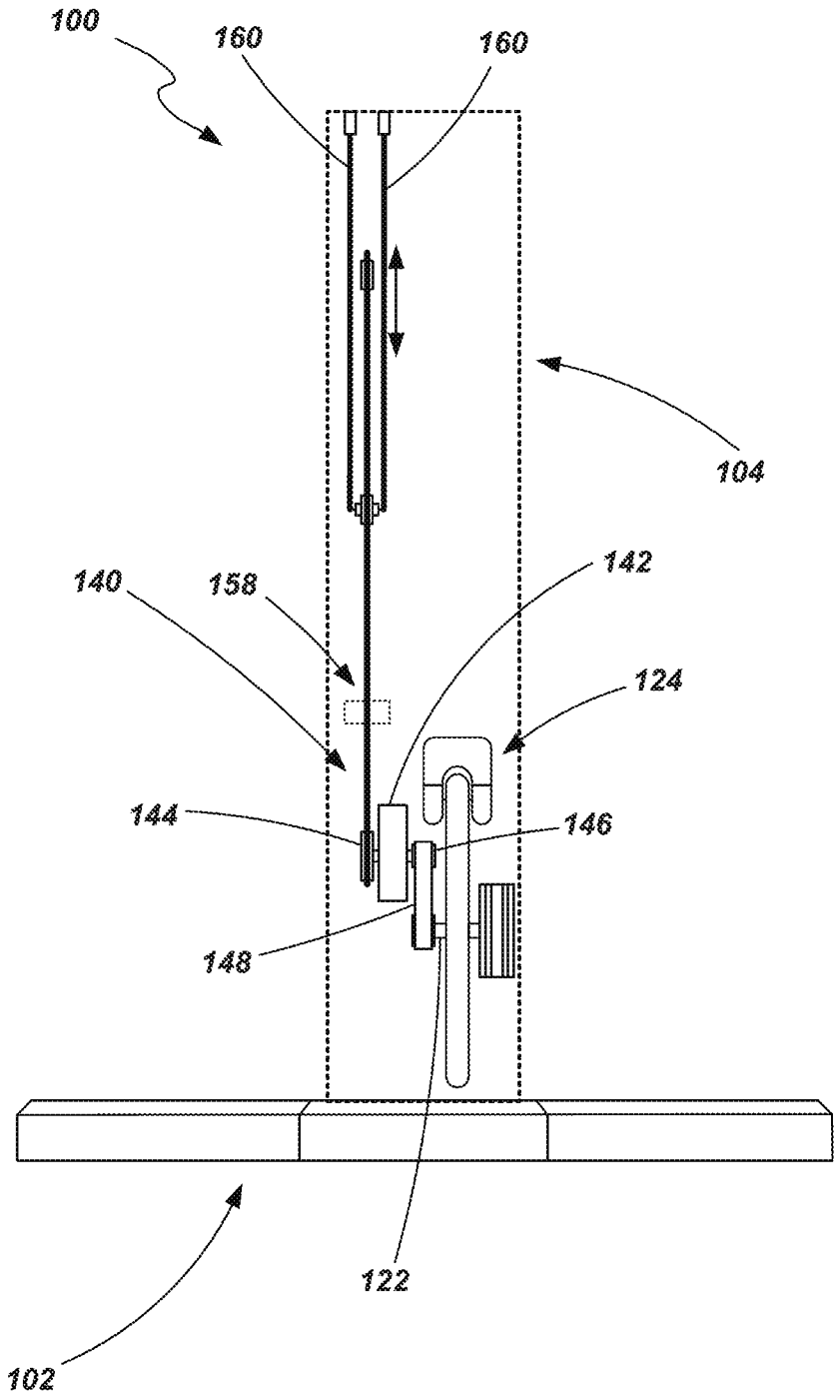

Referring briefly to FIGS. 5A and 5B, views similar to those depicted in FIGS. 4A and 4B, respectively, show certain components in a second position or state. Specifically, FIG. 5A depicts the displacement of a handle 118A due to application of a force by an individual during exercise. Displacement of the handle 118A results in displacement of the associated cable 116A and, ultimately, displacement of the drive chain 150. As indicated in FIG. 5A, a first portion of the drive chain 150 is displaced upwards towards the first sprocket 154 as indicated by directional arrow 170 while a second portion of the drive chain 150 is displaced downwards away from the second sprocket 156 and towards the input shaft 144 as indicated by directional arrow 172. It is noted that this displacement of the drive chain 150 also includes the downward displacement of the second sprocket 156 against the force of the biasing members 160 as seen in both FIGS. 5A and 5B. The displacement of the drive chain 150 results in the rotation of the input shaft 144, actuating the drive mechanism 140 such that the drive belt 148 drives the flywheel 120.

Upon release of the force applied to the handle 118A, the biasing members 160 pull the second sprocket 156 back to its previous position bringing the various components (e.g., drive chain 150, cable 116A and handle 118A) back to the positions shown in FIGS. 4A and 4B. However, as noted above, the return of the drive chain 150 to its previous position does not cause the flywheel 120 to rotate in the opposite direction or otherwise hinder its continued rotation due to the directional preference of the clutch mechanism 142. It is noted that, while the example shown in FIGS. 5A and 5B is described in terms of one particular handle (i.e., 118A) being displaced, the same functionality applies to the displacement to the other handle (i.e., 118B) or to both of them being substantially simultaneously displaced.

INDUSTRIAL APPLICABILITY

During exercise, many individuals desire to focus on anaerobic strength training, or to integrate anaerobic strength training with aerobic work-outs. One of the difficulties in mixing both aerobic and anaerobic activities is the ability of an individual to efficiently and effectively track their progress. For example, many individuals use aerobic exercise equipment such as a treadmill, an elliptical machine or a pedometer to help track the calories that they've burned while using such equipment. However, it is more difficult to track or calculate such information when doing strength training type of exercises.

The exercise apparatus provided herein provides a strength training apparatus that enables a variety of exercises while also providing the ability to track the work performed by an individual during their exercise session. By positioning the adjustable arms at different locations relative to the tower, different types of exercises may be conducted. For example, due to the adjustability of the arms/pulleys, the exercise apparatus may be used to perform exercises including, but not limited to, standing abdominal crunches, curls and other bicep exercises, lat pull-downs, chest presses, incline and decline presses, overhead presses, triceps extensions, shoulder extensions, leg extensions, leg curls, abduction and adduction exercises, and a variety of other exercises, including variations of the examples provided.

Additionally, the use of a flywheel in connection with a strength training apparatus provides a different form of resistance than in conventional strength training exercises, one that can be measured, tracked and incorporated into a planned exercise routine. The flywheel, combined with a braking mechanism such as a magnetic brake, enables considerable flexibility in setting the desired resistance during exercise. In many conventional strength training exercises, the amount of resistance provided (e.g., by free weights, weight stacks or resistance bands) is only adjustable in set increments (e.g., 5 or 10 pound increments). The use of a flywheel with a variable resistance braking mechanism enables fine tuning of the resistance over a continuous spectrum between two defined limits.

The use of a torque sensor in conjunction with the flywheel enables the calculation of work, power or energy so that, for example, a user of the apparatus may determine their performance level while using the exercise apparatus. In one particular example, the power expended during an exercise session may be expressed in watts (i.e., joules/sec (J/s) or newton meters I sec (N*m/s). A user of the machine can review the power expended during an exercise session from a display (or other output device) associated with the exercise apparatus and then compare their performance to a goal or a benchmark.

Such a way of tracking the effort expended during an anaerobic exercise routine provides more insight into the progress of the individual than just the number of repetitions completed during a given work-out session. If desired, other units may be utilized to track the energy expended by an individual during a work-out session. For example, rather than expressing the work-out performance in terms of watts (units of power), it could be expressed in terms of joules (units of work).

This information could be used with information from other work-out activities, including aerobic exercise, to consistently monitor the performance of an individual over a desired period of time. For example, rather than expressing the performance of an individual on a treadmill or an elliptical machine in terms of calories, those performances may similarly be provided in terms of watts (or another selected unit) so that all types of exercise activity may be monitored uniformly. An individual may then customize their exercise routine based, for example, on the amount of work that is to be performed regardless of whether that work occurs during an aerobic or an anaerobic activity.

One example of customizing a work-out that may be utilized in conjunction with the exercise apparatus described herein is set forth in U.S. patent application Ser. No. 13/754,361, filed on Jan. 30, 2013, which published on Aug. 1, 2013 as U.S. Patent Application Publication No. US 2013/0196821 A1 ("the '821 Publication"), the disclosure of which is incorporated by reference herein in its entirety. One particular example of tracking a work-out across various exercise equipment and which may be utilized in conjunction with the exercise apparatus described herein is set forth in U.S. Pat. No. 6,746,371 to Brown et al., the disclosure of which is incorporated by reference herein in its entirety.

For example, FIG. 1 of the '821 Publication illustrates a block diagram of one embodiment of an environment 100 in which the present systems and methods may be implemented. In one configuration, an exercise apparatus 102 may exchange information with a client computing device 106. The client computing device 106 may acquire the information from the apparatus 102. For example, the information may be embedded as a data exchanging module 104 that is included on or by the exercise apparatus 102. Examples of the data exchanging module 104 may include, but are not limited to, barcodes, QR codes, RF tags, etc. The module 104 may be affixed or attached to an area of the apparatus 102 or an area that is not on the apparatus 102 (e.g., a wall close to the apparatus 102). The client computing device 106 may include a data sensing module 108 that is able to sense the data exchanging module 104. For example, the sensing module 108 may provide scanning capabilities that allows the device 106 to scan the data exchanging module 104 to obtain information about the apparatus 102. For example, the data exchanging module 104 may be a barcode and the data sensing module 108 may be a barcode scanner. In another embodiment, the data exchanging module 104 and the data sensing module 108 may include near field communication (NFC) capabilities. As a result, using NFC standards, a radio communication link may be established between the apparatus 102 and the device 106. The client computing device 106 may acquire the information from the exercise apparatus 102 via the radio communication link. The apparatus 102 and the device 106 may exchange information via other methods in addition to bar codes, QR codes, and NFC technologies.

Examples of the exercise apparatus 102 may include a weight machine (e.g., a fly machine, a leg press machine, a leg curl machine, a leg extension machine, a cable lateral pull-down machine, a triceps pull-down machine, a row machine, etc.). The exercise apparatus 102 may also be a free weight, such as a dumbbell, a medicine ball, an exercise ball, a bench press, etc. In another embodiment, the exercise apparatus 102 may be a cardio machine (e.g., a treadmill, a stationary bike, a spinner bike, a stair machine, etc.).

In one embodiment, the client computing device 106 may be a smartphone, a laptop, a tablet, or any other portable computing device. In one configuration, the client computing device 106 may be any device that is able to detect, receive, and interpret the data acquired from the data exchanging module 104. To interpret the received data, the client computing device 106 may communicate with a server 112 across a network 110 connection. The network 110 connection may be a Wi-Fi, a wireless local area network (WLAN), a cellular network, and the like. The server 112 may communicate with an exercise apparatus database 114. The database 114 may be external to the server 112, or the database 114 may be built into the server 112. In one embodiment, the exercise apparatus database 114 may store information regarding the exercise apparatus 102. For example, the database 114 may store instructions that indicate how to properly use the exercise apparatus 102. The database 114 may also store videos that demonstrate how to use the apparatus 102. In one example, the client computing device 106 may acquire information from the apparatus, such as an identifier that identifies the apparatus 102. The identifier may be communicated to the server 112. The server 112 may use the identifier to locate additional information in the database 114 about the apparatus 102. The server may communicate the additional information about the apparatus 102to the computing device 106. In one embodiment, the data exchanging module 104 may include the additional information that is stored in the database 114. As a result, when the computing device 106 acquires the information from the apparatus 102, there may be no need for the client 106 to communicate with the server 112 to acquire the additional information.

FIG. 2 of the '821 Publication is a block diagram illustrating one embodiment of a client computing device 106-a. The client computing device 106-a may be an example of the client computing device 106 illustrated in FIG. 1 of the '821 Publication. In one example, the client computing device 106-a may include a data sensing module 108-a. In one configuration, the module 108-a may include a QR code module 202, a barcode reading module 204, an NFC module 206, a profile module 208, a customized workout module 210, and a tracking module 212. Details regarding each of these modules will be described below.

In one embodiment, the QR code module 202 may sense data affixed to or by the exercise apparatus 102 that is encoded as a QR code. Similarly, the barcode reading module 204 may sense data embedded or encoded as a barcode that may be attached to or near the exercise apparatus 102. The modules 202 and 204 may sense the data by scanning the QR code or the barcode that is attached to the exercise apparatus 102. The NFC module 206 may establish a radio communication link with the exercise apparatus 102. The NFC module 206 may acquire data from the exercise apparatus 102 via the radio communication link.

In one configuration, the profile module 208 may receive and store input from a user relating to the user's profile information. Examples of profile information may include the user's age, height, weight, etc. The profile module 208 may further receive and store input from the user relating to physical fitness goals of the user. Examples of physical fitness goals may include a desired weight loss, strength conditioning goals, target heart rate goals, running/walking distance goals, specific muscle definition goals etc. The customized workout module 210 may receive the data sensed from the modules, 202, 204, and/or 206. The workout module 210 may also receive information stored by the profile module 208. In one embodiment, the workout module 210 may generate a customized workout routine for the user to perform with the exercise apparatus 102 in order to progress towards achieving the physical fitness goals stored in the profile module.

As an example, the client computing device 106-a may receive data relating to the exercise apparatus 102. The data may indicate the name of the apparatus 102, the functions of the exercise apparatus 102, instructions on how to properly use the exercise apparatus 102, the muscle group focused on by the exercise apparatus 102, the health benefits of using the apparatus 102, video or other multimedia data that demonstrate how to use the apparatus 102, etc. The data may be received directly from the data exchange module 104 affixed to the apparatus 102 and/or from the server 112 that obtains the data from the database 114 and communicates the data to the client computing device 106. The customized workout module 210 may analyze the received data about the exercise apparatus 102 together with the information stored by the profile module 208. Based on this analysis, the customized workout module 210 may generate a workout routine for the user to perform with the exercise apparatus 102. The generated workout routine may be focused on helping the user accomplish one or more physical fitness goals stored by the profile module 208. For example, the user may specify a physical fitness goal of bench pressing 200 lbs. The profile module 208 may also include information that indicates that the user is currently able to bench 160 lbs. The user may then approach a chest fly machine with the client computing device 106-a. A barcode may be affixed on a portion of the machine. The computing device 106-a may scan the barcode and obtain data about the machine. As stated above, the data may be acquired from scan of the barcode and/or from the server 112. For example, the client 106-a may scan the barcode and retrieve the identity of the machine (in this example, a chest fly machine). The identity may be transmitted to the server 112. The server 112 may use the received identity to search the database 114 for data about the machine. The server 112 may then communicate the data back to the client computing device 106-a.

The data (either obtained directly from the exercise apparatus 102and/or from the server 112) may indicate that the chest fly machine focuses on certain chest muscles. The data may also include a video demonstration that illustrates how to properly use the chest fly machine. The customized workout module 210 may generate a workout routine (e.g., number of repetitions, sets, and the weight resistance) for the user to follow when using the chest fly machine. The routine may be generated based on an analysis of the information stored by the profile module 208 as well as the data acquired from the exercise apparatus (directly and/or indirectly from the server 112). The workout routine may be customized for the user to assist the user to accomplish the physical fitness goal(s) included in the profile module. As a result, the workout routine, if followed by the user, may assist the user to accomplish the goal of bench pressing 200 lbs.

In one example, the profile module 208 may not include physical fitness goal information that relates to a certain exercise apparatus 102. For instance, the sensing module 108-a may acquire information relating to a treadmill by scanning a barcode, QR code, etc. The customized workout module 210 may analyze the profile module 208 and discover that the user has not entered a goal that may be accomplished by using the treadmill. In one configuration, the customized module 210 may query the user as to whether the user would like to enter a physical fitness goal that may be achieved by using the treadmill. For example, the module 210 may display the following query "Do you want to set a goal to run 3 miles in 30 minutes?" If the user selects this goal, the workout module 210 may continue to generate a customized workout routine for the user to assist the user to complete this goal. Instead of selecting a goal generated by the customized workout module 210, the user may provide his/her own goal as it relates to the treadmill. Once the goal is provided, the module 210 may generate a customized workout routine.

The tracking module 212 may track the progress of the user while the user is using the exercise apparatus 102. For example, the tracking module 212 may be a camera or other tracking device that is capable of monitoring the movement of the user. The tracking module 212 may also track the progress of the user towards completing the goals specified in the profile module 208. For example, the profile module 208may include a goal to lose 20 lbs. The tracking module 212 may track the weight of the user to allow the user to see his/her progress towards achieving the goal of losing 20 pounds. In one example, the user may manually enter his/her weight into the tracking module 212. In another embodiment, the tracking module 212 may track the progress of the user by receiving automatic updates via email, SMS messages, and the like that include the current state of the user. For example, the user may visit a website and record his/her weight on the website. The website may communicate with the tracking module 212 to provide the updated weight of the user.

FIG. 3 of the '821 Publication is a block diagram illustrating one embodiment of a profile module 208-a. The profile module 208-a may be an example of the profile module 208 illustrated in FIG. 2 of the '821 Publication. In one configuration, the profile module 208-a may include a personal information module 302 and a goal information module 304.

In one embodiment, the personal information module 302 may include personal information about the user, such as, but not limited to, the user's age, height, weight, resting heart rate, and any other biometric information. The goal information module 304 may include physical fitness goals provided by the user. For example, the goal information module 304 may store a weight loss goal, a strength conditioning goal, a cardio goal, and the like. In one example, the user may manually input information to the modules 302, 304 via interfaces provided by the client computing device 106. In another embodiment, the user may provide the information to the modules 302, 304 remotely by interfacing with a website and inputting the information. The information may then be transmitted from the website to the client computing device 106 and stored as part of the modules 302, 304.

FIG. 4 of the '821 Publication is a block diagram illustrating one embodiment of a customized workout module 210-a. The module 210-a may be an example of the customized workout module 210 of FIG. 2 of the '821 Publication. In one embodiment, the module 210-a may include a profile analysis module 402, an exercise apparatus analysis module 404, a workout generation module 406, and a demonstration generation module 408.

In one configuration, the profile analysis module 402 may analyze information provided by the profile module 208. The information provided by the profile module 208 may include the physical fitness goals entered by the user. The workout generation module 404 may generate a customized workout routine for the user with relation to the exercise apparatus 102. For example, the exercise apparatus 102 may be a dumbbell. The profile analysis module 402 may determine that the user has set a goal to be able to do 10 repetitions of a bicep curl using a 50 pound dumbbell. The profile analysis module 402 may further determine from the information provided by the profile module 208 that the user has previously performed curls using 25 lb dumbbells. The exercise apparatus analysis module 404 may analyze data about the apparatus. The data may be received by scanning a barcode, QR code, etc. that may be affixed to the apparatus. The analysis module 404 may determine from the specific muscles focused on by the exercise apparatus.

The workout generation module 406 may generate a schedule of workouts for dumbbells of various weights that will gradually build up the user's bicep muscles to eventually reach the user's goal of performing 10 repetitions of a bicep curl using a 50 lb dumbbell. For example, the generation module 406 may suggest the user begin by performing 3 sets of 10 repetitions using 25 lb dumbbells. The generated workout may instruct the user to perform this workout four times a week. The generation module 406 may generate a workout that specifies that each week the weight of the dumbbell should be increased by 5 lbs. As a result, based on the goals provided by the user, the generation module 404 may generate a customized workout for a particular exercise apparatus 102 to assist the user to achieve his/her goals.

The demonstration generation module 408 may generate and/or provide a demonstration of how to use the exercise apparatus 102. For example, the generation module 408 may generate and/or provide a video that the user may view on the client computing device 106 to learn how to properly use the exercise apparatus 102. The demonstration generation module 406 may also generate and/or provide a text document that the user may read that includes instructions on how to use the exercise apparatus 102.

FIG. 5 of the '821 Publication is a block diagram illustrating one embodiment of an exercise apparatus 102-a and a tracking module 212-a. In one example, the exercise apparatus 102-a may be an example of the exercise apparatus 102 illustrated in FIG. 1 of the '821 Publication. The tracking module 212-a may be an example of the tracking module 212 illustrated in FIG. 2 of the '821 Publication.

In one embodiment, the exercise apparatus 102-a may include a monitoring apparatus 502-a-1. The monitoring apparatus 502-a-1 may monitor the user while the user is using the exercising apparatus 102-a. For example, the monitoring apparatus 502-a-1 may be a camera installed or connected to the exercise apparatus 102-a. The apparatus 502-a-1 may also be a magnetic strip attached to the exercise apparatus 102-a that detects movement of the apparatus 102 (e.g., a dumbbell). The monitoring apparatus 502-a-1 may record the actions of the user while the user is performing exercises using the exercising apparatus 102-a. The recorded actions may be transmitted to the tracking module 212-a.

The tracking module 212-a may also include a monitoring apparatus 502-a-2 to record the actions of the user while the user is engaged with a particular exercise apparatus. The apparatus 502-a-2 may be a camera, or other tracking device to record the activity of the user. The tracking module 212-a may further include a workout history module 504 and a goal monitoring module 506. The workout history module 504 may store information regarding past workouts performed by the user. For example, the monitoring apparatuses 502-a-1 and/or 502-a-2may monitor a user running on a treadmill for 30 minutes. At the conclusion of the 30 minutes, the monitoring apparatus 502 may communicate the information to the workout history module 504. If the user is using a weight machine, the monitoring apparatus 502 may detect the number of repetitions as well as the weight used during the repetitions. As a result, the workout history module 504 may include a log that documents the past workout activity of the user with various exercise machines.

In one embodiment, the goal monitoring module 506 may monitor the goals specified by the user. The module 506 may track the progress of the user with respect to achieving the goals. For example, the goal monitoring module 506 may communicate with the workout history module 504 to determine whether the user has satisfied a particular goal. The monitoring module 506 may generate a transmit goal update messages to the user (e.g., via email, SMS text, etc.) that indicate to the user the user's progress in completing a goal. The module 506 may also send a goal completed message to the user when it is determined that a physical fitness goal has been accomplished.

FIG. 9 of the '821 Publication depicts a block diagram of a computer system 910 suitable for implementing the present systems and methods. The computer system 910 may be an example of the client computing device 106 of FIG. 1 of the '821 Publication. Computer system 910 includes a bus 912 which interconnects major subsystems of computer system 910, such as a central processor 914, a system memory 917 (typically RAM, but which may also include ROM, flash RAM, or the like), an input/output controller 918, an external audio device, such as a speaker system 920 via an audio output interface 922, an external device, such as a display screen 924 via display adapter 926, serial ports 928 and 930, a keyboard 932 (interfaced with a keyboard controller 933), multiple USB devices 992 (interfaced with a USB controller 991), a storage interface 934, a floppy disk unit 937operative to receive a floppy disk 938, a host bus adapter (HBA) interface card 935A operative to connect with a Fibre Channel network 990, a host bus adapter (HBA) interface card 935B operative to connect to a SCSI bus 939, and an optical disk drive 940 operative to receive an optical disk 942. Also included are a mouse 946 (or other point-and-click device, coupled to bus 912 via serial port 928), a modem 947(coupled to bus 912 via serial port 930), and a network interface 948(coupled directly to bus 912).

Bus 912 allows data communication between central processor 914and system memory 917, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, the data sensing module 108-b to implement the present systems and methods may be stored within the system memory 917. Applications resident with computer system 910 are generally stored on and accessed via a non-transitory computer readable medium, such as a hard disk drive (e.g., fixed disk 944), an optical drive (e.g., optical drive 940), a floppy disk unit 937, or other storage medium. Additionally, applications can be in the form of electronic signals modulated in accordance with the application and data communication technology when accessed via network modem 947 or interface 948.

In one configuration, when the portable device retrieves information about an exercise machine, the portable device may also access physical fitness goals for the user. The user may have previously entered the goals or, upon retrieving information about an exercise machine, the portable device may query the user to select or enter physical fitness goals. Upon accessing the goals, the information about the exercise machine may be analyzed to determine whether the exercise machine may assist the user to accomplish one or more of the goals. If the machine cannot help the user accomplish the provided goals, the user may be queried as to whether he/she would like to select (or provide) a goal that this particular exercise machine may help the user accomplish. If the machine is able to assist the user in completing a goal, a customized workout routine may be generated and displayed to the user. The workout routine may provide instructions to the user relating to the number of repetitions, sets, the amount of weight, the amount of time, speed, incline, resistance, etc. that the user should perform to accomplish a goal using the exercise machine.

What is claimed is:

1. A strength training apparatus comprising:

a base member;

a tower coupled to and extending vertically upward from the base member;

a first arm coupled with the tower;

a first pulley coupled with the first arm;

a first handle coupled to the first pulley;

a second arm coupled with the tower;

a second pulley coupled with the second arm;

a second handle coupled to the second pulley;

a third pulley;

a biasing member coupled to the third pulley and coupled to a first fixed location on the tower, the biasing member configured to stretch in order to allow the third pulley to be displaced vertically relative to the tower and configured to retract in order to cause the third pulley to vertically return relative to the tower;

a fourth pulley rotatable about an axis that is fixed with respect to the tower;

a flywheel;

a clutch mechanism coupled to the flywheel, the clutch mechanism configured such that rotation of the clutch mechanism in a first direction drives the flywheel to likewise rotate in the first direction, the clutch mechanism further configured such that reversing rotation of the clutch mechanism to a second direction that is opposite the first direction has no effect on the rotation of the flywheel;

a drive cable coupled to the first handle and the second handle, the fourth pulley, the clutch mechanism, and the third pulley, the drive cable configured such that a user pulling on the first handle and/or the second handle causes the drive cable to rotate the clutch mechanism in the first direction and causes the drive cable to stretch the biasing member and thereby vertically displace the third pulley relative to the tower, the biasing member configured such that a user releasing the first handle or the second handle, after pulling thereon, allows the biasing member to retract, thereby causing the drive cable to rotate the clutch mechanism in the second direction and causing the third pulley to vertically return relative to the tower;

a sensor configured to take measurements during the rotation of the flywheel; and a control panel including an input device and an output device, the control panel being in communication with the sensor, the control panel configured to calculate an amount of power expended by the user pulling on the first handle and/or pulling on the second handle during an exercise session based at least in part on the measurements taken during the rotation of the flywheel, the output device configured to provide an indication of the calculated amount of power expended by the user, the control panel further including a connection configured to communicate with another device.

2. The strength training apparatus of claim 1, wherein the output device is configured to provide the indication of the calculated amount of power expended by the user in units of watts.

3. The strength training apparatus of claim 1, wherein the output device is configured to provide the indication of the calculated amount of power expended by the user in units other than watts.

4. The strength training apparatus of claim 1, further comprising a magnetic brake associated with the flywheel and configured to apply a level of resistance to the rotation of the flywheel.

5. The strength training apparatus of claim 4, wherein the sensor is a torque sensor configured to measure torque applied to the flywheel by the magnetic brake during the rotation of the flywheel.

6. The strength training apparatus of claim 4, wherein:

the control panel is in communication with the magnetic brake;

the input device is configured to allow the user to select the level of resistance applied to the rotation of the flywheel by the magnetic brake; and the output device is configured to provide an indication of the selected level of resistance applied to the rotation of the flywheel by the magnetic brake.

7. The strength training apparatus of claim 6, wherein: the input device includes a dial; and the output device includes a display.

8. The strength training apparatus of claim 6, wherein:

the input device includes a button labeled with a '+' symbol for increasing the level of resistance applied to the rotation of the flywheel by the magnetic brake; and the input device further includes a button labeled with a '–' symbol for decreasing the level of resistance applied to the rotation of the flywheel by the magnetic brake.

9. The strength training apparatus of claim 6, wherein the magnetic brake includes:

a U-shaped bracket having two sides defining an open slot and housing multiple permanent magnets on both sides of the open slot configured to provide a magnetic flux to the flywheel when positioned in the open slot; and an arm configured to pivot, relative to the flywheel, to alter the level of resistance applied to the rotation of the flywheel.

10. The strength training apparatus of claim 9, wherein the arm is configured to pivot between:

an upper limit;

a lower limit; and multiple incremental positions between the upper limit and the lower limit.

11. The strength training apparatus of claim 1, wherein:

the first arm is pivotally coupled with the tower; and the second arm is pivotally coupled with the tower.

12. The strength training apparatus of claim 11, wherein:

the first arm is configured to be manually pivoted relative to the tower; and the second arm is configured to be manually pivoted relative to the tower independently of the first arm.

13. The strength training apparatus of claim 1, wherein the base member includes horizontal legs extending perpendicularly away from the tower.

14. The strength training apparatus of claim 1, wherein:

the biasing member is a biasing cable;

the biasing cable is further coupled to a second fixed location on the tower;

the stretching of the biasing cable allows the third pulley to be displaced vertically downward relative to the tower; and the retracting of the biasing cable causes the third pulley to vertically return upward relative to the tower.

15. The strength training apparatus of claim 14, wherein the drive cable is indirectly coupled to the first handle and the second handle, then extends through the fourth pulley, then extends around the clutch mechanism, then extends through the third pulley, and then is coupled to a third fixed location on the tower.

16. A strength training apparatus comprising:

a base member;

a tower coupled to and extending vertically upward from the base member;

a first arm coupled with the tower;

a first pulley coupled with the first arm;

a first handle indirectly coupled to the first pulley;

a second arm coupled with the tower;

a second pulley coupled with the second arm;

a second handle indirectly coupled to the second pulley;

a third pulley;

a biasing cable coupled to the third pulley and coupled to a first fixed location and a second fixed location on the tower, the biasing cable configured to stretch in order to allow the third pulley to be displaced vertically downward relative to the tower and configured to retract in order to cause the third pulley to vertically return upward relative to the tower;

a fourth pulley rotatable about an axis that is fixed with respect to the tower;

a flywheel;

a clutch mechanism coupled to the flywheel, the clutch mechanism configured such that rotation of the clutch mechanism in a first direction drives the flywheel to likewise rotate in the first direction, the clutch mechanism further configured such that reversing rotation of the clutch mechanism to a second direction that is opposite the first direction has no effect on the rotation of the flywheel;

a drive cable coupled to the first handle and the second handle, then extending through the fourth pulley, then around the clutch mechanism, then through the third pulley, then coupled to a third fixed location on the tower, the drive cable configured such that a user pulling on the first handle and/or the second handle causes the drive cable to rotate the clutch mechanism in the first direction and causes the drive cable to stretch the biasing cable and thereby vertically displace the third pulley downward relative to the tower, the biasing cable configured such that a user releasing the first handle or the second handle, after pulling thereon, allows the biasing cable to retract, thereby causing the drive cable to rotate the clutch mechanism in the second direction and causing the third pulley to vertically return upward relative to the tower;

a sensor configured to take measurements during the rotation of the flywheel; and a control panel including an input device and an output device, the control panel being in communication with the sensor, the control panel configured to calculate an amount of power expended by the user pulling on the first handle and/or pulling on the second handle during an exercise session based at least in part on the measurements taken during the rotation of the flywheel, the output device configured to provide an indication of the calculated amount of power expended by the user, the control panel further including a connection configured to communicate with another device.

17. The strength training apparatus of claim 16, wherein:

the strength training apparatus further comprises a magnetic brake associated with the flywheel and configured to apply a level of resistance to the rotation of the flywheel;

the control panel is in communication with the magnetic brake;

the input device is a dial configured to allow the user to select the level of resistance applied to the rotation of the flywheel by the magnetic brake; and the output device is a display configured to provide an indication of the selected level of resistance applied to the rotation of the flywheel by the magnetic brake.

18. The strength training apparatus of claim 17, wherein:

the magnetic brake includes a U-shaped bracket having two sides defining an open slot and housing multiple permanent magnets on both sides of the open slot configured to provide a magnetic flux to the flywheel when positioned in the open slot;

the magnetic brake further includes an arm configured to pivot, relative to the flywheel, to alter the level of resistance applied to the rotation of the flywheel; and the arm is configured to pivot between:

an upper limit;

a lower limit; and multiple incremental positions between the upper limit and the lower limit.

19. The strength training apparatus of claim 18, wherein the output device is configured to provide the indication of the calculated amount of power expended by the user in units other than watts.

20. The strength training apparatus of claim 19, wherein the sensor is a torque sensor configured to measure torque applied to the flywheel by the magnetic brake during the rotation of the flywheel.

21. The strength training apparatus of claim 7, further comprising an application program configured to be loaded on the other device.

22. The strength training apparatus of claim 21, wherein the application program is configured to:

receive and store a physical fitness goal that may be achieved using the strength training apparatus, the stored physical fitness goal inputted by the user via an interface provided by the other device.

23. The strength training apparatus of 22, wherein the application program is further configured to:

track progress of the user toward completing the stored physical fitness goal;

indicate to the user the progress of the user toward completing the stored physical fitness goal;

determine whether the user has achieved the stored physical fitness goal; and indicate to the user that the user has achieved the stored physical fitness goal when it is determined that the stored physical fitness goal has been achieved.

24. The strength training apparatus of claim 21, wherein the application program is configured to:

display videos on the other device that demonstrate how to use the strength training apparatus; and/or display text on the other device that instructs how to use the strength training apparatus.

25. The strength training apparatus of claim 21, wherein the application program is configured to:

display a customized workout routine for the user to perform with the strength training apparatus, the customized workout routine providing instructions to the user relating to the customized workout routine; and/or store information regarding past workout routines performed by the user on the strength training apparatus.

26. The strength training apparatus of claim 21, wherein the application program is configured to:

receive and store a physical fitness goal that may be achieved using the strength training apparatus, the stored physical fitness goal inputted by the user via an interface provided by the other device;

track progress of the user toward completing the stored physical fitness goal;

indicate to the user the progress of the user toward completing the stored physical fitness goal;

determine whether the user has achieved the stored physical fitness goal;

indicate to the user that the user has achieved the stored physical fitness goal when it is determined that the stored physical fitness goal has been achieved;

display a customized workout routine for the user to perform with the strength training apparatus, the customized workout routine providing instructions to the user relating to the customized workout routine;

display videos on the other device that demonstrate how to use the strength training apparatus;

display text on the other device that instructs how to use the strength training apparatus; and store information regarding past workout routines performed by the user on the strength training apparatus.

27. The strength training apparatus of claim 17, further comprising an application program configured to be loaded on the other device.

28. The strength training apparatus of claim 27, wherein the application program is configured to:

receive and store a physical fitness goal that may be achieved using the strength training apparatus, the stored physical fitness goal inputted by the user via an interface provided by the other device.

29. The strength training apparatus of claim 28, wherein the application program is further configured to:

track progress of the user toward completing the stored physical fitness goal;

indicate to the user the progress of the user toward completing the stored physical fitness goal;

determine whether the user has achieved the stored physical fitness goal; and indicate to the user that the user has achieved the stored physical fitness goal when it is determined that the stored physical fitness goal has been achieved.

30. The strength training apparatus of claim 27, wherein the application program is configured to:

display videos on the other device that demonstrate how to use the strength training apparatus; and/or display text on the other device that instructs how to use the strength training apparatus.

31. The strength training apparatus of claim 27, wherein the application program is configured to:

display a customized workout routine for the user to perform with the strength training apparatus, the customized workout routine providing instructions to the user relating to the customized workout routine; and/or store information regarding past workout routines performed by the user on the strength training apparatus.

32. The strength training apparatus of claim 27, wherein the application program is configured to:

receive and store a physical fitness goal that may be achieved using the strength training apparatus, the stored physical fitness goal inputted by the user via an interface provided by the other device;

track progress of the user toward completing the stored physical fitness goal;

indicate to the user the progress of the user toward completing the stored physical fitness goal;

determine whether the user has achieved the stored physical fitness goal;

indicate to the user that the user has achieved the stored physical fitness goal when it is determined that the stored physical fitness goal has been achieved;

display a customized workout routine for the user to perform with the strength training apparatus, the customized workout routine providing instructions to the user relating to the customized workout routine;

display videos on the other device that demonstrate how to use the strength training apparatus;

display text on the other device that instructs how to use the strength training apparatus; and store information regarding past workout routines performed by the user on the strength training apparatus.

33. A strength training apparatus, comprising:

a base member;

a tower structure coupled to the base member;

at least one arm coupled to the tower structure;

a pulley being coupled to the at least one arm;

a cable extending through the pulley;

a handle coupled to a first end of the cable;

a flywheel connected to the tower structure;

a magnetic braking mechanism that resists movement of the flywheel by applying a level of resistance to rotation of the flywheel, the magnetic braking mechanism including an arm having multiple magnets that are arranged to provide a magnetic flux through which the flywheel rotates, the arm configured to pivot, relative to the flywheel, to alter the level of resistance applied to rotation of the flywheel;

a console in communication with the magnetic braking mechanism, the console configured to calculate an amount of power expended by a user pulling on the handle during a workout routine, the console further including a dial and a display, the dial configured to allow the user to select the level of resistance applied to rotation of the flywheel by the magnetic braking mechanism, the display configured to provide an indication of the selected level of resistance, the display further configured to provide an indication of the calculated amount of power expended by the user, the console further including a connection configured to communicate with another device;

an application program configured to be loaded on the other device, the application program configured to:

receive and store a physical fitness goal that may be achieved using the strength training apparatus, the stored physical fitness goal inputted by the user via an interface provided by the other device;

track progress of the user toward completing the stored physical fitness goal;

indicate to the user the progress of the user toward completing the stored physical fitness goal;

determine whether the user has achieved the stored physical fitness goal;

indicate to the user that the user has achieved the stored physical fitness goal when it is determined that the stored physical fitness goal has been achieved;

display a customized workout routine for the user to perform with the strength training apparatus, the customized workout routine providing instructions to the user relating to the customized workout routine;

display videos on the other device that demonstrate how to use the strength training apparatus;

display text on the other device that instructs how to use the strength training apparatus; and store information regarding past workout routines performed by the user on the strength training apparatus;

a second pulley rotatable about a second axis that is fixed relative to the tower structure;

a third pulley rotatable about a third axis that is displaceable relative to the tower structure; and a drive cable coupled to the cable and that extends through the second pulley and through the third pulley and that includes an end that is coupled to a fixed location with respect to the tower structure;

wherein displacement of the handle results in displacement of the cable, rotation of the pulley, displacement of the drive cable, rotation of the second pulley, rotation of the flywheel, rotation of the third pulley, and displacement of the third axis of the third pulley relative to the tower structure.

34. The strength training apparatus of claim 33, further including a biasing member, wherein:

the biasing member is coupled to the third pulley and includes an end that is coupled to a fixed location with respect to the tower structure;

the biasing member is configured to allow the third axis of the third pulley to be displaced vertically downward relative to the tower structure;

the biasing member is configured to pull the third axis of the third pulley to vertically return upward relative to the tower structure;

the drive cable is configured such that the user pulling on the handle causes the drive cable to drive the flywheel to rotate and causes the drive cable to vertically displace the third axis of the third pulley downward relative to the tower structure; and the biasing member is configured such that the user releasing the handle, after pulling thereon, pulls the third axis of the third pulley to vertically return upward relative to the tower structure and pulls on the drive cable which returns the handle without causing rotation of the flywheel.

* * * * *